US012623116B2

(12) United States Patent
Beckwith et al.

(10) Patent No.: US 12,623,116 B2
(45) Date of Patent: May 12, 2026

(54) SYSTEMS FOR PROVIDING TRAINING OPPORTUNITIES BASED ON DATA COLLECTED FROM MONITORING A PHYSIOLOGICAL PARAMETER OF A PLAYER WEARING A PROTECTIVE SPORTS HELMET WHILE ENGAGED IN PLAYING A CONTACT SPORT

(71) Applicant: Riddell, Inc., Des Plaines, IL (US)

(72) Inventors: Jonathan Beckwith, Rutledge, TN (US); Michael Richards, Des Plaines, IL (US); Jeff Chu, Norwich, VT (US); Richard Greenwald, Norwich, VT (US); Richard Bolander, Lebanon, NH (US)

(73) Assignee: Riddell, Inc., Des Plaines, IL (US)

( * ) Notice: Subject to any disclaimer, the term of this patent is extended or adjusted under 35 U.S.C. 154(b) by 585 days.

(21) Appl. No.: 17/346,227

(22) Filed: Jun. 12, 2021

(65) Prior Publication Data

US 2021/0307443 A1 Oct. 7, 2021

Related U.S. Application Data

(63) Continuation of application No. PCT/US2019/066084, filed on Dec. 12, 2019.
(Continued)

(51) Int. Cl.
*G08B 21/02* (2006.01)
*A42B 3/04* (2006.01)
(Continued)

(52) U.S. Cl.
CPC ..... *A63B 24/0062* (2013.01); *A42B 3/046* (2013.01); *A42B 3/06* (2013.01);
(Continued)

(58) Field of Classification Search
CPC ..... A63B 24/0062; A63B 24/0075; A63B 24/0087; A63B 71/0622; A63B 71/10;
(Continued)

(56) References Cited

U.S. PATENT DOCUMENTS 3,646,606 A * 2/1972 Buxton ..... A61B 5/0006 128/903
3,845,389 A * 10/1974 Phillips ..... H04B 1/385 2/5
(Continued)

OTHER PUBLICATIONS

Riddell, Monitoring football concussions, 2013.*

*Primary Examiner* — Quang Pham
(74) *Attorney, Agent, or Firm* — Barnes & Thornburg LLP

(57) ABSTRACT

The present disclosure provides systems and methods for providing training opportunities based on data collected from monitoring a physiological parameter of persons engaged in physical activity. The physical activity can be a sporting activity, such as a contact sport (e.g., football, hockey, lacrosse) or a recreational activity or sport (e.g., biking, hiking, skiing, snowboarding, motorsports). The system is configured with select components that perform a method of (i) recording data related to a physiological parameter of a person engaged in a physical activity (e.g., an impact received by a player engaged in a contact sport), (ii) analyzing the recorded data related to the physiological parameter while the person is engaged in a physical activity (e.g., is the received impact greater than a predetermined threshold), and (iii) providing post-physical activity analysis of the recorded data to make suggested changes in how the person engages in the physical activity.

22 Claims, 75 Drawing Sheets

Related U.S. Application Data

(60) Provisional application No. 62/778,559, filed on Dec. 12, 2018.

(51) Int. Cl.
*A42B 3/06* (2006.01)
*A42B 3/22* (2006.01)
*A63B 24/00* (2006.01)
*A63B 71/06* (2006.01)
*A63B 71/10* (2006.01)

(52) U.S. Cl.
CPC ..... *A42B 3/068* (2013.01); *A42B 3/22* (2013.01); *A63B 24/0075* (2013.01); *A63B 24/0087* (2013.01); *A63B 71/0622* (2013.01); *A63B 71/10* (2013.01); *A63B 2024/0065* (2013.01); *A63B 2071/0636* (2013.01); *A63B 2220/53* (2013.01); *A63B 2230/08* (2013.01); *A63B 2230/105* (2013.01)

(58) Field of Classification Search
CPC .... A63B 2024/0065; A63B 2071/0636; A63B 2220/53; A63B 2230/08; A63B 2230/105; A42B 3/046; A42B 3/06; A42B 3/068; A42B 3/22
See application file for complete search history.

(56) References Cited

U.S. PATENT DOCUMENTS 3,902,478 A * 9/1975 Konopasek ..... A61B 5/363 340/517
3,972,038 A * 7/1976 Fletcher ..... A61B 5/02438 455/100
3,972,320 A * 8/1976 Kalman ..... A61B 5/08 128/903
4,124,904 A * 11/1978 Matthes ..... A42B 3/122 2/413
4,196,429 A * 4/1980 Davis ..... B60R 25/1007 340/576
4,250,894 A * 2/1981 Frei ..... G01L 9/08 600/382
4,440,160 A * 4/1984 Fischell ..... A61N 1/38 128/857
4,468,656 A * 8/1984 Clifford ..... G08B 21/0453 455/100
4,502,035 A * 2/1985 Obenauf ..... A63B 69/3608 340/665
4,590,801 A * 5/1986 Merhav ..... G01C 19/574 73/504.04
4,608,998 A * 9/1986 Murdock ..... A61B 5/22 600/595
4,627,114 A * 12/1986 Mitchell ..... A42B 3/128 267/140
4,665,748 A * 5/1987 Peters ..... G01C 19/574 73/504.03
4,691,556 A * 9/1987 Mellander ..... G01M 17/0078 73/1.15
4,761,005 A * 8/1988 French ..... G01L 1/16 482/84
4,763,275 A * 8/1988 Carlin ..... A42B 3/046 702/41
4,763,284 A * 8/1988 Carlin ..... A63B 69/00 482/84
4,873,867 A * 10/1989 McPherson ..... G01M 17/0078 434/274
4,883,271 A * 11/1989 French ..... A63B 69/305 482/84
4,982,452 A * 1/1991 Chaise ..... A42B 3/08 2/421
4,996,877 A * 3/1991 Stewart ..... G01C 19/5705 73/504.04
5,158,089 A * 10/1992 Swezey ..... A61B 5/486 600/595
5,203,034 A * 4/1993 Foehl ..... A42B 3/08 2/421
5,221,088 A * 6/1993 McTeigue ..... A63B 71/0622 473/218
5,287,562 A * 2/1994 Rush, III ..... A63B 71/10 2/415
5,327,588 A * 7/1994 Garneau ..... A42B 3/0493 2/209.13
5,331,969 A * 7/1994 Silberstein ..... A61B 5/1106 600/558
5,348,008 A * 9/1994 Bornn ..... A61B 5/411 379/38
5,372,365 A * 12/1994 McTeigue ..... A63B 69/3608 473/202
5,383,363 A * 1/1995 Kulmaczewski ... G01P 15/0888 73/510
5,408,879 A * 4/1995 Vreeburg ..... G01P 15/18 73/514.35
5,425,378 A * 6/1995 Swezey ..... A61B 5/1071 600/595
5,473,527 A * 12/1995 Gold ..... A42B 3/30 348/E5.127
5,487,305 A * 1/1996 Ristic ..... G01P 15/18 73/514.24
5,524,894 A * 6/1996 Shannon ..... A63B 69/3608 473/211
5,539,935 A * 7/1996 Rush, III ..... G01P 15/18 455/100
5,546,609 A * 8/1996 Rush, III ..... G01P 15/135 455/100
5,596,491 A 1/1997 Gold
5,615,132 A * 3/1997 Horton ..... G06F 3/0346 340/988
5,621,922 A * 4/1997 Rush, III ..... A63B 71/10 455/100
5,645,077 A * 7/1997 Foxlin ..... A61B 5/7242 600/595
5,697,099 A * 12/1997 Siska, Jr. ..... G08B 25/016 2/5
5,704,707 A * 1/1998 Gebelein ..... A42B 3/0453 362/802
5,723,786 A * 3/1998 Klapman ..... G01P 15/18 482/84
5,732,414 A * 3/1998 Monica ..... A42B 3/003 2/209.13
5,745,028 A * 4/1998 Hock ..... A63B 24/00 73/1.01
5,745,029 A * 4/1998 Garcia ..... A63B 71/0605 463/36
5,819,206 A 10/1998 Horton
5,856,811 A * 1/1999 Shih ..... G02B 27/0176 345/8
5,896,590 A * 4/1999 Fleisch ..... A42B 3/0473 224/186
5,916,181 A * 6/1999 Socci ..... A42B 3/0433 600/595
5,978,972 A * 11/1999 Stewart ..... A63B 24/0003 340/669
6,002,994 A * 12/1999 Lane ..... G08B 21/0469 702/188
6,009,563 A * 1/2000 Swanson ..... A42B 3/10 455/100
6,032,530 A * 3/2000 Hock ..... A63B 69/3608 600/595
6,056,674 A * 5/2000 Cook ..... A63B 71/0605 482/90
6,057,758 A * 5/2000 Dempsey ..... A61B 5/002 128/903
6,067,665 A * 5/2000 DePalma ..... A63B 71/1291 2/468
6,073,271 A * 6/2000 Alexander ..... A42B 3/122 2/413
6,090,044 A * 7/2000 Bishop ..... A61B 5/1071 128/920

(56) References Cited

U.S. PATENT DOCUMENTS 6,186,145 B1 * 2/2001 Brown ..... A63F 13/52 600/300
6,198,394 B1 * 3/2001 Jacobsen ..... A61B 5/1112 340/539.22
6,204,813 B1 * 3/2001 Wadell ..... G01S 5/0205 342/463
6,259,944 B1 * 7/2001 Margulis ..... A61B 5/222 600/509
6,298,483 B1 * 10/2001 Schiebl ..... A42B 3/08 2/9
6,301,718 B1 * 10/2001 Rigal ..... A42B 3/067 2/425
6,302,844 B1 * 10/2001 Walker ..... A61B 5/0022 600/300
6,331,168 B1 * 12/2001 Socci ..... A61B 5/1114 600/595
6,361,507 B1 3/2002 Foxlin
6,366,871 B1 * 4/2002 Geva ..... G16H 80/00 340/539.12
6,375,612 B1 * 4/2002 Guichon ..... G16H 40/67 119/51.02
6,397,151 B1 * 5/2002 Yamagishi ..... G01P 15/0922 482/84
6,406,168 B1 * 6/2002 Whiting ..... B60Q 1/2676 362/802
6,421,840 B1 * 7/2002 Chen ..... A42B 3/06 2/418
6,441,747 B1 * 8/2002 Khair ..... A61B 5/061 607/30
6,446,270 B1 * 9/2002 Durr ..... A42B 3/20 2/412
6,484,133 B1 * 11/2002 Vogt ..... G05B 23/0232 702/182
6,530,884 B2 * 3/2003 Balkin ..... A61B 5/4806 600/300
6,539,336 B1 * 3/2003 Vock ..... A61B 5/11 702/182
6,567,116 B1 * 5/2003 Aman ..... G01S 17/66 348/169
6,588,022 B1 * 7/2003 Anders ..... A42B 3/30 2/424
6,611,782 B1 * 8/2003 Wooster ..... A63B 24/0062 702/41
6,611,789 B1 * 8/2003 Darley ..... G04G 21/025 702/160
6,647,787 B2 * 11/2003 Fore ..... G01P 15/04 73/510
6,730,047 B2 5/2004 Socci
6,735,551 B2 * 5/2004 Voegeli ..... A61B 5/0002 128/920
6,748,250 B1 * 6/2004 Berman ..... G16Z 99/00 128/920
6,798,392 B2 9/2004 Hartwell
6,826,509 B2 11/2004 Crisco, III
6,925,851 B2 8/2005 Reinbold
6,964,638 B2 * 11/2005 Theodoracopulos .. G16H 70/60 128/920
7,054,784 B2 5/2006 Flentov
7,087,015 B1 * 8/2006 Comrie ..... G16H 15/00 600/300
7,092,846 B2 8/2006 Vock
7,162,392 B2 * 1/2007 Vock ..... G01P 15/0891 702/182
7,328,462 B1 * 2/2008 Straus ..... A42B 3/067 2/411
7,386,401 B2 * 6/2008 Vock ..... G01L 1/00 73/12.01
7,478,108 B2 * 1/2009 Townsend ..... G08B 21/0453
7,526,389 B2 * 4/2009 Greenwald ..... A61B 5/1123 702/55
7,548,168 B2 * 6/2009 Ishikawa ..... A63B 71/12 2/455
D603,099 S * 10/2009 Bologna ..... D29/106
7,693,668 B2 4/2010 Vock
7,861,326 B2 * 1/2011 Harty ..... A41D 13/0512 2/468
7,886,168 B2 * 2/2011 Lertora ..... G01P 15/18 600/587
8,104,324 B2 * 1/2012 Hennig ..... G01M 7/08 73/12.01
8,117,679 B2 * 2/2012 Pierce ..... B29C 70/78 2/424
8,156,569 B2 * 4/2012 Cripton ..... A42B 3/0473 2/6.8
8,280,681 B2 * 10/2012 Vock ..... G08G 1/20 600/587
8,382,685 B2 * 2/2013 Vaccari ..... A42B 3/046 600/595
8,465,376 B2 * 6/2013 Bentley ..... A63B 24/0006 473/226
8,466,794 B2 * 6/2013 Mack ..... G01L 1/26 702/41
8,468,613 B2 * 6/2013 Harty ..... A42B 3/0473 2/468
8,477,046 B2 7/2013 Alonso
8,548,768 B2 * 10/2013 Greenwald ..... A61B 5/0002 600/595
8,556,831 B1 * 10/2013 Faber ..... A61B 5/6803 600/595
8,640,267 B1 * 2/2014 Cohen ..... A42B 3/063 2/411
8,690,655 B2 * 4/2014 Meyer ..... A63F 13/533 463/32
8,702,504 B1 * 4/2014 Hughes ..... H04N 21/8586 463/31
8,702,516 B2 * 4/2014 Bentley ..... G06T 7/20 463/40
8,739,317 B2 * 6/2014 Abernethy ..... A42B 3/122 2/6.6
8,786,415 B2 * 7/2014 Cavallaro ..... G01S 17/48 340/572.1
8,797,165 B2 * 8/2014 Greenwald ..... A61B 5/746 600/595
8,860,570 B2 * 10/2014 Thomas ..... G08B 21/0446 340/436
8,863,319 B2 * 10/2014 Knight ..... A42B 3/14 2/411
8,927,088 B2 * 1/2015 Faden ..... A42B 3/063 428/218
8,961,440 B2 * 2/2015 Huang ..... A42B 3/046 600/595
9,024,770 B2 * 5/2015 Reuben ..... G01L 1/00 340/665
9,026,396 B2 * 5/2015 Evans ..... A42B 3/046 340/669
9,035,776 B2 * 5/2015 Miller, II ..... A61B 5/11 340/10.2
9,044,198 B2 * 6/2015 Benzel ..... A61B 5/7264
9,131,741 B2 * 9/2015 Maliszewski ..... A42B 3/046
9,141,759 B2 * 9/2015 Burich ..... G16H 40/67
D747,554 S * 1/2016 Daniel ..... D29/106
9,236,997 B2 * 1/2016 Yoon ..... H04L 27/34
9,247,780 B2 * 2/2016 Iuliano ..... A42B 3/046
9,257,054 B2 * 2/2016 Coza ..... A63B 43/004
9,289,024 B2 * 3/2016 Withnall ..... A42B 3/08
9,314,063 B2 * 4/2016 Bologna ..... A42B 3/068
9,326,737 B2 * 5/2016 Simon ..... A61B 5/7465
9,380,823 B2 * 7/2016 Johnson ..... A42B 3/121
9,380,961 B2 * 7/2016 Borkholder ..... A61B 5/6803
D764,716 S * 8/2016 Bologna ..... D29/102
9,439,468 B1 * 9/2016 Blagg ..... A42B 3/125
9,460,604 B1 * 10/2016 Daniel ..... G03B 21/26
9,468,249 B2 * 10/2016 Fraser ..... A42B 3/121
9,500,464 B2 * 11/2016 Coza ..... G01R 33/0035
9,508,335 B2 * 11/2016 Benattar ..... G10K 11/17823
9,530,248 B2 * 12/2016 Zhang ..... G06F 30/10
9,554,607 B2 1/2017 Mack
9,566,471 B2 * 2/2017 DeAngelis ..... A63B 71/0619
9,572,391 B2 * 2/2017 McInnis ..... A42B 3/124

(56) References Cited

U.S. PATENT DOCUMENTS 9,578,917 B2 * 2/2017 Cohen ..... A42B 3/063
9,586,116 B2 * 3/2017 Churchman ..... A42B 3/0433
9,596,901 B1 * 3/2017 Anvari ..... G05B 1/01
9,597,567 B1 * 3/2017 Tran ..... A63B 71/06
9,610,476 B1 * 4/2017 Tran ..... A63F 11/00
9,622,531 B1 * 4/2017 Crispino ..... A42B 3/067
9,622,661 B2 * 4/2017 Crisco, III ..... A63B 71/06
9,648,915 B2 * 5/2017 Jennings ..... A41D 31/24
9,648,920 B1 * 5/2017 Kuntz ..... A42B 3/20
9,678,850 B1 * 6/2017 Rickard ..... G06F 11/3409
9,711,146 B1 * 7/2017 Cronin ..... G06Q 50/01
9,724,588 B1 * 8/2017 Cronin ..... A61B 5/6896
9,730,482 B2 * 8/2017 Allen ..... A42B 3/046
9,750,296 B2 9/2017 Knight
9,763,571 B2 * 9/2017 Kozloski ..... A61B 3/0008
9,775,396 B1 * 10/2017 Olivares Velasco ..... H04B 1/3833
9,782,660 B2 * 10/2017 Tawiah ..... A63B 24/0087
9,788,589 B2 * 10/2017 Lewis ..... D04H 11/00
9,788,593 B2 * 10/2017 Lebel ..... A42B 3/222
9,788,600 B2 * 10/2017 Wawrousek ..... A43B 3/34
9,791,336 B2 * 10/2017 Zhu ..... A42B 3/046
9,795,177 B1 * 10/2017 Weaver ..... A42B 3/044
9,795,830 B2 * 10/2017 DeAngelis ..... G06Q 10/0833
9,817,439 B2 * 11/2017 Gosieski, Jr. ..... G06F 1/163
9,839,251 B2 * 12/2017 Pannikottu ..... A42B 3/121
9,849,334 B2 * 12/2017 DeAngelis ..... G06V 20/42
9,849,361 B2 * 12/2017 Coza ..... G16H 40/60
9,861,153 B2 * 1/2018 Finisdore ..... A42B 3/127
9,881,206 B2 * 1/2018 Hohteri ..... G09B 19/0038
9,895,099 B2 * 2/2018 Rennaker ..... G01P 15/036
9,900,669 B2 * 2/2018 Touma ..... H04Q 9/00
9,918,110 B2 * 3/2018 Anwar ..... H04N 21/2187
9,924,756 B2 * 3/2018 Hyman ..... A63B 71/10
9,934,298 B2 * 4/2018 Kendrena ..... G06Q 10/04
9,937,383 B2 4/2018 Burich
9,943,128 B2 * 4/2018 Atashbar ..... A42B 3/0433
9,949,516 B2 * 4/2018 Pickett ..... A42B 3/125
9,962,118 B2 * 5/2018 Kozloski ..... A61B 5/7271
10,004,973 B2 * 6/2018 Weatherby ..... A42B 3/122
10,010,127 B1 * 7/2018 Shaffer ..... A42B 3/128
10,022,593 B2 * 7/2018 Krysiak ..... A63B 71/0622
10,022,613 B2 * 7/2018 Tran ..... G06Q 20/321
10,024,743 B2 7/2018 Davis
10,028,679 B2 * 7/2018 Paris ..... A61B 5/6803
10,029,633 B2 7/2018 Phipps
10,049,549 B2 * 8/2018 Howard ..... G08B 21/0244
10,050,650 B2 * 8/2018 O'Hagan ..... H04B 1/719
10,058,761 B2 * 8/2018 Thompson ..... A63B 71/06
10,071,282 B2 * 9/2018 DeAngelis ..... A61B 5/0816
10,071,301 B2 * 9/2018 Vock ..... A63B 24/0062
10,105,076 B2 10/2018 Chu
10,117,010 B2 * 10/2018 Spector ..... H04R 1/028
10,123,582 B2 * 11/2018 Crossman ..... A42B 3/046
10,136,692 B2 * 11/2018 Ide ..... A42B 3/125
10,158,685 B1 * 12/2018 Hobby ..... G06Q 50/10
10,158,826 B2 * 12/2018 Waters ..... H04N 5/04
10,159,296 B2 12/2018 Pietrzak
10,165,979 B2 * 1/2019 Kozloski ..... G16H 40/67
10,172,406 B2 * 1/2019 Olivares Velasco ..... A61B 5/0022
10,172,555 B2 * 1/2019 Cam ..... A61B 5/682
10,182,135 B2 * 1/2019 Black ..... A42B 3/303
10,200,834 B2 * 2/2019 Tran ..... A63B 69/38
10,219,573 B2 * 3/2019 Podboy ..... A42B 3/20
10,241,205 B2 * 3/2019 Cavallaro ..... G01S 17/18
10,244,810 B2 4/2019 Martin
10,244,971 B2 4/2019 Kozloski
10,251,440 B1 * 4/2019 Staton ..... B60R 1/04
10,265,001 B2 4/2019 Kozloski
10,278,443 B2 * 5/2019 Miller, II ..... A61B 5/0004
10,282,011 B2 * 5/2019 McMillen ..... G01L 1/146
10,292,650 B2 5/2019 Greenwald
10,292,651 B2 5/2019 Kozloski
10,350,477 B2 * 7/2019 Schneider ..... A63C 5/07
10,362,829 B2 * 7/2019 Lowe ..... A42B 3/128
10,368,604 B2 * 8/2019 Linares ..... A42B 3/0473
10,376,210 B2 * 8/2019 Paris ..... A61B 5/01
10,561,189 B2 * 2/2020 Lee ..... A42B 3/28
10,646,154 B2 * 5/2020 Merchant-Borna ..... A61B 5/6803
11,497,964 B1 * 11/2022 Hunter ..... A63B 53/005
2001/0039674 A1 * 11/2001 Shida ..... A42B 3/283 2/414
2002/0011250 A1 * 1/2002 Stewart ..... A61B 5/4023 600/301
2002/0024450 A1 * 2/2002 Townsend ..... G08B 21/0446 340/572.1
2002/0049507 A1 * 4/2002 Hameen-Anttila ..... H04W 4/00 700/92
2002/0060633 A1 * 5/2002 Crisco, III ..... A61B 5/6814 340/669
2002/0087054 A1 * 7/2002 Lin ..... B42D 15/00 600/300
2002/0116147 A1 * 8/2002 Vock ..... G01P 3/50 702/182
2002/0183657 A1 * 12/2002 Socci ..... G08B 21/06 600/595
2003/0014210 A1 * 1/2003 Vock ..... A63B 71/10 702/149
2003/0071766 A1 * 4/2003 Hartwell ..... A42B 3/046 345/8
2003/0151554 A1 * 8/2003 McCarthy ..... G01S 5/14 342/450
2003/0163287 A1 * 8/2003 Vock ..... A61B 5/1112 702/187
2003/0217582 A1 * 11/2003 Reinbold ..... A63B 71/06 73/12.09
2004/0008106 A1 * 1/2004 Konczal ..... B62J 6/045 340/432
2004/0168246 A1 * 9/2004 Phillips ..... A42B 3/064 2/411
2004/0225236 A1 11/2004 Wheeler
2004/0240198 A1 * 12/2004 Van Laar ..... A42B 3/044 362/108
2005/0177335 A1 * 8/2005 Crisco, III ..... A63B 71/10 702/141
2005/0177929 A1 * 8/2005 Greenwald ..... A61B 5/11 73/865.9
2006/0038694 A1 * 2/2006 Naunheim ..... A42B 3/046 73/514.24
2006/0074338 A1 * 4/2006 Greenwald ..... A61B 5/11 600/595
2006/0189852 A1 * 8/2006 Greenwald ..... A61B 5/6803 600/595
2007/0061106 A1 * 3/2007 Vock ..... G01C 9/00 702/182
2008/0086916 A1 * 4/2008 Ellis ..... F16F 7/00 36/103
2009/0260133 A1 * 10/2009 Del Rosario ..... A42B 3/063 2/412
2010/0076321 A1 * 3/2010 Zhang ..... A61B 5/4878 600/483
2010/0076692 A1 3/2010 Vock
2011/0125065 A1 * 5/2011 Voronin ..... A61D 17/002 600/595
2011/0184663 A1 * 7/2011 Mack ..... A42B 3/046 702/41
2011/0215931 A1 * 9/2011 Callsen ..... F41H 1/04 340/573.1
2011/0219852 A1 * 9/2011 Kasten ..... G01L 5/0052 73/12.04
2012/0017358 A1 * 1/2012 Princip ..... A42B 3/063 2/414
2012/0047634 A1 * 3/2012 Vaidya ..... B29C 43/021 525/432
2012/0083714 A1 * 4/2012 Yuen ..... A61B 5/4815 600/587
2012/0150453 A1 * 6/2012 Benzel ..... A61B 5/682 702/41

(56) References Cited

U.S. PATENT DOCUMENTS

2012/0157243 A1* 6/2012 Gallo ..... A63B 71/0054 473/422
2012/0210498 A1* 8/2012 Mack ..... A42B 3/0466 2/209.13
2012/0220893 A1* 8/2012 Benzel ..... A61B 5/6844 600/553
2012/0223833 A1* 9/2012 Thomas ..... G16H 50/30 702/19
2012/0304367 A1* 12/2012 Howard ..... A42B 3/121 2/413
2013/0031700 A1* 2/2013 Wacter ..... A42B 3/322 2/410
2013/0060168 A1* 3/2013 Chu ..... A61B 5/6803 600/595
2013/0061375 A1* 3/2013 Bologna ..... A42B 3/122 2/414
2013/0074248 A1* 3/2013 Evans ..... G08B 21/02 340/669
2013/0110415 A1* 5/2013 Davis ..... A61B 5/6803 702/41
2013/0122256 A1* 5/2013 Kleiven ..... B32B 5/16 428/158
2013/0150684 A1* 6/2013 Cooner ..... A61B 5/4082 600/595
2013/0152286 A1* 6/2013 Cormier ..... A41D 13/0156 2/24
2013/0167290 A1* 7/2013 Ben Ezra ..... A42B 3/046 473/570
2013/0174329 A1* 7/2013 Hanson ..... A42B 3/069 2/411
2013/0185837 A1* 7/2013 Phipps ..... A42B 3/0453 2/2.5
2013/0209977 A1* 8/2013 Lathan ..... G16H 50/20 434/236
2013/0211774 A1* 8/2013 Bentley ..... G01P 13/00 702/145
2013/0232667 A1* 9/2013 Leon ..... A42B 3/08 2/411
2013/0303946 A1* 11/2013 Gettens ..... G01P 15/04 600/587
2014/0035658 A1* 2/2014 Usui ..... G05F 1/10 327/512
2014/0039354 A1* 2/2014 Greenwald ..... A61B 5/7282 600/595
2014/0052405 A1* 2/2014 Wackym ..... A61B 5/6803 702/141
2014/0072938 A1* 3/2014 Krull ..... G09B 19/00 434/219
2014/0081601 A1* 3/2014 Zhang ..... A42C 2/00 703/1
2014/0149067 A1* 5/2014 Merril ..... A42B 3/046 702/141
2014/0188426 A1* 7/2014 Fastert ..... G08B 21/0277 702/139
2014/0201889 A1* 7/2014 Pietrzak ..... G05B 19/4099 2/410
2014/0208486 A1* 7/2014 Krueger ..... A42B 3/064 2/414
2014/0215693 A1* 8/2014 O'Gara ..... A42B 3/069 2/410
2014/0223990 A1* 8/2014 Reuben ..... G01L 1/00 73/12.04
2014/0288432 A1* 9/2014 Hennig ..... A63B 71/085 600/553
2014/0333446 A1* 11/2014 Newlove ..... A61B 5/746 340/669
2014/0364772 A1* 12/2014 Howard ..... A61B 5/6803 600/595
2014/0376876 A1* 12/2014 Bentley ..... G06V 40/23 386/227
2015/0040669 A1* 2/2015 Borkholder ..... G01P 15/14 73/514.35
2015/0040685 A1* 2/2015 Nicholson ..... A61B 5/4064 73/862.51
2015/0080766 A1* 3/2015 Ji ..... A61B 5/11 600/595
2015/0081076 A1* 3/2015 Fernandes ..... B33Y 50/00 700/98
2015/0089721 A1* 4/2015 Hanna ..... A42B 3/069 2/412
2015/0089723 A1* 4/2015 Jean ..... A42B 3/085 2/414
2015/0101899 A1* 4/2015 Russo ..... A42B 3/121 267/116
2015/0107005 A1* 4/2015 Schneider ..... A63C 5/07 2/455
2015/0109129 A1* 4/2015 Merril ..... G08B 21/0438 702/141
2015/0119759 A1* 4/2015 Gonzales ..... A61B 5/682 600/595
2015/0157081 A1* 6/2015 Hyman ..... A42B 3/12 2/413
2015/0157083 A1* 6/2015 Lowe ..... A42B 3/064 2/412
2015/0173669 A1* 6/2015 Simon ..... G16H 50/20 600/595
2015/0196252 A1* 7/2015 Iuliano ..... A61B 5/746 600/595
2015/0208751 A1* 7/2015 Day ..... A42B 3/124 2/414
2015/0223546 A1* 8/2015 Cohen ..... A42B 3/127 2/412
2015/0223547 A1* 8/2015 Wibby ..... A42B 3/064 2/414
2015/0230534 A1* 8/2015 McGuckin, Jr. ..... A42B 3/128 2/410
2015/0238143 A1* 8/2015 Meurer ..... A61B 5/11 600/595
2015/0250250 A1* 9/2015 Ellis ..... A42B 3/125 2/413
2015/0305430 A1* 10/2015 Rush ..... A42B 3/124 2/412
2015/0313305 A1* 11/2015 Daetwyler ..... A63B 71/10 2/414
2015/0359477 A1* 12/2015 Ramachandran ..... A61B 5/486 434/362
2015/0377694 A1* 12/2015 Shepard, Jr. ..... G01S 5/018 73/658
2016/0018278 A1* 1/2016 Jeter, II ..... G16H 40/63 340/665
2016/0058092 A1* 3/2016 Aldino ..... A42B 3/046 2/412
2016/0100794 A1* 4/2016 Miller ..... A61B 5/369 607/110
2016/0113348 A1* 4/2016 Twardowski, Jr. ... F41H 5/0492 2/412
2016/0120238 A1* 5/2016 Duncan ..... A63B 71/1291 2/462
2016/0128415 A1* 5/2016 Tubbs ..... A42B 3/20 2/424
2016/0135706 A1* 5/2016 Sullivan ..... A61B 5/7275 600/509
2016/0255900 A1* 9/2016 Browd ..... A42B 3/065
2016/0262694 A1* 9/2016 Calcano ..... G01L 5/00
2016/0267663 A1* 9/2016 Sicking ..... G06T 7/75
2016/0270473 A1* 9/2016 Warmouth ..... A63B 71/10
2016/0278666 A1* 9/2016 Kozloski ..... A61B 5/4064
2016/0286885 A1* 10/2016 Hyman ..... A42B 3/328
2016/0286891 A1* 10/2016 Stramacchia ..... H04B 7/26
2016/0302496 A1* 10/2016 Ferrara ..... A42B 3/065
2016/0322078 A1* 11/2016 Bose ..... G11B 20/10527
2016/0331296 A1* 11/2016 Kozloski ..... A61B 5/14546
2016/0331581 A1* 11/2016 Kozloski ..... A61F 7/10
2016/0335396 A1* 11/2016 Kozloski ..... G16H 10/60
2016/0339293 A1* 11/2016 Perkins ..... G01R 33/0206
2016/0349738 A1* 12/2016 Sisk ..... B33Y 50/02
2016/0370239 A1* 12/2016 Cummings ..... G01L 5/0052
2017/0019629 A1* 1/2017 Fukasawa ..... H04L 51/043

(56) References Cited

U.S. PATENT DOCUMENTS

2017/0071526 A1* 3/2017 Lyren ..... A63B 71/085
2017/0071538 A1* 3/2017 Calcano ..... A61B 5/1123
2017/0144024 A1* 5/2017 Warners ..... G09B 19/0038
2017/0188648 A1* 7/2017 Larrabee ..... A42B 3/125
2017/0209092 A1* 7/2017 Crisco, III ..... A61B 5/4076
2017/0220746 A1* 8/2017 Marshall ..... G16Z 99/00
2017/0224252 A1* 8/2017 Salzar ..... G16H 40/67
2017/0225032 A1* 8/2017 Jones ..... A63B 71/0622
2017/0232327 A1* 8/2017 Kuntz ..... A42B 3/125 2/413
2017/0245575 A1* 8/2017 Branch ..... A42B 3/20
2017/0245808 A1* 8/2017 Jain ..... A61B 5/746
2017/0273387 A1* 9/2017 Sicking ..... A42B 3/20
2017/0278420 A1* 9/2017 João Viol Vieira .. A61B 5/4504
2017/0295881 A1* 10/2017 Martin ..... G05B 19/048
2017/0300755 A1* 10/2017 Bose ..... G11B 27/10
2017/0303622 A1* 10/2017 Stone ..... A42B 3/065
2017/0357716 A1* 12/2017 Bellegarda ..... G06F 16/345
2018/0014771 A1* 1/2018 Merchant-Borna ..... A61B 5/6814
2018/0021661 A1* 1/2018 Bologna ..... A42B 3/20 2/414
2018/0035952 A1* 2/2018 Fraylick ..... A61B 5/7275
2018/0085012 A1* 3/2018 Wei ..... A61B 5/318
2018/0116543 A1* 5/2018 Miller ..... G16H 30/40
2018/0132557 A1* 5/2018 Torres ..... A42B 3/205
2018/0154242 A1* 6/2018 Austin ..... A63B 71/085
2018/0213875 A1* 8/2018 Tutunaru ..... A42B 3/128
2018/0264346 A1* 9/2018 Jimenez ..... A42B 3/069
2018/0265738 A1* 9/2018 Rolland ..... B29C 64/129
2018/0310881 A1* 11/2018 Yoon ..... A61B 5/02416
2018/0326288 A1* 11/2018 Simpson ..... A42B 3/128
2019/0014848 A1* 1/2019 Tutunaru ..... A42B 3/069
2019/0014850 A1* 1/2019 Johnson, Jr. ..... A42B 3/0486
2019/0029353 A1* 1/2019 Ogata ..... A42B 3/283
2019/0059498 A1* 2/2019 Kovarik ..... A42B 3/046
2019/0090578 A1 3/2019 Tubbs
2019/0090807 A1* 3/2019 Goode, II ..... A61B 5/1126
2019/0110546 A1* 4/2019 Wacter ..... A42B 3/322
2019/0114690 A1* 4/2019 Paquette ..... G06Q 30/0631
2019/0145740 A1* 5/2019 Czerski ..... B32B 5/02 2/463
2019/0149644 A1 5/2019 Black
2019/0155969 A1* 5/2019 Haaland ..... G06N 3/09
2019/0166945 A1* 6/2019 Martin ..... G06F 17/18
2019/0167095 A1* 6/2019 Krueger ..... A61B 3/113
2019/0223535 A1 7/2019 Miller, II
2020/0100554 A1* 4/2020 Bologna ..... A42B 3/046
2020/0188733 A1* 6/2020 Beckwith ..... A42B 3/0433
2020/0215415 A1* 7/2020 Bologna ..... B29C 64/393
2020/0305708 A1* 10/2020 Krueger ..... G06F 3/013
2020/0329801 A1* 10/2020 Ciccaglione ..... A42B 3/22
2021/0030097 A1* 2/2021 Morgan ..... A61B 5/6803
2021/0307443 A1* 10/2021 Beckwith ..... A63B 24/0075

* cited by examiner

| | FRONT | BACK | LEFT | RIGHT | TOP |
|---|---|---|---|---|---|
| 1ST SEVERITY | | | | | 2 |
| 2ND SEVERITY | | 3 | | | |
| 3RD SEVERITY | | | | 2 | |
| 4TH SEVERITY | | | | | |
| 5TH SEVERITY | | | | | |
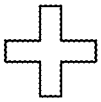
| | FRONT | BACK | LEFT | RIGHT | TOP |
|---|---|---|---|---|---|
| 1ST SEVERITY | | | | | |
| 2ND SEVERITY | | 1 | | | |
| 3RD SEVERITY | | | | 1 | |
| 4TH SEVERITY | | | 4 | | |
| 5TH SEVERITY | | | | | |
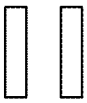
| | FRONT | BACK | LEFT | RIGHT | TOP |
|---|---|---|---|---|---|
| 1ST SEVERITY | | | | | 2 |
| 2ND SEVERITY | | 4 | | | |
| 3RD SEVERITY | | | | 3 | |
| 4TH SEVERITY | | | 4 | | |
| 5TH SEVERITY | | | | | |
FIG. 21

576, 578 508 590

| | | TOTAL NUMBER OF IMPACTS | NUMBER OF HIGH MAGNITUDE IMPACT | SET 1 | SET 2 | SET 3 | SET 4 | SET 5 | SET 6 | SET 7 | SET 8 | SET 9 | SET 10 | SET 11 | SET 12 | SET 13 | SET 14 | SET 15 | BASELINE AVERAGE NUMBER OF HIGH MAGNITUDE IMPACTS | 9TH THRESHOLD |
|---|---|---|---|---|---|---|---|---|---|---|---|---|---|---|---|---|---|---|---|---|
| HISTORICAL PHYSIOLOGICAL PARAMETER DATA | MON | 10 | 1 | 1 | | | | | | | | | | | | | | | | |
| | TUE | 12 | 3 | 3 | 3 | | | | | | | | | | | | | | | |
| | WED | 1 | 0 | 0 | 0 | 0 | | | | | | | | | | | | | | |
| | THUR | 7 | 0 | 0 | 0 | 0 | 0 | | | | | | | | | | | | | |
| | FRI | 2 | 0 | 0 | 0 | 0 | 0 | 0 | | | | | | | | | | | | |
| | SAT | 30 | 6 | 6 | 6 | 6 | 6 | 6 | 6 | | | | | | | | | | | |
| | SUN | 0 | 0 | 0 | 0 | 0 | 0 | 0 | 0 | 0 | | | | | | | | | | |
| | MON | 3 | 0 | | 0 | 0 | 0 | 0 | 0 | 0 | 0 | | | | | | | | | |
| | TUE | 8 | 1 | | | 1 | 1 | 1 | 1 | 1 | 1 | 1 | | | | | | | | |
| | WED | 14 | 3 | | | | 3 | 3 | 3 | 3 | 3 | 3 | 3 | | | | | | | |
| | THUR | 5 | 0 | | | | | 0 | 0 | 0 | 0 | 0 | 0 | 0 | | | | | | |
| | FRI | 2 | 0 | | | | | | 0 | 0 | 0 | 0 | 0 | 0 | 0 | | | | | |
| | SAT | 40 | 10 | | | | | | | 10 | 10 | 10 | 10 | 10 | 10 | 10 | | | | |
| | SUN | 0 | 0 | | | | | | | | 0 | 0 | 0 | 0 | 0 | 0 | 0 | | | |
| | MON | 8 | 2 | | | | | | | | | 2 | 2 | 2 | 2 | 2 | 2 | 2 | | |
| | TUE | 4 | 1 | | | | | | | | | | 1 | 1 | 1 | 1 | 1 | 1 | | |
| | WED | 10 | 3 | | | | | | | | | | | 3 | 3 | 3 | 3 | 3 | | |
| | THUR | 2 | 0 | | | | | | | | | | | | 0 | 0 | 0 | 0 | | |
| | FRI | 3 | 0 | | | | | | | | | | | | | 0 | 0 | 0 | | |
| | SAT | 25 | 5 | | | | | | | | | | | | | | 5 | 5 | | |
| | SUN | 0 | 0 | | | | | | | | | | | | | | | 0 | | |
| AVERAGE HISTORICAL NUMBER OF HIGH MAGNITUDE IMPACTS OVER 4TH TIME PERIOD | | | | 1.43 | 1.29 | 1.00 | 1.43 | 1.43 | 1.43 | 2.00 | 2.00 | 2.29 | 2.29 | 2.29 | 2.29 | 2.29 | 1.57 | 1.57 | 1.77 | 2.66 |

580 584

| | | | |
|---|---|---|---|
| RECENT PHYSIOLOGICAL PARAMETER DATA | MON | 10 | 3 |
| | TUE | 7 | 3 |
| | WED | 13 | 6 |
| | THUR | 2 | 0 |
| | FRI | 2 | 0 |
| | SAT | 35 | 8 |
| | SUN | 0 | 0 |
| AVERAGE RECENT NUMBER OF HIGH MAGNITUDE IMPACTS OVER 4TH TIME PERIOD | | | 2.86 |

588

FIG. 22

512

604

| | | TOTAL NUMBER OF IMPACTS | SET 1 | SET 2 | SET 3 | SET 4 | SET 5 | SET 6 | SET 7 | SET 8 | SET 9 | SET 10 | SET 11 | SET 12 | SET 13 | SET 14 | SET 15 | BASELINE AVERAGE NUMBER OF IMPACTS |
|---|---|---|---|---|---|---|---|---|---|---|---|---|---|---|---|---|---|---|
| HISTORICAL PHYSIOLOGICAL PARAMETER DATA | MON | 20 | 20 | | | | | | | | | | | | | | | |
| | TUE | 30 | 30 | 30 | | | | | | | | | | | | | | |
| | WED | 1 | 1 | 1 | 1 | | | | | | | | | | | | | |
| | THUR | 7 | 7 | 7 | 7 | 7 | | | | | | | | | | | | |
| | FRI | 2 | 2 | 2 | 2 | 2 | 2 | | | | | | | | | | | |
| | SAT | 75 | 75 | 75 | 75 | 75 | 75 | 75 | | | | | | | | | | |
| | SUN | 0 | 0 | 0 | 0 | 0 | 0 | 0 | 0 | | | | | | | | | |
| | MON | 15 | | 15 | 15 | 15 | 15 | 15 | 15 | 15 | | | | | | | | |
| | TUE | 35 | | | 35 | 35 | 35 | 35 | 35 | 35 | 35 | | | | | | | |
| | WED | 14 | | | | 14 | 14 | 14 | 14 | 14 | 14 | 14 | | | | | | |
| | THUR | 5 | | | | | 5 | 5 | 5 | 5 | 5 | 5 | 5 | | | | | |
| | FRI | 2 | | | | | | 2 | 2 | 2 | 2 | 2 | 2 | 2 | | | | |
| | SAT | 80 | | | | | | | 80 | 80 | 80 | 80 | 80 | 80 | 80 | | | |
| | SUN | 0 | | | | | | | | 0 | 0 | 0 | 0 | 0 | 0 | 0 | | |
| | MON | 32 | | | | | | | | | 32 | 32 | 32 | 32 | 32 | 32 | 32 | |
| | TUE | 15 | | | | | | | | | | 15 | 15 | 15 | 15 | 15 | 15 | |
| | WED | 10 | | | | | | | | | | | 10 | 10 | 10 | 10 | 10 | |
| | THUR | 2 | | | | | | | | | | | | 2 | 2 | 2 | 2 | |
| | FRI | 3 | | | | | | | | | | | | | 3 | 3 | 3 | |
| | SAT | 60 | | | | | | | | | | | | | | 60 | 60 | |
| | SUN | 0 | | | | | | | | | | | | | | | 0 | |
| AVERAGE HISTORICAL NUMBER OF IMPACTS OVER 6TH TIME PERIOD | | | 19.29 | 18.57 | 19.29 | 21.14 | 20.86 | 20.86 | 21.57 | 21.57 | 24.00 | 21.14 | 20.57 | 20.14 | 20.29 | 17.43 | 17.43 | 20.28 |

600

584

| | | |
|---|---|---|
| RECENT PHYSIOLOGICAL PARAMETER DATA | MON | 40 |
| | TUE | 10 |
| | WED | 31 |
| | THUR | 3 |
| | FRI | 2 |
| | SAT | 70 |
| | SUN | 0 |
| AVERAGE RECENT NUMBER OF IMPACTS OVER 6TH TIME PERIOD | | 22.28571429 |

608

FIG. 23

516

624

| | | IMPACT LOAD | SET 1 | SET 2 | SET 3 | SET 4 | SET 5 | SET 6 | SET 7 | SET 8 | SET 9 | SET 10 | SET 11 | SET 12 | SET 13 | SET 14 | SET 15 | BASELINE AVERAGE IMPACT LOAD |
|---|---|---|---|---|---|---|---|---|---|---|---|---|---|---|---|---|---|---|
| HISTORICAL PHYSIOLOGICAL PARAMETER DATA | MON | 325 | 325 | | | | | | | | | | | | | | | |
| | TUE | 250 | 250 | 250 | | | | | | | | | | | | | | |
| | WED | 125 | 125 | 125 | 125 | | | | | | | | | | | | | |
| | THUR | 0 | 0 | 0 | 0 | 0 | | | | | | | | | | | | |
| | FRI | 0 | 0 | 0 | 0 | 0 | 0 | | | | | | | | | | | |
| | SAT | 750 | 750 | 750 | 750 | 750 | 750 | 750 | | | | | | | | | | |
| | SUN | 100 | 100 | 100 | 100 | 100 | 100 | 100 | 100 | | | | | | | | | |
| | MON | 423 | | 423 | 423 | 423 | 423 | 423 | 423 | 423 | | | | | | | | |
| | TUE | 310 | | | 310 | 310 | 310 | 310 | 310 | 310 | 310 | | | | | | | |
| | WED | 100 | | | | 100 | 100 | 100 | 100 | 100 | 100 | 100 | | | | | | |
| | THUR | 0 | | | | | 0 | 0 | 0 | 0 | 0 | 0 | 0 | | | | | |
| | FRI | 0 | | | | | | 0 | 0 | 0 | 0 | 0 | 0 | 0 | | | | |
| | SAT | 680 | | | | | | | 680 | 680 | 680 | 680 | 680 | 680 | 680 | | | |
| | SUN | 200 | | | | | | | | 200 | 200 | 200 | 200 | 200 | 200 | 200 | | |
| | MON | 328 | | | | | | | | | 328 | 328 | 328 | 328 | 328 | 328 | 328 | |
| | TUE | 390 | | | | | | | | | | 390 | 390 | 390 | 390 | 390 | 390 | |
| | WED | 0 | | | | | | | | | | | 0 | 0 | 0 | 0 | 0 | |
| | THUR | 0 | | | | | | | | | | | | 0 | 0 | 0 | 0 | |
| | FRI | 0 | | | | | | | | | | | | | 0 | 0 | 0 | |
| | SAT | 830 | | | | | | | | | | | | | | 830 | 830 | |
| | SUN | 0 | | | | | | | | | | | | | | | 0 | |
| AVERAGE HISTORICAL IMPACTLOAD OVER 8TH TIME PERIOD | | | 221.43 | 235.43 | 244.00 | 240.43 | 240.43 | 240.43 | 230.43 | 244.71 | 231.14 | 242.57 | 228.29 | 228.29 | 228.29 | 249.71 | 221.14 | 235.11 |

620

| | | |
|---|---|---|
| RECENT PHYSIOLOGICAL PARAMETER DATA | MON | 490 |
| | TUE | 275 |
| | WED | 200 |
| | THUR | 0 |
| | FRI | 0 |
| | SAT | 920 |
| | SUN | 100 |
| AVERAGE RECENT IMPACT LOAD OVER 8TH TIME PERIOD | | 283.57 |

628

FIG. 24

| | FRONT | BACK | LEFT | RIGHT | TOP |
|---|---|---|---|---|---|
| 1ST SEVERITY | $P_{F1}$ | $P_{B1}$ | $P_{L1}$ | $P_{R1}$ | $P_{T1}$ |
| 2ND SEVERITY | $P_{F2}$ | $P_{B2}$ | $P_{L2}$ | $P_{R2}$ | $P_{T2}$ |
| 3RD SEVERITY | $P_{F3}$ | $P_{B3}$ | $P_{L3}$ | $P_{R3}$ | $P_{T3}$ |
| 4TH SEVERITY | $P_{F4}$ | $P_{B4}$ | $P_{L4}$ | $P_{R4}$ | $P_{T4}$ |
| 5TH SEVERITY | $P_{F5}$ | $P_{B5}$ | $P_{L5}$ | $P_{R5}$ | $P_{T5}$ |
| TOTAL | $P_F$ | $P_B$ | $P_L$ | $P_R$ | $P_T$ |

FIG. 25A

| | FRONT | BACK | LEFT | RIGHT | TOP |
|---|---|---|---|---|---|
| 1ST SEVERITY | $N_{F1}$ | $N_{B1}$ | $N_{L1}$ | $N_{R1}$ | $N_{T1}$ |
| 2ND SEVERITY | $N_{F2}$ | $N_{B2}$ | $N_{L2}$ | $N_{R2}$ | $N_{T2}$ |
| 3RD SEVERITY | $N_{F3}$ | $N_{B3}$ | $N_{L3}$ | $N_{R3}$ | $N_{T3}$ |
| 4TH SEVERITY | $N_{F4}$ | $N_{B4}$ | $N_{L4}$ | $N_{R4}$ | $N_{T4}$ |
| 5TH SEVERITY | $N_{F5}$ | $N_{B5}$ | $N_{L5}$ | $N_{R5}$ | $N_{T5}$ |
| TOTAL | $N_F$ | $N_B$ | $N_L$ | $N_R$ | $N_T$ |

FIG. 25B $$X^2_{ESTIMATED} = \frac{(P_F - N_F)^2}{N_F} + \frac{(P_B - N_B)^2}{N_B} + \frac{(P_L - N_L)^2}{N_L} + \frac{(P_R - N_R)^2}{N_R} + \frac{(P_T - N_T)^2}{N_T}$$

FIG. 25C $$X^2_{ESTIMATED} > X^2_{TABLE}$$

FIG. 25D

| PERCENTAGE POINTS OF THE CHI-SQUARE DISTRIBUTION | | | | | | | | | |
|---|---|---|---|---|---|---|---|---|---|
| DEGREES OF FREEDOM | PROBABILITY OF A LARGER VALUE OF $X^2$ | | | | | | | | |
| | 0.99 | 0.95 | 0.90 | 0.75 | 0.50 | 0.25 | 0.10 | 0.05 | 0.01 |
| 1 | 0.000 | 0.004 | 0.016 | 0.102 | 0.455 | 1.32 | 2.71 | 3.84 | 6.63 |
| 2 | 0.020 | 0.103 | 0.211 | 0.575 | 1.386 | 2.77 | 4.61 | 5.99 | 9.21 |
| 3 | 0.115 | 0.352 | 0.584 | 1.212 | 2.366 | 4.11 | 6.25 | 7.81 | 11.34 |
| 4 | 0.297 | 0.711 | 1.064 | 1.923 | 3.357 | 5.39 | 7.78 | 9.49 | 13.28 |
| 5 | 0.554 | 1.145 | 1.610 | 2.675 | 4.351 | 6.63 | 9.24 | 11.07 | 15.09 |
| 6 | 0.872 | 1.635 | 2.204 | 3.455 | 5.348 | 7.84 | 10.64 | 12.59 | 16.81 |
| 7 | 1.239 | 2.167 | 2.833 | 4.255 | 6.346 | 9.04 | 12.02 | 14.07 | 18.48 |
| 8 | 1.647 | 2.733 | 3.490 | 5.071 | 7.344 | 10.22 | 13.36 | 15.51 | 20.09 |
| 9 | 2.088 | 3.325 | 4.168 | 5.899 | 8.343 | 11.39 | 14.68 | 16.92 | 21.67 |
| 10 | 2.558 | 3.940 | 4.865 | 6.737 | 9.342 | 12.55 | 15.99 | 18.31 | 23.21 |
| 11 | 3.053 | 4.575 | 5.578 | 7.584 | 10.341 | 13.70 | 17.28 | 19.68 | 24.72 |
| 12 | 3.571 | 5.226 | 6.304 | 8.438 | 11.340 | 14.85 | 18.55 | 21.03 | 26.22 |
| 13 | 4.107 | 5.892 | 7.042 | 9.299 | 12.340 | 15.98 | 19.81 | 22.36 | 27.69 |
| 14 | 4.660 | 6.571 | 7.790 | 10.165 | 13.339 | 17.12 | 21.06 | 23.68 | 29.14 |
| 15 | 5.229 | 7.261 | 8.547 | 11.037 | 14.339 | 18.25 | 22.31 | 25.00 | 30.58 |
| 16 | 5.812 | 7.962 | 9.312 | 11.912 | 15.338 | 19.37 | 23.54 | 26.30 | 32.00 |
| 17 | 6.408 | 8.672 | 10.085 | 12.792 | 16.338 | 20.49 | 24.77 | 27.59 | 33.41 |
| 18 | 7.015 | 9.390 | 10.865 | 13.675 | 17.338 | 21.60 | 25.99 | 28.87 | 34.80 |
| 19 | 7.633 | 10.117 | 11.651 | 14.562 | 18.338 | 22.72 | 27.20 | 30.14 | 36.19 |
| 20 | 8.260 | 10.851 | 12.443 | 15.452 | 19.337 | 23.83 | 28.41 | 31.41 | 37.57 |
| 22 | 9.542 | 12.338 | 14.041 | 17.240 | 21.337 | 26.04 | 30.81 | 33.92 | 40.29 |
| 24 | 10.856 | 13.848 | 15.659 | 19.037 | 23.337 | 28.24 | 33.20 | 36.42 | 42.98 |

FIG. 25E 1000, 1170, 1168

ALERTS (28) | [illegible]

28 Single Alerts 0 Multiple Alerts

| Alert Date | No. | Name | Position | Alert Time | Alert Type | Alert Location |
|---|---|---|---|---|---|---|
| Tue 09/05/2017 | 41 | Bridges, Lucas | LB | 04:17pm | Single | Front |
| Wed 09/06/2017 | 20 | Collins, Conrad | RB | 04:52pm | Single | Front |
| | 41 | Bridges, Lucas | LB | 04:19pm | Single | Front |
| | | | | 05:18pm | Single | Front |
| Thu 09/07/2017 | 22 | six, west | DB | 10:58am | Single | Back |
| Sat 09/09/2017 | 20 | Collins, Conrad | RB | 06:18pm | Single | Front |
| | 41 | Bridges, Lucas | LB | 03:15pm | Single | Front |
| | 43 | Katz, Jesse | LB | 02:31pm | Single | Front |
| Wed 09/13/2017 | 20 | Collins, Conrad | RB | 04:55pm | Single | Front |
| | | | | 06:01pm | Single | Front |
| | | | | 05:02pm | Single | Front |

1172 1174 1176 1178 1180 1182 1184

FIG. 28C 1000, 3600

HIE LOCATION: TEAM

3630

| Position | Front | Top | Right | Back | Left |
|---|---|---|---|---|---|
| OL | 92% | 0% | 8% | 0% | 0% |
| RB | 100% | 0% | 0% | 0% | 0% |
| QB | 0% | 100% | 0% | 0% | 0% |
| WR | 0% | 0% | 0% | 0% | 0% |
| P/K/LS | 0% | 0% | 0% | 0% | 0% |
| DL | 69% | 0% | 31% | 0% | 0% |
| LB | 93% | 0% | 7% | 0% | 0% |
| DB | 15% | 38% | 0% | 46% | 0% |

WEEK BY WEEK SUMMARY: TEAM

3640

| Week | HIE Impacts (3641) | HITsp 95th% (3642) | HITsp 99th% (3643) | Multiple Alerts (3644) | Training Opportunities (3645) |
|---|---|---|---|---|---|
| Sun 11/05/2017 | 149 | 3 | 3 | 0 | 0 |

ALERTS: TEAM

3630

| Alert Date | No. | Name | Position | Alert Time | Alert Type | Alert Location |
|---|---|---|---|---|---|---|
| Tue 11/07/2017 | 20 | Collins, Conrad | RB | 05:01pm<br>05:10pm | Single<br>Single | Front<br>Front |
| Thu 11/09/2017 | 41 | Bridges, Lucas | LB | 04:01pm | Single | Front |

TRAINING OPPORTUNITIES: TEAM

3660

No Training Opportunities

95th %: TEAM

| Impact Date | No. | Name | Position | Alert Time | Alert Location |
|---|---|---|---|---|---|
| Wed 11/08/2017 | 20<br>41 | Collins, Conrad<br>Bridges, Lucas | RB<br>LB | 04:01pm<br>04:54pm | Front<br>Front |
| Thu 11/09/2017 | 20 | Collins, Conrad | RB | 04:56pm | Front |

3670

FIG. 55B

SYSTEMS FOR PROVIDING TRAINING OPPORTUNITIES BASED ON DATA COLLECTED FROM MONITORING A PHYSIOLOGICAL PARAMETER OF A PLAYER WEARING A PROTECTIVE SPORTS HELMET WHILE ENGAGED IN PLAYING A CONTACT SPORT

PRIORITY CLAIM

This Application is a Continuation of International Patent Application No. PCT/US2019/066084, filed on Dec. 12, 2019, which claims priory the benefit of U.S. Provisional Patent Application No. 62/778,559, filed on Dec. 12, 2018, the disclosure of which are hereby incorporated by reference in their entirety for all purposes.

CROSS-REFERENCE TO OTHER APPLICATIONS AND PAPERS

U.S. Pat. No. 10,105,076 entitled "Systems And Methods For Monitoring A Physiological Parameter Of Persons Engaged In Physical Activity," filed on Sep. 4, 2012, U.S. Provisional Patent Application Ser. No. 61/530,282 entitled "System & Method For Monitoring A Physiological Parameter Of Persons Engaged In Physical Activity," filed on Sep. 1, 2011, and U.S. Provisional Patent Application Ser. No. 61/533,038 entitled "System & Method For Monitoring A Physiological Parameter Of Persons Engaged In Physical Activity," filed on Sep. 9, 2011, the disclosure of which is hereby incorporated by reference in its entirety for all purposes.

U.S. Pat. No. 9,622,661 entitled "Impact Monitoring System For Players Engaged In A Sporting Activity," filed on Oct. 7, 2013 and U.S. Provisional Patent Application Ser. No. 60/239,379 entitled "Multi-Directional Head Acceleration System," filed on Oct. 11, 2000, the disclosure of which is hereby incorporated by reference in its entirety for all purposes.

U.S. Pat. No. 8,797,165 entitled "System For Monitoring A Physiological Parameter Of Players Engaged In A Sporting Activity," filed on Sep. 13, 2005 and U.S. Provisional Patent Application Ser. No. 60/609,555 entitled "System For Measuring And Monitoring Acceleration Of A Body Part," filed on Sep. 13, 2004, the disclosure of which is hereby incorporated by reference in its entirety for all purposes.

U.S. Pat. No. 8,548,768 entitled "System And Method For Evaluating And Providing Treatment To Sports Participants," filed on Jan. 9, 2005, and U.S. Provisional Patent Application Ser. No. 60/642,240 entitled "System And Method For Evaluating And Providing Treatment To Sports Participants," filed on Jan. 7, 2005, the disclosure of these are hereby incorporated by reference in their entirety for all purposes.

U.S. patent application Ser. No. 16/691,436 entitled "Football Helmet with Components Additively Manufactured to Manage Impact Forces," filed on Nov. 21, 2019, U.S. Design patent application Ser. No. 29/671,111, entitled "Internal Energy attenuation assembly of a Protective Sports Helmet," filed on Nov. 22, 2018 and U.S. Provisional Patent Application Ser. No. 62/770,453, entitled "Football Helmet With Components Additively Manufactured To Optimize The Management Of Energy From Impact Forces," filed on Nov. 21, 2018, the disclosure of these are hereby incorporated by reference in their entirety for all purposes.

U.S. patent application Ser. No. 16/543,371 entitled "System And Method For Designing And Manufacturing A Protective Helmet Tailored To A Selected Group Of Helmet Wearers," filed on Aug. 16, 2019 and U.S. Provisional Patent Application Ser. No. 62/719,130 entitled "System and Methods for Designing and Manufacturing a Protective Sports Helmet Based on Statistical Analysis of Player Head Shapes," filed on Aug. 16, 2018, the disclosure of these are hereby incorporated by reference in their entirety for all purposes.

U.S. patent application Ser. No. 15/655,490 entitled "System And Methods For Designing And Manufacturing A Bespoke Protective Sports Helmet," filed on Jul. 20, 2017, U.S. Pat. No. 10,159,296 entitled "System and Method for Custom Forming a Protective Helmet for a Customers Head," filed on Jan. 15, 2014, U.S. Pat. No. 9,314,063 entitled "Football Helmet with Impact Attenuation System," filed on Feb. 12, 2014, U.S. Design Pat. No. D764,716 entitled "Football Helmet," filed on Feb. 2, 2012, U.S. Pat. No. 9,289,024 entitled "Protective Sports Helmet," filed on May 2, 2011, and U.S. Design Pat. No. D603,099 entitled "Sports Helmet," filed on Oct. 27, 2009, the disclosure of these are hereby incorporated by reference in their entirety for all purposes.

Crisco J J, et. al. An Algorithm for Estimating Acceleration Magnitude and Impact Location Using Multiple Non-orthogonal Single-Axis Accelerometers. *J BioMech Eng.* 2004; 126(1), Duma S M, et. al. Analysis of Real-time Head Accelerations in Collegiate Football Players. *Clin J Sport Med.* 2005; 15(1):3-8, Brolinson, P. G., et al. "Analysis of Linear Head Accelerations from Collegiate Football Impacts." *Current Sports Medicine Reports*, vol. 5, no. 1, 2006, pp. 23-28, Greenwald R M, et., al. Head impact severity measures for evaluating mild traumatic brain injury risk exposure. *Neurosurgery.* 2008; 62(4):789-798, J. J. Crisco, et., al. Frequency and location of head impact exposures in individual collegiate football players. J. Athl. Train., 45 (2010), pp. 549-559, and Rowson, S., et., al. A six degree of freedom head acceleration measurement device for use in football. *J. Appl. Biomech.* 27:8-14, 2011, the disclosure of which is hereby incorporated by reference in its entirety for all purposes.

TECHNICAL FIELD

This disclosure relates to a system and method for: (i) recording data related to a physiological parameter of a person engaged in a physical activity (e.g., an impact experienced by a player engaged in a contact sport), (ii) analyzing the recorded data related to the physiological parameter while the person is engaged in a physical activity (e.g., is the experienced impact greater than a predetermined threshold), and (iii) providing post-physical activity analysis of the recorded data to make suggested changes in how the person engages in the physical activity.

BACKGROUND

There is a concern in various contact sports, such as football, lacrosse and hockey, of brain injury due to impacts to the head of an individual engaged in playing the contact sport. During such physical activity, the head of the individual is often subjected to contact which results in an impact to the skull and brain of the individual, as well as the movement of the head or body part itself.

While considerable research has been under taken in the scientific community, a fair amount of information regarding the response of the brain to head accelerations in the linear and rotational directions and even less about the correspondence between specific impact forces and injury, particularly with respect to injuries caused by repeated exposure to impact forces of a lower level than those that result in a catastrophic injury or fatality. A considerable amount of what was known is derived from animal studies, studies of cadavers under specific directional and predictable forces (i.e. a head-on collision test), from crash dummies, from human volunteers in well-defined but limited impact exposures or from other simplistic mechanical models. The conventional application of known forces and/or measurement of forces applied to animals, cadavers, crash dummies, and human volunteers limit our knowledge of a relationship between forces applied to a living human head and any resultant severe brain injury. These prior studies also have limited value as they typically relate to research in non-contact sports settings, such as automobile safety area.

The concern for sports-related injuries, particularly to the head, is higher than ever. The Center for Disease Control and Prevention estimates that the incidence of sports-related mild traumatic brain injury (MTBI) approaches 300,000 annually in the United States. Approximately one-third of these injuries occur in football, with MTBI being a major source of lost playing time. Head injuries accounted for 13.3% of all football injuries to boys and 4.4% of all soccer injuries to both boys and girls in a large study of high school sports injuries. Approximately 62,800 MTBI cases occur annually among high school varsity athletes, with football accounting for about 63% of cases. It has been reported that concussions in hockey affect 10% of the athletes and makeup 12%-14% of all injuries.

For example, a typical range of 4-6 concussions per year in a football team of 90 players (7%), and 6 per year from a hockey team with 28 players (21%) is not uncommon. In rugby, concussions can affect as many as 40% of players on a team each year. Concussions, particularly when repeated multiple times, significantly threaten the long-term health of the athlete. The health care costs associated with MTBI in sports are estimated to be in the hundreds of millions of dollars annually. The National Center for Injury Prevention and Control considers sports-related traumatic brain injury (mild and severe) an important public health problem because of the high incidence of these injuries, the relative youth of those being injured with possible long term disability, and the danger of cumulative effects from repeat incidences.

Athletes who suffer head impacts during a practice or game situation often find it difficult to assess the severity of the impact even with the assistance of coaches and trainers. In an attempt to assess the severity of the impact, devices have been developed that attempt to record the acceleration/deceleration of a player's head when the player experiences an impact. Examples of such devices are discussed within patents (e.g., U.S. Pat. Nos. 10,105,076, 9,622,661, 8,797,165, and 8,548,768) that are assigned to the current assignee of this application. While these devices may be able to detect and record acceleration/deceleration of a player's head when the player experiences an impact, these devices cannot determine if the impacts experienced are uncommon for the player or if the number/frequency of impacts that the player is experiencing are uncommon for the player's level and/or position. For example, a player may not be using proper tackling form (e.g., leading with the crown of his helmet) or after returning from an injury, the player may improperly alter his form to protect the part of the player's body that was previously injured. In a further example, the player may be experiencing more impacts during a day, week, or season in comparison to players of similar playing levels and/or positions, which may inform a coach or member of the coaching staff that the player needs additional instruction on tackling techniques and/or additional breaks to help ensure that they do not maintain a high head impact exposure ("HIE") load.

Based on the above, there is a demand for a physiological measuring and reporting system that is designed for post-activity analysis, which takes into account the player's level and/or position in determining if the player is experiencing impacts that are uncommon for the player's level and/or position. Additionally, there is also a demand that the foregoing system not only takes into account the player's level and/or position, but uses algorithms that self-update the thresholds that are utilized to determine if the impacts that the player is experiencing are uncommon for the player's level and/or position. Further, there is a demand for a graphical user interface ("GUI") that is shown on a display, wherein the GUI includes summary screens and other intuitive screens to increase the usability of the system and efficiently present information to the authorized user (e.g., coach, trainer, equipment manager, other member of the coaching staff, administrator, parent of the player, or the player, or other similar individuals).

This disclosure addresses shortcomings discussed above and other problems and provides advantages and aspects not provided by the prior art of this type. A full discussion of the features and advantages of the present disclosure is deferred to the following detailed description, which proceeds with reference to the accompanying drawings.

SUMMARY

The present disclosure provides a system for monitoring at least one physiological parameter of multiple players engaged in a contact sport. The system includes a plurality of monitoring units, each monitoring unit being associated with a specific or target player and having a sensor assembly that actively monitors at least one physiological parameter of the target player while engaged in the contact sport to determine a physiological parameter value. The monitoring unit selectively generates a first alert when the physiological parameter value exceeds a first predetermined threshold based upon a single incidence of the physiological parameter and a second alert when the physiological parameter value exceeds a second predetermined threshold based upon cumulative incidences of the physiological parameter. The system also includes a portable alert unit that receives the first alert and second alert transmitted from a particular monitoring unit and displays information relating to the particular alert to a user of the system.

The system also provides training opportunities geared for the authorized user, typically the coaching staff and/or athletic trainers. The training opportunities are based on comparing an individual player's data, a subset of the team's data, or the team's data against similar collections of data on different scales (e.g., team scale, local scale, regional scale, national scale, or nation-wide/worldwide scale). Specifically, training opportunities for an individual player may be based on comparing a player's recent physiological parameter data against various collections of historical physiological parameter data for other similar players (e.g., players that play at a similar playing level and/or position). For example, various collections of data may include: (A) player's own historical data, (B) team's historical data, (C) historical local player, position, unit or team data, (D) historical regional player, position, unit or team data, or (E) historical national player, position, unit or team data. Other training opportunities for an individual player may also be based on comparing a player's recent physiological parameter data against various collections of recent physiological parameter data for other similar players. For example, various collections of data may include: (A) team's recent data, (B) recent local player, position, unit or team data, (C) recent regional player, position, unit or team data, or (D) recent national player, position, unit, or team data. Alternatively, the system may adjust the algorithms that generate the training opportunities based upon that player's historical data, not solely historical data of other similar players.

Additionally, training opportunities for all players that play a specific position on a team (e.g., all players within a team that primarily play one position, such as lineman or running backs) and their historical data may be based on comparing a team's recent positional physiological parameter data against various collections of historical physiological parameter data for that specific position or other similar positions. For example, collections of data may include: (A) position's own historical data, (B) team's historical data, (C) historical local position, unit or team data, (D) historical regional position unit or team data, or (E) historical national position, unit or team data. Other training opportunities for all players that play a specific position on a team may also be based on comparing a team's positional recent physiological parameter data against various collections of recent physiological parameter data for other similar players. For example, various collections of data may include: (A) team's recent data, (B) recent local position, unit or team data, (C) recent regional position unit or team data, or (D) recent national position, unit, or team data.

Further, training opportunities for a unit's (e.g., all players within a team that primarily play in one unit, such as the "offense," "defense," kickoff," "field goal" unit) historical data may be based on comparing a unit's recent physiological parameter data against various collections of historical physiological parameter data for specific units or other similar units. For example, collections of data may include: (A) unit's own historical data, (B) team's historical data, (C) historical local unit or team data, (D) historical regional unit or team data, or (E) historical national unit or team data. Other training opportunities for a unit may also be based on comparing a unit's recent physiological parameter data against various collections of recent physiological parameter data for other similar units. For example, various collections of similar data may include: (A) team's recent data, (B) recent local unit or team data, (C) recent regional unit or team data, or (D) recent national unit or team data.

Moreover, training opportunities for a team's historical data may be based on comparing a team's recent physiological parameter data against various collections of historical physiological parameter data for other similar teams. For example, various collections of similar physiological data may include: (A) team's own historical data, (B) historical local team data, (C) historical regional team data, or (D) historical national team data. Other training opportunities for a team may also be based on comparing a team's recent physiological parameter data against various collections of recent physiological parameter data for other similar teams. For example, various collections of similar physiological data may include: (A) recent local team data, (B) recent regional team data, or (C) recent national team data.

Also, it should be understood that other training opportunities are contemplated by this disclosure.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict one or more implementations in accord with the present teachings, by way of example only, not by way of limitation. In the figures, like reference numerals refer to the same or similar elements.

FIG. 21 is a schematic showing how to impact matrixes can be added together;

FIG. 22 is a chart showing the calculations that are performed by algorithm 508 for an exemplary player;

FIG. 23 is a chart showing the calculations that are performed by algorithm 512 for an exemplary player;

FIG. 24 is a chart showing the calculations that are performed by algorithm 516 for an exemplary player;

FIG. 25A is a player's impact matrix;

FIG. 25B is a national average impact matrix;

FIG. 25C is an algorithm used to determine the estimated Chi value for the comparison between the player's impact matrix against the national average impact matrix;

FIG. 25D is an algorithm used to compare the estimated Chi value against the actual Chi value determined from the table shown in FIG. 25E;

FIG. 25E is a table that is used to determine the actual Chi value used in the algorithm shown in FIG. 25D;

FIG. 28C illustrates a third section of the first screen of the coaching tool of the GUI, which includes a month view of an alert chart;

FIG. 55B illustrates a second section of the first screen of the team report tool of the GUI;

DETAILED DESCRIPTION

1. Introduction of the Inventive System

Figure 1:
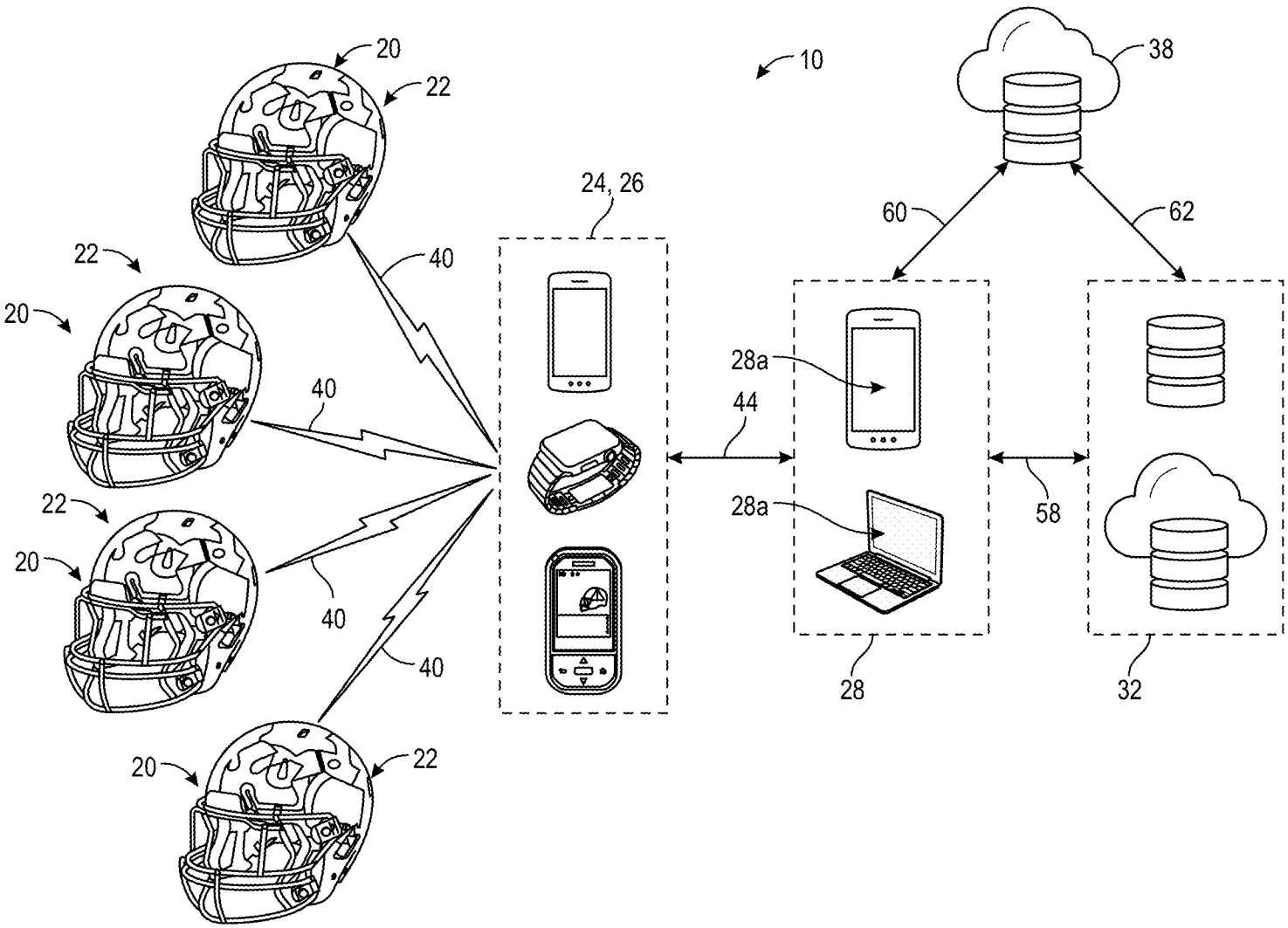
FIG. 1 illustrates a first exemplary multi-functional system showing: (i) helmets that each have an in-helmet unit (IHU) installed therein, (ii) a receiving device, which is an alert unit, (iii) a remote terminal, (iv) a team database, and (v) a national database.

In the following detailed description, numerous specific details are set forth by way of examples in order to provide a thorough understanding of the relevant teachings. However, it should be apparent to those skilled in the art that the present teachings may be practiced without such details. In other instances, well-known methods, procedures, components, and/or circuitry have been described at a relatively high-level, without detail, in order to avoid unnecessarily obscuring aspects of the present teachings.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspects of the disclosed concepts to the embodiments illustrated. As will be realized, the disclosed methods and systems are capable of other and different configurations and several details are capable of being modified all without departing from the scope of the disclosed methods and systems. For example, one or more of the following embodiments, in part or whole, may be combined consistent with the disclosed methods and systems. As such, one or more steps from the flow charts or components in the Figures may be selectively omitted and/or combined consistent with the disclosed methods and systems. Accordingly, the drawings, flow charts and detailed descriptions are to be regarded as illustrative in nature, not restrictive or limiting.

FIGS. 1-6 illustrate exemplary embodiments of a multi-functional system 10 that: (i) records data related to a physiological parameter of a person engaged in a physical activity (e.g., an impact experienced by a player engaged in a contact sport), (ii) analyzes the recorded data related to the physiological parameter, while the person is engaged in a physical activity (e.g., is the experienced impact greater than a threshold), (iii) transmits the recorded data related to the physiological parameter, while the person is engaged in a physical activity, to an external device (e.g., if experienced impact is greater than a threshold, then part of the system sends an alert to an alert unit), and (iv) provides post-physical activity analysis of the recorded data to make suggested changes in how the person engages in the physical activity.

To provide post-physical activity analysis, the multi-functional system 10 utilizes a complex collection of algorithms to analyze data related to at least one physiological parameter (e.g., pressure) for a selected player or group of players to inform the authorized user that the selected player or group of players have experienced physiological parameters that are uncommon or atypical for the selected player or group. This complex collection of algorithms provides an unconventional solution to the problem of trying to understand what the player experiences during the activity. This unconventional solution is rooted in technology and provides information that was not available in conventional systems. This unconventional solution also represents an improvement in the subject technical field otherwise unrealized by conventional systems. Specifically, unlike conventional systems, the multi-functional system 10 determines if the player or group of players experiences, for example: (i) more alertable impacts then other player/groups, (ii) more high magnitude impacts then other player/groups, (iii) more impacts then the player or group of players has experienced in a past interval of time, (iv) more high magnitude impacts then the player or group of players has experienced in a past interval of time, (v) impacts in uncommon locations of a body part (e.g., irregular locations of the head) or patterns in comparison to other player/groups, (vi) impacts in uncommon locations of a body part (e.g., irregular locations of the head) or patterns in comparison to the impacts that the player or group of players has experienced in a past interval of time, and (vii) other determinations that are discussed below.

After the system 10 makes these determinations about the player or group of players, the system 10 displays the data using a GUI on a display 28*a* in a unique and easy way to understand format. Conventional devices could not provide this solution for at least the following reasons: (i) the significant processing power required for the in-helmet units, (ii) the considerable data storage requirements for the in-helmet units, (iii) a large enough pool of physiological parameter data to provide accurate thresholds for the algorithms, (iv) algorithms that allow for the thresholds to be self-updated in light of additional data that is added to the pool of physiological parameter data, (v) other hardware and software features that are discussed below, or (vi) other reasons that are known to one of skill in the art based on the disclosure herein.

The complex collection of algorithms are operational linked and tied to the multi-functional system 10, which ensures that the disclosed algorithms cannot preempt all uses of these algorithms beyond the system 10. Also, as detailed below, these algorithms are complicated and cannot be performed using a pen and paper or within the human mind. In addition, the GUI displays the results of the execution of these complex algorithms in a manner that is easily understandable by a human user, sometimes views such results on a small or handheld screen 28*a*, improves operation of computing devices. Additionally, translation of outcomes from these complex algorithms through the GUI onto images displayed for a user, improves comprehension of considerable quantities of highly processed data. For example, an exemplary algorithm from this complex collection of algorithms requires: taking inputs from multiple sensors, selecting some data provided by the sensors, ignoring some of the data that was provided by the sensors, performing multiple calculations on a selected subset of the data, combining the data from these multiple calculations and then outputting that data within a short amount of time (e.g., preferably less than a minute), all for multiple members on a team.

The exemplary algorithm cannot be performed with a pen and paper or within the human mind because the algorithm requires analyzing millions of data points to find similarities between individuals, grouping individuals that have similarities together, determining the physiological parameters that these similar individuals experience, determining the level of the physiological parameter that a similar individual must experience to place an individual above 95% of these similar individuals, obtaining additional physiological parameter data about the similar individuals, making a new determination about the level of the physiological parameter that a similar individual must experience to place above 95% of the similar individuals in light of the newly obtained data, comparing physiological parameter data from similar individuals against this new threshold, providing the results of this analysis to the authorized user, and then repeating the above steps over a relatively short time period (e.g., every day) and for hundreds of different groups of players. Additional reasons why this complex collection of algorithms cannot be performed with a pen and paper or within the human mind will be obvious to one of skill in the art based on the below disclosure.

Additionally, multi-functional system 10 provides multiple improvements over conventional systems, including improving the efficiency of monitoring players to identify coaching and training opportunities via the GUI that is displayed on a screen 28*a*. The authorized user can then utilize the information provided by the GUI to proactively identify, coach and adjust player behavior, group behavior, or team behavior through new/different training techniques and practice plans. For example, in the context where the physiological parameter is pressure exerted on the player's head due to a helmet impact, the multi-functional system 10 learns the type of impacts a player experiences and identifies if the player deviates from these impact types over time. Also, the system 10 can determine if the impacts experienced by the player deviate from other similarly situated players. Deviations indicate to the users of the system 10 that: (i) new or different drills should be utilized or (ii) additional coaching within a particular drill should be utilized to train the player in order to alter the number, magnitude, or type of impacts the player is experiencing or may experience during future play of the contact sport.

Additionally, the system 10 learns the type of impacts a subset of players of the team experiences and identifies if the subset of the team deviates from these types of impacts over time. Also, the system 10 can determine if the impacts experienced by the player subset deviate from other similar subsets on that team or other teams. Deviations indicate to the users of the system 10 that new or different drills could be utilized to train the player subset in order to alter the number, magnitude, or type of impacts the player subset is experiencing or may experience during future play of the contact sport.

Further, system 10 learns the type of impacts an entire team experiences and identifies if the team deviates from these types of impacts over time. Also, the system 10 can determine if the impacts experienced by the team deviate from similar teams. Deviations indicate to the users of the system 10 that new or different drills could be utilized to train the team in order to alter the number, magnitude, or type of impacts the team is experiencing or may experience during future play of the contact sport. Moreover, system 10 allows multiple people to collaborate, locally or remotely, about the use of these training techniques and practice plans. Also, the system 10 allows for the tracking of a player's history (e.g., impacts, sizes, medical histories, equipment, etc.) and other relevant information to aid in the monitoring and training of the player.

The present disclosure, as will be discussed in detail below, is capable of monitoring and analyzing data gathered from any body part of an individual but has particular application in monitoring the human head. For example, system 10 could be employed within protective equipment other than helmets to monitor a player's shins, knees, hips, chest, shoulders, elbows, or wrists. Therefore, any reference to a body part is understood to encompass the head and any reference to the head alone is intended to include applicability to any body part. For ease of discussion and illustration, discussion of the prior art and the present disclosure is directed to the human head, by way of example, and is not intended to limit the scope of discussion to the human head.

Since most contact sports involve multi-player teams, the system 10 actively monitors, records, analyzes, and transmits data related to the selected physiological parameter(s) for all players on the team throughout the course of play, including a game or practice session. System 10 is especially well suited for helmeted team sports where players are susceptible to head impacts and injuries; for example, football, hockey, and lacrosse. The system 10 could also be applied to helmets for a: baseball player, cyclist, polo player, equestrian rider, rock climber, auto racer, motorcycle rider, motocross racer, skier, skater, ice skater, snowboarder, snow skier and other snow or water athletes, skydiver.

2. In-Helmet Unit (IHU)

FIGS. 1-6 and 10 illustrate exemplary configurations of the system 10. These exemplary configurations of the system 10 include a helmet 20 and an in-helmet unit (IHU) 22. The helmet 20 may include: (i) shell 20*a*, (ii) faceguard 20*b*, and (iii) internal energy attenuation assembly 20*c*. Exemplary shells 20*a*, faceguards 20*b*, and internal energy attenuation assemblies 20*c* that may be used in connection with the system 10 disclosed herein are discussed in greater detail within U.S. patent application Ser. No. 16/691,436, U.S. Design Patent Application Ser. No. 29/671,111, U.S. patent application Ser. No. 16/543,371, U.S. patent application Ser. No. 15/655,490, U.S. Pat. Nos. 10,159,296, 9,314,063, 9,289,024, D764,716, D603,099, or any other helmet that has been described above or is described within the materials that are incorporated by reference.

The IHU or monitoring unit 22 includes a sensor assembly 120 and a control module 130. The IHU 22 may be specifically designed and programmed to: (i) measure and record data related to a physiological parameter, (ii) analyze the recorded data using the algorithm shown in FIG. 12, and (iii) depending on the outcome of the algorithm shown in FIG. 12, transmit the recorded data to a receiving device 24 that is remote from the IHU 22. In one exemplary embodiment, this physiological parameter may be pressure on a player's head as a result of an impact the player experienced while engaged in a contact sport, such as football, hockey or lacrosse. As discussed in greater detail below, physiological parameter data that is recorded in this exemplary embodiment includes alert data and data contained within the impact matrix. It should be understood that this exemplary embodiment should not be construed as limiting and that the system disclosed herein can be applied to other physiological parameters. Specifically, other physiological parameters that the system may record include: temperature, heart rate, blood pressure, balance, activity, or other similar physiological parameters.

In an alternative embodiment, the IHU 22 may be morphed to fit within a mouthguard. It should be understood that this alternative embodiment is not preferred because it requires placing a battery and other functional components within a user's mouth. Additionally, this configuration may create a device that exceeds the FCC transmission limits associated with devices that are placed within a player's mouth when the mouth guard sends an alert to the receiving device 24. Nevertheless, it may be desirable to be able to record data when a player is not wearing his helmet 20 or is involved in an activity that does not utilize a helmet 20. Thus, the designer may omit some of the components from the IHU 22 in order to overcome some of the limitations associated with this morphed embodiment. For example, the designer may create a mouth guard that only records impact data and does not transmit alert data. This mouth guard configuration can still be utilized by the system 10 because the impact data that it collects can be analyzed by the complex collection of algorithms to provide training opportunity determinations. In further alternative embodiments and as described above, the IHU 22 may be placed in other equipment that is worn on the player's body, such as shins, knees, hips, chest, shoulders, elbows, and wrists. For example, the IHU 22 may be morphed to fit into a set of shoulder pads, a shin guard, jersey, pants, girdle, elbow pads, shoes, knee pads, gloves, jackets, boots, life vest, or other types of equipment that is worn by the player.

Other components that may be included within the system 10 include: (i) the receiving device 24, which may be an alerting unit 26, (ii) a remote terminal 28, (iii) a team database 32, and (iv) national database 38. Different configurations of these other components (e.g., the combination of some of these components into a single combination component) are discussed in connection with FIGS. 1-6. At a high level, the receiving device 24 is a device that receives the alert data and/or the impact data that is transmitted from the IHU 22. This receiving device 24 may be a simple relay or may be an internet enabled device that can display all or a subset of the alert data and/or impact data to the authorized user. The remote terminal 28 may be an internet enabled device that is configured to interact with the team database 32 and/or national database 38 via the internet to obtain and display information (e.g., training opportunities) to the authorized user in the GUI 1000. These training opportunities can then be utilized by the authorized user in order to provide suggested changes in how the person engages in the physical activity.

It should be understood that system 10 may include additional or fewer components. For example, system 10 may include additional database(s) that is external to the system and the databases 32, 38 therein. This external database(s) may store player/team data, such as: (i) videotape of the games, scrimmages, or practices, (ii) activity levels of the player/team, or (iii) historical information about the player/team. In another embodiment, the system 10 may include the ability to connect other external systems in order to pull the data from these other external systems into this system 10 for analysis. For example, in this embodiment, the system 10 may be able to connect to a $3^{rd}$ party external impact detection system in order to pull in the data that was recorded within that external impact detection system in order to analyze the data using the algorithms contained within the system 10 disclosed herein. In another example, these external systems may include a register's database at the school that includes the grades of the player. This information can be pulled into the system 10 disclosed herein to inform the authorized user of whether the player is authorized to play that week. In a further example, these external systems may include a weather database that can be used to record the weather during games or practice sessions. Also, this weather database could be used to send an alert to the receiving device 24 to inform the authorized user that the game or practice should be canceled or moved indoors. It should be understood that these are just examples of other components that may be added into the system 10 to provide the authorized user with additional information about the player and these examples are non-limiting.

a. Sensor Assembly Contained within the Helmet

Figure 7A:
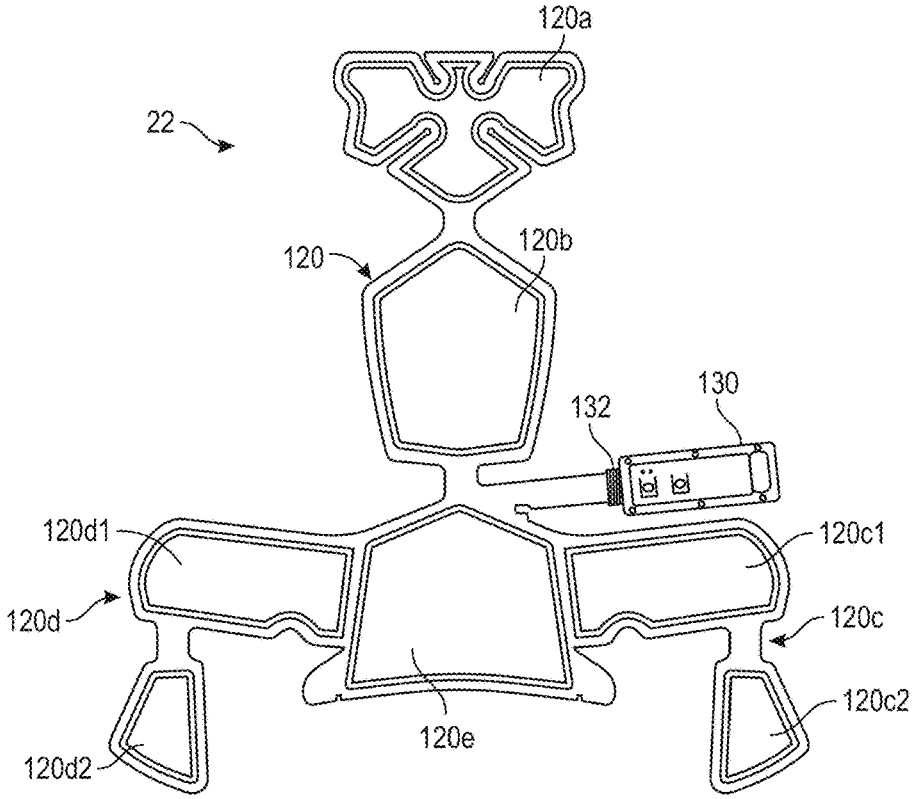
FIG. 7A illustrates an exemplary IHU that fits within the helmet, wherein the IHU is in a substantially flat, pre-installed, configuration.
Figure 7B:
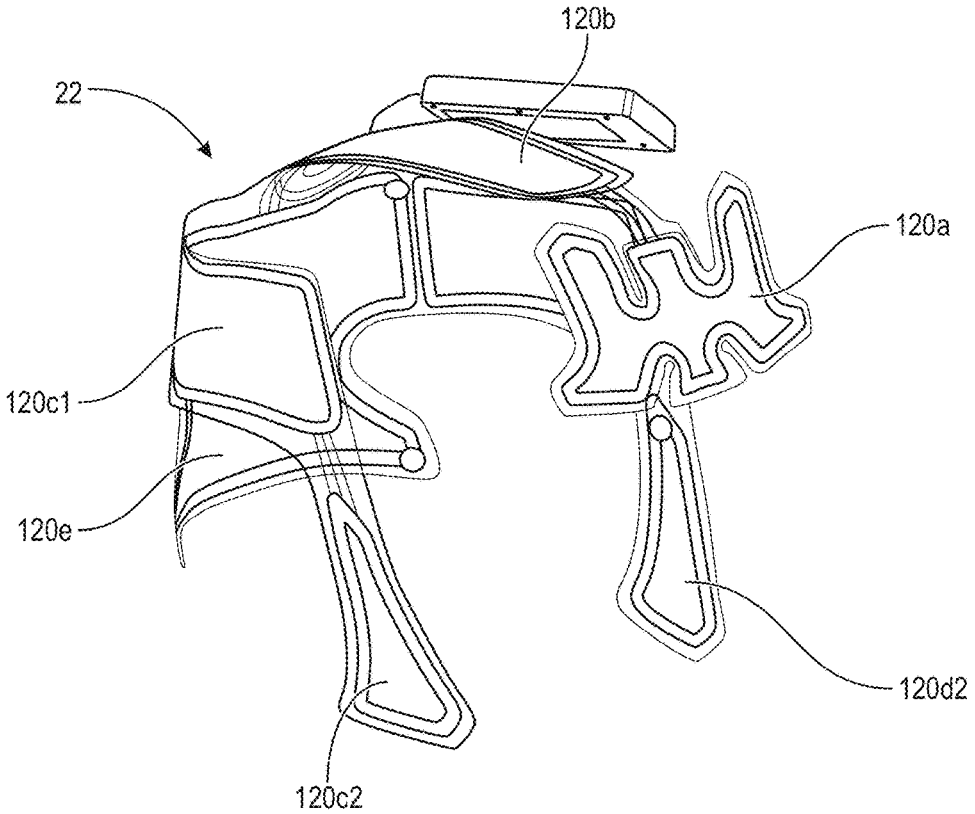
FIG. 7B is a perspective view of the exemplary IHU from FIG. 7A, wherein the IHU is in a folded configuration that minims an installed configuration.
Figure 8A:
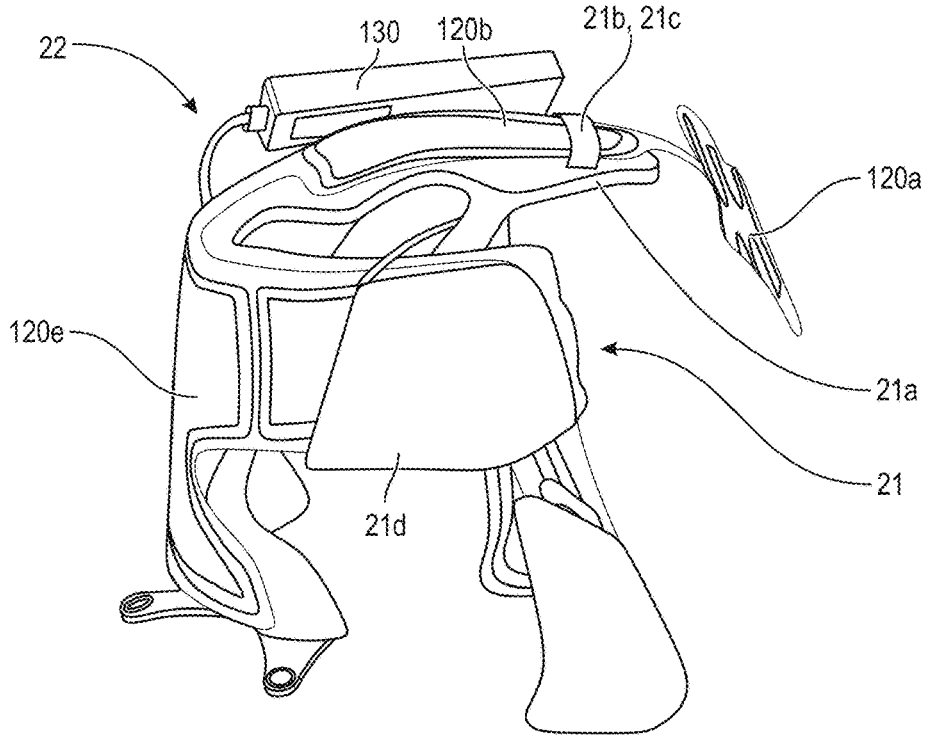
FIG. 8A side view of the exemplary IHU from FIG. 7A, wherein the IHU is inserted within an overliner that is installed against an inner surface of an energy attenuation assembly of the helmet.
Figure 8B:
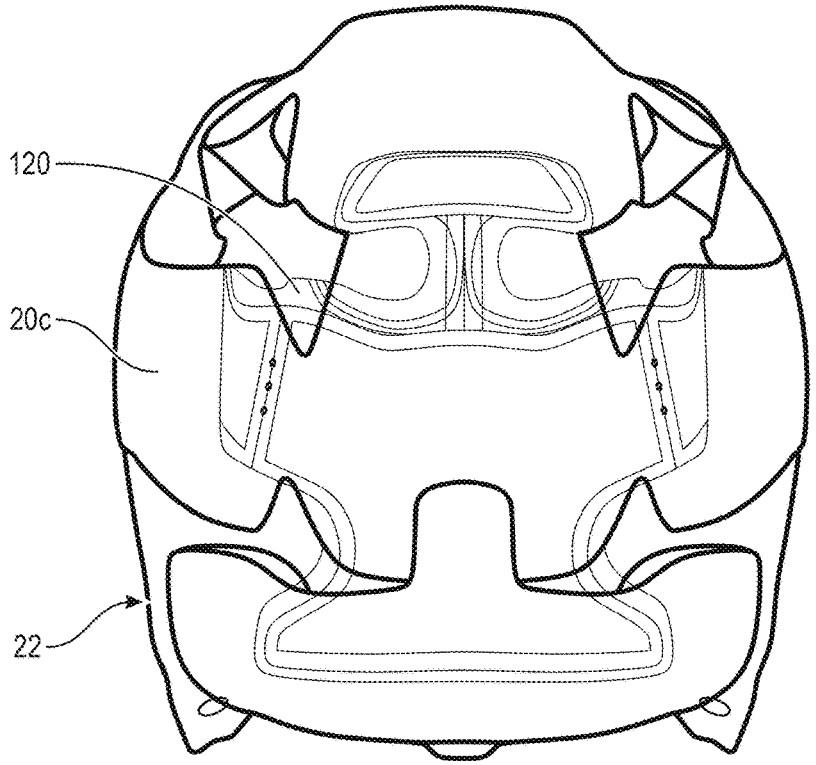
FIG. 8B is a rear view of the exemplary IHU from FIG. 7A, wherein the IHU is inserted within the helmet's overliner and the overliner is positioned within the energy attenuation assembly.
Figure 9A:
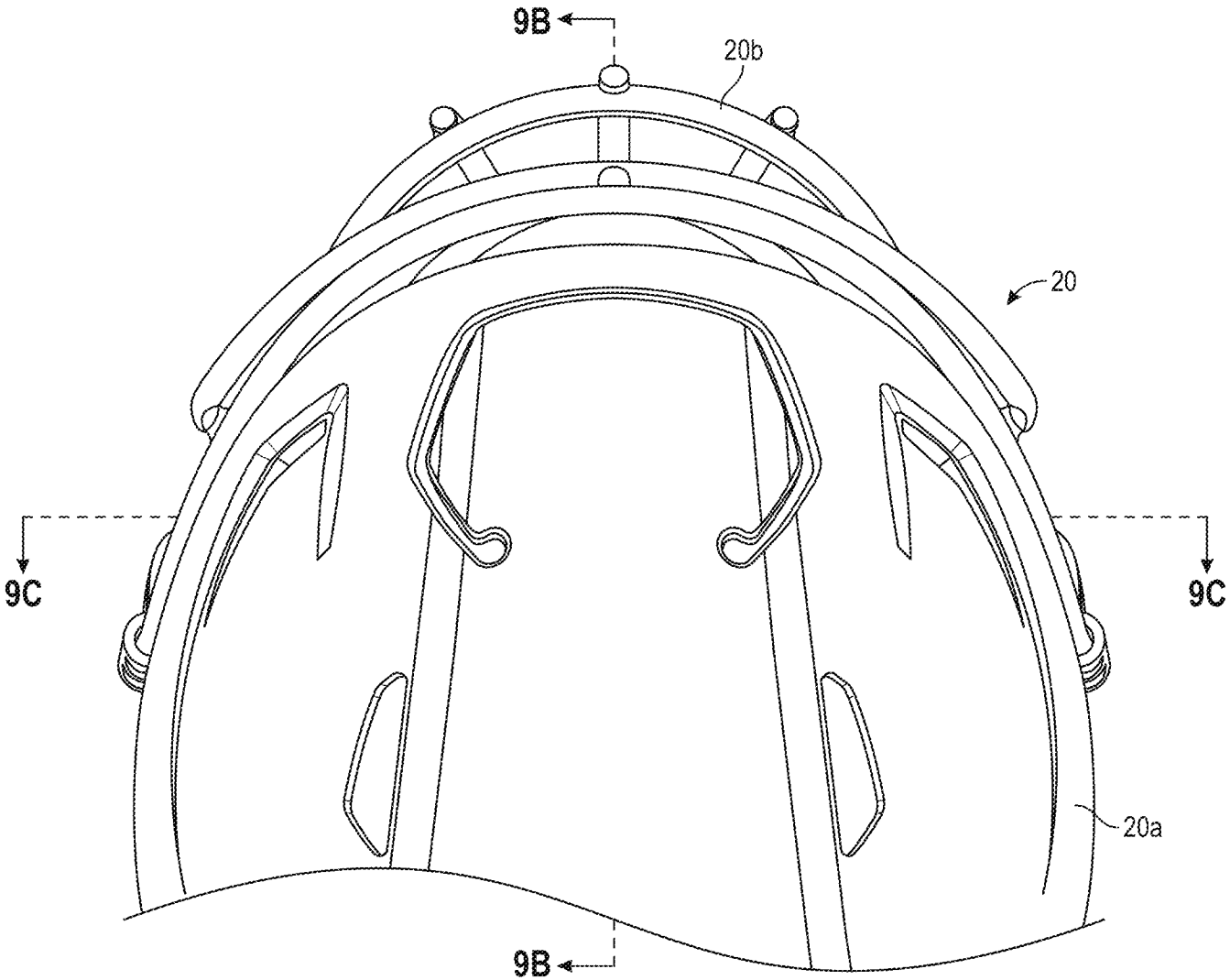
FIG. 9A is a partial top view of the helmet.
Figure 9B:
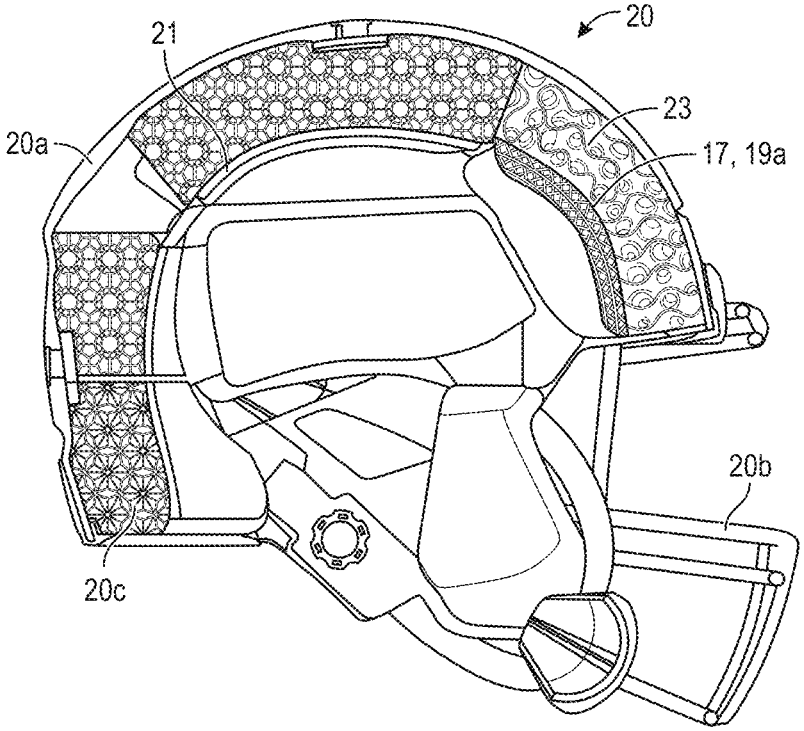
FIG. 9B is a first cross-sectional view of the helmet taken along the 9B-9B line shown in FIG. 9A, wherein the energy attenuation assembly is configured to receive an extent of the IHU when it is installed within the helmet.
Figure 9C:
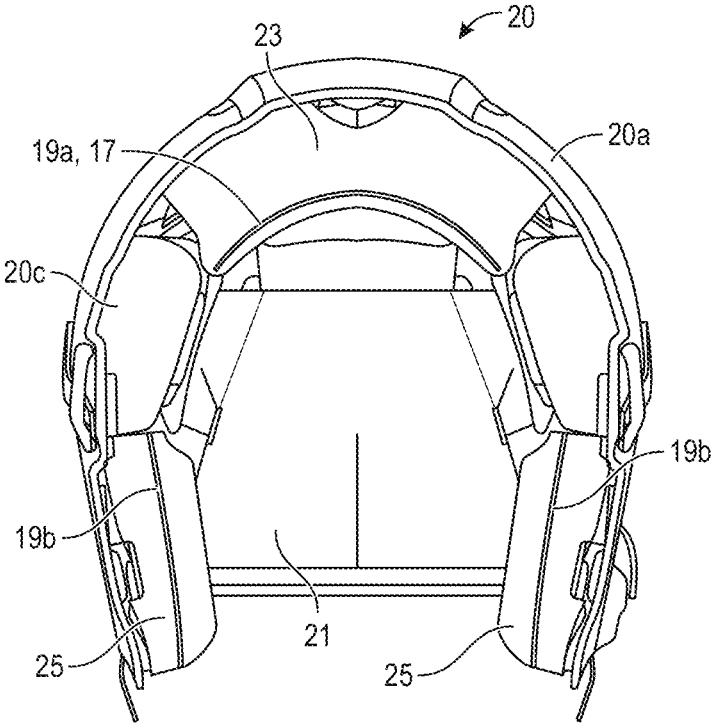
FIG. 9C is a second cross-sectional view of the helmet taken along the 9C-9C line shown in FIG. 9A, wherein the energy attenuation assembly is configured to receive an extent of the IHU when it is installed within the helmet.
Figure 10:
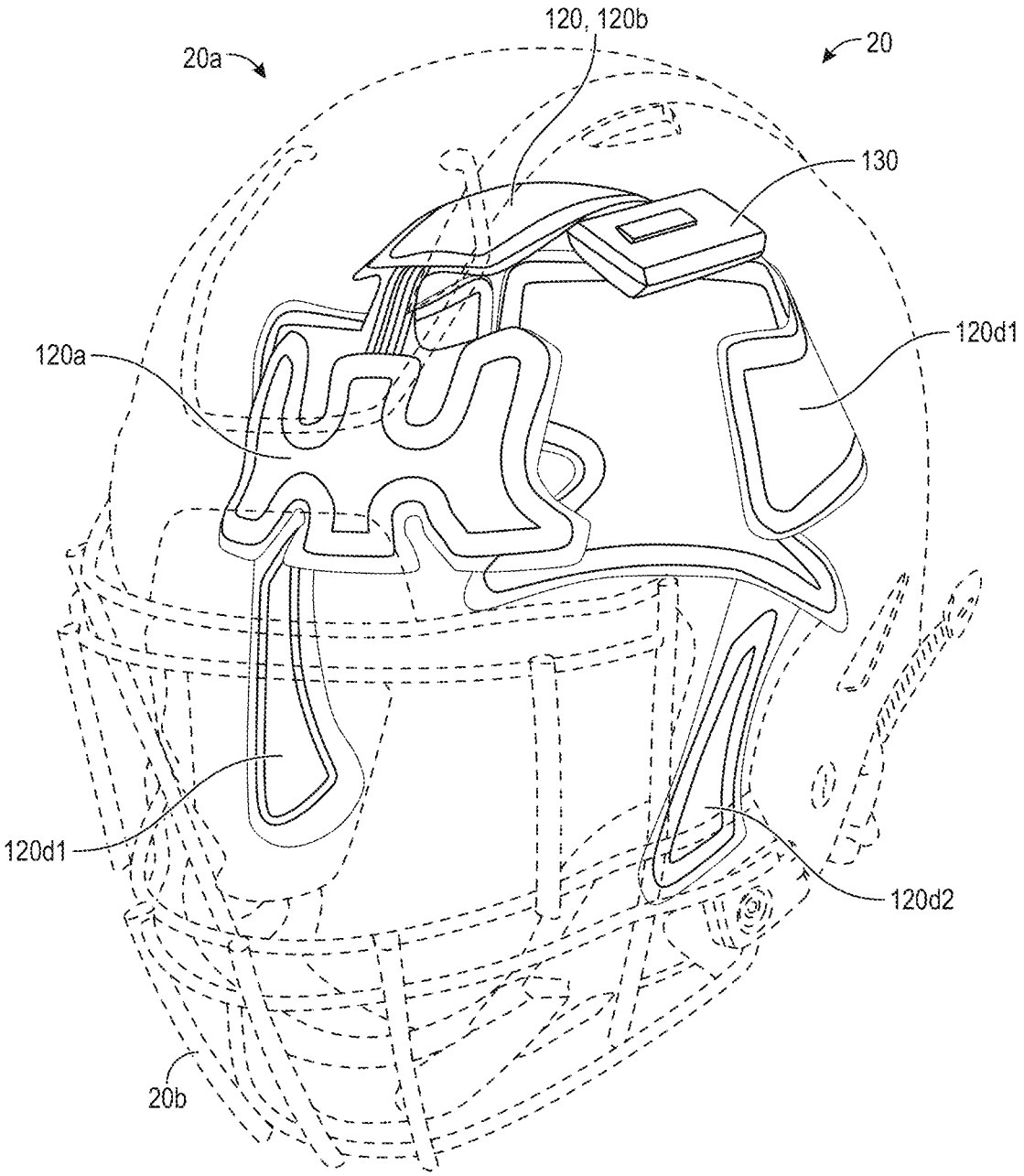
FIG. 10 illustrates a 3D model of the helmet with the IHU installed therein and a faceguard attached to the helmet.

FIGS. 7A-10 shows the IHU 22 in various configurations to enable the viewing of the layout of the sensor assembly 120, connector 132, and the control module 130. As best shown in FIG. 7A, the sensor assembly 120 includes five sensors 120*a*, 120*b*, 120*c*, 120*d*, and 120*e* that each provides distinct electrical channels that measure at least one physiological parameter of a player (e.g., pressure). As shown, sensors 120*c* and 120*d* each have a horizontal component 120*c*1, 120*d*1, and a vertical component 120*c*2, 120*d*2. As best shown in FIGS. 8A-8B, the IHU 22 may be fitted within the overliner 21, which is configured to be positioned within the helmet 20 and designed to rest on the player's head. The overliner 21 includes a thin layer of padding 21*a* that is positioned between the sensor assembly 120 and the wearer's head when the helmet is worn by the wearer. Additionally, as shown in FIG. 8B, an energy attenuation assembly 20*c* resides outside of and adjacent to the sensor assembly 120. Further, as shown in FIG. 10, the shell 20*a* is the outward most layer and the sensor assembly 120 is positioned within the shell 20*a* without contacting the shell 20*a*. Thus, when the IHU 22 is installed within the helmet 20 and the helmet 20 is worn by the wearer, the shell 20*a* is the outward most layer, then the energy attenuation assembly 20*c* is the next outermost layer, then the sensor assembly 120 is the next outermost layer, then the overliner 21 is the next outermost layer, and finally the wearer's head is the next outermost layer or the innermost layer. It should be understood, that in this configuration the sensor assembly 120 is removable from the helmet 20 and does not directly touch the player's head.

Referring back to FIG. 8A, the overliner 21 also includes coupling means 21*b* to couple the sensor assembly 120 within the overliner 21. This coupling means 21*b* may include loops or straps 21*c* that can extend from one side of a portion of the overliner 21 to the other side of the overliner 21. Additionally, the coupling means 21*c* may include pockets 21*d* that are designed to receive an extent of the sensor assembly 120. It should be understood that the coupling means 21*c* may take other forms, such as snaps, Velcro, other mechanical connectors, or chemical-based connectors that allow the sensor assembly 120 to be removed from the overliner 21.

In a slightly different implementation, the sensor assembly 120 is positioned adjacent to the innermost portion of the overliner 21, such that when the overliner 21 is positioned within the player's helmet 20, there is substantially no padding material that is positioned between the player's head and the sensor assembly 120. In this implementation, the sensor assembly 120 is positioned extremely close to the player's head, but is still not directly touching the player's head because the extent of the overliner 21 is still placed between the player's head and the sensor assembly 120. In yet another implementation, the sensor assembly 120 may be placed in direct contact with the player's head when the helmet is worn by the player.

FIG. 9A shows a partial top view of the helmet 20 that is configured to receive the IHU 22, while FIGS. 9B-9C show cross-sectional views of the helmet 20 shown in FIG. 9A. Specifically, FIGS. 9B-9C show an energy attenuation assembly 20*c* that omits an extent of the overliner 21 and an extent of the energy attenuation assembly 20*c* is configured to receive a portion of the sensor assembly 120. Specifically, FIG. 9B shows a cross-sectional view of the stock helmet described within U.S. patent application Ser. No. 16/691,436, wherein the members contained within the energy attenuation assembly 20*c* include different lattice regions that are comprised of different lattice cells. Additional details about these members are described within U.S. patent application Ser. No. 16/691,436, which is incorporated herein by reference. FIG. 9C does not show lattice structures to make viewing of the slots within the energy attenuation members easier to see; however, it should be understood that these members within the energy attenuation assembly 20*c* include lattice structures. To receive the portion of the sensor assembly 120, a plurality of slots 17 are formed within the energy attenuation assembly 20*c*. In particular, a front member 23 of the energy attenuation assembly 20*c* includes a slot 19*a* and jaw members 25 of the energy attenuation assembly 20*c* includes a slot 19*b*. As shown in FIGS. 9B-9C, the plurality of slots 17 are formed a distance from the inner surface of the energy attenuation assembly 20*c*, which ensures that there is some energy attenuation material that is positioned between the player's head and the sensor assembly 120, when the helmet 20 is worn by the player.

Alternatively, the sensor assembly 120 may be integrally formed as part of the energy attenuation assembly 20*c*. For example, the skin of each member of the energy attenuation assembly 20*c* or the lattice structure contained within each member of the energy attenuation assembly 20*c* may be coated with or integrally formed with a material that can act as a sensor. Specifically, the skin or the lattice structure contained within the energy attenuation assembly 20*c* may be composed of a material that includes carbon nanotubes blended within a light sensitive polyurethane. Additional information about this material and other possible materials are discussed within N. Hu, et al. *Investigation on sensitivity of a polymer/carbon nanotube composite strain sensor*. Carbon, 48 (3) (2010), pp. 680-687 and Radeti, M. & Cortes, Pedro & Kubas, George & Cook, Jim & Gade, Ravi & Oder, T. (2016). *The Sensing Properties of Fuzzy Carbon Nanotube Based Silica Fibers: Ceramic Transactions*, Volume CCLX. 10.1002/9781119323624.ch13, both of which are fully incorporated herein by reference. It should be understood that a combination of the above described sensor placements may be utilized within a helmet, wherein one sensor within the sensor assembly 120 may be placed within an energy attenuation member and another sensor within the sensor assembly 120 may be integrally formed within the energy attenuation assembly 20*c*. It should be further understood that the sensor assembly 120 may be placed in other locations within the helmet 20 and may be coupled to other structures within the helmet 20.

Although the IHU 22 is shown and described to include five sensors 120*a-e* within the sensor assembly 120, one of ordinary skill in the art recognizes that the IHU 22 may have more or fewer sensors (e.g., between 1 sensor and 100 sensors). The number of sensors may depend on the application and the information that is required to meet the needs of the application. For monitoring at least one physiological parameter of a player engaged in a sports activity, (e.g., American football), the location of pressure applied by an impact is useful in determining the severity of the impact. In another application, the location may not be as important and in these applications a single sensor may be used. For example, a single sensor may be sufficient, if the IHU 22 is utilized to determine when a single impact helmet should not be worn after experiencing an impact with a large enough magnitude.

i. Sensors Contained within the Sensor Assembly

In one exemplary embodiment, the sensors 120*a*-120*e* of the sensor assembly 120 are formed from an electret film, which has a unique, strong electromechanical response to an impact(s) to the helmet 20. The film is based on a polyolefin material manufactured in a continuous biaxial orientation process that stretches the film in two perpendicular directions (machine direction and the transverse direction). Further the film is expanded in thickness at high-pressure gas-diffusion-expansion (GDE) process. The structure of electret film consists of flat voids separated by thin polyolefin layers. Typically the electret film is 70-80 μm thick. The voids are made by compounding small particles, which function as rupture nuclei and form closed lens like cavities to the film during the biaxial orientation. The voids are enlarged at with the GDE process, which more than doubles the thickness and elasticity of the film by increasing the size of air-voids inside it. Electromechanical response with GDE processed film is over 10-fold compared to non-swelled film. A permanent electric charge is injected into the material by corona charging it in a high electric field. This causes electric breakdowns to occur inside the material, thus charging the void interfaces inside the film in order to form an electret material capable of interacting with its environment. Thin metal electrodes are, for example, arranged by screen-printing them first to 75-100 μm polyester film and laminating together with electret film. Vacuum evaporation to both surfaces of the film is also possible for actuator purposes. Other typical ways to arrange electrodes are using aluminum-polyester laminate and etching the electrode pattern prior to laminating with electret film. In another implementation, the sensors 120*a*-120*e* are made of piezoelectric material (e.g., Polyvinylidene Flouride (PVDF) and Lead Ziconate Titanate (LZT). It should be understood that other materials or configurations of materials may be utilized to form the sensors within the sensor assembly.

b. Control Module Contained within the Helmet

Figure 11:
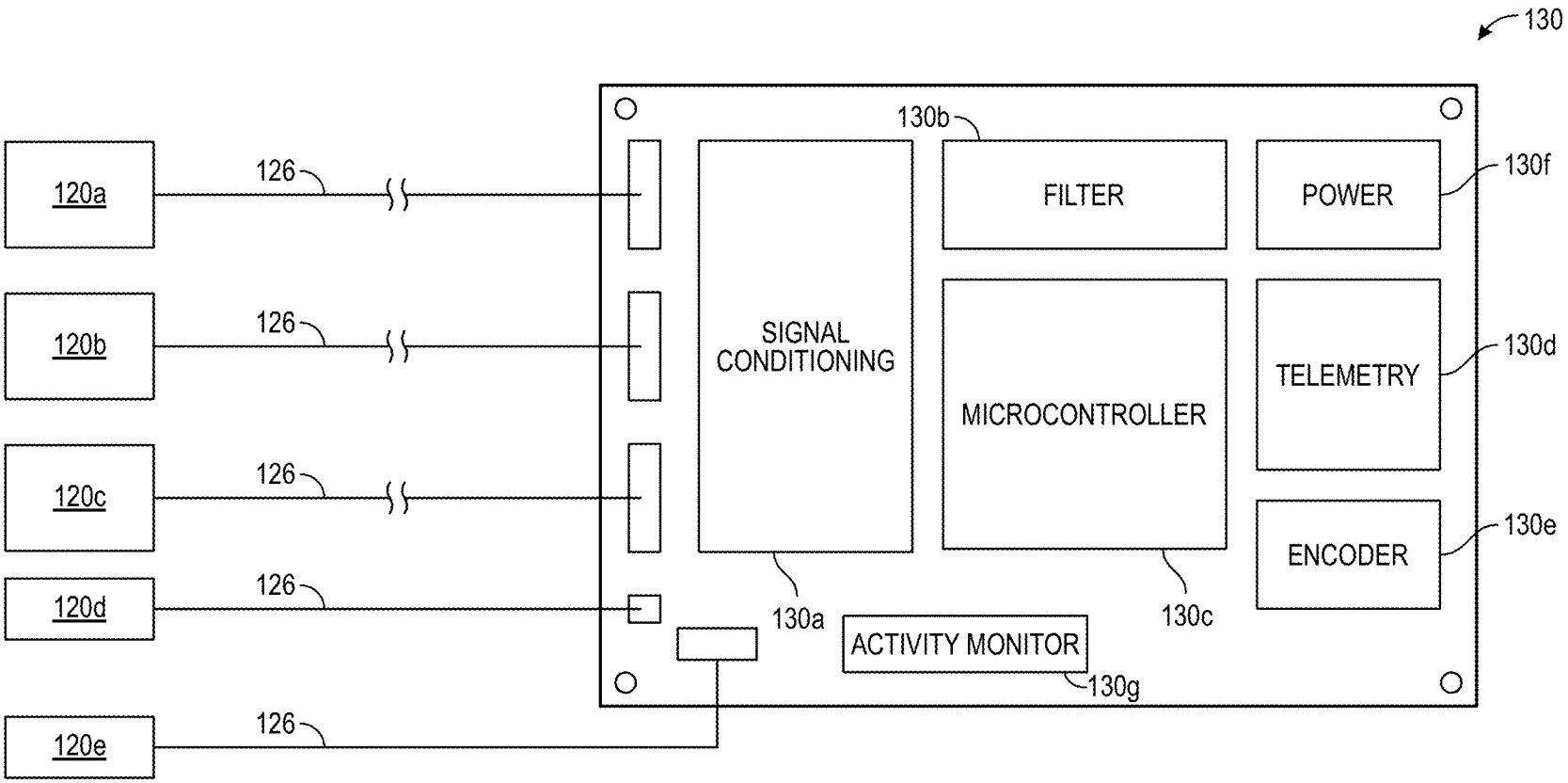
FIG. 11 is a schematic of the IHU shown in FIG. 10.

FIG. 11 illustrates a schematic of the IHU 22. As shown, the control module 130 is connected to each sensor 120*a*-120*e* via separate leads 126. The control module 130 may include a signal conditioner 130*a*, a filter 130*b*, a microcontroller 130*c* (or microprocessor), a telemetry element 130*d*, an encoder 130*e*, a power source 130*f* and an activity sensing module 130*g*. Each of these elements is contained within the control module 130 function together to measure at least one physiological parameter, compare this measured physiological parameter using various algorithms, and transmit the data captured by the measurement of the physiological parameter upon determining that the captured information is above a predefined threshold value. Additional details about these hardware modules and their functionality are discussed below.

i. Signal Conditioner and Filter

The signal conditioner 130*a* and a filter 130*b* are utilized by the control module 130, as necessary, to condition the signals that are received from the sensors 120*a*-120*e*. For example, the signal conditioner 130*a* and filter 130*b* may be utilized to filter out low and high-frequency noise that is generated by the sensors 120*a*-120*e*. Such noise may be introduced into the system due to environmental conditions, miss-alignment of the sensors 120*a*-120*e* within the helmet 20, or other similar factors. It should be understood that in some embodiments, a signal conditioner 130*a* and filter 130*b* may not be utilized or only one of these components may be utilized.

ii. Microcontroller

The microcontroller 130*c* may be a processor that is specifically designed for use within the IHU 22. The microcontroller 130*c* includes memory that stores the algorithms described in FIG. 12, receive the signals from the signal conditioner 130*a* and a filter 130*b*, and analyze these signals using the algorithm described in FIG. 12. Alternatively, the algorithms described within FIG. 12 may be stored within a separate memory contained within the IHU 22, which the microcontroller 130*c* may call upon once signals are received from the signal conditioner 130*a* and a filter 130*b*. It should be understood that the microcontroller 130*c* must have sufficient capability's to perform the calculations within FIG. 12 in less than 5 minutes, preferably less than 1 minute, more preferably less than 30 seconds, and most preferably less than 10 seconds. This processing power is necessary to ensure that: (i) the complex monitoring of physiological parameter(s) of multiple players is correctly performed, (ii) physiological parameter data is rapidly computed and reported, and (iii) near-instantaneous decisions can be made regarding whether to remove a particular player from the activity prior to the start of the next play or sequence of activity. Without being able to perform these steps, including the necessary monitoring and calculations, in real time or near real time, the system 10 will not adequately function. For example, if the calculations took several minutes, then sideline personnel (e.g. coaches and athletic trainers) in American football would not know if a player sustained a suspect impact and should be removed from the course of play for observation, which would potentially expose the player to additional impacts. Additionally, the delay in these calculations may accumulate over the duration of the sporting activity, which would increase these delays and render the system 10 largely ineffective for sporting activity that occurs over an appreciable duration of time (e.g., hours in the context of football, hockey or lacrosse). It should also be understood that a processor that includes too much processing power (e.g., state of the art desktop processor) will also render the system 10 inoperable because this processor's power consumption are too high and will drain the battery 130*f* of the IHU 22 before it can last a sufficient amount of time (e.g., the length of the activity). The battery 130*f* of the IHU 22 cannot be enlarged without regard to the configuration and footprint of the IHU 22 that must fit within the helmet 20. Accordingly, the processing power of the IHU 22—namely, the microcontroller 130*c*—must be balanced to ensure that it can perform the necessary calculations while lasting a sufficient amount of time.

It should also be understood that at least an extent of the data collected by the sensor assembly 120 of the system 10 must be analyzed by the microcontroller 130*c* within the helmet 20 and this data cannot be sent to a person for performing the necessary calculations within their head or a central computer that is remotely located from the helmet 20. For example, a hypothetical system that is designed to transfer all of the data collected by the sensor assembly 120 to a central computer for analysis would not be able to function as the system 10 described herein for at least the following reasons. First, the hypothetical system's in-helmet unit would not know when to wake up and record the data because the hypothetical system would not know if the impact was over the noise threshold. Second, the hypothetical system would take too long to transfer and process this data on a remote computer or attempt to have a person perform these calculations, which would cause the same problems identified above. Third, increasing the amount of data that is transferred out of the helmet 20 will increase the power requirements of the hypothetical system's in-helmet unit, which in turn will require the use of a larger battery to maintain the same length of operational time between charges. However, increasing the battery size is not permissible due to the space and footprint constraints that apply to the hypothetical system's in-helmet unit. The IHU 22 of the multi-functional system 10 can last multiple weeks and even over one year without needing to be recharged. This is because: (i) in normal operation (e.g., continuous monitoring for alertable impacts), the IHU 22 may consume about 12-20 uA, (ii) in a deep sleep state (e.g., everything is off except timekeeping), the IHU 22 may consume about 8 uA, and (iii) in an alert state (e.g., the IHU 22 is trying to send an alert to the alert unit 26) the IHU 22 may consume about 1-5 mA. Increasing the size of the battery to maintain these operational times will undesirably: (i) add weight to the IHU 22, (ii) make the IHU 22 more expensive to manufacture, and (iii) require additional analysis to determine if it is even possible to place a larger battery within the helmet 20 without requiring alterations to the helmet's design.

iii. Telemetry Module

The IHU 22 uses the telemetry module 130*d* to wirelessly connect and transmit physiological parameter data to the receiving unit 24 via communication links 40, 50, 52, 54, 56 (shown in FIGS. 1-6). Specifically, the communication link 40, 50, 52, 54, 56 may be based on any type of wireless communication technologies. These wireless communication technologies may operate in unlicensed bands (e.g., 433.05 MHz-434.79 MHz, 902 MHz-928 MHz, 2.4 GHz-2.5 GHz, 5.725 GHz-5.875 GHz) or in a licensed band. A few examples of wireless communication technologies that may be used include: Bluetooth (e.g., Bluetooth version 5), ZigBee, Wi-Fi (e.g., 802.11a, b, g, n), Wi-Fi Max (e.g., 802.16e), Digital Enhanced Cordless Telecommunications (DECT), cellular communication technologies (e.g., CDMA-1X, UMTS/HSDPA, GSM/GPRS, TDMA/EDGE, EV/DO, or LTE), near field communication (NFC), or a custom designed wireless communication technology. In other embodiments (FIG. 5, which has an outdoor transmission range from 50 to 200 meters), the telemetry module 130*d* may include both wired and wireless communication technologies. A few examples of wired communication technologies that may be used, include but are not limited to, any USB based communications link, Ethernet (e.g., 802.3), FireWire, or any other type packet based wired communication technology. Specifically, communications link 42 shown in FIG. 5 enables the transmission of physiological parameter data from the IHU 22 to the receiving device 24 over a wired connection. It should be understood that the telemetry element 130*d* may include a single transmitter/receiver or multiple transmitters/receivers depending on the configuration and application of the system 10.

An example of a custom designed wireless communication technology that is specifically designed for this application is described below. This wireless communication technology is based on a time division multiple access (TDMA) approach. Approximately every 9.6 seconds, the receiving unit 24 broadcasts a ping 75 times every 30 ms. After each ping, the receiving unit 24 listens for an IHU 22 that is scheduled to respond at a specific ping set and time slot. There are two-time slots per ping where an IHU 22 can respond. The ping plus time slot listen period is a "superframe." During setup, the IHU 22 is paired with the receiving unit 24 to align the wireless communication settings (e.g. channel, PAN ID, etc) as well as a timeslot within a superframe between these devices. Since communications are happening asynchronously and the actual communication time is in a small window, the IHU 22 wakes up periodically at some multiple of ping windows (the 75 superframes). If it hears a ping from it's receiving unit 24, the IHU 22 calculates the time required to wakeup on the next ping cycle (9.6 sec+an offset it calculates to wakeup right before the appropriate superframe). After an IHU 22 checks in with the receiving unit 24, the receiving unit 24 responds with an acknowledgment. Included in this acknowledgment are the player's $2^{nd}$, $3^{rd}$ and $4^{th}$ thresholds. The IHU 22 monitors the impacts on the player wearing the IHU 22 and reports an alert to the receiving unit 24, if the impacts exceed the $3^{rd}$ or $4^{th}$ thresholds. It should be understood that other multiplexing techniques may be used instead of TDMA, such as code division multiple access (CDMA), or frequency division multiple access (FDMA) technology. Also, system 10 may analyze the operating environment and pick a channel that has the least amount of noise that is within the operating range of the radios/transmitters. Once a new frequency has been identified, the receiving unit 24 instructs all or a subset of the telemetry modules 130*d* contained within the IHUs 22 to switch over to this new frequency.

iv. Encoder and Power Source

The encoder 130*e* is designed to encode the alert data and/or the impact data before the telemetry modules 130*d* transmit this data. Specifically, the encoding of this data includes adding a unique identifier to the data, such as player number, name, the serial number of the IHU 22, the location of the player on the team roster, and etc. While the encoder 130*e* is shown as separate from the telemetry element 130*d*, the encoder 130*d* can be integrated within the telemetry element 130*d* or the microcontroller 130*c*. In certain embodiments, encoder 130*e* can encrypt the data to increase the security of the data. The power source 130*e* may be designed to last at least as long as the activity, preferably as long as a week, more preferably more than a week. To meet this design requirement, the system 10 can utilize a non-removable rechargeable battery, removable rechargeable battery, or a removable non-rechargeable battery.

v. Activity Sensing Module

The activity sensing module 130*g* may be used to turn the IHU 22 ON or OFF based on the movement of the helmet 20 that it is installed therein. For example, moving the helmet 20 over a predefined amount of time, and/or hitting the helmet 20 and/or shaking the helmet 20 will then turn ON the IHU 22. If the helmet has not moved for another predefined amount of time (e.g., 7 minutes) or has not been hit and/or shook for a predefined amount of time then the IHU 22 will turn OFF. It should be understood that the activity sensing module 130*g* will default to the ON position even when the movement of the helmet 20 is extremely low, as this helps ensure that the IHU 22 is activated during the activity. Alternatively, the helmet 20 may have control buttons, such as a power button and a configuration button. In a further alternative, the IHU 22 may turn ON and OFF based on a shaking pattern, proximity to a radio beacon (e.g., Wi-Fi beacon, Bluetooth, etc.), a timer, a completion of a circuit based on the connection of the player's chin strap, pressure on an extent of the sensor assembly 120, a combination of the above, or other similar methods of turning ON and OFF an electronic circuit in close proximity to a player's head.

c. IHU Performs Certain Algorithms

Figure 12:
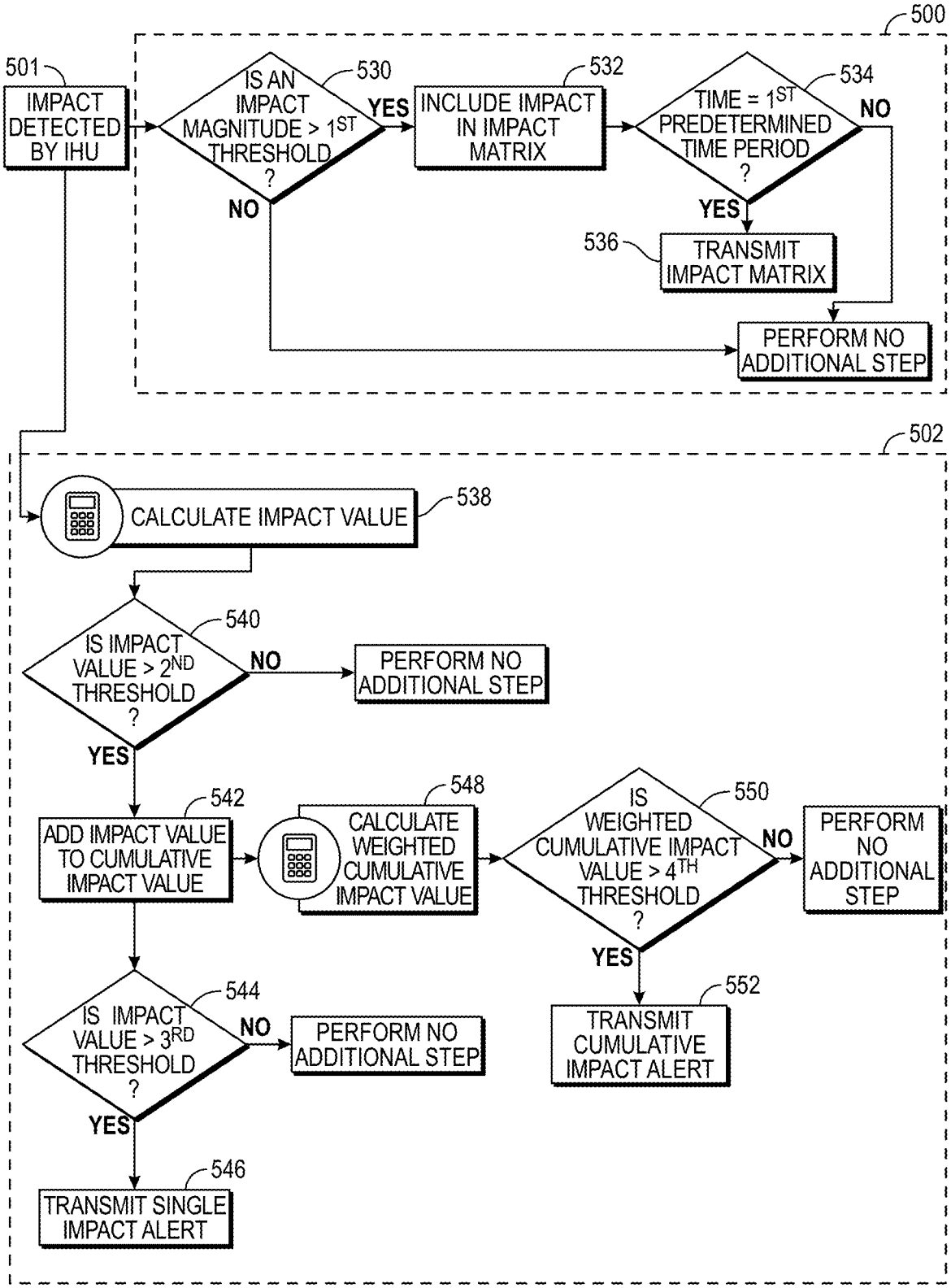
FIG. 12 is an exemplary flowchart showing the data flow within the helmet after an impact has been detected by the IHU.

As discussed above, the IHU 22 and the algorithms shown in FIG. 12 in this exemplary embodiment are designed to determine an impact magnitude value from the pressure applied to a player's head as a result of an impact the player experienced while engaged in a contact sport.

i. Threshold Values/Ranges Utilized by the IHU

To determine the impact magnitude value, multiple threshold values/ranges are programmed into the memory of the IHU 22. Some of these threshold values/ranges are standardized across all IHUs 22. In other words, the same or non-custom threshold value is programmed into each and every IHU 22. For example, a predetermined noise threshold and a $1^{st}$ threshold/an impact matrix threshold are standardized values that are the same across all IHUs 22. These values can be standardized and do not need to be tailored to a player who is going to utilize the IHU 22 because these values are only used to determine if an impact occurred and if that impact has a magnitude that is high enough to warrant analysis.

Other threshold values/ranges are not standardized across all IHUs 22. In other words, different or custom threshold values/ranges may be programmed into the IHU 22. The non-standardized or custom threshold values/ranges are based upon information that is entered or obtained from the player who is going to utilize the IHU 22. In particular, tailoring the IHU 22 to the specific player is desirable because the pressure that is applied to a player's head during the course of the activity varies between playing levels, such as the pressure levels seen at the youth level in comparison to the levels seen at the NFL professional level. Tailoring the IHU 22 to the specific player by inputting non-standardized or custom threshold values/ranges within the IHU 22 creates a specialized machine with specialized functionality to determine the impact magnitude value for impacts that the specific player(s) experiences during the activity. This specialized IHU 22 provides more accurate information, thereby providing a significant technical improvement to the system 10. Additionally, the accuracy of the information provided by the specialized IHU 22 improves the monitoring capabilities of the system 10 and the efficiency of the authorized user's ability to make suggested changes in how the monitored player(s) engages in the physical activity.

The non-standardized or custom threshold values/ranges in this embodiment are: (i) $2^{nd}$ threshold or high magnitude impact threshold, (ii) $3^{rd}$ threshold or single impact alert, (iii) $4^{th}$ threshold or a cumulative impact alert threshold and (iv) ranges of impact magnitude values that are associated with the severity values. The system 10 determines the values of these non-standardized threshold values/ranges based on the player's position (e.g., offensive line, running backs, quarterback, wide receivers, defensive linemen, linebackers, defensive backs and special teams) and level (e.g., youth, high school, college and professional players). For example, the system 10 may have between 5 and 100 different values for each threshold/value, preferably between 20 and 60 different values for each threshold/value, and most preferably between 25 and 40 different values for each threshold/value. To select the proper custom thresholds/values, a player or authorized user will set up the IHU 22 by programming the player's level and position into the remote terminal 28. The remote terminal 28 pulls the custom thresholds/values from the team/national database 32, 38 that correspond to the player's level and position. In particular, these corresponding values were previously determined based on a statistical analysis of data that have been collected using the proprietary technologies owned by the assignee of the present Application and are disclosed in U.S. Pat. Nos. 10,105,076, 9,622,661, 8,797,165, and 8,548,768. After the custom thresholds/values have been determined, these thresholds/values are sent to the receiving device 24 in order to relay this information to the IHU 22. Overall, it should be understood that a player who plays offensive line at the youth level will have non-standardized or custom threshold values/ranges that are different than a player who plays running back at the NCAA level.

In an alternative embodiment, system 10 may select a set of custom thresholds/values based on the player's level and position that is entered into the system 10 using the remote terminal 28. After the player has experienced over a predefined number of impacts (e.g., over 50 impacts and preferably over 100 impacts), the system 10 may adjust the custom thresholds/values or may select a different set of custom thresholds/values from the team/national database 32, 38. This adjustment or the selection of a different set of custom thresholds/values will aid the system 10 in providing more accurate information to the authorized user. For example, a player who plays two different positions (e.g., quarterback and linebacker) can only select one of these positions during the initial setup, which in turn may lead to over/under-reporting of alerts because the selection of custom thresholds/values were not specifically tailored to the individual player's playing style. In another example, a player who plays quarterback may not experience impacts that a quarterback would typically experience based on the player's playing style. For example, the quarterback may run the ball an unusual amount of times, which causes the quarterback to experience impacts that are more similar to a running back than a quarterback. In a further example, a player who has a medical condition may be susceptible to high magnitude impacts; therefore, the custom thresholds/values should be adjusted to account for these medical conditions. Thus, this adjustment or the selection of a different set of thresholds/values can use the information from the experienced impacts to help ensure that the proper custom thresholds/values are selected for the player.

Adjustments to the selected custom thresholds/values may be made using a learning algorithm that takes into account at least a plurality of the following: (i) the player's position and level, (ii) the impacts the player has experienced, (iii) the preset custom thresholds/values contained within the team/national database 32, 38, (iv) player's medical condition(s), and/or (v) videotape analysis. Alternatively, the adjustments to the selected custom thresholds/values may be made by reducing or increasing the selected thresholds/values be a certain percentage that is based on the percentage over the mean impact levels that are experienced by players who play at a similar level and position. For example, if the player is experiencing impact levels that are 10% over the mean impact levels for other similar players, then the player's thresholds/values are increased by 10%. It should be understood that these adjustments to the thresholds/values or selection of a different set of thresholds/values (e.g., running back values instead of quarterback values) may be provided to the authorized user to ensure that the authorized user desired to make this change or may be automatically changed without the authorized user's input or knowledge. Also, the authorized user may request that the system 10 perform the above analysis on any player, even if the system does not detect or suggest such a change. This may be beneficial if an authorized user believes that the player is not experiencing enough alertable impacts.

ii. IHU Detects an Impact

Figure 20:
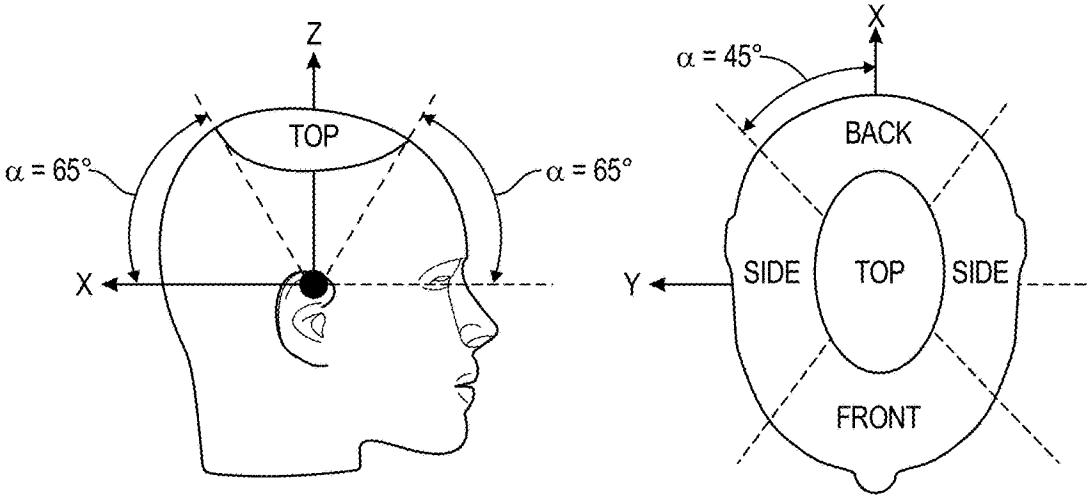
FIG. 20 illustrates a reference image of a player's head split into five different regions (i.e., front, back, left, right, top)

The IHU 22 includes five distinct sensors 1220*a-e* for five distinct regions (e.g., top, left, right, front, and back) of the player's head. Specifically, FIG. 20 shows these regions on a graphical representation of a player's head. The IHU 22 continually monitors for a value from any sensor 120*a-e* that exceeds the predetermined noise threshold, which is programmed into the IHU 22. Once the IHU 22 determines that a sensor 120*a-e* has recorded a value that is greater than the predetermined noise threshold, the IHU 22 detects there is an impact in Step 501. This detection causes the microcontroller 130*c* to wake up and record data from all sensors 120*a-e*. When an impact to the helmet 20 is detected by multiple sensors, only data from the closest sensor to the impact location and the sensors adjacent to the closest sensor are used in calculations that will be discussed below. For example, when an off-center impact is experienced on the helmet 20 and the back sensor 120*e* and left sensor 120*c* detect equal impact energy without significant energy from other sensors, then the impact location is determined by the system 10 to be directly between the back sensor 120*e* and left sensor 120*c*. Also, if the impact location is on the left side of the helmet 20, the system 10 will combine usable data from the left 120*c*, front 120*a*, top 120*b*, and rear 120*c* sensors to calculate the impact magnitude value from the recorded physiological parameter values. However, any data recorded by the right 120*d* sensor will be ignored and not included in this impact magnitude value. Similarly, when an on-center impact is applied to the front of the helmet 20, any data from the rear sensor 120*e* is ignored and not included in the impact magnitude value. Accordingly, the system 10 is configured to selectively utilize data from a limited number of sensors 120*a-e* to create an impact magnitude value, while disregarding other, essentially irrelevant sensor data, based upon the location of the impact to the helmet 20. Ignoring this irrelevant data may be significant because it helps ensure that the impact magnitude value is properly calculated. Without doing such, the impact magnitude value may become skewed by the player's head resonating within the helmet 20.

iii. IHU Performs Head Impact Exposure Algorithm

After the microcontroller 130*c* determines the impact magnitude value in Step 501, the microcontroller 130*c* will simultaneously perform both algorithms shown in FIG. 12. The first algorithm or head impact exposure (HIE) algorithm 500 does not weight the impact magnitude value based on the location of the impact, while the second algorithm or alert algorithm 502 may weigh the impact magnitude value based on the location of the impact and other factors. The first algorithm or HIE algorithm 500 compares the impact magnitude value to the $1^{st}$ threshold or an impact matrix threshold in step 530. The $1^{st}$ threshold or an impact matrix threshold is set between 1 g and 80 gs and preferably between 5 gs and 30 gs. If the impact magnitude value is less than the impact matrix threshold, than the microcontroller 130*c* will disregard the impact magnitude value. However, if the impact magnitude value is greater than the impact matrix threshold, than the microcontroller 130*c* will add the impact magnitude value to the impact matrix in step 532. Examples of impact matrixes are shown in FIG. 21. Specifically, the impact matrix may be comprised of 5 columns and 5 rows, where the 5 columns correspond to the location of the impact on the player's head (e.g., front, back, left, right, and top) and the 5 rows correspond to the severity of the impact (e.g., $1^{st}$, $2^{nd}$, $3^{rd}$, $4^{th}$ or $5^{th}$ severity). As discussed above, FIG. 20 shows a graphical representation of a player's head and where each of these regions is located.

Each of these severity values (e.g., 11, $2^{nd}$, $3^{rd}$, $4^{th}$ or $5^{th}$) corresponds to a range of impact magnitude values that are programmed into the IHU 22. The $1^{st}$ range may include impact magnitude values between the impact matrix threshold and the $50^{th}$ percentile of historical impact magnitude values for players of similar position and level, the $2^{nd}$ range may include impact magnitude values between the $51^{st}$ percentile and the $65^{th}$ percentile of historical impact magnitude values for players of similar position and playing level, the $3^{rd}$ range may include impact magnitude values between the $66^{th}$ percentile and the $85^{th}$ percentile of historical impact magnitude values for players of similar position and playing level, the $4^{th}$ range may include impact magnitude values between the $86^{th}$ percentile and the $95^{th}$ percentile of historical impact magnitude values for players of similar position and playing level, and the $5^{th}$ range may include impact magnitude values above the $95^{th}$ percentile of historical impact magnitude values for players of similar position and playing level.

Figure 19:
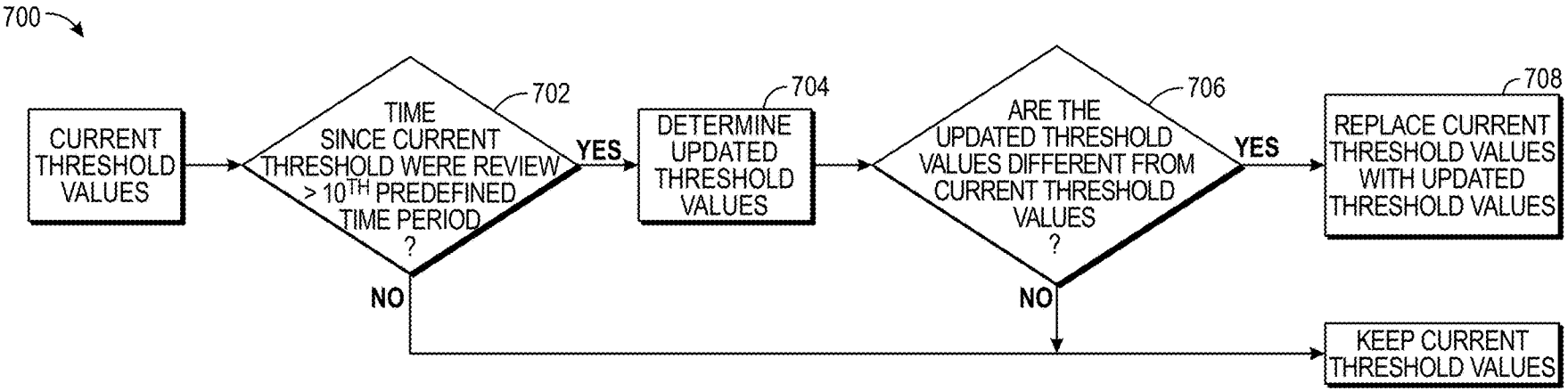
FIG. 19 is a flowchart showing how the self-updating thresholds are updated.

Once the microcontroller 130*c* has added the impact magnitude value to the impact matrix in step 532, as shown in FIG. 19, the microcontroller 130*c* determines if a $1^{st}$ predefined amount of time or an impact matrix transmit time period has passed from the time the IHU 22 last transmitted the impact matrix to a receiving device 24. The impact matrix transmit time period may be set to any time, preferably it is set between one second and 90 days and most preferably between 30 seconds and 1 hour. If the amount of time that has passed since the unit last transmitted the impact matrix to a receiving device 24 is less than or greater than the impact matrix transmit time period, then the microcontroller 130*c* will include this most recent impact within the impact matrix and then will perform no additional steps. However, if the amount of time that has passed since the unit last transmitted the impact matrix to a receiving device 24 is equal to the impact matrix transmit time period, then the control module 130 of the IHU 22 will transmit the impact matrix from the IHU 22 to a receiving device 24 (e.g., an alert unit 26, a remote terminal 28, a controller 30, a network element 34, or a combination of these items and other items) in step 536. Upon the completion of this decision, the IHU 22 has finished performing the HIE algorithm 500. It should be understood that the impact matrix may be transmitted at any time and does not require the detection of an impact.

iv. IHU Performs Certain Algorithms

While the IHU 22 is performing the HIE algorithm 500 of FIG. 12, the IHU 22 is also performing the alert algorithm 502. First, the microcontroller 130*c* will calculate an impact value by weighting the impact magnitude value based on the location of the impact and other factors in step 538. In one exemplary embodiment, the impact value is calculated by first determining the linear acceleration, rotational acceleration, head injury criterion (HIC), and the Gadd severity index (GSI) for the given impact. The algorithms used to calculate these values are described in Crisco J J, et. al. An Algorithm for Estimating Acceleration Magnitude and Impact Location Using Multiple Nonorthogonal Single-Axis Accelerometers. *J BioMech Eng.* 2004;126(1), Duma S M, et. al. Analysis of Real-time Head Accelerations in Collegiate Football Players. *Clin J Sport Med.* 2005; 15(1):3-8, Brolinson, P. G., et al. Analysis of Linear Head Accelerations from Collegiate Football Impacts. *Current Sports Medicine Reports*, vol. 5, no. 1, 2006, pp. 23-28, and Greenwald R M, et., al. Head impact severity measures for evaluating mild traumatic brain injury risk exposure. *Neurosurgery.* 2008; 62(4):789-798, the disclosure of which is hereby incorporated by reference in its entirety for all purposes. Once the linear acceleration, rotational acceleration, head injury criterion (HIC), and the Gadd severity index (GSI) are calculated for a given impact, these scores are weighted according to the algorithm set forth in Greenwald R M, et., al. Head impact severity measures for evaluating mild traumatic brain injury risk exposure. *Neurosurgery.* 2008; 62(4):789-798, the disclosure of which is hereby incorporated by reference in its entirety for all purposes. This resulting weighted value is the impact value. In this exemplary embodiment, the impact value is also equal to what has been called a HITsp value. While not diagnostic of injury, HITsp values are more sensitive and specific to diagnose concussions than any of the component measures alone.

In other exemplary embodiment, the impact value may be equal to only the linear acceleration for the given impact. In a further exemplary embodiment, the impact value may be equal to only the HIC score for the given impact. In another exemplary embodiment, the impact value may be equal to only the rotational acceleration for a given impact. In another exemplary embodiment, the impact value may be equal to the linear acceleration weighted by a combination of impact location and impact duration. In another exemplary embodiment the impact value may be equal to the weighted combination of linear acceleration, rotational acceleration, HIC, GSI, impact location, impact duration, impact direction. In another exemplary embodiment, the impact value may be equal to a value that is determined by a learning algorithm that is taught using historical data and diagnosed injuries. In even a further exemplary embodiment, the impact value may be equal to any combination of the above.

Once the impact value is calculated in step 538 by the microcontroller 130*c*, the impact value is compared against a $2^{nd}$ threshold or high magnitude impact threshold in step 540. This high magnitude impact threshold may be set to the $95^{th}$ percentile for impacts recorded by players of similar playing level and similar position. If the impact value is less than the high magnitude impact threshold, than the microcontroller 130*c* will not perform any additional steps. However, if the impact value is greater than the high magnitude impact threshold, than the impact value will be added to the cumulative impact value in step 542 and compared against a $3^{rd}$ threshold or single impact alert threshold in step 544. This single impact alert threshold may be set to the $99^{th}$ percentile for impacts recorded by players of similar playing level and position.

If the impact value is greater than the single impact alert threshold, than the control module 130 of the IHU 22 transmits alert data that is associated with the single impact alert to the receiving device 24 (e.g., an alert unit 26, a controller 30, a network element 34, or a combination of these items and other items) in step 546. The alert data may include, but is not limited to: (i) the impact value, (ii) impact location, (iii) impact time, (iv) impact direction, (v) player's unique identifier, (vi) alert type, (vii) player's heart rate, (viii) player's temperature, (ix) impact magnitude and/or (x) other relevant information (e.g., activity information). As will be discussed in greater detail below, the alert data may be displayed on the alert unit 26 in a graphical (e.g., on a representative image of a player) manner or in a non-graphical (e.g., numerical value) manner. If the impact value is less than the single impact alert threshold, than the microcontroller 130*c* will not perform any additional steps along this path of the algorithm 502.

While the microcontroller 130*c* is determining whether the impact value is greater than the single impact alert threshold in step 544, the microcontroller 130*c* further calculates a weighted cumulative impact value that includes this new impact value, in step 548. Specifically, the weighted cumulative impact value is calculated based on a weighted average of every relevant impact value that is over a $2^{nd}$ threshold or high magnitude impact threshold. To determine this weighted average, every impact value that is over a $2^{nd}$ threshold is weighted by a decaying factor. For example, an impact that was recorded 4 days ago may be multiplied by 0.4 decaying factor, thereby reducing the magnitude level of this impact. After the weighted impact values are determined, these values are summed together to generate the weighted cumulative impact value. It should be understood that the microcontroller 130*c* will exclude irrelevant impact values that are old enough to cause their weighted impact value to be zero due to the decaying factor. For example, if the decaying factor for an impact that is over 7 days old is 0; then regardless of the impact value, an impact that is over 7 days old is considered irrelevant to this calculation and will not be included within this calculation. One skilled in the art recognizes that weighting variables (e.g., time window, decay function, input threshold) can be adjusted to values other than then values disclosed herein. For example, the decaying factor for an impact that is over 14 days old is 0, while the decaying factor for an impact that is over 7 days old is 0.5. In a further example, the decaying factor for an impact over a set time period may be non-linear.

Once the weighted cumulative impact value has been calculated in step 548, this value is compared against a $4^{th}$ threshold or a cumulative impact alert threshold in step 550. This cumulative impact alert threshold may be set to the $95^{th}$ percentile for weighted cumulative impact values recorded by players of similar playing level and position. If the weighted cumulative impact value is less than the cumulative impact alert threshold, than the microcontroller 130*c* will not perform any additional steps. However, if the weighted cumulative impact value is greater than the cumulative impact value threshold, than the control module 130 of the IHU 22 transmits alert data that is associated with a cumulative impact alert to the receiving device 24 (e.g., an alert unit 26, a controller 30, a network element 34, or a combination of these items and other items) in step 552. Upon the completion of this decision, the IHU 22 has finished performing the alert algorithm 502.

The system 10 is also configured to monitor impacts and process data from players who experience multiple impacts on the same play. A person of skill in the art of designing sophisticated monitoring equipment for contact sports recognizes that many football players, including running backs, offensive lineman and defensive lineman, experience multiple impacts on a single play. For example, when a running back experiences multiple impacts while carrying the football (e.g., a rushing play), the algorithm in FIG. 12 is completed every impact detected by IHU 22, as long as a predetermined time period or an impact time period (e.g., 60 ms) has passed between impacts. In the context of the running back experiencing two impacts, if both detected impacts exceed a $3^{rd}$ threshold or a single impact alert threshold, each impact is treated as an independent peak overexposure alert and the alert data is transmitted to the alert unit 26. It should be understood that based on the impacts experienced by the player, the IHU 22 and specifically the control module 130 may send a cumulative impact alert to the experiencing device 24 without sending a single impact alert. Likewise, the control module 130 may send a single impact alert to the receiving device 24 without sending a cumulative impact alert. Further, the control module 130 may send an impact matrix to the receiving device 24 without sending either a single or cumulative impact alert.

Unlike conventional systems (e.g., the systems disclosed within U.S. Pat. Nos. 10,105,076, 9,622,661, 8,797,165, and 8,548,768), the multi-functional system 10 disclosed herein performs multiple algorithms within the IHU 22 contained within the player's helmet 20 in order to monitor that player and provide the authorized user with information about the monitored player's recently recorded physiological parameter data, including how that data may differ from the monitored player's previously recorded physiological parameter data or how the physiological parameter data that has been recorded in connection with other players. This functionality is beneficial because it provides information to the authorized user about what the player is actually experiencing on-field, in comparison to his past playing experiences and history and other similar players, which in turn allows the authorized user—coaching staff or athletic trainers—to identify and correct the player's playing techniques or provide aid to the player. Additionally, the multi-functional system 10 provides information that the authorized user can share with the player to provide support for what the authorized user is telling the player. Overall, this multi-functional system 10 provides many significant advantages over other conventional systems, which enable the system 10 to improve how the authorized user trains, practices, and handles players, practice sessions and games.

3. Alternative Embodiments of the IHU

Instead of or in addition to monitoring and recording physiological parameter data related to pressure on a player's head as a result of an impact, the IHU 22 may monitor and record data related to other physiological parameters. For example, another physiological parameter that may be analyzed by the system 10 is the player's temperature. The IHU 22 may measure the player's temperature by including at least one temperature sensor within the sensor assembly 120 of the IHU 22. Specifically, the temperature sensor may be a thermistor, which comprises resistive circuit components having a high negative temperature coefficient of resistance so that the resistance decreases as the temperature increases. Alternatively, the temperature sensor may be a thermal ribbon sensor or a band-gap type integrated circuit sensor. Using one of these temperature sensors, the player's temperature may be recorded when an impact is detected and that impact resulted in either: (i) the impact magnitude being included in the impact matrix, (ii) a transmission of alert data based on a single alert, or (iii) a transmission of alert data based on a cumulative alert. In this example, the number of columns in the impact matrix may be doubled to include a temperature column that is located adjacent to each of the impact locations (e.g., front, back, left, right, and top). This would allow for the player's temperature to be recorded within these cells. If multiple impacts were experienced that have the same severity level and location, the temperature measurements for those specific impacts may be averaged together to create an average temperature for that specific severity level and location.

In an alternative example, a player's temperature may be actively monitored to determine if the player's temperature exceeds or drops below a threshold. Specifically, an alert may be transmitted to the receiving device 24 to inform sideline personal that a player is overheating and the player should be pulled out of the activity to allow the player to cool down. In a further example, the player's temperature may be periodically recorded and transmitted to the receiving device 24. These recordings can then be later analyzed by sideline personal to suggest different equipment configurations or different workout regiments in order to optimize the player's thermal management.

Instead of or in addition to monitoring and recording physiological parameter data related to: (i) pressure on a player's head as a result of an impact or (ii) the player's temperature, the IHU 22 may also monitor and record data related to other physiological parameters. For example, another physiological parameter may be the player's heart rate and/or blood pressure. The IHU 22 may measure the player's heart rate and blood pressure by including at least one microelectromechanical system (MEMS) type sensors that use auscultatory (e.g., listening to the internal sounds made by the body) and/or oscillometric (e.g., oscillations of the arterial pulse) within the sensor assembly 120 of the IHU 22. Using one of these heart rate and/or blood pressure sensors, the player's heart rate and/or blood pressure may be recorded when an impact is detected and that impact resulted in either: (i) the impact magnitude being included in the impact matrix, (ii) a transmission of alert data based on a single alert, or (iii) a transmission of alert data based on a cumulative alert. In this example, the number of columns in the impact matrix may be increased by 3 to include a heart rate column and a blood pressure column that is located adjacent to each of the impact locations (e.g., front, back, left, right, and top). This would allow for the player's heart rate and blood pressure to be recorded within these cells. Once multiple impacts were experienced that have the same severity level and location, the heart rate and blood pressure measurements for those specific impacts may be averaged together to create an average heart rate or blood pressure for that specific severity level and location.

In an alternative example, a player's heart rate and/or blood pressure may be actively monitored to determine if the player's heart rate and/or blood pressure exceeds or drops below a threshold. Specifically, an alert may be transmitted to the receiving device 24 to inform a trainer or a coach than a player's heart rate is too high and the player should be pulled out of the activity to allow the player to lower their heart rate. In an alternative example, the player's heart rate and/or blood pressure may be periodically recorded and transmitted to the receiving device 24. These recordings can then be later analyzed by a trainer or a coach to suggest different equipment configurations or different workout regiments in order to optimize the player's management of their heart rate and/or blood pressure.

Instead of or in addition to monitoring and recording physiological parameter data related to: (i) pressure on a player's head as a result of an impact, (ii) the player's temperature, (iii) the player's heart rate or (iv) the player's blood pressure, the IHU 22 may also monitor and record data related to the player's balance. The IHU 22 may measure small movements by the player by using at least one low acceleration (low G) accelerometer within the sensor assembly 120 of the IHU 22. Using this low G accelerometer, small movements by the player may be measured to detect balance issues. Specifically, the IHU 22 may include an algorithm that calculates and observes a player's balance between plays or during extended stoppages in play, such as when a penalty is being assessed or a timeout. When a player assumes the ready position prior to the commencement of the play, for example a three-point stance, the low G accelerometers and the algorithm would detect player movements indicative of balance issues. If the IHU 22 detects that the player has a balance issue, then an alert can be sent from the IHU 22 to the receiving device 24 to alert the authorized user of this balance issue.

Instead of or in addition to monitoring and recording physiological parameter data related to: (i) pressure on a player's head as a result of an impact, (ii) the player's temperature, (iii) the player's heart rate or (iv) the player's blood pressure, (v) player's balance, the IHU 22 may also monitor and record data related to the player's O2 saturation (Sp02%) or molecular quantiles of certain substances contained within the player's blood (e.g. lactic acid, blood sugar). The IHU 22 may measure O2 saturation or quantiles of certain substances contained within the player's blood using optical sensing such as PPG (photoplethysmogram). Specifically, the IHU 22 may include an algorithm that calculates and observes a player's O2 saturation or quantiles of certain substances contained within the player's blood. If anyone of these values is measured to be outside of the 95% for similar players, then an alert can be sent from the IHU 22 to the receiving device 24 to alert the authorized user of the issue. Alternatively, these values could be recorded upon the detection of an alerting event and may be tracked to gain additional insight into these levels during an alerting event.

Instead of or in addition to monitoring and recording physiological parameter data related to: (i) pressure on a player's head as a result of an impact, (ii) the player's temperature, (iii) the player's heart rate, (iv) the player's blood pressure or (v) player's balance, (vi) player's O2 saturation (Sp02%) or molecular quantiles of certain substances contained within the player's blood (e.g. lactic acid, blood sugar), the IHU 22 may also monitor and record data related to other physiological parameters. For example, the activity sensing module 130*g* may include multiple hardware components (e.g., (i) accelerometer, (ii) gyroscope, (iii) GPS sensor/indoor location sensors, (iv) a magnetometer, and/or (v) a heart rate monitor, such as the one discussed above) to determine the activity levels and events that occurred during the game or activity. Specifically, information for these sensors can be processed to determine a player's: (i) acceleration of the player, (ii) deceleration of the player, (iii) velocity of the player, (iv) direction the player is running (e.g., forward, laterally, backward, etc.), (v) when a player left the ground, (vi) sharp changes in direction while running, and/or (vii) other general strength and condition metrics.

Using the above-identified information that was derived from data collected by the activity sensing module 130*g*, the system 10 could determine player and/or team metrics, which include: (i) when a practice started, (ii) what drills likely occurred during the practice, (iii) how hard the player is working during practice (e.g., duration of time the player is standing, duration of time the player is jogging, and duration of time the player is running), (iv) how accurate where the player's routes he ran, (v) number of times the QB to a 3 step drop, 5 step drop or scrambled from the pocket and (vi) other desirable metrics. Examples of how the system 10 could use the information from the sensors contained within the activity sensing module 130*g* to determine when practice started and ended could be done by setting a threshold number of player's (e.g., 25% of the team) that have registered a minimal amount of movement. Additionally, the system 10 could determine the drills that likely occurred during the practice by recording at least a plurality of the following parameters: heart rate, movement of the players, impact data, and/or alert data. Then a learning algorithm may be utilized to compare these recently recorded values with values that have been previously associated with certain drills. Based on this comparison, the system 10 can make a prediction of the drill that the player/team is likely performing at a given time.

Further, determining how hard a player is working during a workout could be based on his heart rate level, acceleration/deceleration levels, velocity levels, distance traveled, or a combination of one or more of these levels. Moreover, determining the accuracy of the routes a player ran could be done by analyzing the data that is gathered by the accelerometer, gyroscope, GPS sensor/indoor location sensors, a magnetometer and comparing that against a set of identified plays. For example, the authorized user may input a drill into the practice planner that sets out 10 plays that will be run during that drill period. The data gathered by the above sensors can then determine the location of the player during the drill period and it can compare the player's location against a predicted location. The difference between the predicted and actual locations will provide accuracy measurement. From these examples it should be clear to one of skill in the art that other information may be derived from the data that is generated by the activity sensing module 130*g* to provide additional information to the authorized user.

The player/team metrics can be used by the system 10 to help provide a more complete picture of what the player is experiencing on the field, which can be used by the coaching staff to improve the training of the player/team. For example, system 10 may inform the authorized user that a certain set of drills carry a high impact load and only a few players have a high activity level during this drill, which may suggest to the coach that a different drill should be utilized. Additionally, after the system 10 informs the authorized user that a wide receiver has a poor route quality, the coaching staff can use this information to suggest drills that will improve the player's routes. Overall, providing additional actionable data in a usable format to the authorized user will improve the coach's ability to improve his player's playing level and help ensure that his players are in the best position to be successful.

It should be understood that other contextual data or data that is not related to the player's physiological parameter data may be recorded by the IHU 22 or an external device. For example, a temperature sensing device could be utilized to determine the relative heat index during the monitoring session relating to practice or game play. This data may suggest that an authorized user move training to an alternate location or time that has less risk exposure to harmful conditions, such as heat stroke. Other contextual data that may be monitored and recorded by the system 10 includes general fatigue, travel, sleep, blood/spit work, prescribed drugs (e.g., insulin, blood thinners). This data may be utilized to make suggested changes to coaching plans, such as practice plans.

4. Receiving Device that is External from the Helmet

In the embodiment shown in FIG. 1, the external receiving device 24 is an alert unit 26 and the physiological parameter data (e.g., (i) pressure, such as alert data and impact matrixes (ii) temperature, (iii) heart rate, (iv) blood pressure, (v) balance, or other similar physiological parameters, such as data recorded by the activity sensing module 130*g* or information derived therefrom) is transmitted from the IHU 22 to the receiving device 24 via communications link 40. Specifically, the alerting unit 26 is hand-held, portable and is typically carried by a person that is: (i) positioned proximate (e.g., within 50 yards) to the field or location that the physical activity is taking place and (ii) is not engaged in the physical activity. Additional information about the alerting unit 26 will be discussed below. The receiving device 24 includes various components typically contained within the below described exemplary embodiments of the receiving device 24, such as a display, a processor, a memory unit, peripheral devices, a radio/transmitter/receiver, sensors, and other components. It should be understood that the radio/transmitter/receiver of receiving device 24, must be the same as or compatible with the radio/transmitter/receiver 130*d* contained within the IHU 22. In other words, the radio/transmitter/receiver contained within the receiving device 24 may utilize any type of wired or wireless communication technologies that are discussed above in connection with the IHU 22 which the IHU 22 utilizes.

Figure 3:
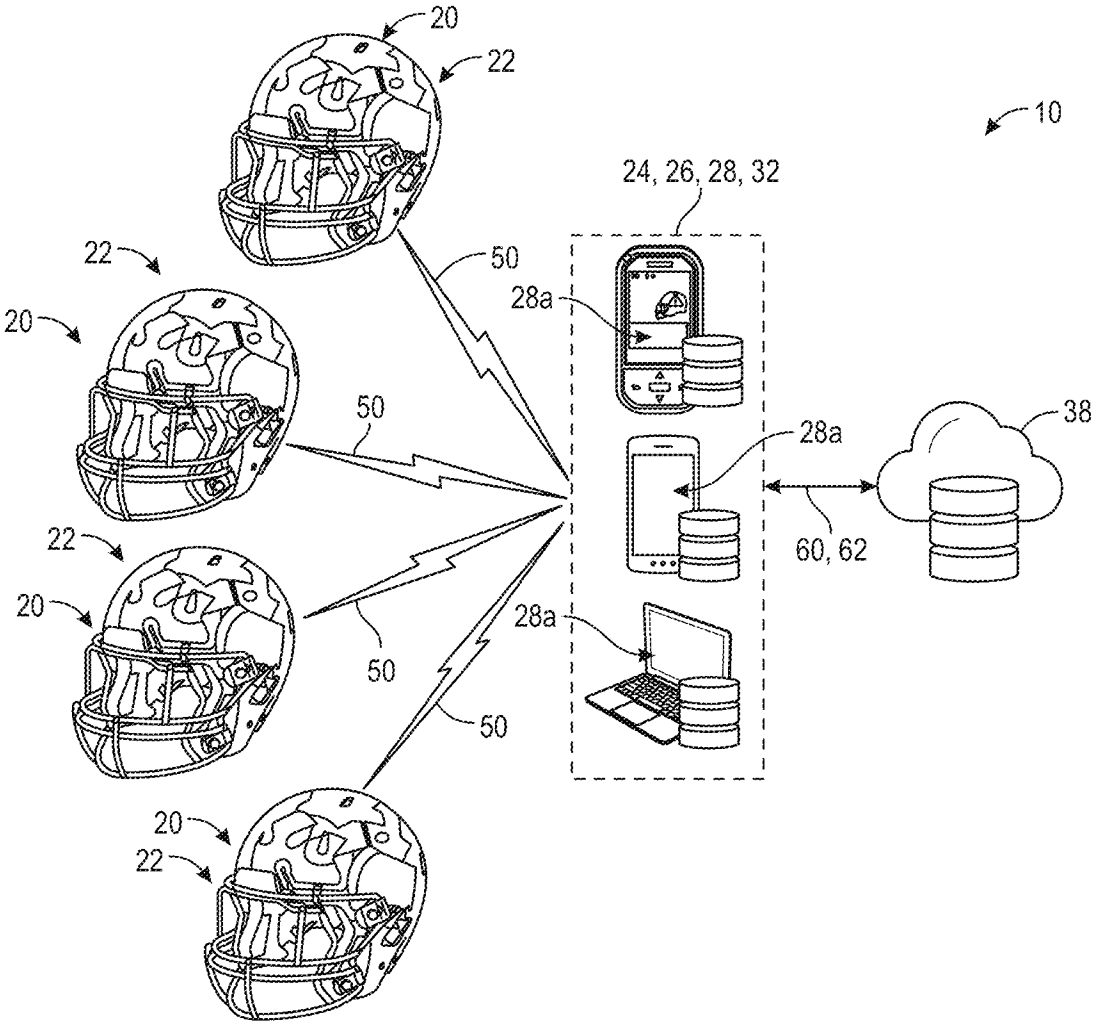
FIG. 3 illustrates a third exemplary system showing: (i) helmets that each have an IHU installed therein, (ii) a receiving device, which is a combination of an alert unit, remote terminal, and a team database, and (iii) a national database.

In the embodiment shown in FIG. 3, the receiving device 24 is a combination of: (i) an alerting unit 26, (ii) a remote terminal 28, and (iii) a team database 32. In this embodiment, physiological parameter data is transmitted from the IHU 22 to this receiving device 24 via communications link 50. As such, the receiving device 24 in this embodiment may be hand-held and portable in some instances and is typically positioned around (e.g., within 150 yards) the field or location that the physical activity is taking place. While the receiving device 24 may be positioned around the field or location, the receiving device 24 in this embodiment is not typically carried by a person. Specifically, the receiving device 24 in this embodiment may be a PDA, a cellular phone (e.g., iPhone or Samsung Galaxy), a tablet (e.g., iPad or Android-based tablet), a laptop, a desktop computer, or a custom designed device. For example, the receiving device 24 in this embodiment may be a tablet that is positioned within the press box and can be carried into the locker room.

Figure 4:
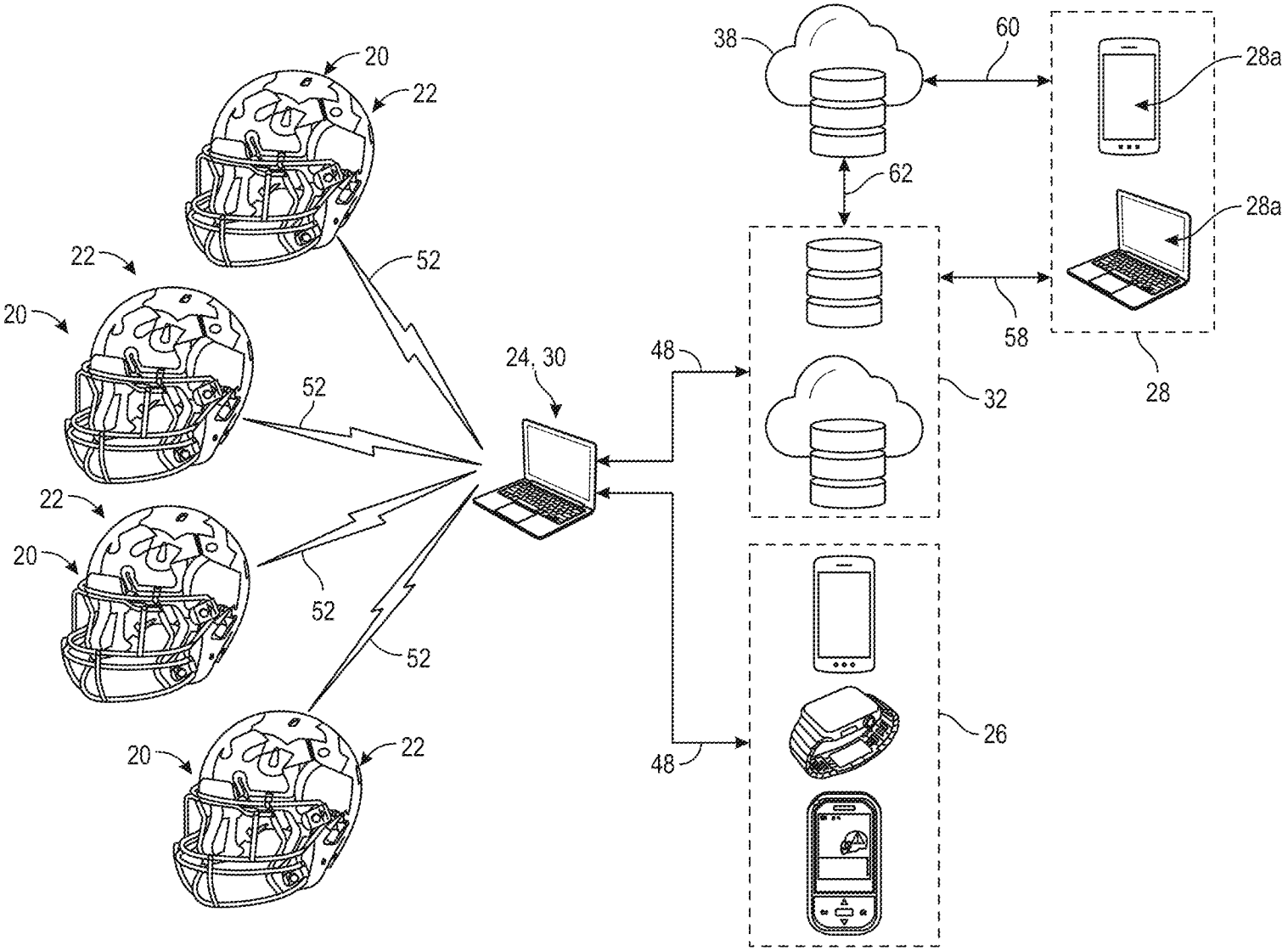
FIG. 4 illustrates a fourth exemplary system showing: (i) helmets that each have an IHU installed therein, (ii) a receiving device, which is a controller, (iii) an alerting unit, (iv) a team database, (v) a national database, and (vi) a remote terminal.

In the embodiment shown in FIG. 4, the receiving device 24 is a controller 30 and physiological parameter data is transmitted from the IHU 22 to this receiving device 24 via communications link 52. As such, the receiving device 24 is not hand-held, but it may be portable in some instances, and is typically positioned around (e.g., within 150 yards) the field or location that the physical activity is taking place. While the receiving device 24 may be positioned around the field or location, the receiving device 24 in this embodiment is not carried by a person. Specifically, the receiving device 24 in this embodiment may be a tablet (e.g., iPad or Android-based tablet), a laptop, a desktop computer, or a custom designed device. For example, the receiving device 24 in this embodiment may be a custom device that includes a laptop that is coupled to a receiving radio and is positioned on the sideline of the field.

Figure 5:
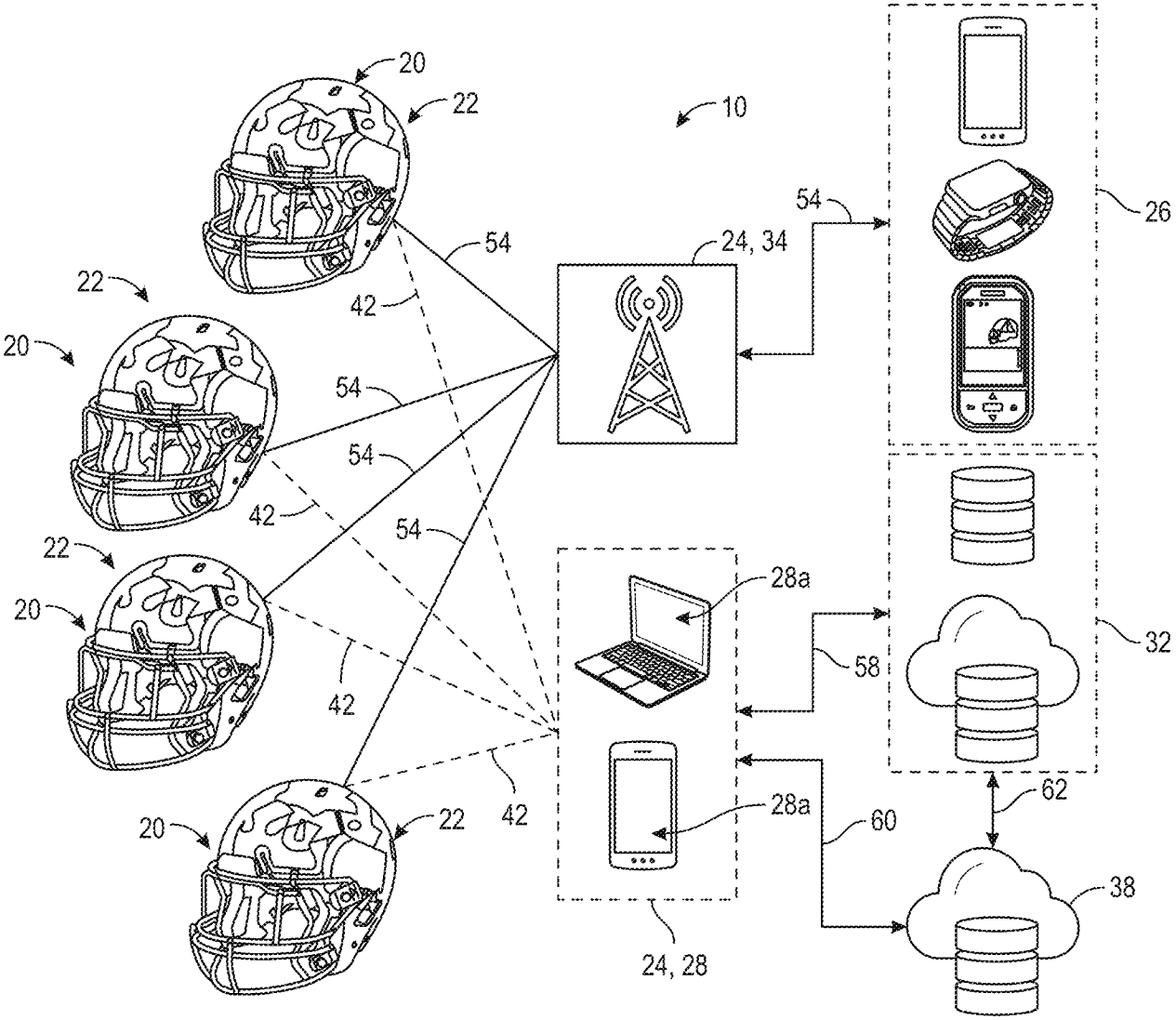
FIG. 5 illustrates a fifth exemplary system showing: (i) helmets that each have an IHU installed therein, (ii) receiving device, which includes both a network element and a remote terminal, (iii) an alerting unit, (iv) a team database, (v) a national database.

In the embodiment shown in FIG. 5, the receiving device 24 includes both a network element 34 and a remote terminal 28. As such, alert data may be nearly instantaneously transmitted to the alert unit 26 via a wireless transmission over communications link 54, while all other physiological parameter data that is recorded by the IHU 22 may be transmitted via communications link 42 to the remote terminal 28 in a non-instantaneous fashion. For example, alert data associated with the single and cumulative impact alerts may be wirelessly transmitted from the IHU 22 to a network element 34 (e.g., Wi-Fi compatible router) that is positioned proximate (e.g., within 50 yards) to the field or location that the physical activity is taking place. The network element 34 (e.g., Wi-Fi compatible router) may then route the alert data associated with the single and cumulative impact alerts to the alert unit 26. Meanwhile, the IHU 22 will store all other recorded physiological parameter data within the IHU 22. Once the physical activity has concluded, the authorized user can download the physiological parameter data from the IHU 22 using any wired or wireless technologies described herein to the remote terminal 28 or directly to the team database 32.

Figure 6:
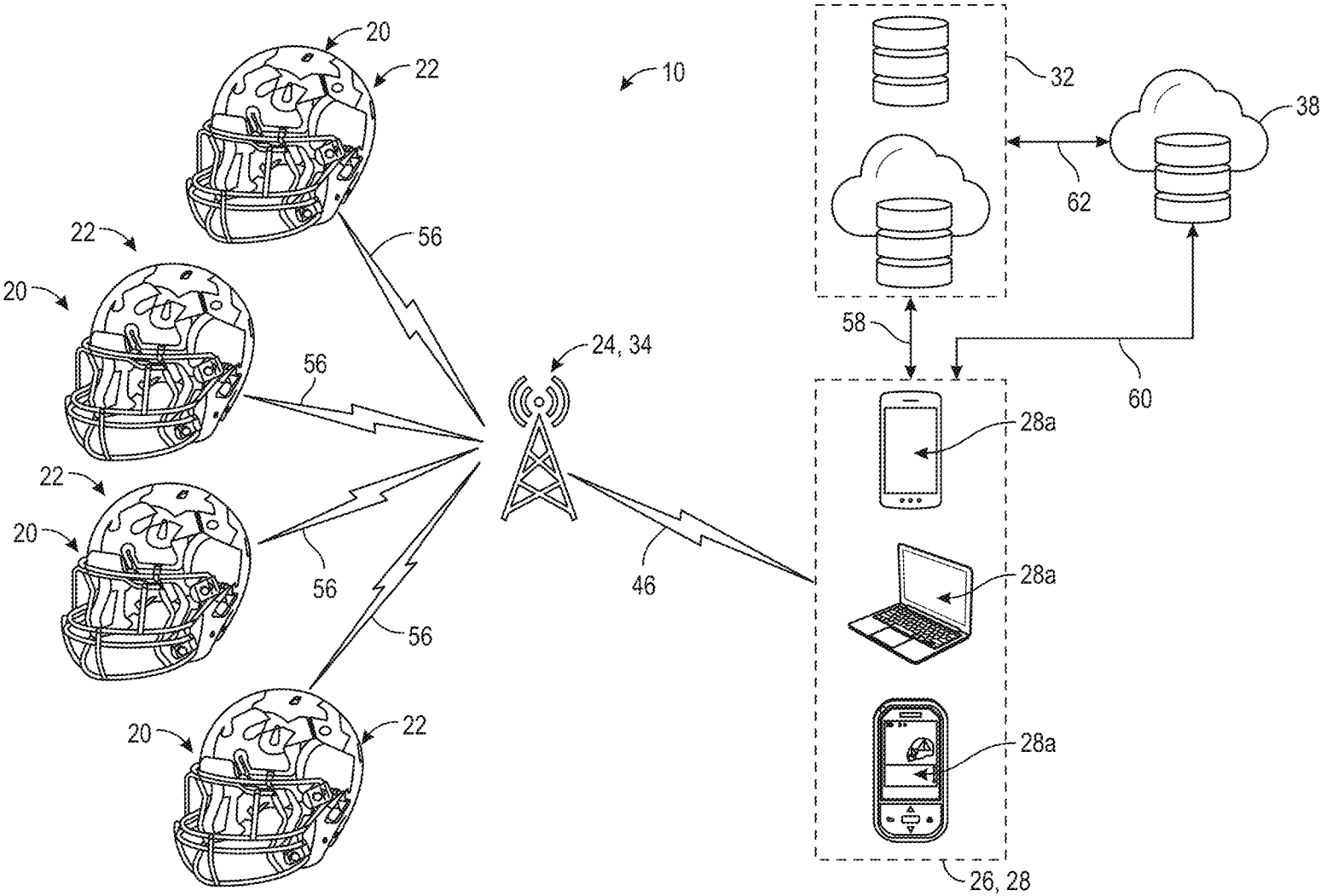
FIG. 6 illustrates a sixth exemplary system showing: (i) helmets that each have an IHU installed therein, (ii) receiving device, which is a network element, (iii) team database, (iv) a national database, and (v) a combination of an alerting unit and a remote terminal.

In an embodiment shown in FIG. 6, the receiving device 24 is a network element 34. As such, all physiological parameter data recorded by the IHU 22 will be transmitted to the alert unit 26 via a wireless transmission over the network element 34. For example, all physiological parameter data may be wirelessly transmitted from the IHU 22 to a network element 34 (e.g., cellular network) via communications link 56. The network element 34 (e.g., cellular network) may then route the physiological parameter data to the alert unit 26 via communications link 46. It should be understood that some of the data recorded by the IHU 22 may be transmitted in a nearly instantaneous fashion, while data recorded by the IHU 22 may be transmitted in a non-instantaneous fashion.

a. Alert Unit

As described above, the alert unit 26 is hand-held, portable and is typically carried by a person that is: (i) positioned proximate (e.g., within 50 yards) to the field or location that the physical activity is taking place and (ii) is not engaged in the physical activity (e.g., sideline personnel, which may be a trainer). Specifically, the alert unit 26 in this embodiment may be a PDA, a cellular phone (e.g., iPhone or Samsung Galaxy), a watch (e.g., iWatch or Android-based watch), a tablet (e.g., iPad or Android-based tablet), or a custom designed device specifically designed to be a portable alert unit 26. For example, the alert unit 26 may be an iPhone or a custom designed device that is carried within the trainer's pocket. In these exemplary embodiments, the alert unit 26 includes various components, such as a display, a processor, a memory, peripheral devices, a radio/transmitter/receiver, sensors, and other components.

Figure 1B:
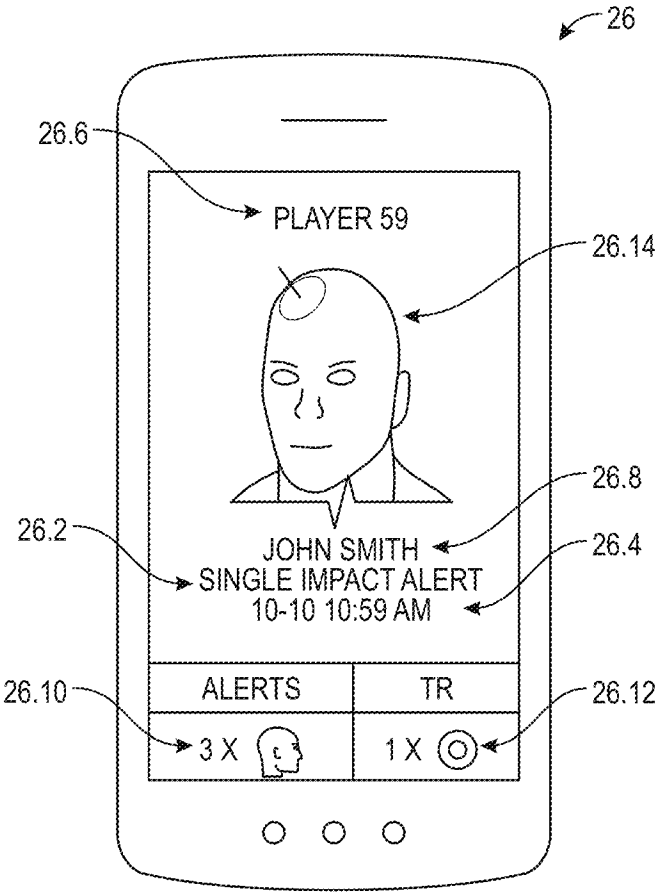
FIG. 1B illustrates a second embodiment of an alert unit with a second embodiment of a graphical interface.
Figure 1A:
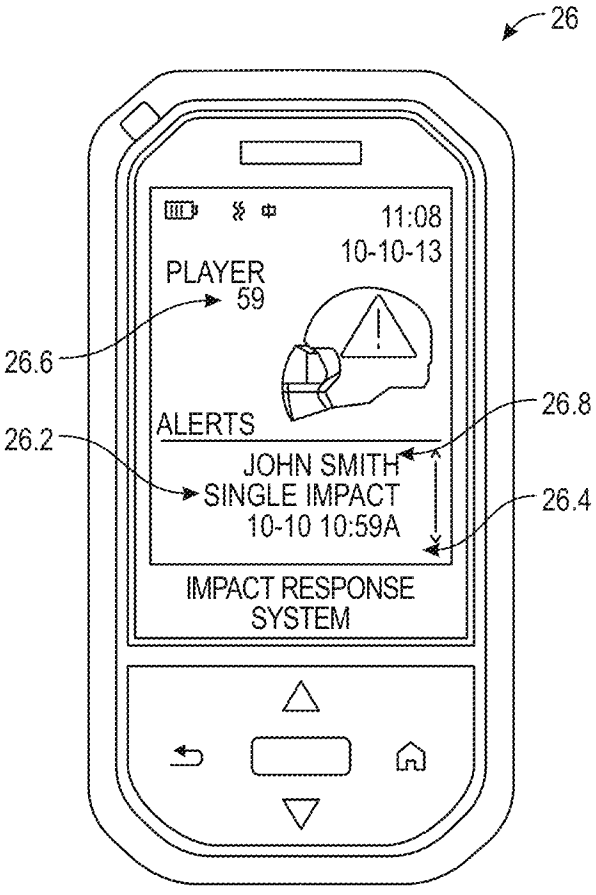
FIG. 1A illustrates a first embodiment of an alert unit with a first embodiment of a graphical interface.
Figure 2:
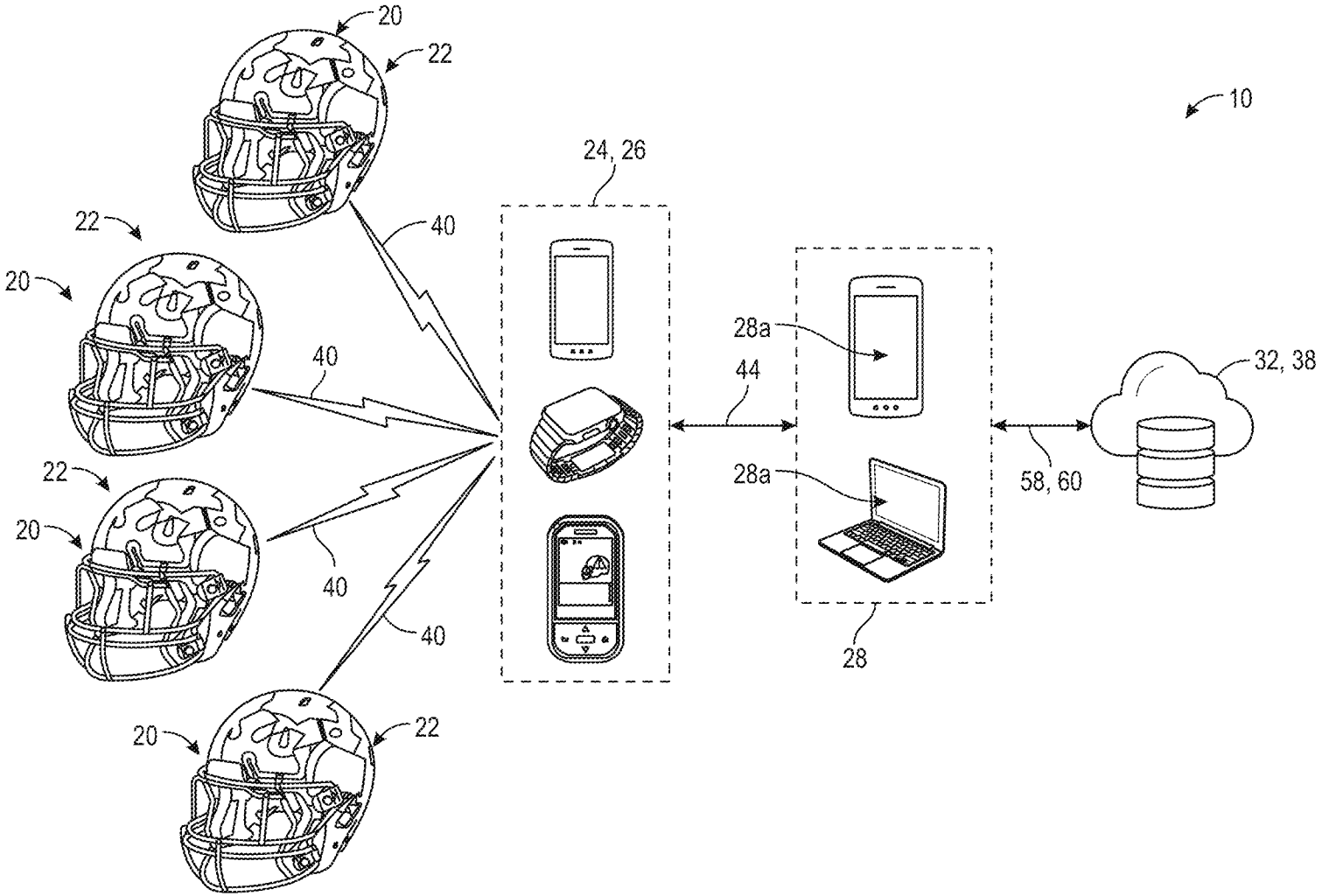
FIG. 2 illustrates a second exemplary system showing: (i) helmets that each have an IHU installed therein, (ii) a receiving device, which is an alert unit, (iii) a remote terminal, and (iv) a combined team database and national database.

In FIG. 1, the alert unit 26 receives physiological parameter data from the IHU 22, which includes alert data and impact magnitude data contained within the impact matrixes from the IHU 22. The alert unit 26 can process this physiological parameter data to display all of the alert data or a subset of the alert data to the sideline personnel (e.g., trainer) bearing the alert unit 26. In response to receiving alert data, the alert unit 26, shown in FIG. 1A, may display: (i) alert type 26.2, (ii) impact time 26.4, and (iii) player's unique identifier (e.g., name or jersey number) 26.6, 26.8. In other embodiments, the alert unit 26 may be configured to display all or a subset of the following: (i) the impact value, (ii) impact location, (iii) impact time, (iv) impact direction, (v) player's unique identifier, (vi) alert type, (vii) player's heart rate, (viii) player's temperature, (ix) impact magnitude and/or (x) other relevant information (e.g., activity information). The alert data may be displayed on the alert unit 26 in a graphical (e.g., on a representative image of a player) manner or in a non-graphical (e.g., numerical value) manner. An alternative embodiment of the alert unit 26 is shown in FIG. 1B, which displays: (i) alert type 26.2, (ii) impact time 26.4, (iii) player's unique identifier (e.g., name or jersey number) 26.6, 26.8, (iv) number and type of alerts received of a predefined amount of time (e.g., 7 days) 26.10, (v) number and type of training opportunities received of a predefined amount of time (e.g., 7 days) 26.12, and a graphical representative image of a player showing the location of the impact that led to the single impact alert 26.14. Specifically, the user or administrator may set or select which of the above data is displayed on the alert unit 26.

Once sideline personnel (e.g., trainer), who are typically not engaged in the physical activity, have received an alert on the alerting unit 26, they can employ a method for evaluating and treating the player in question. Specifically, evaluating and treating the player in question is described within U.S. Pat. No. 8,548,768, which is fully incorporated herein by reference. For example, the alert unit 26 be programmed with interactive software that assures best practices are followed in the treatment and documentation of injuries, such as mild traumatic brain injuries (MTBI). The interactive software may include a bundle of team management programs that enable the signaling device to store all team data, including medical histories and testing baselines. The interactive software also provides the signaling device with an active response protocol for guiding sideline personnel through appropriate examination procedures and recording the results. For example, when the alert unit 26 receives an alert and the relevant player is brought to the sideline for evaluation, the alert unit 26 can display the individual's head-injury history, the results of previous evaluations and other pertinent medical data. With the assistance of the interactive software, the signaling device prompts the medical staff member to conduct the appropriate sideline examination, records the responses, compares the results to established baselines and prompts either further testing or a play/no-play decision. The interactive software may also include a session manager program that allows the authorized user to document incidents as they occur during a practice or a game. The appropriate information about the team, players and conditions is entered at the beginning of each session. Then, as injuries occur, the interactive software provides a template for recording injury data on a per-player basis. The data and results stored on the device can be uploaded to the team database 32 wherein authorized users can access the same for team management and player evaluation functions.

5. Team Database and National Database

FIG. 1 includes the team database 32, which stores all relevant team data. This team data may include, but is not limited to including: (i) alert data for each player, which includes single and cumulative alerts for each player, (ii) impact matrix for each player, (iii) other data related to the recorded physiological parameters for each player, (iv) setup associated with each IHU 22, (v) practice calendars/schedules, (vi) equipment assignments and profiles (e.g., relevant sizes, type of shoes, type of helmet, type of helmet padding, type of chin strap, type of faceguard, and etc.), (vii) medical data for each player (e.g., medical histories, injuries, height, weight, emergency information, and etc.), (viii) statistics for each player, (ix) workout regiments for each player, and (x) other player data (e.g., head and helmet scans, contact information, class year). It should be understood that the team database 32 may contain data that has been generated by the team over a single day or may have been collected over many years.

As shown in FIGS. 1, 4 and 5, the team database 32 is separate from: (i) the receiving device 24, (ii) the remote terminal 28, and (iii) the national database 38. The team database 32 may be stored in a physical database located near where the team plays or on the team campus. For example, the team database 32 may be located within the athletic department of a college or university, wherein the team database 32 functions as an interactive clearinghouse or warehouse for all athlete information shared among various departments or sports. Alternatively, the team database 32 may be stored on a cloud server that is accessible via the internet.

In another embodiment shown in FIG. 3, the team database 32 may be combined with: (i) the receiving device 24 and (ii) the remote terminal 28. This configuration may be simpler to implement in a smaller setting. Like system 10 described in FIGS. 1, 4 and 6, the national database 38 is separate from the team database 32 in this embodiment. This allows the team database 32 to be stored locally on the remote terminal 28, which may allow an authorized user to access the team database 32 without an internet connection. Once a predefined amount of time has passed since the combination device shown in FIG. 3 has been connected to the national database 38 via the internet, the device shown in FIG. 3 will suggest that the user connect the combination device to the internet to allow the device to: (i) pull updated thresholds from the national database via communications link 60 and (ii) upload a copy of the team database 32 to the national database 38 via communications link 60. In a further embodiment shown in FIG. 2, the team database 32 and the national database 38 are combined into one database that is stored on a cloud server that is accessible via the internet. This embodiment may be beneficial because it allows all data to be centrally located, which improves the functioning of the system 10 due to the fact it allows the system 10 perform the algorithms on the data without trying to acquire this data from individual sources that may be unavailable or may have a slow internet connection. Other benefits of combining these databases includes reducing the requirements for the remote terminal 28, which in turn improves usability of the system because it allows greater access to the data. Other benefits of combining these databases are known to one of skill in the art. Accordingly, in this embodiment, the remote terminal 28 will connect to the combination of the team database 32 and the national database 38 via the internet.

National database 38 stores all the data or a subset of the data that is stored in each of the team databases 32 around a geographic region, such as the nation or world. Specifically, the team databases 32 uploads a copy of the data to the national database 38 via communications link 62 after a predefined amount of time has passed since the team database 32 was last uploaded to the national database 38. Additionally, after the new data from the team database 32 is uploaded to the national database 38, the team database 32 may download new thresholds from the national database 38 via communications link 62. The data that may be contained within the national database 38 may include, but is not limited to: (i) alert data for each player across the nation/world, which includes single and cumulative alerts for each player across the nation/world, (ii) impact matrix for each player across the nation/world, (iii) other data related to the recorded physiological parameters for each player across the nation/world, (iv) equipment assignments and profiles of each player across the nation/world (e.g., relevant sizes, type of shoes, type of helmet, type of helmet padding, type of chin strap, type of faceguard, and etc.), (v) medical data for each player across the nation/world (e.g., medical histories, injuries, height, weight, emergency information, and etc.), (vi) statistics for each player across the nation/world, (vii) workout regiments for each player across the nation/world, and (viii) other player data across the nation/world (e.g., head and helmet scans, contact information). It should be understood that in certain embodiments a team may elect not to contribute certain information from the team database 32 to the national database 38.

6. Remote Terminal

The display 28*a* of the remote terminal 28 permits an authorized user to view via the GUI, remotely or locally, the data contained within the team/national database 32, 38 via communications link 60. This allows the authorized user to remotely keep abreast of changes in a player's status or check to see if the team has equipment components to replace the equipment that was lost or damaged during the physical activity. For example, the authorized user can view comparisons that may include: (i) recently recorded data contained within the team database 32 against historical data contained within the team database 32, (ii) recently recorded data contained within the team database 32 against historical data contained within the national database 38, and (iii) recently recorded data contained within the team database 32 against recently recorded data contained within the national database 38. Each comparison can provide information that can be used to make suggested changes in how the player or team engages in physical activity. For example, if it is determined that the current quarterback for Team A is currently experiencing more single alerts then other historical quarterbacks for Team A, the authorized user may need to look at the playing style of the current quarterback of Team A or may need to review the techniques of his lineman.

The remote terminal 28 may be an internet enabled device, such as a PDA, a cellular phone (e.g., iPhone or Samsung Galaxy), a tablet (e.g., iPad or Android-based tablet), a laptop, a desktop computer, or a custom device specifically designed to be a remote terminal. Unlike the alert unit 26, the remote terminal 28 is not specifically configured to be carried by a person that is: (i) positioned proximate (e.g., within 50 yards) to the field or location that the physical activity is taking place and (ii) is not engaged in the physical activity. While typically being a portable device that can be transported from one location to another location, the remote terminal 28 is typically configured to be positioned in a trainer's office, the press box, locker room, home of the player or other similar locations. It should be understood that in some embodiments, the remote terminal 28 and the alert unit 26 may be combined into a single device, as shown in FIG. 3. Accordingly, in this embodiment, the remote terminal 28 will be adapted to perform the functions of both the remote terminal 28 and the alert unit 26. Thus, this combination device will have the form factor that is similar to the form factor of the alerting unit 26. In these exemplary embodiments, remote terminal 28 includes various components, such as a display, a processor, a memory, peripheral devices, a radio/transmitter/receiver, sensors, and other components.

In certain embodiments, such as those shown in FIGS. 3 and 5, the physiological parameter data is transmitted from the IHU 22 to the remote terminal 28 via communications link 42. It should be understood that these transmissions may include one or more network elements that are positioned between the IHU 22 and the remote terminal 28. The communications link 42 may use any type of wireless or wired communication technology, examples of such technologies are discussed above. In other embodiments, the physiological parameter data may be passed through at least one device (e.g., network element, such as a router) prior to being received by the remote terminal 28. For example, in FIGS. 1 and 2, sometime after the physiological parameter data has been sent from the IHU 22 to the receiving device 24, the receiving unit 24 transmits the physiological parameter data to a remote terminal 28 via communications link 44. Typically, the recorded data is transmitted from the receiving device 24 to the remote terminal 28 after the conclusion of the physical activity for that day. However, it should be understood that the recorded data may be transmitted more or less frequently depending on the physical activity. In still further embodiments, as shown in FIG. 4, the physiological parameter data may be sent to the team database 32 via communications link 48 from controller 30.

In any of the above embodiments, the team/national database 32, 38 may be remotely accessed over the internet by an authorized user using the remote terminal 28. To ensure that the user is an authorized user, the system 10 requires that the user provide some type of information to identify the user. For example, the remote terminal 28 may request a connection with the team/national database 32, 38 from an internet enabled device. Once the team/national database 32, 38 receives this request from the remote terminal 28, the team/national database 32, 38 may ask the authorized user to enter their user name and password using the remote terminal 28. The user will then enter this information using the remote terminal 28 and the information will be sent to the team/national database 32, 38 over the internet. The team/national database 32, 38 then verifies this information by confirming the user name and password that was provided matches the user name and password that is stored within the team/national database 32, 38. After verification is complete, remote terminal 28 is given access, according to the authorized user's access level (e.g., admin, full access to team information, only access to a single player, access to another subset of the data, etc.), to the information contained within the team/national database 32, 38. It should be understood that other types of identifying information (e.g., RSA tokens, information derived from the BIOS of a computer, etc.) may be provided by the user in alternative embodiments. This allows the authorized user to remotely keep abreast of changes in the player's status or check to see if the team has equipment components to replace an equipment component that was lost or damaged during the physical activity.

It should be understood an authorized user who can view data contained within the team database 32 is not typically granted full access to view data contained within the national database 38. Typically, the only users that have full access to this national database 38 are the database administrators. This helps ensure that the data from the player's around the nation/world cannot be accessed by other authorized users. In certain embodiments, where the national database 38 and/or team database 32 is cloud-based and is accessible via the internet, a partial authorized user (e.g., a parent) may have restricted access to an extent of the national database 38 and/or team database 32 may be accessed by the remote terminal 28 via communications link 60. For example, this restricted access allows the partial authorized user and/or remote terminal 28 to view a specific player's recently recorded physiological parameter data.

It should be understood that the disclosure contained herein discusses that the remote terminal 28 performs the algorithms (e.g., 504, 506, 508, 510, 512, 514, 516, and 518) discussed below and thus is performing the comparison of the datasets (e.g., data contained within the team database 32 with data contained within the national database 38). In an alternative embodiment, another device (e.g., remote cloud server) that is connected to the team database 32 and the national database 38 may perform these algorithms described below, while the remote terminal 28 merely displays the outcomes of these algorithms in the GUI 1000.

This alternative embodiment allows the remote terminal 28 to operate more efficiently because it does not have to perform all of these algorithms, which also improves the efficiency of the system 10 as it reduces the amount of data that system 10 must simultaneously monitor and process. For example, the algorithms that are described above can be performed during times when the system 10 is not being used (e.g., late at night) during practice or game play, which in turn allows the system 10 to focus on requests made by authorized users that are actively logged into the system 10. Additionally, this alternative embodiment centralizes the processing of the algorithms, which allows for specialized devices to rapidly perform the algorithms. Further, centralization of the algorithms reduce the cost of running the system 10 because the system can tailor its power usage (e.g., when it performs the above described algorithms) to select times when power is less expensive, and by providing the reports the authorized user does not have to log into the system to pull this information therefrom. Moreover, this centralization allows for the remote terminal 28 to have less processing power and storage then would otherwise be required. This allows for the system 10 to provide access to a greater number of authorized users in a greater number of locations; thus, improving the usability and efficiently of the system 10.

d. Training Opportunities

As discussed above, the system 10 provides post-physical activity analysis of the recorded data to make suggested changes in how the person engages in the physical activity using a unique set of rules or algorithms. Specifically, these suggestions are based on specific training opportunities.

i. Overview

Figure 13A:
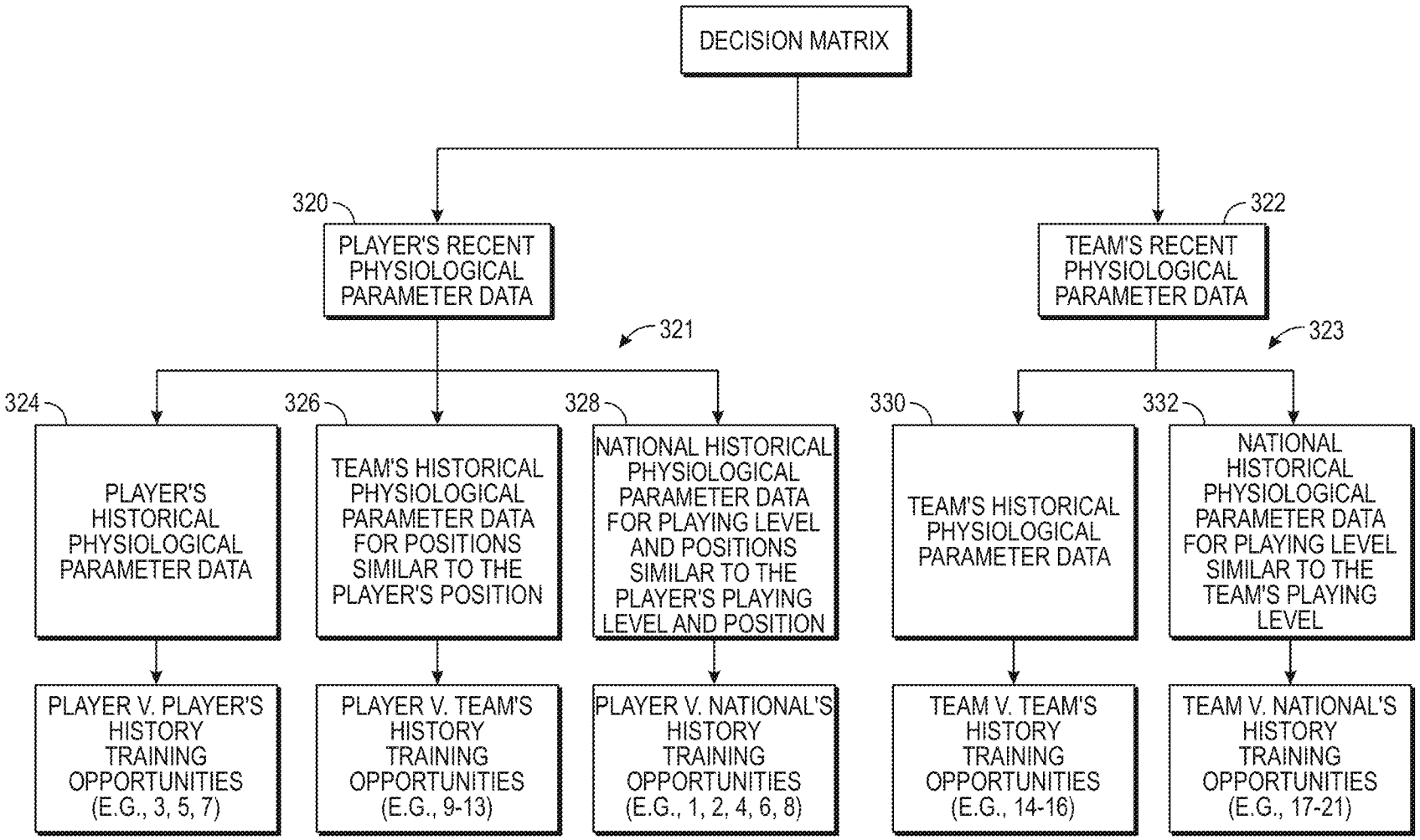
FIG. 13A is a chart showing categories of potential training opportunities.
Figure 13B:
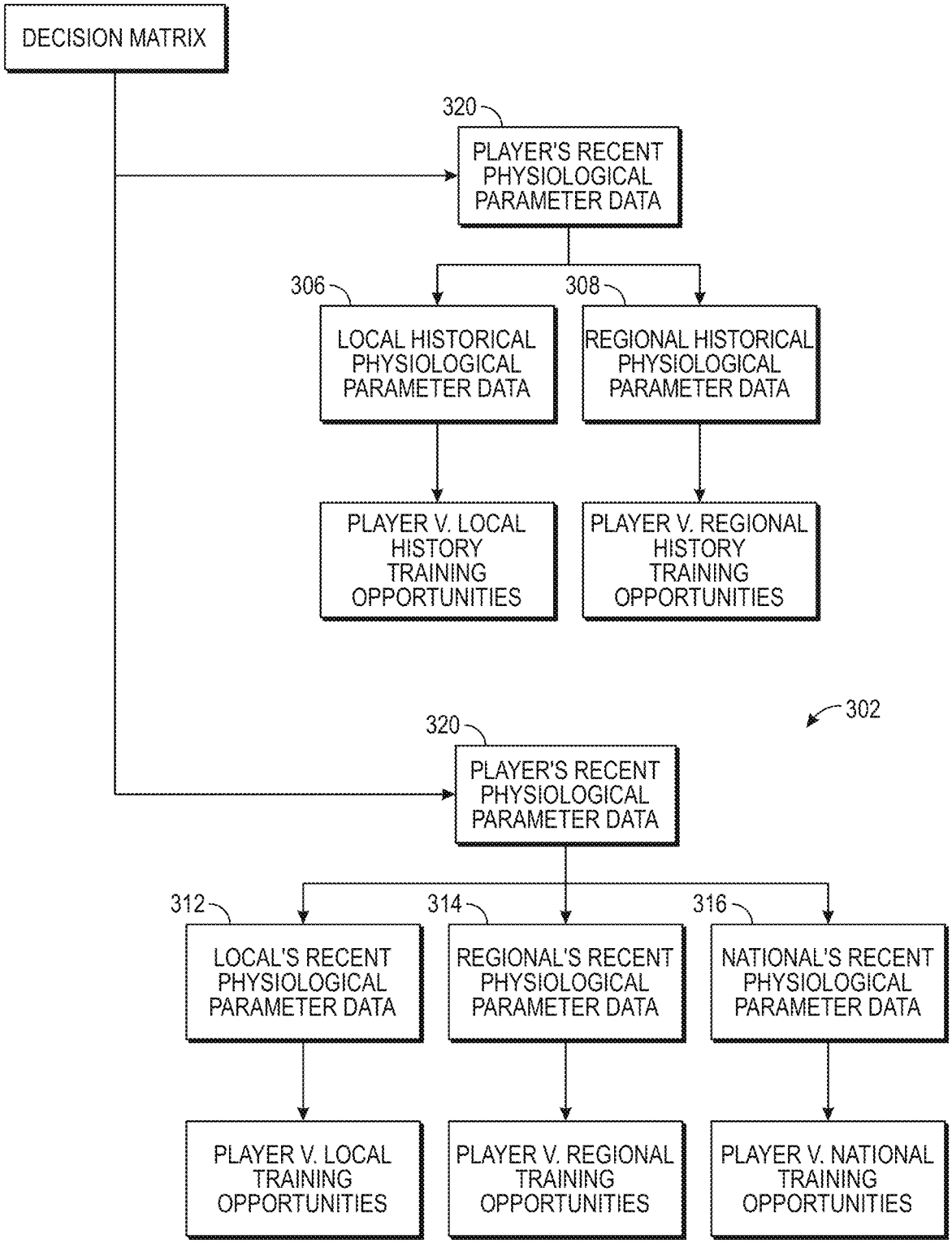
FIG. 13B is an exemplary chart showing additional categories of potential training opportunities for a player.

Examples of training opportunities that the system 10 can determine are shown in FIG. 13A. Specifically, training opportunities may be based on: (i) comparing a specific or target player's recent physiological parameter data 320 against various collections of historical physiological parameter data 321 or (ii) comparing a specific or target team's recent physiological parameter data 322 against various collections of historical physiological parameter data 323. As will be discussed in greater detail below, the following comparisons can be made:

a. Comparing a specific or target player's recent physiological parameter data against the player's own historical physiological parameter data 324 will provide training opportunities that are numbered 3, 5, and 7. This comparison may allow the specific or target player to understand how they are currently performing in comparison to their history.

b. Comparing a specific or target player's recent physiological parameter data against the physiological parameter data from other teammates that play the same or similar positions 326 will provide training opportunities that are numbered 9-13. This comparison may allow the specific or target player to understand how they are currently performing in comparison to the history of the player's teammates.

c. Comparing a specific or target player's recent physiological parameter data against other player's physiological parameter data, which have the same or similar playing level and position, 328 will provide training opportunities that are numbered 1, 2, 4, 6, and 8. This comparison may allow the specific or target player to understand how they are currently performing in comparison to the history of the player's around the nation/world.

d. Comparing a specific or target team's recent physiological parameter data against the team's own historical physiological parameter data 330 will provide training opportunities that are numbered 14-16. This comparison may allow the specific or target team to understand how they are currently performing in comparison to their history.

e. Comparing a specific or target team's physiological parameter data against other team's physiological parameter data, which have the same or similar playing level, 332 will provide training opportunities that are numbered 17-21. This comparison may allow the specific or target team to understand how they are currently performing in comparison to the history of the player's around the nation/world.

Examples of other training opportunities that the system 10 may determine are shown in FIGS. 13B-13E. Specifically, FIG. 13B discusses how training opportunities may be based on: (i) comparing a specific or target player's recent physiological parameter data 320 against various collections of historical physiological parameter data 300 or (ii) comparing a specific or target player's recent physiological parameter data 320 against various collections of recent physiological parameter data 302. For example, the following comparisons can be made:

a. Comparing a specific or target player's recent physiological parameter data against historical physiological parameter data for players that: (i) are geographically local to the specific or target player, (ii) have a playing level that is the same or similar to the specific or target player, and (iii) play a position that is the same or similar to the specific or target player 306.

b. Comparing a specific or target player's recent physiological parameter data against historical physiological parameter data for players that: (i) are geographically regional to the specific or target player, (ii) have a playing level the same or similar to the specific or target player, and (iii) play a position that is the same or similar to the specific or target player 308.

c. Comparing a player's recent physiological parameter data against recent physiological parameter data for players that: (i) are geographically local to the specific or target player, (ii) has a playing level that is the same or similar to the specific or target player, and (iii) play a position that is the same or similar to the specific or target player 312.

d. Comparing a player's recent physiological parameter data against recent physiological parameter data for players that: (i) are geographically regional to the player, (ii) have a playing level similar to the player, and (iii) play a position that is similar to the player 314.

e. Comparing a specific or target player's recent physiological parameter data against recent physiological parameter data for players that: (i) have playing level that is the same or similar to the specific or target player, and (ii) play a position that is the same or similar to the specific or target player 316.

Figure 13C:
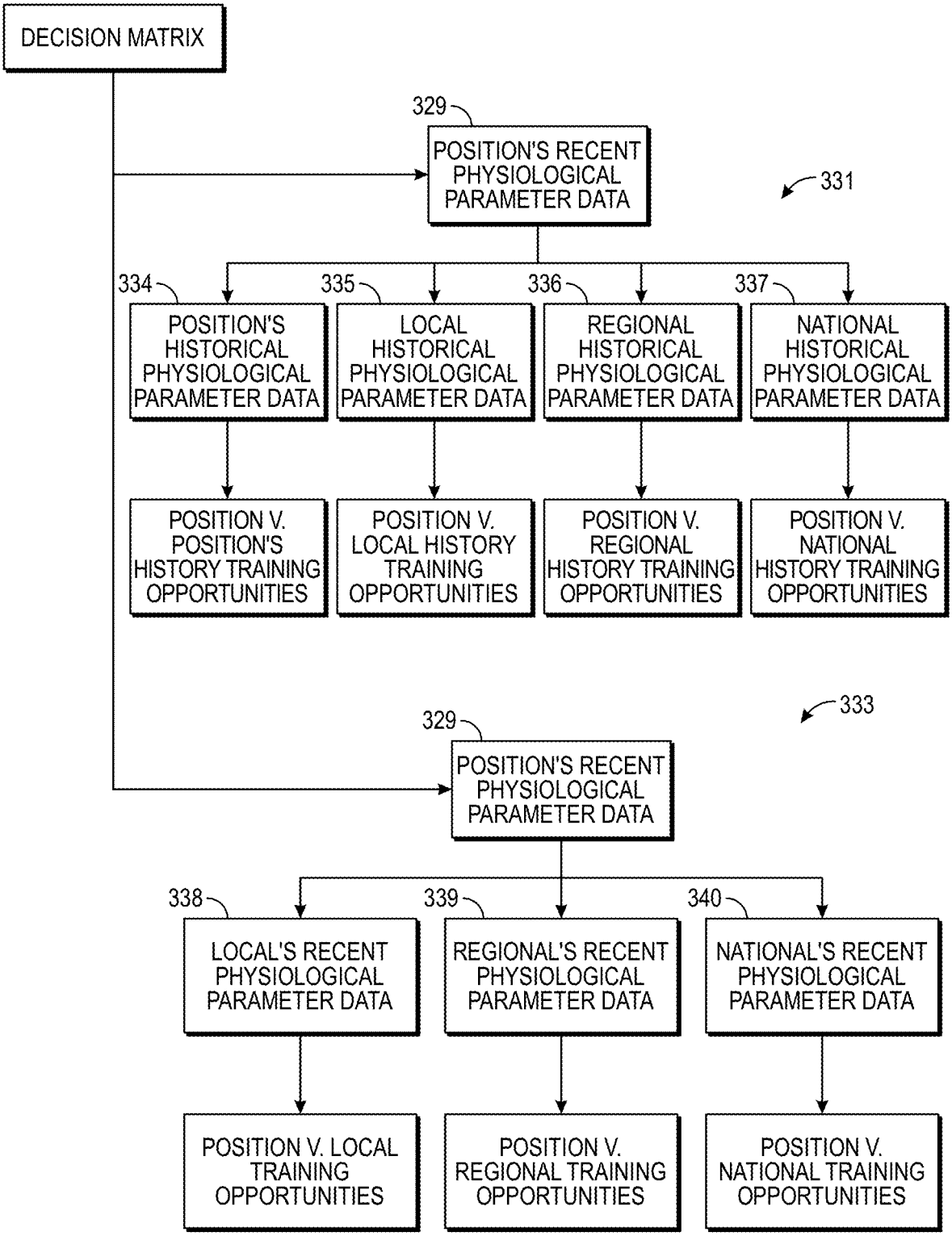
FIG. 13C is an exemplary chart showing additional categories of potential training opportunities for a position.

Similarly, FIG. 13C discusses how training opportunities may be based on: (i) comparing a specific or target position's (e.g., offensive line, running backs, quarterback, wide receivers, defensive linemen, linebackers, defensive backs and special teams) recent physiological parameter data 329 against various collections of historical physiological parameter data in 331 or (ii) comparing a specific or target position's recent physiological parameter data 329 against various collections of recent physiological parameter data in 333. For example, the following comparisons can be made:

a. Comparing a specific or target position's recent physiological parameter data against the position's own historical physiological parameter data 334.

b. Comparing a specific or target position's recent physiological parameter data against historical physiological parameter data for positions that: (i) are geographically local to the specific or target position and (ii) have a playing level that is the same or similar to the specific or target position 335.

c. Comparing a specific or target position's recent physiological parameter data against historical physiological parameter data for positions that: (i) are geographically regional to the specific or target position and (ii) have a playing level that is same or similar to the specific or target position 336.

d. Comparing a specific or target position's recent physiological parameter data against historical physiological parameter data for positions have a playing level that is the same or similar to the specific or target position 337.

e. Comparing a specific or target position's recent physiological parameter data against recent physiological parameter data for positions that: (i) are geographically local to the position and (ii) has a playing level the same or similar to the specific or target position 338.

f. Comparing a specific or target position's recent physiological parameter data against recent physiological parameter data for positions that: (i) are geographically regional to the position and (ii) have a playing level that is the same or similar to the specific or target position 339.

g. Comparing a specific or target position's recent physiological parameter data against recent physiological parameter data for positions that have a playing level that is the same or similar to the specific or target position 340.

Figure 13D:
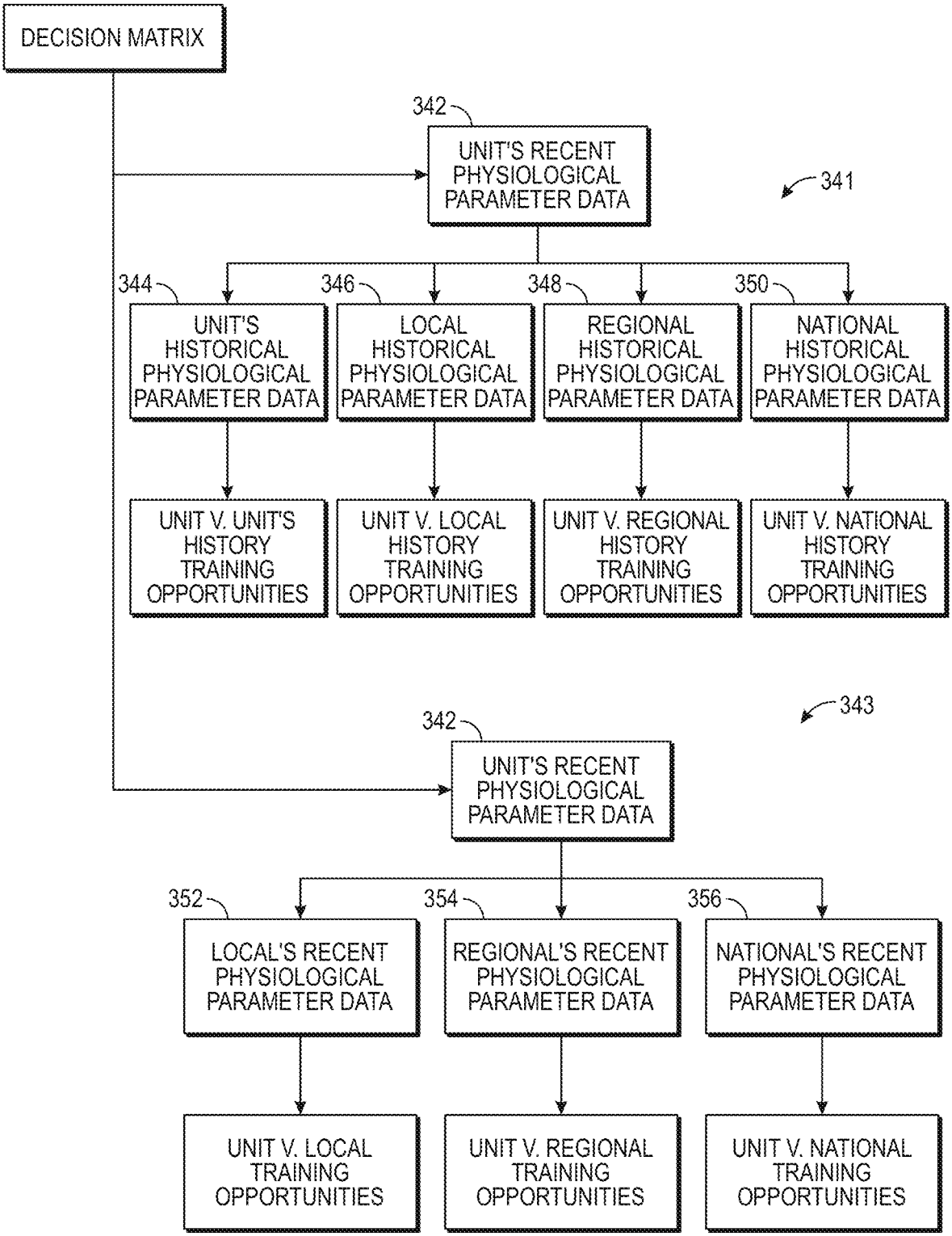
FIG. 13D is a chart showing additional categories of potential training opportunities for a unit.

Similarly, FIG. 13D discusses how training opportunities may be based on: (i) comparing a specific or target unit's (e.g., offense, defense) recent physiological parameter data 342 against various collections of historical physiological parameter data in 341 or (ii) comparing a specific or target unit's recent physiological parameter data 342 against various collections of recent physiological parameter data in 343. For example, the following comparisons can be made:

a. Comparing a specific or target unit's recent physiological parameter data against the unit's own historical physiological parameter data 344.

b. Comparing a specific or target unit's recent physiological parameter data against historical physiological parameter data for units that: (i) are geographically local to the specific or target unit, (ii) have a playing level that is the same or similar to the specific or target unit, and (iii) include positions that are the same or similar to the positions the specific or target unit includes 346.

c. Comparing a specific or target unit's recent physiological parameter data against historical physiological parameter data for units that: (i) are geographically regional to the specific or target unit, (ii) have a playing level that is the same or similar to the unit, and (iii) include positions that are the same or similar to the positions the specific or target unit includes 348.

d. Comparing a specific or target unit's recent physiological parameter data against historical physiological parameter data for units that: (i) have playing level that is the same or similar to the specific or target unit, and (iii) include positions that are the same or similar to the positions the specific or target unit includes 350.

e. Comparing a specific or target unit's recent physiological parameter data against recent physiological parameter data for units that: (i) are geographically local to the specific or target unit, (ii) has a playing level that is the same or similar to the unit, and (iii) include positions that are the same or similar to the positions the specific or target unit includes 352.

f. Comparing a specific or target unit's recent physiological parameter data against recent physiological parameter data for units that: (i) are geographically regional to the specific or target unit, (ii) have a playing level that is the same or similar to the unit, and (iii) include positions that are the same or similar to the positions the specific or target unit includes 354.

g. Comparing a specific or target unit's recent physiological parameter data against recent physiological parameter data for units that: (i) have playing level that is the same or similar to the specific or target unit, and (iii) include positions that are the same or similar to the positions the specific or target unit includes 356.

Figure 13E:
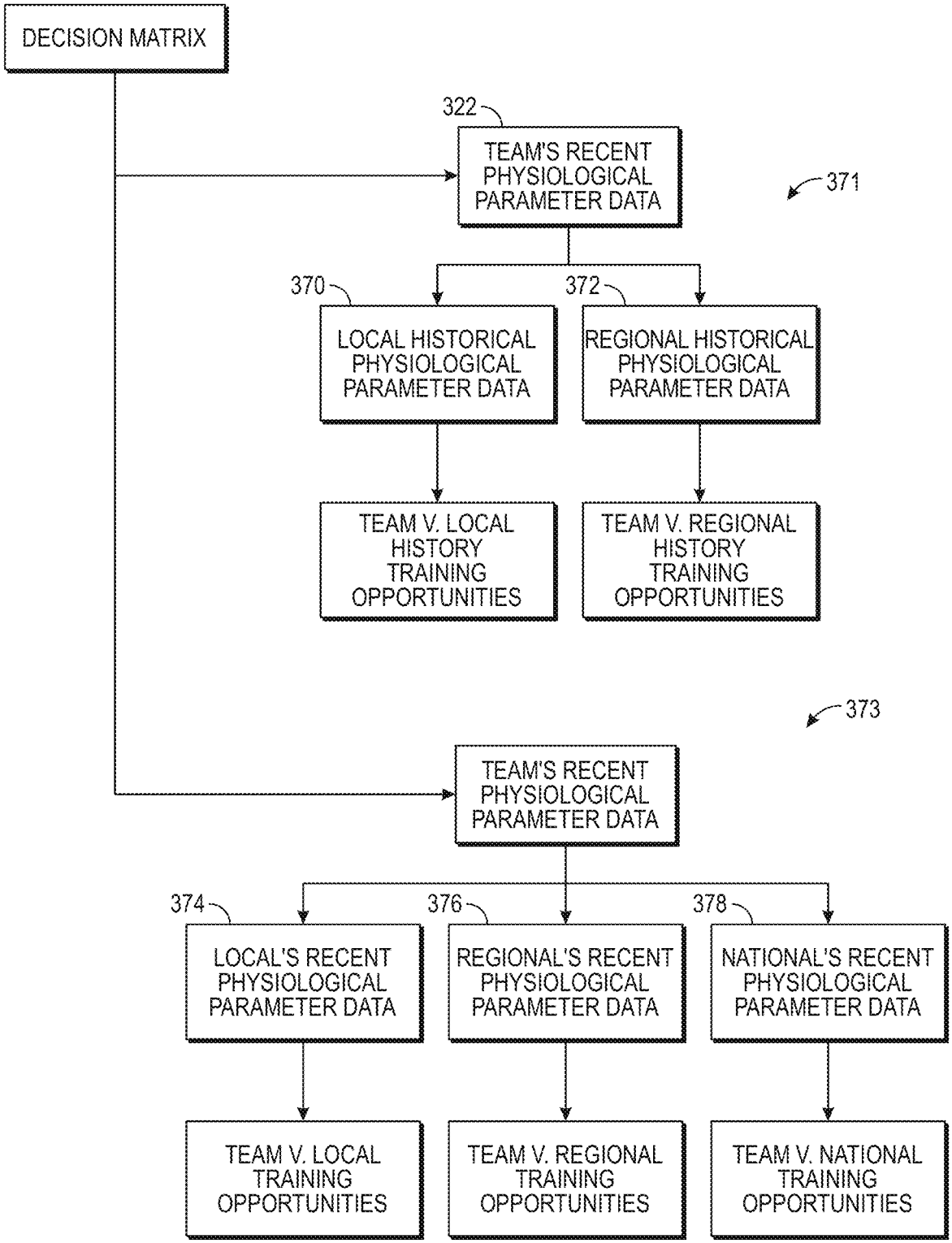
FIG. 13E is a chart showing additional categories of potential training opportunities for a team.

Similarly, FIG. 13E discusses how training opportunities may be based on: (i) comparing a specific or target team's recent physiological parameter data 322 against various collections of historical physiological parameter data in 371 or (ii) comparing a specific or target team's recent physiological parameter data 322 against various collections of recent physiological parameter data in 373. For example, the following comparisons can be made:

a. Comparing a specific or target team's recent physiological parameter data against historical physiological parameter data for teams that: (i) are geographically local to the specific or target team and (ii) have a playing level that is the same or similar to the specific or target team 370.

b. Comparing a specific or target team's recent physiological parameter data against historical physiological parameter data for teams that: (i) are geographically regional to the specific or target team and (ii) have a playing level that is the same or similar to the specific or target team 372.

c. Comparing a specific or target team's recent physiological parameter data against recent physiological parameter data for teams that: (i) are geographically local to the specific or target team and (ii) has a playing level that is the same or similar to the specific or target team 374.

d. Comparing a specific or target team's recent physiological parameter data against recent physiological parameter data for teams that: (i) are geographically regional to the specific or target team, (ii) have a playing level that is the same or similar to the specific or target team 376.

e. Comparing a specific or target team's recent physiological parameter data against recent physiological parameter data for teams that have playing level that is the same or similar to the specific or target team 378.

As discussed above in connection with the IHU 22, certain threshold values/ranges that are utilized by the algorithms are not standardized across all players. In other words, different or custom threshold values/ranges may be utilized by the algorithms for each player. Also, like above, the non-standardized or custom threshold values/ranges are based upon information that is entered or obtained from the player whose data is going to be analyzed by the algorithm. In particular, tailoring the algorithms to the specific player by using non-standardized or custom threshold values/ranges creates a specialized multi-function system 10 that determines training opportunities for the specific player. This specialized multi-function system 10 provides more accurate information, including monitoring and training opportunities to the authorized user. This in turn improves the efficiency of the system 10 and the authorized user's ability to make suggested changes in how the person engages in the physical activity.

The non-standardized or custom threshold values/ranges in this embodiment are: (i) $5^{th}$ threshold or number of alertable impacts threshold, (ii) $6^{th}$ threshold or number of high magnitude impacts threshold, (iii) $10^{th}$ threshold or number of impacts threshold, (iv) $13^{th}$ threshold or over baseline average number of impacts threshold, (v) $14^{th}$ threshold or impact load threshold, (vi) $17^{th}$ threshold or over baseline average load threshold, and (vii) $19^{th}$ threshold or location threshold. Similar to the above described process, system 10 determines the values of these non-standardized or custom threshold values/ranges based on the player's position and level. To select the proper thresholds/values, the remote terminal 28 pulls the thresholds/values from the team/national database 32, 38 that were associated with the player during the setup of the IHU 22. Also, as described above, these non-standardized threshold values/ranges may be adjusted or a different set of thresholds/values may be selected in a manner that is similar to the above described processes. It should be understood that additional threshold values/ranges may be added to the above disclosed list of threshold values/ranges or threshold values/ranges may be subtracted.

2. Algorithms for Training Opportunity

FIGS. 14-18 disclose eight novel training opportunity algorithms 504, 506, 508, 510, 512, 514, 516, and 518. These novel training opportunity algorithms each create multiple training opportunities depending on the data that is compared within the algorithm. For example, one algorithm may compare a specific player's recent physiological parameter data with a specific player's historical physiological parameter data. Additionally, the same algorithm may compare a specific or target team's recent physiological parameter data with a specific team's historical physiological parameter data. It should be understood that while a few training opportunities for each algorithm are discussed below, additional training opportunities for each of these algorithms exist and are contemplated by this disclosure.

Figure 14:
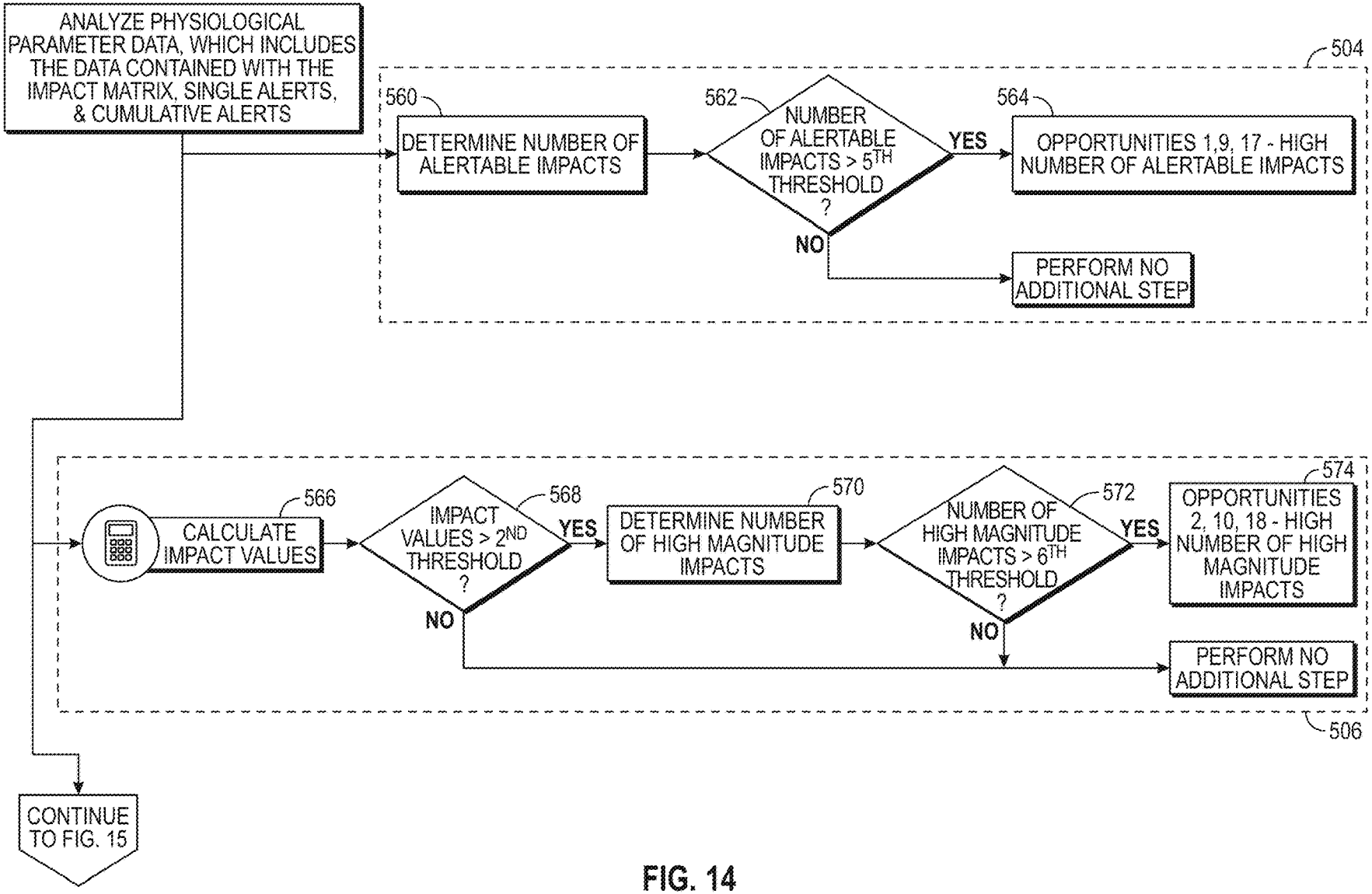
FIG. 14 is a flowchart showing how training opportunities 1, 2, 9, 10, 17, and 18 are determined.

Training opportunity algorithm 504 is shown in FIG. 14 and generally relates to a high number of alertable impacts. For example, the alertable impacts are the impacts that the specific player experienced that are greater than the $3^{rd}$ or $4^{th}$ thresholds, as described in FIG. 12. In other words, only impacts that generate either a single alert or a cumulative alert are analyzed by algorithm 504. The $1^{st}$ training opportunity or the high number of alertable impacts for a specific player v. nation training opportunity may be generally determined by comparing a value that is derived from a specific player's alert data with a value that is derived from the national alert data. In other words, the $1^{st}$ training opportunity may be generally determined by comparing a specific player value derived from data contained within the team database 32 with a value derived from data contained within the national database 38 using algorithm 504. Specifically, values and data used in this $1^{st}$ training opportunity include:

a. Training Opportunity #1 or High Number of Alertable Impacts for Specific Player v. National Player
   i. Comparison: a specific player's number of alertable impacts vs. historical number of alertable impacts experienced by similarly situated players in terms of playing level and/or position;
   ii. Data Requirement: (i) number of alertable impacts over a $2^{nd}$ predefined amount of time for the specific player and (ii) number of alertable impacts over the $2^{nd}$ predefined amount of time for similarly situated players in terms of playing level and/or position;
   iii. $2^{nd}$ Predefined Amount of Time or Alertable Time Period: set to any amount of time, preferably set between 2 days and 90 days, and most preferably set to 7 days; and
   iv. $5^{th}$ Threshold or Number of Alertable Impacts Threshold: set to the $95^{th}$ percentile of the number of alertable impacts that have historically occurred over the $2^{nd}$ predefined amount of time for similarly situated players in terms of playing level and/or position.

Specifically, the remote terminal 28 performs the steps described in algorithm 504. First, in step 560, the remote terminal 28 sums up the total number of single and cumulative impacts that the specific player experienced over a $2^{nd}$ predefined time period or an alertable time period. The $2^{nd}$ predefined time period or an alertable time period may be set to any amount of time, preferably set between 2 days and 90 days, and most preferably set to 7 days. Once the remote terminal 28 has determined the total number of alertable impacts experienced by the specific player over the alertable time period in step 560, this total number is compared with a 5th threshold or a number of alertable impacts threshold in step 562. The number of alertable impacts threshold may be set to the $95^{th}$ percentile of the number of alertable events that have historically occurred over the alertable time period for similarly situated players in terms of playing level and/or position. If the total number of alertable impacts over the alertable time period is less than the number of alertable impacts threshold, then remote terminal 28 performs no additional steps. However, if the total number of alertable impacts over the alertable time period is greater than the number of alertable impacts threshold, then the $1^{st}$ training opportunity is triggered in step 564. This $1^{st}$ training opportunity informs an authorized user that the specific player is experiencing more alerts than other similarly situated players in terms of playing level and/or position. Accordingly, the authorized user should review the game tape with this player at the timestamps that each alertable incident occurred to determine how the specific player may change their playing style to reduce the number of alertable impacts in the future.

Training opportunity algorithm 504 may be used to generate another training opportunity by altering the data the algorithm 504 compares. Instead of comparing a specific player's data to national data, the training opportunity algorithm 504 may compare a specific player's data to team data. The $9^{th}$ training opportunity or the high number of alertable impacts for specific player v. team training opportunity may be generally determined by comparing a value that is derived from a specific player's alert data with a value that is derived from the team's alert data. In other words, the $9^{th}$ training opportunity may be generally determined by comparing a specific player value derived from data contained within the team database 32 with a team value derived from data contained within the team database 32 using algorithm 504. Specifically, values and data used in this $9^{th}$ training opportunity include:

a. Training Opportunity #9 or High Number of Alertable Impacts for Specific Player v. Team
   i. Comparison: specific player's number of alertable impacts vs. historical number of alertable impacts experienced by teammates that play similar positions;
   ii. Data Requirement: (i) number of alertable impacts over a $2^{nd}$ predefined amount of time for the specific player and (ii) number of alertable impacts over the $2^{nd}$ predefined amount of time for teammates that play similar positions;
   iii. $2^{nd}$ Predefined Amount of Time or Alertable Time Period: set to any amount of time, preferably set between 2 days and 90 days, and most preferably set to 7 days; and
   iv. $5^{th}$ Threshold or Number of Alertable Impacts Threshold: set to the $95^{th}$ percentile of the number of alertable events that have historically occurred over the $2^{nd}$ predefined amount of time for teammates that play similar positions.

This $9^{th}$ training opportunity uses the same data flow that is described above in connection with the $1^{st}$ training opportunity, except for the fact that it utilizes different data sets. This $9^{th}$ training opportunity informs an authorized user that the specific player is experiencing more alertable impacts than other team players that play the same or similar positions. Accordingly, the authorized user should review the game tape at the alertable time periods with this specific player to determine how to correct their playing style to match other players that play the same or similar positions.

Training opportunity algorithm 504 may further be used to generate another training opportunity by altering the data the algorithm 504 compares. Instead of comparing a specific player's data to national data, the training opportunity algorithm 504 compares a team's data to national team data. The $17^{th}$ training opportunity or the high number of alertable impacts for team v. national team data training opportunity may be generally determined by comparing a value that is derived from a specific team's alert data with a value that is derived from national alert data. In other words, the $17^{th}$ training opportunity may be generally determined by comparing a specific team value derived from data contained within the team database 32 with a value derived from data contained within the national database 38 using algorithm 504. Specifically, values and data used in this $17^{th}$ training opportunity include:

a. Training Opportunity #17 or High Number of Alertable Impacts for Team v. National Team
   i. Comparison: specific team's number of alertable impacts vs. historical number of alertable impacts for teams of similar playing level;
   ii. Data Requirement: (i) number of alertable impacts over a $2^{nd}$ predefined amount of time for the specific team and (ii) number of alertable impacts over the $2^{nd}$ predefined amount of time for all teams of similar playing level;
   iii. $2^{nd}$ Predefined Amount of Time or Alertable Time Period: set to any amount of time, preferably set between 2 days and 90 days, and most preferably set to 7 days; and
   iv. $5^{th}$ Threshold or Number of Alertable Impacts Threshold: set to the $95^{th}$ percentile of the number of alertable events that have historically occurred over the $2^{nd}$ predefined amount of time for teams of similar playing levels.

This $17^{th}$ training opportunity uses the same data flow that is described above in connection with the $1^{st}$ training opportunity, except for the fact that it utilizes different data sets. This $17^{th}$ training opportunity informs an authorized user that the specific team is experiencing more alerts than other teams that play at a similar level. Accordingly, a wholesome review of the specific teams playing style should be reviewed.

Training opportunity algorithm 506 is shown in FIG. 14 and generally relates to a high number of high magnitude impacts. For example, high magnitude impacts are the impacts that are greater than the $2^{nd}$ threshold, as described in FIG. 12. In other words, high magnitude impacts are impacts that are greater than the 95 percentile for similarly situated players in terms of playing level and/or position. The $2^{nd}$ training opportunity or the high number of high magnitude impacts for specific player v. nation training opportunity may be generally determined by comparing a value that is derived from a specific player's recorded impact values with a value that is derived from the national recorded impact values. In other words, the $2^{nd}$ training opportunity may be generally determined by comparing the specific player value derived from data contained within the team database 32 with a value derived from data contained within the national database 38 using algorithm 506. Specifically, values and data used in this $2^{nd}$ training opportunity include:

a. Training Opportunity #2 or High Number of High Magnitude Impacts for Specific Player v. National Player
   i. Comparison: specific player's number of high magnitude impacts vs. historical number of high magnitude impacts experienced by similarly situated players in terms of playing level and/or position;
   ii. Data Requirement: (i) number of high magnitude impacts over a $3^{rd}$ predefined amount of time for the specific player and (ii) number of high magnitude impacts over the $3^{rd}$ predefined amount of time for similarly situated players in terms of playing level and/or position;
   iii. $3^{rd}$ Predefined Amount of Time or High Magnitude Time Period: set to any amount of time, preferably set between 2 days and 90 days, and most preferably set to 7 days;
   iv. $2^{nd}$ Threshold or High Magnitude Impact Threshold: set to the $95^{th}$ percentile of impacts recorded by similarly situated players in terms of playing level and/or position; and
   v. $6^{th}$ Threshold or Number of High Magnitude Impacts Threshold: set to the $95^{th}$ percentile of the number of high magnitude impacts that have historically occurred over the $3^{rd}$ predefined amount of time for similarly situated players in terms of playing level and/or position.

Specifically, remote terminal 28 performs the steps described in algorithm 506. First, in step 566, the remote terminal 28 calculates an impact value for each impact that is contained within the specific player's physiological parameter data over the $3^{rd}$ predefined amount of time or the high magnitude time period. These impact values may be calculated using any of the methods discussed above in connection with FIG. 12. For example, the impact values may be based on HITsp. The $3^{rd}$ predefined amount of time may be set to any amount of time, preferably set between 2 days and 90 days, and most preferably set to 7 days. Next, in step 568, the remote terminal 28 determines if the specific player has experienced an impact that is over the $2^{nd}$ threshold or high magnitude impact threshold. The high magnitude impact threshold may be set to the $95^{th}$ percentile of impacts recorded by similarly situated players in terms of playing level and/or position. If the specific player has not experienced a high magnitude impact during the high magnitude time period, then the remote terminal 28 performs no additional steps. However, if the specific player has experienced a high magnitude impact during the high magnitude time period, then, in step 570, the remote terminal 28 determines the number of high magnitude impacts the specific player experienced during the high magnitude time period.

Once the remote terminal 28 has determined the total number of high magnitude impacts experienced by the specific player over the high magnitude time period in step 570, this total number is compared with a $6^{th}$ threshold or a number of high magnitude impacts threshold in step 572. The number of high magnitude impacts threshold may be set to the $95^{th}$ percentile of the number of high magnitude impacts that have historically occurred over the high magnitude time period for similarly situated players in terms of playing level and/or position. If the specific player's total number of high magnitude impacts over the high magnitude time period is less than the number of high magnitude impacts threshold, then the remote terminal 28 performs no additional steps. However, if the specific player's total number of high magnitude impacts over the high magnitude time period is greater than the number of high magnitude impacts threshold, then the $2^{nd}$ training opportunity is triggered in step 574. This $2^{nd}$ training opportunity informs an authorized user that the specific player is experiencing more high magnitude impacts than similarly situated players in terms of playing level and/or position. Accordingly, the authorized user should review the game tape with this specific player to determine how the player may change their playing style to avoid these high magnitude impacts in the future.

Training opportunity algorithm 506 may also be used to generate another training opportunity by altering the data the algorithm 506 compares. Instead of comparing a specific player's data to national data, the training opportunity algorithm 506 may compare a specific player's data to team data. The $10^{th}$ training opportunity or the high number of high magnitude impacts for specific player v. team training opportunity may be generally determined by comparing a value that is derived from a specific player's recorded impact values with a value that is derived from the team's recorded impact values. In other words, the $10^{th}$ training opportunity may be generally determined by comparing a specific player value derived from data contained within the team database 32 with a team value derived from data contained within the team database 32 using algorithm 506. Specifically, values and data used in this $10^{th}$ training opportunity include:

a. Training Opportunity #10 or High Number of High Magnitude Impacts for Specific Player v. Team
   i. Comparison: specific player's number of high magnitude impacts vs. historical number of high magnitude impacts experienced by teammates that play similar positions;
   ii. Data Requirement: (i) number of high magnitude impacts over a $3^{rd}$ predefined amount of time for the specific player and (ii) number of high magnitude impacts over the $3^{rd}$ predefined amount of time for teammates that play similar positions;
   iii. $3^{rd}$ Predefined Amount of Time or High Magnitude Time Period: set to any amount of time, preferably set between 2 days and 90 days, and most preferably set to 7 days;
   iv. $2^{nd}$ Threshold or High Magnitude Impact Threshold: set to the $95^{th}$ percentile of impacts recorded by similarly situated players in terms of playing level and/or position; and
   v. $6^{th}$ Threshold or Number of High Magnitude Impacts Threshold: set to the $95^{th}$ percentile of the number of high magnitude impacts that have historically occurred over the $3^{rd}$ predefined amount of time for teammates that play similar positions.

This $10^{th}$ training opportunity uses the same data flow that is described above in connection with the $2^{nd}$ training opportunity, except for the fact that it utilizes different data sets. It should be understood that instead of using all players of similar player level and position to determine the $2^{nd}$ threshold, this $2^{nd}$ threshold may be based on teammates that play similar positions. This $10^{th}$ training opportunity informs an authorized user that the specific player is experiencing more high magnitude impacts than other team players that play the same or similar positions. Accordingly, the authorized user should review the game tape with this specific player to determine how to correct their playing style to match other players that play similar positions.

Training opportunity algorithm 506 may be used to generate another training opportunity by altering the data the algorithm 506 compares. Instead of comparing a specific player's data to national data, the training opportunity algorithm 506 may compare a specific team's data to national data. The $18^{th}$ training opportunity or the high number of high magnitude impacts for specific team v. nation training opportunity may be generally determined by comparing a value that is derived from a team's recorded impact values with a value that is derived from the national recorded impact values. In other words, the $18^{th}$ training opportunity may be generally determined by comparing a specific team value derived from data contained within the team database 32 with a value derived from data contained within the national database 38 using algorithm 506. Specifically, values and data used in this $18^{th}$ training opportunity are described below:

a. Training Opportunity #18 or High Number of High Magnitude Impacts for Specific Team v. National Team
   i. Comparison: specific team's number of high magnitude impacts vs. historical number of high magnitude impacts experienced by all teams of similar playing level;
   ii. Data Requirement: (i) number of high magnitude impacts over a $3^{rd}$ predefined amount of time for the specific team and (ii) number of high magnitude impacts over the $3^{rd}$ predefined amount of time for all teams of similar playing level;
   iii. $3^{rd}$ Predefined Amount of Time or High Magnitude Time Period: set to any amount of time, preferably set between 2 days and 90 days, and most preferably set to 7 days;
   iv. $2^{nd}$ Threshold or High Magnitude Impact Threshold: set to the $95^{th}$ percentile of impacts recorded by similarly situated players in terms of playing level and/or position; and
   v. $6^{th}$ Threshold or Number of High Magnitude Impacts Threshold: set to the $95^{th}$ percentile of the number of high magnitude impacts that have historically occurred over the $3^{rd}$ predefined amount of time for teams of similar playing level.

This $18^{th}$ training opportunity uses the same data flow that is described above in connection with the $2^{nd}$ training opportunity except for the fact that it utilizes different data sets. This $18^{th}$ training opportunity informs an authorized user that the specific team is experiencing more high magnitude impacts than other teams that play at a similar playing level. Accordingly, a wholesome review of the specific teams playing style should be review.

Figure 15:
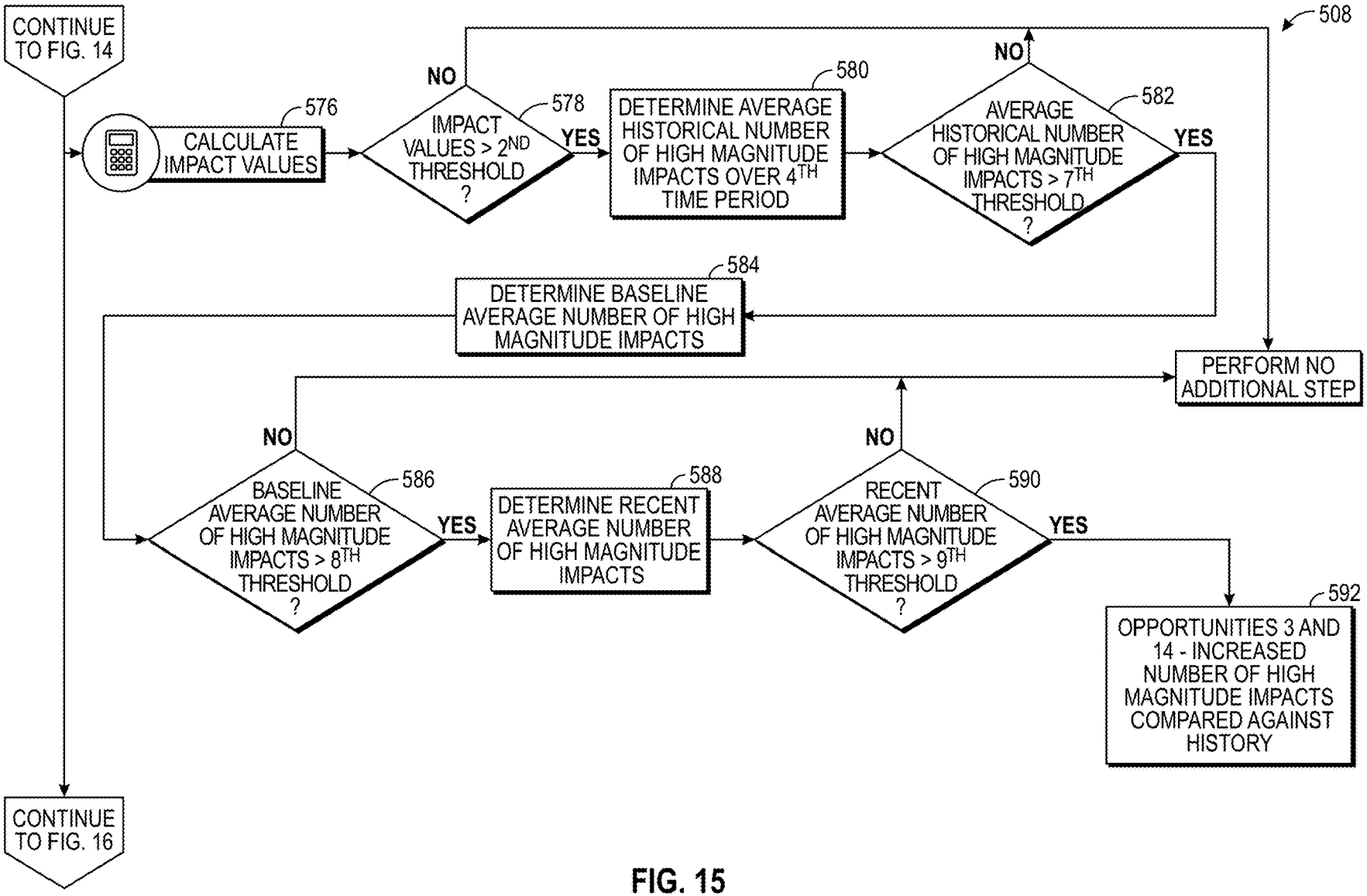
FIG. 15 is a flowchart showing how training opportunities 3 and 14 are determined.

Training opportunity algorithm 508 is shown in FIG. 15 and generally relates to an increase in the number of high magnitude impacts. For example, high magnitude impacts are the impacts that the specific player experiences that are greater than the $2^{nd}$ threshold, as described in FIG. 12. In other words, high magnitude impacts may be impacts that are greater than the $95^{th}$ percentile for impacts recorded by similarly situated players in terms of playing level and/or position. The $3^{rd}$ training opportunity or the increased number of high magnitude impacts for specific player v. specific player's history training opportunity may be generally determined by comparing a value that is derived from a specific player's recently recorded impact values with a value that is derived from a specific player's historical recorded impact values. Specifically, values and data used in this $3^{rd}$ training opportunity include:

a. Training Opportunity #3 or Increased Number of High Magnitude Impacts for Specific Player v. Specific Player's History i. Comparison: specific player's recent number of high magnitude impacts vs. specific player's historical number of high magnitude impacts;

ii. Data Requirement: (i) number of recent high magnitude impacts over a $4^{th}$ predefined amount of time for the specific player and (ii) historical number of high magnitude impacts over the $4^{th}$ predefined amount of time for the specific player;

iii. $4^{th}$ Predefined Amount of Time or High Magnitude Frequency Time Period: set between 2 days and 90 days, preferably set between 2 days and 30 days, and most preferably set to 7 days;

iv. $2^{nd}$ Threshold or High Magnitude Impact Threshold: set to the $95^{th}$ percentile of impacts recorded by similarly situated players in terms of playing level and/or position;

v. $7^{th}$ Threshold or Historical High Magnitude Impact Threshold: set to require at least 2 datasets, preferably at least 5 datasets, and most preferably at least 10 datasets;

vi. $8^{th}$ Threshold or Baseline Number of High Magnitude Impact Threshold: set above 0.1 average number of high magnitude impacts, preferably above 0.05 average number of high magnitude impacts, and most preferably above 1 average number of high magnitude impacts; and vii. $9^{th}$ Threshold or Over Baseline Average Number Of High Magnitude Impacts Threshold: set to 1% over the baseline average number of high magnitude impacts, which was calculated in step 584, preferably set between 5% and 50% over the baseline average number of high magnitude impacts, which was calculated in step 584, and most preferably between 10% and 40% over the baseline average number of high magnitude impacts, which was calculated in step 584.

Specifically, remote terminal 28 performs the steps described in algorithm 508. Also, FIG. 22 provides an example of how the specific player's physiological parameter data may be analyzed by algorithm 508. First, in step 576, the remote terminal 28 calculates an impact value for each impact contained within the specific player's physiological parameter data. These impact values may be calculated using any of the methods discussed above in connection with FIG. 12. For example, the impact values may be based upon HITsp. Next, in step 578, the remote terminal 28 determines if the specific player has experienced an impact that is over the $2^{nd}$ threshold or high magnitude impact threshold. The high magnitude impact threshold may be set to the $95^{th}$ percentile of impacts recorded by similarly situated players in terms of playing level and/or position. If the specific player has not experienced a high magnitude impact, then the remote terminal 28 performs no additional steps. However, if the specific player has experienced a high magnitude impact, then, in step 580, the remote terminal 28 determines the average historical number of high magnitude impacts over each $4^{th}$ predefined time period or high magnitude frequency time period contained within the specific player's physiological parameter data. Specifically, the remote terminal 28 groups the high magnitude impacts into datasets based on the date they occurred, wherein the dataset boundaries are defined by the $4^{th}$ predefined amount of time. The $4^{th}$ predefined amount of time is set between 2 days and 90 days, preferably set between 2 days and 30 days, and most preferably set to 7 days. Once the high magnitude impacts have been grouped into these datasets, the remote terminal 28 averages the number of high magnitude impacts that occurred within each of these datasets.

Next, in step 582, the remote terminal 28 determines if the specific player's physiological parameter data contains enough high magnitude impacts to perform the calculations involved with this training opportunity. This helps ensure that this training opportunity is not unnecessarily suggested when there is not enough data for this training opportunity to be accurately presented to the authorized user. The $7^{th}$ threshold or historical high magnitude impact threshold may be set to require at least 2 datasets, preferably at least 5 datasets, and most preferably at least 10 datasets. If the specific player has not played long enough to record data over the required number of historical high magnitude impacts threshold, then the remote terminal 28 performs no additional steps. However, if the specific player has recorded data over the required number of historical high magnitude impacts, then, in step 584, the remote terminal 28 determines the baseline average number of high magnitude impacts for the specific player.

Next, in step 586, the remote terminal 28 compares the baseline average number of high magnitude impacts to an $8^{th}$ threshold or a baseline number of high magnitude impacts threshold. The $8^{th}$ threshold may be set above 0.1 average number of high magnitude impacts, preferably above 0.05 average number of high magnitude impacts, and most preferably above 1 average number of high magnitude impacts. If the specific player's baseline average number of high magnitude impacts is not over the baseline number of high magnitude impacts threshold, then the remote terminal 28 performs no additional steps. However, if the specific player's baseline average number of high magnitude impacts is over the baseline number of high magnitude impacts threshold, then, in step 588, the remote terminal 28 determines the recent average number of high impacts. The remote terminal 28 then compares the recent average number of high impacts against the $9^{th}$ threshold or the over baseline average number of high magnitude impacts threshold in step 590. The $9^{th}$ threshold may be set to 1% over the baseline average number of high magnitude impacts, which was calculated in step 584, preferably set between 5% and 50% over the baseline average number of high magnitude impacts and most preferably between 10% and 40% over the baseline average number of high magnitude impacts. If the recent average number of high magnitude impacts is not over the $9^{th}$ threshold, then the remote terminal 28 performs no additional steps. However, if the recent average number of high magnitude impacts is over the $9^{th}$ threshold, then the training opportunity is triggered in step 592. This $3^{rd}$ training opportunity informs an authorized user that the specific player is experiencing, on average, more high magnitude impacts than the specific player has previously experienced. Accordingly, the authorized user should review the specific player's form to see what has recently changed with the specific player. For example, did the specific player recently come back from an injury and is now favoring that side, which is causing the specific player to have additional high magnitude impacts.

Training opportunity algorithm 508 may be used to generate another training opportunity by altering the data the algorithm 508 compares. Instead of comparing a specific player's recent data to the specific player's historical data, the training opportunity algorithm 508 may compare a specific team's recent data to the specific team's historical data. The $15^{th}$ training opportunity or the increased number of high magnitude impacts for specific team v. specific team's history training opportunity may be generally determined by comparing a value that is derived from a specific team's recent recorded impact values with a value that is derived from the specific team's historical impact values. Specifically, values and data used in this $15^{th}$ training opportunity are described below:

a. Training Opportunity #3 or Increased Number of High Magnitude Impacts for Specific Team v. Team's History
   i. Comparison: specific team's recent number of high magnitude impacts vs. specific team's historical number of high magnitude impacts;
   ii. Data Requirement: (i) number of recent high magnitude impacts over a $4^{th}$ predefined amount of time for the specific team and (ii) historical number of high magnitude impacts over the $4^{th}$ predefined amount of time for the specific team;
   iii. $2^{nd}$ Threshold or High Magnitude Impact Threshold: set to the $95^{th}$ percentile of impacts recorded by similarly situated players in terms of playing level and/or position;
   iv. $4^{th}$ Predefined Amount of Time or High Magnitude Frequency Time Period: set between 2 days and 90 days, preferably set between 2 days and 30 days, and most preferably set to 7 days;
   v. $7^{th}$ Threshold or Historical High Impact Threshold: set to require at least 2 datasets, preferably at least 5 datasets, and most preferably at least 10 datasets;
   vi. $8^{th}$ Threshold or Baseline Number of High Magnitude Impact Threshold: set above 0.1 average number of high magnitude impacts, preferably above 0.05 average number of high magnitude impacts, and most preferably above 1 average number of high magnitude impacts; and
   vii. $9^{th}$ Threshold or Over Baseline Average Number Of High Magnitude Impacts Threshold: set to 1% over the baseline average number of high magnitude impacts, which was calculated in step 584, preferably set between 5% and 50% over the baseline average number of high magnitude impacts, which was calculated in step 584, and most preferably between 10% and 40% over the baseline average number of high magnitude impacts, which was calculated in step 584; and This $15^{th}$ training opportunity uses the same data flow that is described above in connection with the $3^{rd}$ training opportunity except for the fact that it utilizes different data sets. This $15^{th}$ training opportunity informs an authorized user that the specific team is experiencing an increase in high magnitude impacts in comparison to the specific team's history. Thus, a review of the recent drills that the team is performing or other changes in coaching style should be reviewed.

Figure 16:
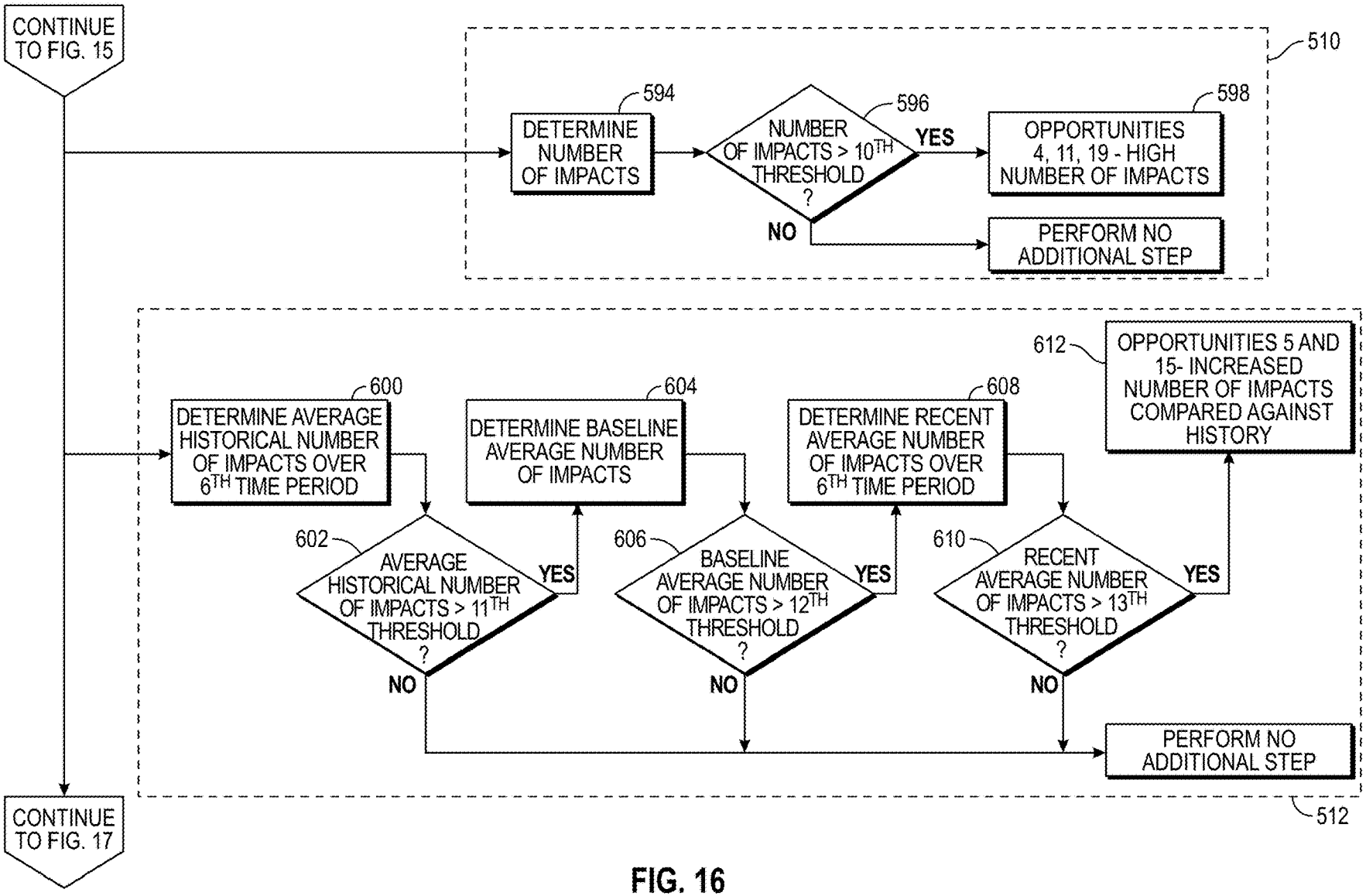
FIG. 16 is a flowchart showing how training opportunities 4, 5, 11, 15, and 19 are determined.

Training opportunity algorithm 510 is shown in FIG. 16 and generally relates to a high number of impacts. The $4^{th}$ training opportunity or the high number of impacts for specific player v. nation training opportunity may be generally determined by comparing a value that is derived from a specific player's physiological parameter data with a value that is derived from the national physiological parameter data. In other words, the $4^{th}$ training opportunity may be generally determined by comparing a specific player value derived from data contained within the team database 32 with a value derived from data contained within the national database 38 using algorithm 510. Specifically, values and data used in this $4^{th}$ training opportunity include:

a. Training Opportunity #4 or High Number of Impacts for Specific Player v. National Player
   i. Comparison: specific player's number of impacts vs. historical number of impacts experienced by similarly situated players in terms of playing level and/or position;
   ii. Data Requirement: (i) number of impacts over a $5^{th}$ predefined amount of time for the specific player and (ii) number of impacts over the $5^{th}$ predefined amount of time for similarly situated players in terms of playing level and/or position;
   iii. $5^{th}$ Predefined Amount of Time or Impact Time Period: set to any amount of time, preferably set between 2 days and 90 days, and most preferably set to 7 days; and
   iv. $10^{th}$ Threshold or Number of Impacts Threshold: set to the $95^{th}$ percentile of the number of impacts that have historically occurred over the $5^{th}$ predefined amount of time for similarly situated players in terms of playing level and/or position.

Specifically, the remote terminal 28 performs the steps described in algorithm 510. First, in step 594, the remote terminal 28 sums up the total number of impacts that the specific player experienced over a $5^{th}$ predefined time period or an impact time period. The $5^{th}$ predefined time period may be set to any amount of time, preferably set between 2 days and 90 days, and most preferably set to 7 days. Specifically, this is done by adding together every impact matrix contained within the $5^{th}$ predefined time period to generate a summed impact matrix. An example of how matrixes can be added together is shown in FIG. 21. Once all impact matrixes are added together over the $5^{th}$ predefined time period, each entry in the summed impact matrix is added together. For example, this final number of impacts is equal to 13 for the example shown in FIG. 21.

Once the remote terminal 28 has determined the total number of impacts experienced by the specific player over the impact time period in step 594, this total number is compared with a $10^{th}$ threshold or a number of impacts threshold in step 596. The number of impacts threshold may be set to the $95^{th}$ percentile of the number of impacts that have historically occurred over the impact time period for similarly situated players in terms of playing level and/or position. If the total number of impacts over the impact time period is less than the number of impacts threshold, then remote terminal 28 performs no additional steps. However, if the total number of impacts over the impacts time period is greater than the number of impacts threshold, then the 4th training opportunity is triggered in step 598. This 4th training opportunity informs an authorized user that the specific player is experiencing more impacts than other similarly situated players in terms of playing level and/or position.

As described above, training opportunity algorithm 510 may be used to generate another training opportunity by altering the data the algorithm 510 compares. Instead of comparing a specific player's data to national data, the training opportunity algorithm 510 may compare a specific player's data to team data. The $11^{th}$ training opportunity or the high number of impacts for specific player v. team training opportunity may be generally determined by comparing a value that is derived from a specific player's physiological parameter data with a value that is derived from the team's physiological parameter data. In other words, the $11^{th}$ training opportunity may be generally determined by comparing a specific player value derived from data contained within the team database 32 with a team value derived from data contained within the team database 32 using algorithm 510. Specifically, values and data used in this $10^{th}$ training opportunity include:

a. Training Opportunity #10 or High Number of Impacts for Specific Player v. Team
   i. Comparison: specific player's number of impacts vs. historical number of impacts experienced by teammates that play similar positions;
   ii. Data Requirement: (i) number of impacts over a $5^{th}$ predefined amount of time for the specific player and (ii) number of impacts over the $5^{th}$ predefined amount of time for teammates that play similar positions;
   iii. $5^{th}$ Predefined Amount of Time or Impact Time Period: set to any amount of time, preferably set between 2 days and 90 days, and most preferably set to 7 days; and
   iv. $10^{th}$ Threshold or Number of Impacts Threshold: set to the $95^{th}$ percentile of the number of impacts that have historically occurred over the $5^{th}$ predefined amount of time for teammates that play similar positions.

This $11^{th}$ training opportunity uses the same data flow that is described above in connection with the $4^{th}$ training opportunity, except for the fact that it utilizes different data sets. This $11^{th}$ training opportunity informs an authorized user that the specific player is experiencing more impacts than other team players that play similar positions. This training opportunity may inform the authorized user that the individual specific player's playing style needs to be reviewed because they are experiencing impacts that are different than their teammates.

Training opportunity algorithm 510 may be used to generate another training opportunity by altering the data the algorithm 510 compares. Instead of comparing a specific player's data to national data, the training opportunity algorithm 510 compares a team's data to national team data. The $19^{th}$ training opportunity or the high number of impacts for team v. national training opportunity may be generally determined by comparing a value that is derived from a team's physiological parameter data with a value that is derived from national physiological parameter data. In other words, the $19^{th}$ training opportunity may be generally determined by comparing a specific team value derived from data contained within the team database 32 with a value derived from data contained within the national database 38 using algorithm 504. Specifically, values and data used in this $19^{th}$ training opportunity include:

a. Training Opportunity #19 or High Number of Impacts for Specific Team v. National Team
   i. Comparison: specific team's number of impacts vs. historical number of impacts for teams of similar playing level;
   ii. Data Requirement: (i) number of impacts over a $5^{th}$ predefined amount of time for the teams and (ii) number of impacts over the $5^{th}$ predefined amount of time for all teams of similar playing level;
   iii. $5^{th}$ Predefined Amount of Time or Impact Time Period: set to any amount of time, preferably set between 2 days and 90 days, and most preferably set to 7 days; and
   iv. $10^{th}$ Threshold or Number of Impacts Threshold: set to the $95^{th}$ percentile of the number of impacts that have historically occurred over the $5^{th}$ predefined amount of time for teams of similar playing level.

This $19^{th}$ training opportunity uses the same data flow that is described above in connection with the $4^{th}$ training opportunity, except for the fact that it utilizes different data sets. This $19^{th}$ training opportunity informs an authorized user that the specific team is experiencing more impacts than other teams that play at a similar level. Accordingly, a wholesome review of the specific teams playing style should be reviewed.

Training opportunity algorithm 512 is shown in FIG. 16 and generally relates to an increase in the number of impacts. The $5^{th}$ training opportunity or the increased number of impacts for specific player v. specific player's history training opportunity may be generally determined by comparing a value that is derived from a specific player's recently recorded physiological parameter data with a value that is derived from a specific player's historical recorded physiological parameter data. Specifically, values and data used in this $5^{th}$ training opportunity include:

a. Training Opportunity #5 or Increased Number of Impacts for Specific Player v. Specific Player's History
   i. Comparison: specific player's recent number of impacts vs. specific player's historical number of impacts;
   ii. Data Requirement: (i) number of recent impacts over a $6^{th}$ predefined amount of time for the specific player and (ii) historical number of impacts over the $6^{th}$ predefined amount of time for the specific player;
   iii. $6^{th}$ Predefined Amount of Time or Impact Frequency Time Period: set between 2 days and 90 days, preferably set between 2 days and 30 days, and most preferably set to 7 days;
   iv. $11^{th}$ Threshold or Historical Impact Threshold: set to require at least 2 datasets, preferably at least 5 datasets, and most preferably at least 10 datasets;
   v. $12^{th}$ Threshold or Baseline Impact Threshold: set above 0.1 average number of impacts, preferably above 8 average number of impacts, and most preferably above 15 average number of impacts; and
   vi. $13^{th}$ Threshold or Over Baseline Average Number of Impacts Threshold: set to 95th percentile of change of players of similar skill level.

Specifically, the remote terminal 28 performs the steps described in algorithm 512. Also, FIG. 23 provides an example of how the specific player's physiological parameter data may be analyzed by algorithm 512. First, in step 600, the remote terminal 28 determines the average historical number of impacts over each $6^{th}$ predefined time period or impact frequency time period contained within the specific player's physiological parameter data. Specifically, this is done by adding together every impact matrix contained within one day to generate a historical summed daily impact matrix. An example of how matrixes can be added together is shown in FIG. 21. Once all impact matrixes are added together for one day, each entry in the historical summed daily impact matrix is added together. For example, the number of historical impacts per day is equal to 13 for the example shown in FIG. 21. Then, the remote terminal 28 groups the number of historical impacts per day into datasets based on the date they occurred, wherein the dataset boundaries are defined by the $6^{th}$ predefined amount of time. The $6^{th}$ predefined amount of time is set between 2 days and 90 days, preferably set between 2 days and 30 days, and most preferably set to 7 days. Once the number of historical impacts per day has been grouped into these datasets, the remote terminal 28 averages the number of historical impacts per day that occurred within each of these datasets to determine the average historical number of impacts over the $6^{th}$ time period.

Next, in step 602, the remote terminal 28 determines if the specific player's physiological parameter data contains enough impact data to perform the calculations involved with this training opportunity. This helps ensure that this training opportunity is not unnecessarily suggested when there is not enough data for this training opportunity to be accurately presented to the authorized user. The $11^{th}$ threshold or historical impacts threshold may be set to require at least 2 datasets, preferably at least 5 datasets, and most preferably at least 10 datasets. If the specific player has not played long enough to record data over the required number of historical impacts threshold, then the remote terminal 28 performs no additional steps. However, if the specific player has recorded data over the required number of historical impacts threshold, then, in step 604, the remote terminal 28 determines the baseline average number of impacts for the specific player.

Next, in step 606, the remote terminal 28 compares the baseline average number of impacts to a $12^{th}$ threshold or a baseline number of impacts threshold. The $8^{th}$ threshold may be set above 0.1 average number of impacts, preferably above 8 average number of impacts, and most preferably above 15 average number of impacts. If the specific player's baseline average number of impacts is not over the baseline number of impacts threshold, then the remote terminal 28 performs no additional steps. However, if the specific player's baseline average number of impacts is over the baseline number of impacts threshold, then, in step 608, the remote terminal 28 determines the recent average number of impacts. Specifically, this is done by adding together every impact matrix contained within one day to generate a recent summed daily impact matrix. An example of how matrixes can be added together is shown in FIG. 21. Once all impact matrixes are added together for one day, each entry in the recent summed daily impact matrix is added together. For example, this number of recent impacts per day is equal to 13 for the example shown in FIG. 21. Then, the remote terminal 28 groups the number of recent impacts per day into datasets based on the date they occurred, wherein the dataset boundaries are defined by the $6^{th}$ predefined amount of time. Once the number of recent impacts per day has been grouped into these datasets, the remote terminal 28 averages the number of recent impacts per day that occurred within each of these datasets to determine the recent average number of impacts over the $6^{th}$ time period.

In step 610, the remote terminal 28 then compares the recent average number of impacts against the $13^{th}$ threshold or the percent change over the baseline average number of impacts threshold. The $13^{th}$ threshold may be set to 95 percentile of historical change based on a specific player's position and playing level. If the recent average number of impacts is not over the $13^{th}$ threshold, then the remote terminal 28 performs no additional steps. However, if the recent average number of impacts is over the $13^{th}$ threshold, then the training opportunity is triggered in step 612. This $5^{th}$ training opportunity informs an authorized user that the specific player is experiencing more impacts than the specific player has previously experienced based on an average of their impact history. Accordingly, the authorized user should review the specific player's form to see what has recently changed with the specific player. For example, did the specific player recently come back from an injury and is now favoring that side, which is causing the specific player to have additional impacts.

Training opportunity algorithm 510 may be used to generate another training opportunity by altering the data the algorithm 510 compares. Instead of comparing a specific player's recent data to the specific player's historical data, the training opportunity algorithm 510 may compare a team's recent data to the team's historical data. The $15^{th}$ training opportunity or the increased number of impacts for team v. team's history training opportunity may be generally determined by comparing a value that is derived from a team's recent recorded impact values with a value that is derived from the team's historical impact values. Specifically, values and data used in this $15^{th}$ training opportunity are described below:

a. Training Opportunity #5 or Increased Number of Impacts for Specific Team v. Team's History
   i. Comparison: specific team's recent number of impacts vs. specific the team's historical number of impacts;
   ii. Data Requirement: (i) number of recent impacts over a $6^{th}$ predefined amount of time for the specific team and (ii) historical number of impacts over the $6^{th}$ predefined amount of time for the specific team;
   iii. $6^{th}$ Predefined Amount of Time or Impact Frequency Time Period: set between 2 days and 90 days, preferably set between 2 days and 30 days, and most preferably set to 7 days;
   iv. $11^{th}$ Threshold or Historical Impact Threshold: set to require at least 2 datasets, preferably at least 5 datasets, and most preferably at least 10 datasets;
   v. $12^{th}$ Threshold or Baseline Impact Threshold: set above 0.1 average number of impacts, preferably above 8 average number of impacts, and most preferably above 15 average number of impacts; and
   vi. $13^{th}$ Threshold or Over Baseline Average Number Of Impacts Threshold: set to 95th percentile of change of teams of similar skill level.

This $15^{th}$ training opportunity uses the same data flow that is described above in connection with the $5^{th}$ training opportunity except for the fact that it utilizes different data sets. This $15^{th}$ training opportunity informs an authorized user that the team is experiencing an increase in impacts in comparison to the team's history. Accordingly, a wholesome review of the specific teams playing style should be review.

Figure 17:
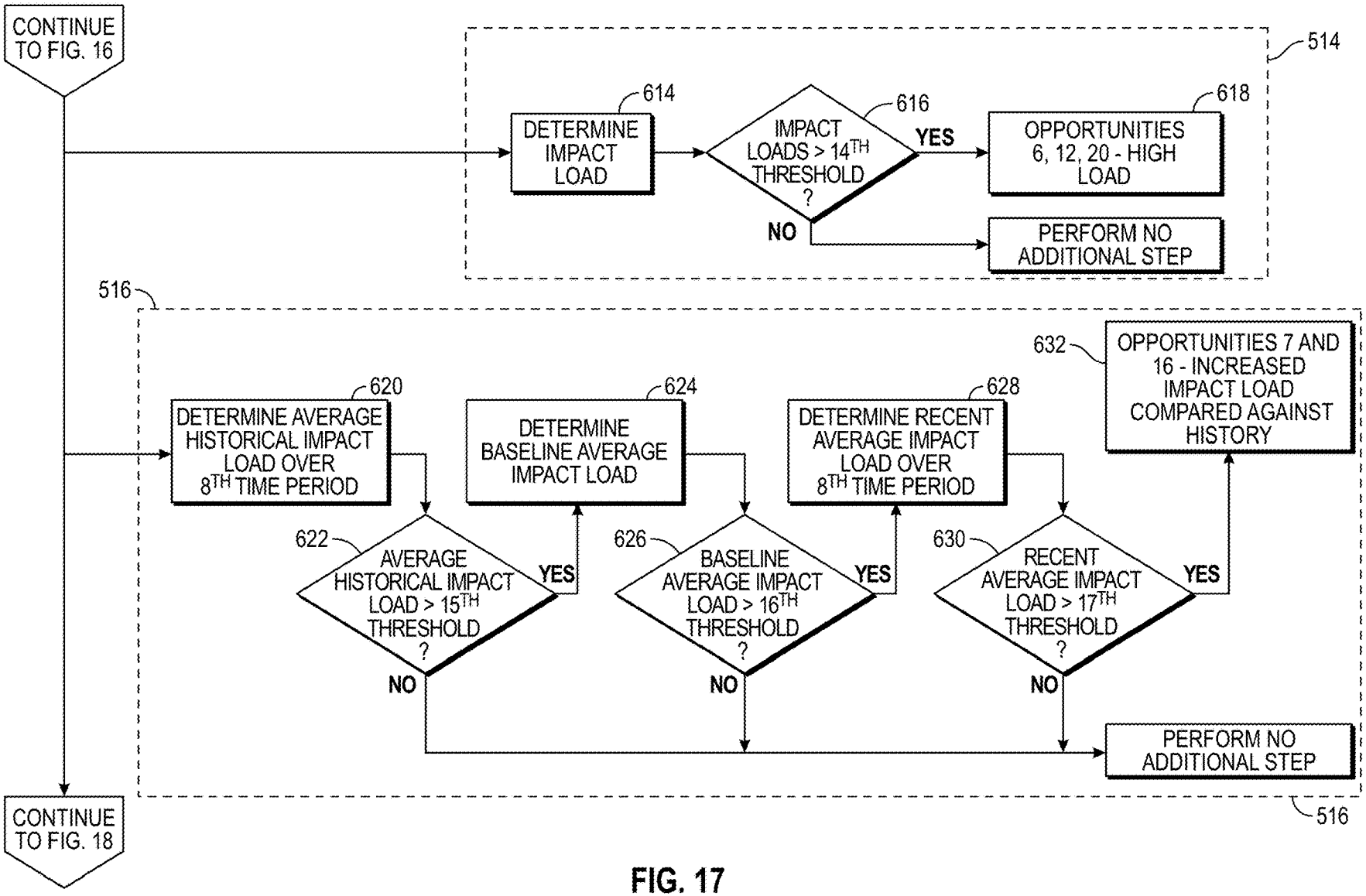
FIG. 17 is a flowchart showing how training opportunities 6, 7, 12, 16, and 20 are determined.

Training opportunity algorithm 514 is shown in FIG. 17 and generally relates to a high impact load. The $6^{th}$ training opportunity or the high impact load for specific player v. nation training opportunity may be generally determined by comparing a value that is derived from a specific player's physiological parameter data with a value that is derived from the national physiological parameter data. In other words, the $6^{th}$ training opportunity may be generally determined by comparing a specific player value derived from data contained within the team database 32 with a value derived from data contained within the national database 38 using algorithm 514. Specifically, values and data used in this $6^{th}$ training opportunity include:

a. Training Opportunity #6 or High Impact Load for Specific Player v. National Player
   i. Comparison: specific player's impact load vs. historical impact load experienced by similarly situated players in terms of playing level and/or position;
   ii. Data Requirement: (i) impact load over a $7^{th}$ predefined amount of time for the specific player and (ii) impact load over the $7^{th}$ predefined amount of time for similarly situated players in terms of playing level and/or position;
   iii. $7^{th}$ Predefined Amount of Time or Impact Load Time Period: set to any amount of time, preferably set between 2 days and 90 days, and most preferably set to 7 days; and iv. $14^{th}$ Threshold or Impact Load Threshold: set to the $95^{th}$ percentile of the impact load that has historically occurred over the $7^{th}$ predefined amount of time for similarly situated players in terms of playing level and/or position.

Specifically, the remote terminal 28 performs the steps described in algorithm 514. First, in step 614, the remote terminal 28 sums up the total load the specific player experienced over a $7^{th}$ predefined time period or an impact load time period. The $7^{th}$ predefined time period may be set to any amount of time, preferably set between 2 days and 90 days, and most preferably set to 7 days. Specifically, this is done by adding together every impact matrix contained within the $7^{th}$ predefined time period to generate a summed impact load matrix. An example of how matrixes can be added together is shown in FIG. 21. Once all impact matrixes are added together over the $7^{th}$ predefined time period, each entry in the summed impact load matrix is weighted by a severity value. This severity value is based on the severity of the impact grouping contained within the impact matrix (e.g., $1^{st}$, $2^{nd}$, $3^{rd}$, $4^{th}$ or $5^{th}$ severity), as described above in connection with FIG. 12. Once each entry contained within the summed impact load matrix is weighted by a severity value, the remote terminal 28 added each of the entries together to determine the total impact load. For example, the total impact load for the bottom matrix shown in FIG. 21 would be equal to 35 (i.e., ((2 impacts)*(1 severity weight))+((4 impacts)*(2 severity weight))+((3 impacts)*(3 severity weight))+((4 impact)*(4 severity weight)). It should be understood that different severity weights may be used.

Once the remote terminal 28 has determined the total impact load experienced by the specific player over the impact load time period in step 614, this total impact load is compared with a $14^{th}$ threshold or impact load threshold in step 616. The impact load threshold may be set to the $95^{th}$ percentile of the load that has historically been experienced over the impact load time period for similarly situated players in terms of playing level and/or position. If the total impact load experienced by the specific player over the impact load time period is less than impact load threshold, then the remote terminal 28 performs no additional steps. However, if the total impact load experienced by the specific player over the impact load time period is greater than the impact load threshold, then the 6th training opportunity is triggered in step 618. This 6th training opportunity informs an authorized user that the specific player is experiencing a higher impact load than other similarly situated players in terms of playing level and/or position.

As described above, training opportunity algorithm 514 may be used to generate another training opportunity by altering the data the algorithm 514 compares. Instead of comparing a specific player's data to national data, the training opportunity algorithm 514 may compare a specific player's data to team data. The $12^{th}$ training opportunity or the high impact load for specific player v. team training opportunity may be generally determined by comparing a value that is derived from a specific player's physiological parameter data with a value that is derived from the team's physiological parameter data. In other words, the $12^{th}$ training opportunity may be generally determined by comparing a specific player value derived from data contained within the team database 32 with a team value derived from data contained within the team database 32 using algorithm 514. Specifically, values and data used in this $12^{th}$ training opportunity include:

a. Training Opportunity #12 or High Impact Load for Specific Player v. Team
   i. Comparison: specific player's impact load vs. historical impact load experienced by teammates that play similar positions;
   ii. Data Requirement: (i) impact load over a $7^{th}$ predefined amount of time for the specific player and (ii) impact load over the $7^{th}$ predefined amount of time for teammates that play similar positions;
   iii. $7^{th}$ Predefined Amount of Time or Impact Load Period: set to any amount of time, preferably set between 2 days and 90 days, and most preferably set to 7 days; and
   iv. $14^{th}$ Threshold or Impact Load Threshold: set to the $95^{th}$ percentile of the impact load that has historically occurred over the $7^{th}$ predefined amount of time for teammates that play similar positions.

This $14^{th}$ training opportunity uses the same data flow that is described above in connection with the $6^{th}$ training opportunity, except for the fact that it utilizes different data sets. This $14^{th}$ training opportunity informs an authorized user that the specific player is carrying a high impact load than other team players that play similar positions.

Training opportunity algorithm 514 may also be used to generate another training opportunity by altering the data the algorithm 514 compares. Instead of comparing a specific player's data to national data, the training opportunity algorithm 514 compares a team's data to national data. The $20^{th}$ training opportunity or the high impact load for team v. national training opportunity may be generally determined by comparing a value that is derived from a team's physiological parameter data with a value that is derived from national physiological parameter data. In other words, the $20^{th}$ training opportunity may be generally determined by comparing a team value derived from data contained within the team database 32 with a value derived from data contained within the national database 38 using algorithm 504. Specifically, values and data used in this $20^{th}$ training opportunity include:

a. Training Opportunity #20 or High Impact Load for Specific Team v. National Team
   i. Comparison: specific team's impact load vs. historical impact load for teams of similar playing level;
   ii. Data Requirement: (i) impact load over a $7^{th}$ predefined amount of time for the teams and (ii) impact load over the $7^{th}$ predefined amount of time for all teams of similar playing level;
   iii. $7^{th}$ Predefined Amount of Time or Impact Load Time Period: set to any amount of time, preferably set between 2 days and 90 days, and most preferably set to 7 days; and
   iv. $14^{th}$ Threshold or Impact Load Threshold: set to the $95^{th}$ percentile of the impact load that has historically occurred over the $7^{th}$ predefined amount of time for teams of similar playing level.

This $21^{st}$ training opportunity uses the same data flow that is described above in connection with the $6^{th}$ training opportunity, except for the fact that it utilizes different data sets. This $21^{st}$ training opportunity informs an authorized user that the team is experiencing more impacts than other teams that play at a similar level. Accordingly, a wholesome review of the specific teams playing style should be reviewed.

Training opportunity algorithm 516 is shown in FIG. 17 and generally relates to an increase in the impact load. The $7^{th}$ training opportunity or the increased impact load for specific player v. specific player's history training opportunity may be generally determined by comparing a value that is derived from a specific player's recently recorded physiological parameter data with a value that is derived from a specific player's historical recorded physiological parameter data. In other words, the $7^{th}$ training opportunity may be generally determined by comparing a specific player value derived from data contained within the team database 32 with a team value derived from data contained within the team database 32 using algorithm 516. Specifically, values and data used in this $7^{th}$ training opportunity include:

a. Training Opportunity #7 or Increased Impact Load for Specific Player v. Specific Player's History
   i. Comparison: specific player's recent impact load vs. specific player's historical impact load;
   ii. Data Requirement: (i) recent impact load over $8^{th}$ predefined amount of time for the specific player and (ii) historical impact load over the $8^{th}$ predefined amount of time for the specific player;
   iii. $8^{th}$ Predefined Amount of Time or Load Frequency Time Period: set between 2 days and 90 days, preferably set between 2 days and 30 days, and most preferably set to 7 days;
   iv. $15^{th}$ Threshold or Historical Load Threshold: set to require at least 2 datasets, preferably at least 5 datasets, and most preferably at least 10 datasets;
   v. $16^{th}$ Threshold or Baseline Load Threshold: set above 0.1 average number of impacts, preferably above 8 average number of impacts, and most preferably above 15 average number of impacts; and
   vi. $17^{th}$ Threshold or Over Baseline Average Load Threshold: set to 95th percentile of change of players of similar skill level.

Specifically, the remote terminal 28 performs the steps described in algorithm 516. Also, FIG. 24 provides an example of how the specific player's physiological parameter data may be analyzed by algorithm 516. First, in step 620, the remote terminal 28 determines the average historical load over each $8^{th}$ predefined time period or load frequency time period contained within the specific player's physiological parameter data. Specifically, this is done by adding together every impact matrix contained within one day to generate a historical summed daily load matrix. An example of how matrixes can be added together is shown in FIG. 21. Once all impact matrixes are added together for one day, each entry in the historical summed daily impact load matrix is weighted by a severity value. This severity value is based on the severity of the impact grouping contained within the impact matrix (e.g., $1^{st}$, $2^{nd}$, $3^{rd}$, $4^{th}$ or $5^{th}$ severity), as described above in connection with FIG. 12. Once each entry contained within the historical summed daily impact load matrix is weighted by a severity value, the remote terminal 28 adds each of the entries together to generate a historical daily load. For example, the daily load for the bottom matrix shown in FIG. 21 would be equal to 35 (i.e., ((2 impacts)*(1 severity weight))+((4 impacts)*(2 severity weight))+((3 impacts)*(3 severity weight))+((4 impact)*(4 severity weight)). Then, the remote terminal 28 groups the historical daily loads into datasets based on the date they occurred, wherein the dataset boundaries are defined by the $8^{th}$ predefined amount of time. The $8^{th}$ predefined amount of time is set between 2 days and 90 days, preferably set between 2 days and 30 days, and most preferably set to 7 days. Once the historical daily loads have been grouped into these datasets, the remote terminal 28 averages the historical daily loads that occurred within each of these datasets to determine the average historical impact load over the $8^{th}$ time period.

Next, in step 622, the remote terminal 28 determines if the specific player's physiological parameter data contains enough data to perform the calculations involved with this training opportunity. This helps ensure that this training opportunity is not unnecessarily suggested when there is not enough data for this training opportunity to be accurately presented to the authorized user. The $15^{th}$ threshold or historical impact load threshold may be set to require at least 2 datasets, preferably at least 5 datasets, and most preferably at least 10 datasets. If the specific player has not played long enough to record data over the required historical impact load threshold, then the remote terminal 28 performs no additional steps. However, if the specific player has recorded data over the required historical impact load threshold, then, in step 624, the remote terminal 28 determines the baseline average impact load for the specific player.

Next, in step 626, the remote terminal 28 compares the baseline average impact load to a $16^{th}$ threshold or a baseline impact load threshold. The $16^{th}$ threshold may be set above 0.1 average impact load, preferably above 8 average impact load, and most preferably above 15 average impact load. If the specific player's baseline average impact load is not over the baseline impact load threshold, then the remote terminal 28 performs no additional sets. However, if the specific player's baseline average impact load is over the baseline impact load threshold, then, in step 628, the remote terminal 28 determines the recent average impact load. Specifically, this is done by adding together every impact matrix contained within one day to generate a recent summed daily load matrix. An example of how matrixes can be added together is shown in FIG. 21. Once all recent impact matrixes are added together for one day, each entry in the recent summed daily impact load matrix is weighted by a severity value. Once each entry contained within the recent summed daily impact load matrix is weighted by a severity value, the remote terminal 28 adds each of the entries together to generate a recent daily load. For example, the daily load for the bottom matrix shown in FIG. 21 would be equal to 35 (i.e., ((2 impacts)*(1 severity weight))+((4 impacts)*(2 severity weight))+((3 impacts)*(3 severity weight))+((4 impact)*(4 severity weight))). Then, the remote terminal 28 groups the recent daily loads into datasets based on the date they occurred, wherein the dataset boundaries are defined by the $8^{th}$ predefined amount of time. Once the recent daily loads have been grouped into these datasets, the remote terminal 28 averages the recent daily loads that occurred within each of these datasets to determine the average recent impact load over the $8^{1}$ time period.

In step 630, the remote terminal 28 then compares the recent average impact load against the $17^{th}$ threshold or the percent change over the baseline average impact load threshold in step 630. The $17^{th}$ threshold may be set to the $95^{th}$ percentile of historical change based on a specific player's position and playing level. If the recent average impact load is not over the $17^{th}$ threshold, then the remote terminal 28 performs no additional steps. However, if the recent average impact load is over the $17^{th}$ threshold, then the training opportunity is triggered in step 632. This $7^{th}$ training opportunity informs an authorized user that the specific player has a higher impact load than the specific player has previously experienced based on an average of their impact history. Accordingly, the authorized user should review the specific player's form to see what has recently changed with the specific player. For example, did the specific player recently come back from an injury and is now favoring that side, which is causing the specific player to carry additional impact load.

Training opportunity algorithm 516 may be used to generate another training opportunity by altering the data the algorithm 516 compares. Instead of comparing a specific player's recent data to the specific player's historical data, the training opportunity algorithm 516 may compare a team's recent data to the team's historical data. The $16^{th}$ training opportunity or the increased impact load for team v. team's history training opportunity may be generally determined by comparing a value that is derived from a team's recent recorded impact values with a value that is derived from the team's historical impact values. Specifically, values and data used in this $15^{th}$ training opportunity are described below:

a. Training Opportunity #16 or Increased Impact Load for Specific Team v. Team's History
   i. Comparison: team's recent impact load vs. team's historical impact load;
   ii. Data Requirement: (i) recent impact load over an $8^{th}$ predefined amount of time for the team and (ii) historical impact load over the $8^{th}$ predefined amount of time for the team;
   iii. $8^{th}$ Predefined Amount of Time or Load Frequency Time Period: set between 2 days and 90 days, preferably set between 2 days and 30 days, and most preferably set to 7 days;
   iv. $15^{th}$ Threshold or Historical Load Threshold: set to require at least 2 datasets, preferably at least 5 datasets, and most preferably at least 10 datasets;
   v. $16^{th}$ Threshold or Baseline Load Threshold: set above 0.1 average number of impacts, preferably above 8 average number of impacts, and most preferably above 15 average number of impacts; and
   vi. $17^{th}$ Threshold or Over Baseline Average Load Threshold: set to 95th percentile of change of teams of similar skill level.

This $16^{th}$ training opportunity uses the same data flow that is described above in connection with the $7^{th}$ training opportunity except for the fact that it utilizes different data sets. This $16^{th}$ training opportunity informs an authorized user that the team is experiencing an increased impact load in comparison to the team's history. Accordingly, a wholesome review of the teams playing style should be reviewed.

Figure 18:
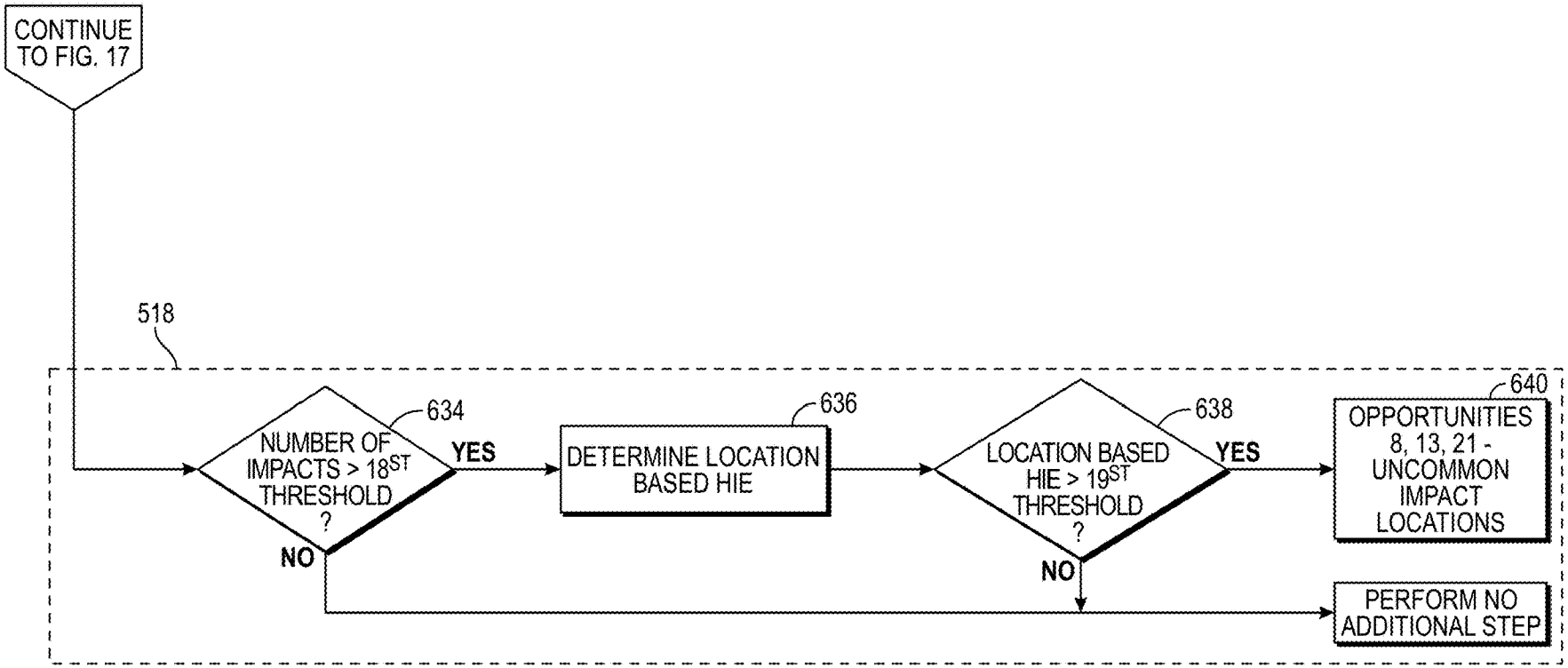
FIG. 18 is a flowchart showing how training opportunities 8, 13, and 21 are determined.

Training opportunity algorithm 518 is shown in FIG. 18 and generally relates to uncommon impact locations. The $8^{th}$ training opportunity or the uncommon impact locations for specific player v. nation training opportunity may be generally determined by comparing a value that is derived from a specific player's physiological parameter data with a value that is derived from the national physiological parameter data. In other words, the $8^{1}$ training opportunity may be generally determined by comparing a specific player value derived from data contained within the team database 32 with a value derived from data contained within the national database 38 using algorithm 518. Specifically, values and data used in this $8^{th}$ training opportunity include:

a. Training Opportunity #8 or Uncommon Impact Location for Specific Player v. National Player
   i. Comparison: location of impacts experienced by a specific player vs. historical location of impact experienced by similarly situated players in terms of playing level and/or position;
   ii. Data Requirement: (i) impact matrix determined over a $9^{th}$ predefined amount of time for the specific player and (ii) impact matrix determined over the $9^{th}$ predefined amount of time for similarly situated players in terms of playing level and/or position;
   iii. $9^{th}$ Predefined Amount of Time or Location Time Period: set to any amount of time, preferably set between 2 days and 90 days, and most preferably set to 7 days;
   iv. $18^{th}$ Threshold or Minimum Number of Impacts for Location Analysis: set to require at least 1 impact, preferably at least 10 impacts, and most preferably at least 15 impacts; and
   v. $19^{th}$ Threshold or Location Threshold: set to the $95^{th}$ percentile of the chi-squared value based on impact matrixes that have historically occurred over the $9^{th}$ predefined amount of time for similarly situated players in terms of playing level and/or position.

Specifically, the remote terminal 28 performs the steps described in algorithm 518. First, in step 634, the remote terminal 28 determines if the specific player's physiological parameter data contains enough impact data to perform the calculations involved with this training opportunity. This helps ensure that this training opportunity is not unnecessarily suggested when there is not enough data for this training opportunity to be accurately presented to the authorized user. The $18^{th}$ threshold or a minimum number of impacts for location analysis threshold may be set to require at least 1 impact, preferably at least 10 impacts, and most preferably at least 15 impacts. If the specific player has not played long enough to record data over the required minimum number of impacts for location analysis threshold, then the remote terminal 28 performs no additional steps. However, if the specific player has recorded data over the required minimum number of impacts for location analysis threshold, then, in step 636, the remote terminal 28 determines the summed location impact matrix over the $9^{th}$ predefined amount of time or location time period. The $9^{th}$ predefined amount of time may be set between 2 days and 90 days, and most preferably set to 7 days. Specifically, this is done by adding together every impact matrix contained within the $9^{th}$ predefined time period to generate a summed location impact matrix. An example of how matrixes can be added together is shown in FIG. 21. Once all impact matrixes are added together over the $9^{th}$ predefined time period, the entries for each impact location (e.g., front, back, left, right, top) are summed together in step 636. For example, in FIG. 25A, $P_F=P_{F1}+P_{F2}+P_{F3}+P_{F4}+P_{F5}$.

Once the remote terminal 28 has determined the summed location impact matrix experienced by the specific player over the impact load time period in step 636, this number is compared with a $19^{th}$ threshold or location threshold in step 638. The location threshold may be set to the $95^{th}$ percentile of the chi-squared value based on impact matrixes that have historically occurred over the $9^{th}$ predefined amount of time for similarly situated players in terms of playing level and/or position. Specifically, the table is shown in FIG. 25B shows an exemplary summed location impact matrix for the nation. This exemplary summed location impact matrix for the nation is then compared against the summed location impact matrix experienced by the specific player using the formula shown in FIG. 25C to calculate an estimated Chi-Squared. The estimated Chi-Squared determined from the equation shown in FIG. 25C is compared against the value from the Chi-Squared table shown in FIG. 25E. In particular, for this equation the degrees of freedom are set to 1-number of elements (i.e., 4) and the convenience level is set to the $95^{th}$ percentile. Tracing that these values across the rows and columns in FIG. 25E, the Chi-Squared value is 0.711. Thus, if the estimated Chi-Squared value calculated using the equation in FIG. 25C is greater than 0.711, then the $8^{th}$ training opportunity is triggered in step 640. However, if the estimated Chi-Squared value calculated using the equation in FIG. 25C is less than 0.711, then remote terminal 28 performs no additional steps.

As described above, training opportunity algorithm 518 may be used to generate another training opportunity by altering the data the algorithm 518 compares. Instead of comparing a specific player's data to national data, the training opportunity algorithm 518 may compare a specific player's data to team data. The $13^{th}$ training opportunity or the uncommon impact location for specific player v. team training opportunity may be generally determined by comparing a value that is derived from a specific player's physiological parameter data with a value that is derived from the team's physiological parameter data. In other words, the $13^{th}$ training opportunity may be generally determined by comparing a specific player value derived from data contained within the team database 32 with a team value derived from data contained within the team database 32 using algorithm 518. Specifically, values and data used in this $13^{th}$ training opportunity include:

a. Training Opportunity #13 or Uncommon Impact Location for Specific Player v. Team
   i. Comparison: location of impacts experienced by a specific player vs. historical location of impact experienced by teammates that play similar positions;
   ii. Data Requirement: (i) impact matrix determined over a $9^{th}$ predefined amount of time for the specific player and (ii) impact matrix determined over the $9^{th}$ predefined amount of time for teammates that play similar positions;
   iii. $9^{th}$ Predefined Amount of Time or Location Time Period: set to any amount of time, preferably set between 2 days and 90 days, and most preferably set to 7 days;
   iv. $18^{th}$ Threshold or Minimum Number of Impacts for Location Analysis: set to require at least 1 impact, preferably at least 10 impacts, and most preferably at least 15 impacts; and
   v. $19^{th}$ Threshold or Location Threshold: set to the $95^{th}$ percentile of the chi-squared value based on impact matrixes that have historically occurred over the $9^{th}$ predefined amount of time for teammates that play similar positions.

This $13^{th}$ training opportunity uses the same data flow that is described above in connection with the $8^{th}$ training opportunity, except for the fact that it utilizes different data sets. This $13^{th}$ training opportunity informs an authorized user that the specific player has experienced impacts in uncommon locations when compared to other team players that play similar positions.

Training opportunity algorithm 518 may be used to generate another training opportunity by altering the data the algorithm 518 compares. Instead of comparing a specific player's data to national data, the training opportunity algorithm 518 compares a team's data to national data. The $21^{st}$ training opportunity or the uncommon impact location for team v. national training opportunity may be generally determined by comparing a value that is derived from a team's physiological parameter data with a value that is derived from national physiological parameter data. In other words, the $21^{st}$ training opportunity may be generally determined by comparing a team value derived from data contained within the team database 32 with a value derived from data contained within the national database 38 using algorithm 518. Specifically, values and data used in this $21^{st}$ training opportunity include:

a. Training Opportunity #21 or Uncommon Impact Location for Specific Team v. National Team
   i. Comparison: location of impacts experienced by a team vs. historical location of impact experienced by all teams of similar playing level;
   ii. Data Requirement: (i) impact matrix determined over a $9^{th}$ predefined amount of time for the teams and (ii) impact matrix determined over the $9^{th}$ predefined amount of time for all teams of similar playing;
   iii. $9^{th}$ Predefined Amount of Time or Location Time Period: set to any amount of time, preferably set between 2 days and 90 days, and most preferably set to 7 days;
   iv. $18^{th}$ Threshold or Minimum Number of Impacts for Location Analysis: set to require at least 1 impact, preferably at least 10 impacts, and most preferably at least 15 impacts; and
   v. $19^{th}$ Threshold or Location Threshold: set to the $95^{th}$ percentile of the chi-squared value based on impact matrixes that have historically occurred over the $9^{th}$ predefined amount of time for teams of similar playing level.

This $21^{st}$ training opportunity uses the same data flow that is described above in connection with the $8^{th}$ training opportunity, except for the fact that it utilizes different data sets. This $21^{st}$ training opportunity informs an authorized user that the specific team is experiencing impacts in uncommon locations when compared to other teams that play at a similar level. Accordingly, a wholesome review of the specific teams playing style should be reviewed.

It should be understood that the system 10 may include only some of the above described algorithms or it may contain additional algorithms that were no discussed above. For example, the system 10 may include training opportunities that are based on one or more tools/approaches: (i) Bayes Theorem, (ii) standard t-tests or ANOVA, (iii) changes in kurtosis, (iv) Kruskal Wallis non-parametric distribution testing, (v) machine learning using various neural network topologies including RNN and LSTM, (vi) pattern detection using Support Vector Machines (SVM), (vii) principal component Analysis (PCA), (viii) Independent Component Analysis (ICA), (ix) clustering approaches including k-nearest neighbor or (x) other similar techniques.

3. Updating the Threshold Values

As described above, each training opportunity is determined by the system 10 based on comparing datasets to one another using various algorithms. Each of these algorithms contains at least one threshold value (e.g., $1^{st}$ threshold-$19^{th}$ threshold) and some of these algorithms contain predefined amounts of time (e.g., $1^{st}$ predefined amount of time-$9^{th}$ predefined amount of time). These threshold values and the predefined amounts of time can be updated by the system administrator. Specifically, the system administrator could update these values by pushing an update to the individual remote terminals 28 of the system 10. Alternatively, if all of the calculations are remotely performed within a cloud server, then the system administrator can update the values within that server.

Alternatively, the system 10 may utilize self-updating threshold values in connection with certain algorithms. These self-updating threshold values are different than the threshold values that can be manually updated (e.g., the threshold values and predefined amounts of time) because they do not require human (e.g., system administrator)

intervention. These self-updating thresholds provide a significant advantage over conventional systems because it allows the system 10 to adapt to how the activity is currently being played. For example, changes to the rules of the activity and/or improvements in the protective equipment worn by players may significantly affect what a player experiences (e.g., impacts) during the activity. These significant alterations in what the specific player experiences (e.g., impacts) may alter the physiological parameter data (e.g., magnitude of impacts) that is recorded from these activities. Specifically, football helmets that were recently developed are testing over 20% better on the NFL's Helmet Laboratory Testing in comparison to football helmets that were developed fifteen years earlier. Without using self-updating threshold values, some of the above described training opportunities may not be accurately monitored and triggered and thus are not useful for the authorized user. Additionally, self-updating thresholds allow the system 10 to selectively tailor the amount of data that is the system 10 monitors and process in connection with each algorithm. Specifically, tailoring of the amount of data that is processed is accomplished by selecting narrower threshold values or broader threshold values. This selective balancing reduces processing requirements, increases efficiencies, decreases battery/power consumption, and provides other likely benefits to the system 10.

In certain embodiments, the following threshold values can be self-updating: (i) $2^{nd}$ threshold or high magnitude impact threshold, (ii) $3^{rd}$ threshold or single impact alert threshold, (iii) $4^{th}$ threshold or a cumulative impact alert threshold, (iv) $5^{th}$ threshold or number of alertable impacts threshold, (v) $6^{th}$ threshold or number of high magnitude impacts threshold, (vi) $10^{th}$ threshold or number of impacts threshold, (vii) $13^{th}$ threshold or over baseline average number of impacts threshold, (viii) $14^{th}$ threshold or impact load threshold, (ix) $17^{th}$ threshold or over baseline average load threshold and (x) $19^{th}$ threshold or location threshold. Specifically, FIG. 19 shows one example of how these self-updating threshold values can be updated or recalculated using algorithm 700. The system 10 reviews when the current self-updating threshold value was last updated in step 702. If a $10^{th}$ predetermined amount of time has passed since this value was last updated, then the system 10 will recalculate the self-updating threshold values based on all data contained within the databases (e.g., team database 32 and national database 38), which is associated with the self-updating threshold value that is being recalculated in step 704. For example, the data set that is used to calculate the self-updating threshold value may contain 10,000 impacts before the expiration of the $10^{th}$ predetermined amount of time and may have 20,000 impacts after the expiration of the $10^{th}$ predetermined amount of time. It should be understood that the $10^{th}$ predefined time period may be greater than 1 day and preferably greater than 1 week. Additionally, the $10^{th}$ predefined time period may be set to different lengths of time for each self-updating threshold value. If the $10^{th}$ predetermined amount of time has not passed since this value was last updated or the recalculated self-updating threshold values are not different than the current self-updating threshold values, then the system 10 will perform no additional steps and the current self-updating threshold values will be kept. However, if one of the self-updating threshold value is different in step 706, then the system 10 automatically replaces the current self-updating threshold value with the recalculated self-updating threshold value in step 708. These recalculated self-updating threshold values are then downloaded by the remote terminals 28. It should be understood that all threshold values may not be updated at the same time. Alternatively, if all of the calculations are remotely performed within a cloud server, then the system 10 can update the self-updating threshold values within that server.

In addition to the above described steps, an alternative embodiment may perform an additional step to ensure that the self-updating threshold values are not being replaced too frequently. To help ensure this, the self-updating threshold values are only replaced if they are significantly different than the current self-updating threshold value. Significantly different in this context may mean where the recalculated self-updating threshold value is greater than 5% different than the current self-updating threshold value. Alternatively, significantly different could mean where the recalculated self-updating threshold value is greater than 15% different than the current self-updating threshold value.

Instead of calculating the self-updating threshold values from all data contained within the databases (e.g., team database 32 and national database 38) that is associated with the self-updating threshold value, the self-updating threshold values may be calculated based on a subset of data contained within the databases (e.g., team database 32 and national database 38) that is associated with the self-updating threshold value. Specifically, in this alternative exemplary embodiment, the self-updating threshold values may be calculated based on a weighting of all relevant data. To determine the weighted self-updating threshold values, all relevant data is weighted by a decaying factor. For example, data recorded 5 years ago may be multiplied by 0.5 decaying factor, thereby reducing the value of this data. It should be understood that certain data will be excluded from this calculation because is old enough to cause its weighting value to be zero due to the decaying factor. For example, if the decaying factor for data that is over 10 years old is 0; then regardless of the value of the data, this data is irrelevant to this calculation and will not be included within this calculation. One skilled in the art recognizes that weighting variables (e.g., time window and decay function) are adjustable. Calculating the self-updating threshold values in the manner described within this alternative embodiment may be beneficial because it excludes data that may be skewing the self-updating threshold values. For example, data that was recorded prior to significant rule changes and/or significant improvements in protective equipment.

Instead of calculating the self-updating threshold values using a weighted average, the system 10 may calculate the self-updating threshold values by simply excluding relevant data from the calculation that occurred before a predetermined amount of time. For example, relevant data that was collected over 15 years ago may be excluded. As described above, calculating the self-updating threshold values in this manner may be beneficial because it excludes data that may be skewing the self-updating threshold values. In a further embodiment, the self-updating threshold values may be calculated using a combination of the above techniques or methods.

i. GUI

Figure 26:
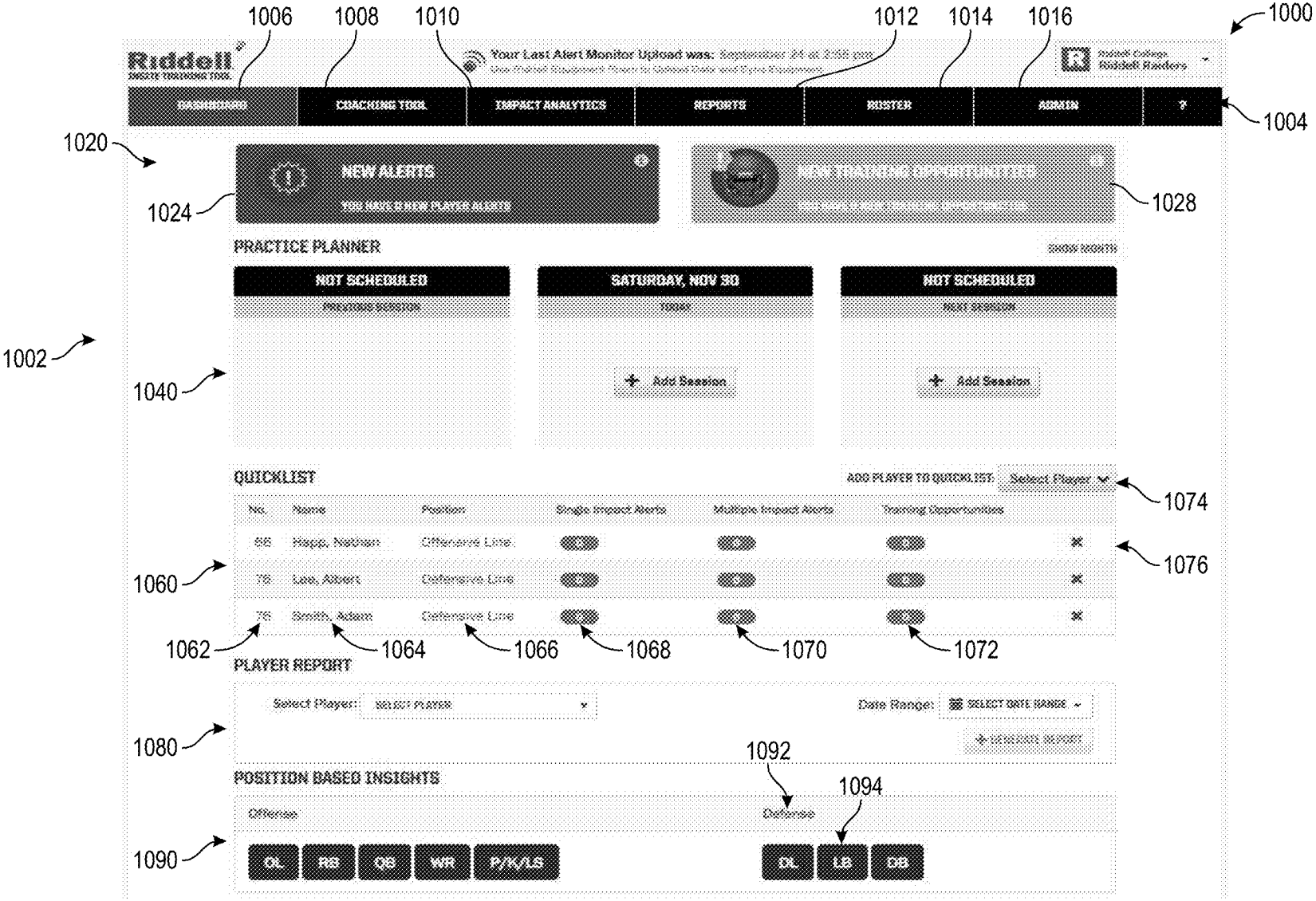
FIG. 26 shows a landing page of the GUI, which can be shown on the display contained within the multi-faceted system.

Below is a high level description of the user interface that may be shown on the display 28*a* of the remote terminal 28 to inform the user of the training opportunities, other information based on the recorded physiological parameter data and/or other information that has been determined by the system 10 or information that the system 10 obtained from another source. The remote terminal 28 may also peripheral devices 28*b* that allow the authorized user to interact with the GUI 1000. FIG. 26 illustrates a first screen of a GUI 1000 of the system 10 that may be shown to the authorized user on the display 28*a* of the remote terminal 28 or a device that is combined with the remote terminal 28 (e.g. device shown in FIGS. 3 and 6). Specifically, the screen is shown in FIG. 26 is a dashboard 1002 that is the landing page that is displayed after the authorized user logs into the system 10. The dashboard 1002 includes a row of buttons 1004 on the top of the screen, wherein these buttons include a dashboard button 1006, coaching tool button 1008, impact analysis button 1010, reports button 1012, team setup button 1014, and an administrator button 1016. The authorized user can utilize the peripheral devices 28*b* to navigate to other sections/tool contained within the GUI 1000 using buttons 1004. To indicate which screen the user is currently viewing, one of the buttons 1006-1016 in the row of buttons 1004 is identified (e.g., illuminated in a different color). For example, FIG. 26 shows the dashboard button 1006 in a different color than the rest of the buttons 1008-1016 contained within the row of buttons 1004. Setting aside the row of buttons 1004 that is displayed on every screen of the GUI 1000, the dashboard 1002 page specifically includes user notifications 1020 (e.g., new alerts 1024 and new training opportunities 1028), practice planner 1040, a quick list that includes a list of players 1060, a player report 1080, and position-based insights 1090.

Figure 41:
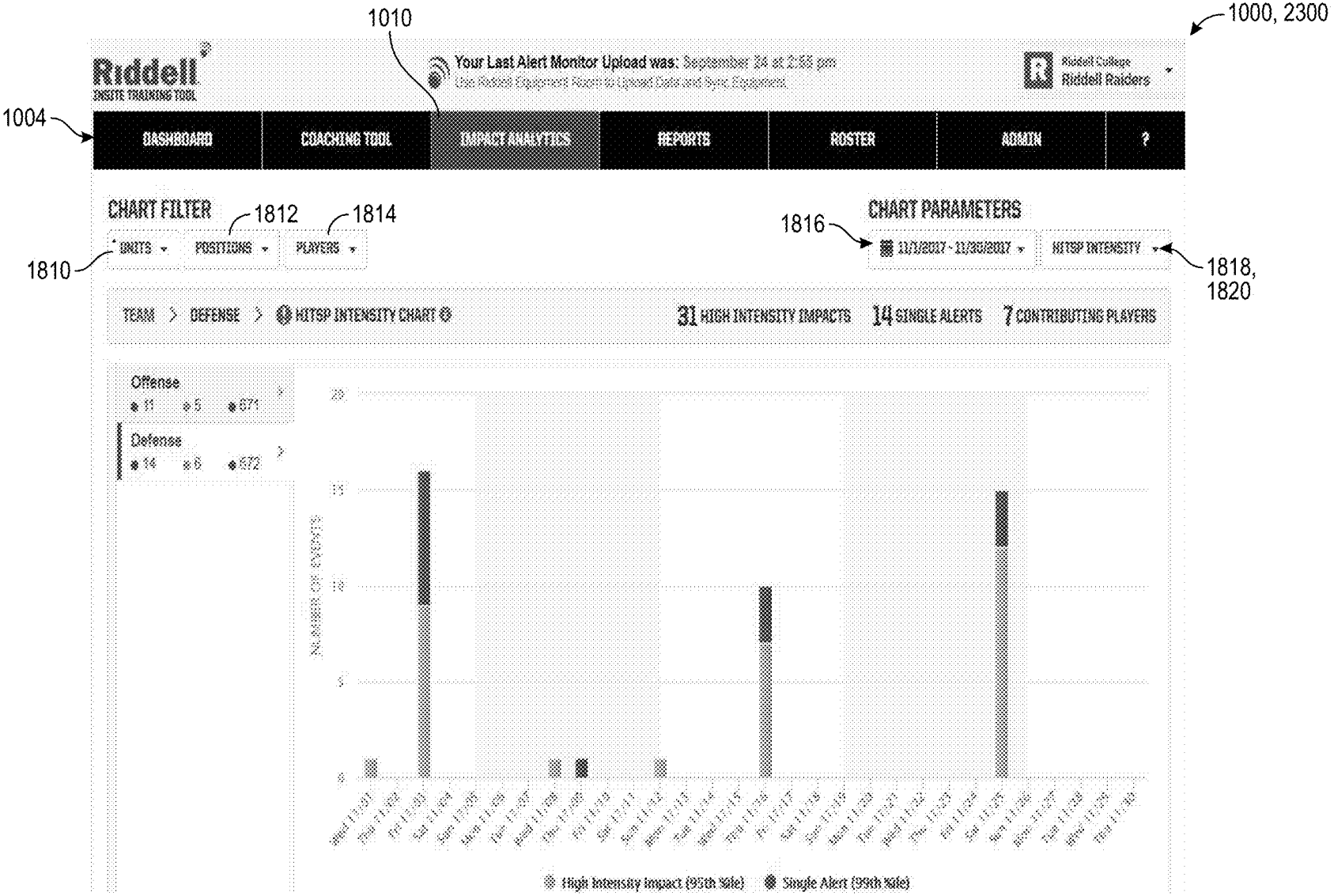
FIG. 41 illustrates a replacement first section of the first screen contained within the impact analytics tool of the GUI, which includes a HITsp load chart for a selected unit (i.e., defense) of the team.
Figure 42:
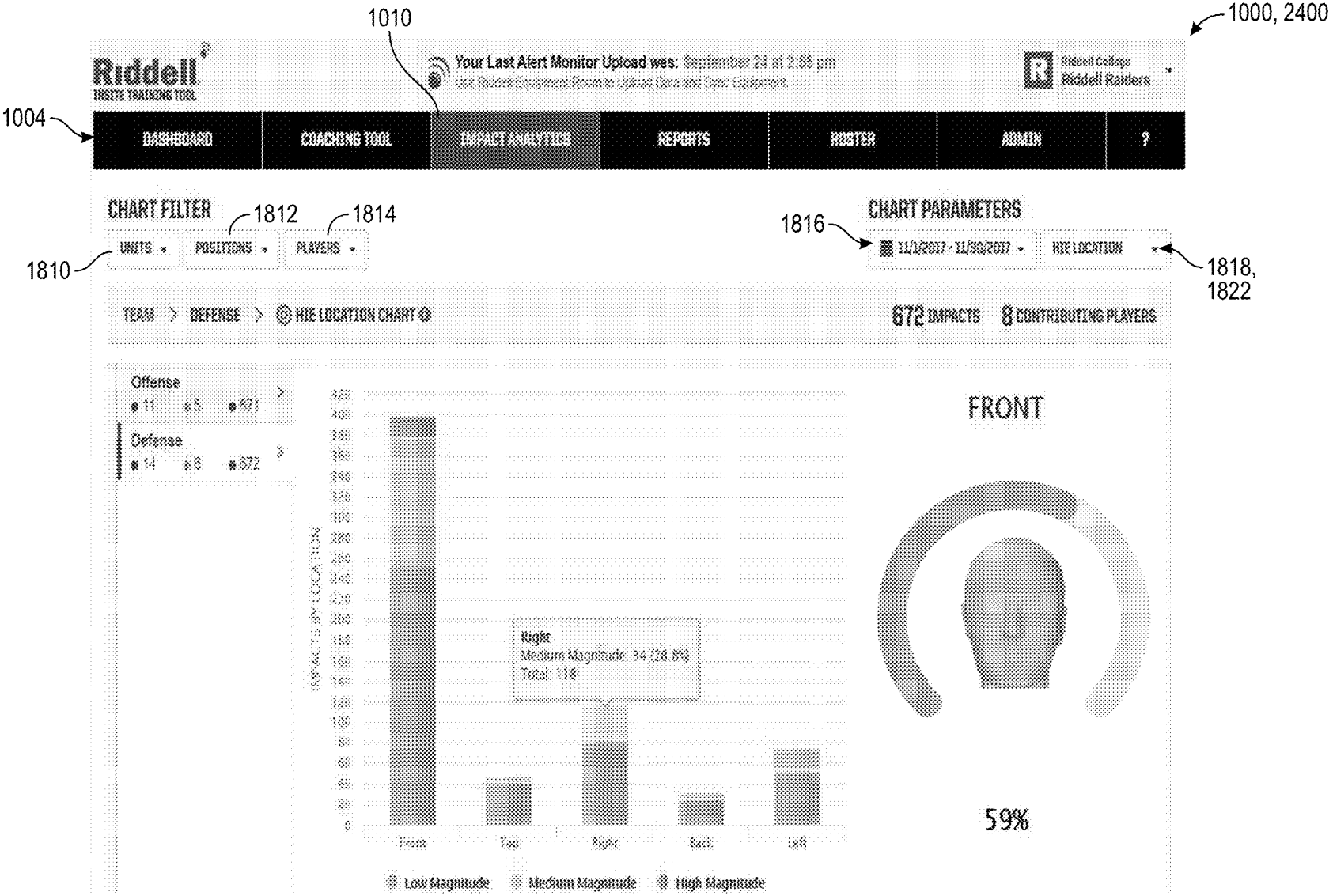
FIG. 42 illustrates a replacement first section of the first screen contained within the impact analytics tool of the GUI, which includes an HIE location chart for a selected unit (i.e., offense) of the team.
Figure 43:
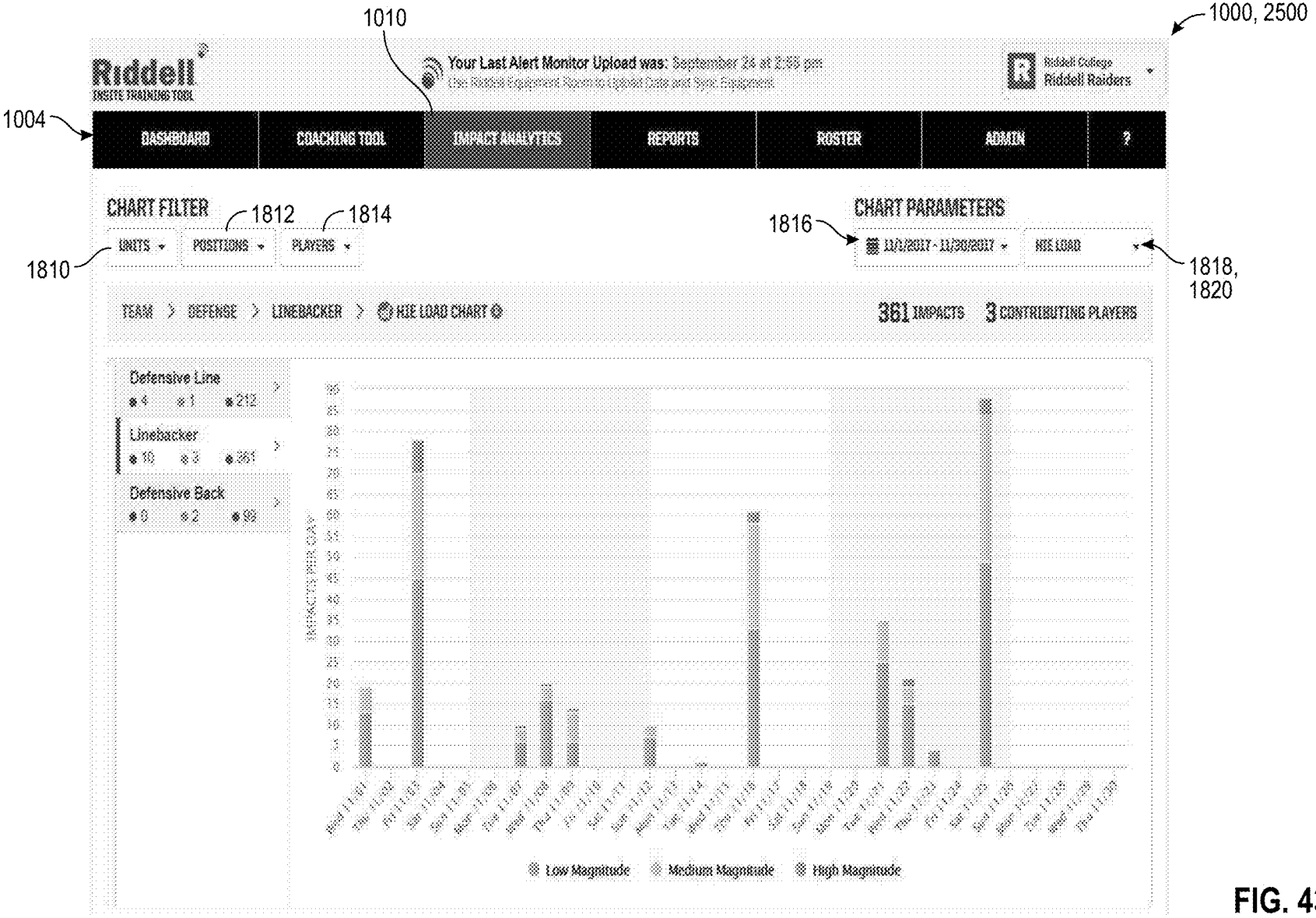
FIG. 43 illustrates a replacement first section of the first screen contained within the impact analytics tool of the GUI, which includes an HIE load chart for a selected player position (i.e., linebacker)
Figure 44:
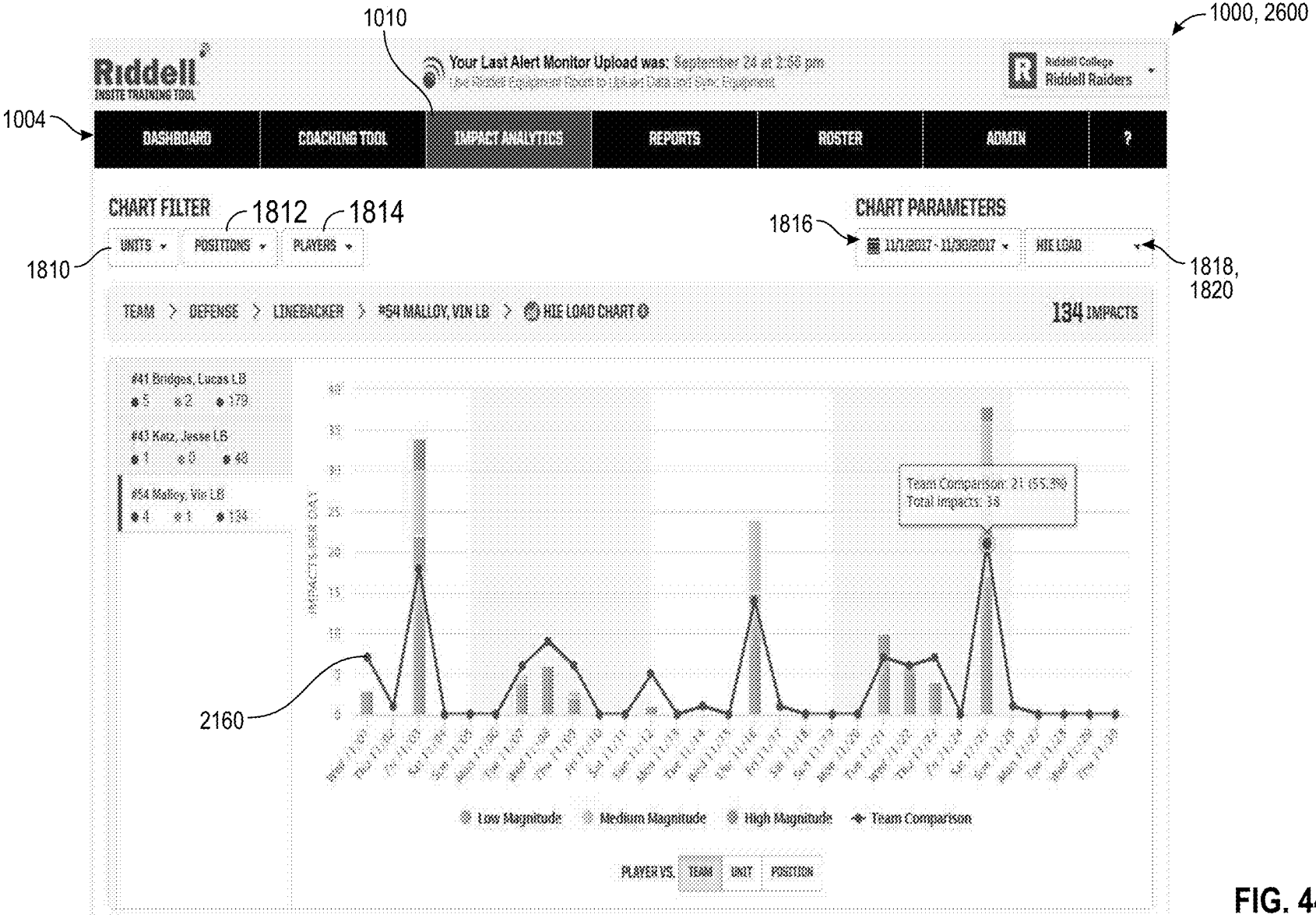
FIG. 44 illustrates a replacement first section of the first screen contained within the impact analytics tool of the GUI, which includes an HIE load chart for a first selected player (i.e., Vin Malloy)
Figure 45:
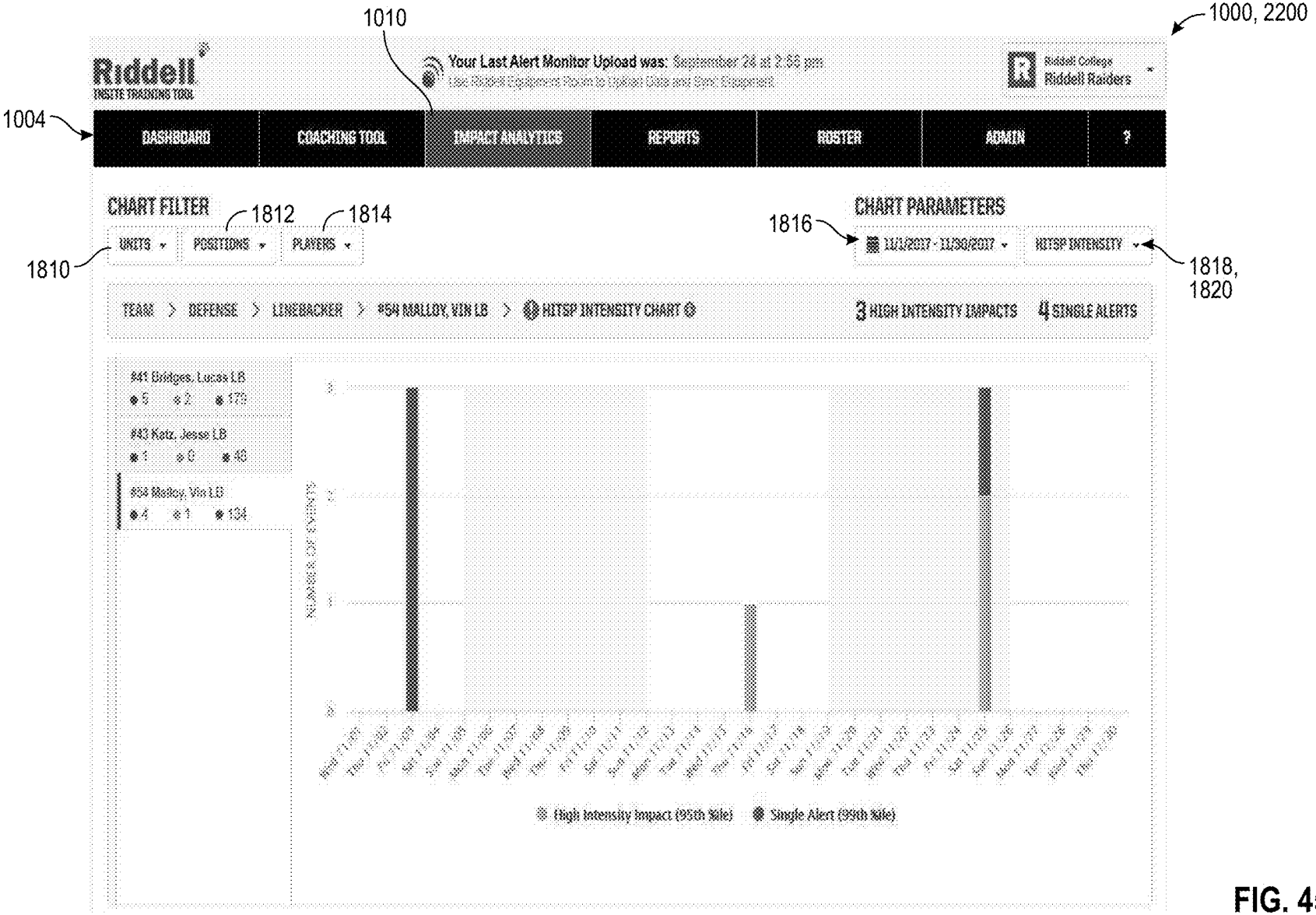
FIG. 45 illustrates a replacement first section of the first screen contained within the impact analytics tool of the GUI, which includes a HITsp load chart for the first selected player (i.e., Vin Malloy)
Figure 46:
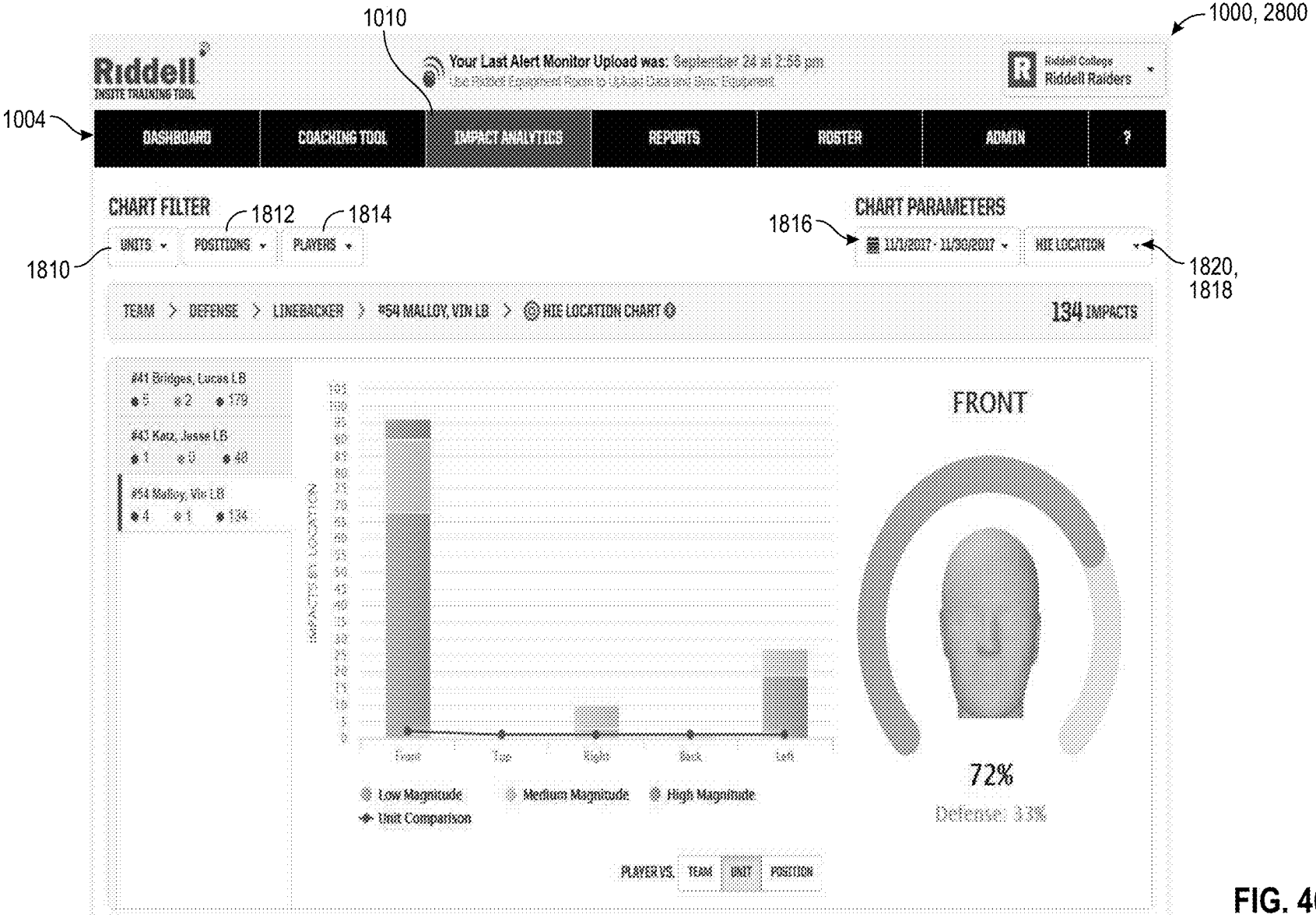
FIG. 46 illustrates a replacement first section of the first screen contained within the impact analytics tool of the GUI, which includes an HIE location chart for the first selected player (i.e., Vin Malloy)
Figure 47:
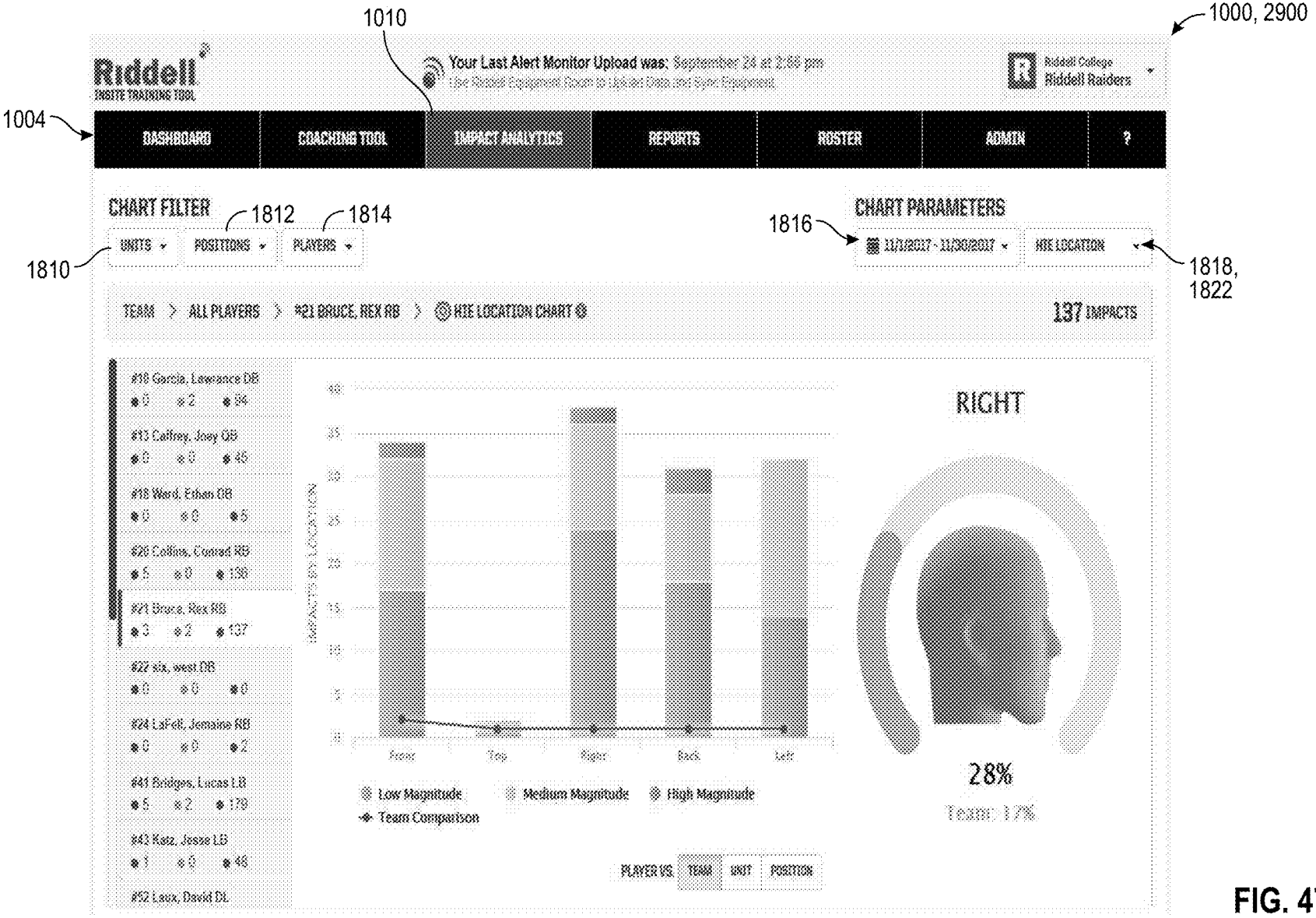
FIG. 47 illustrates a replacement first section of the first screen contained within the impact analytics tool of the GUI, which includes an HIE location chart for a second selected player (i.e., Rex Bruce)
Figure 48:
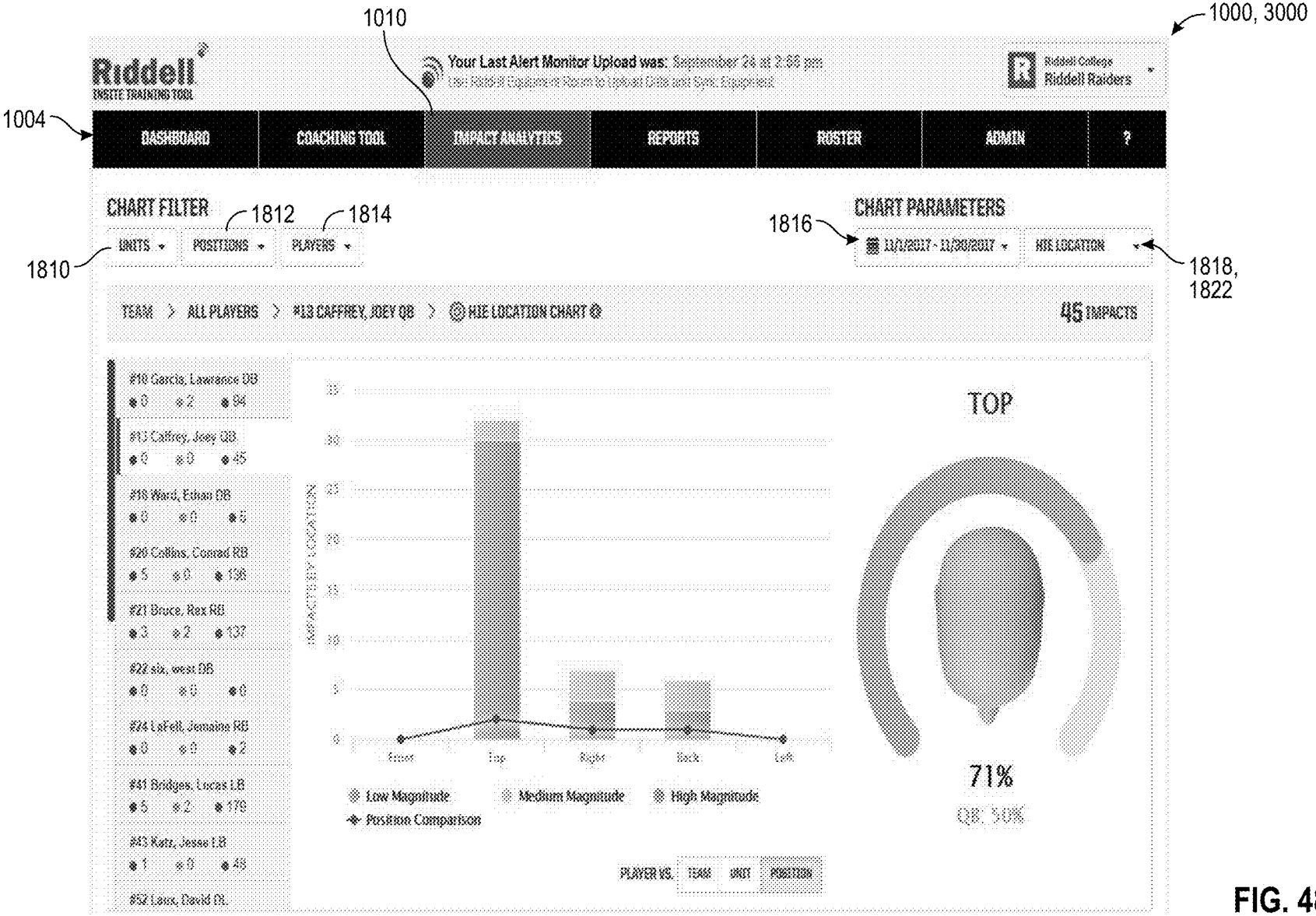
FIG. 48 illustrates a replacement first section of the first screen contained within the impact analytics tool of the GUI, which includes an HIE location chart for a third selected player (i.e., Joey Caffrey)

The quick list 1060 is designed to show a subset of the information (e.g., identifier 1062, name 1064, position 1066, single impact alerts 1068, multiple impacts alerts 1070, and training opportunities 1072) about a subset of the players to allow the authorized user keep abreast of these players without going through multiple screens contained within the GUI 1000. The authorized user can add players to the quick list 1060 using the select player feature 1074 and can remove players from the quick list 1060 by pressing the "X" 1076 that is associated with the player. The player report 1080 section allows the authorized user to generate a report about a specific player. Additional details about these reports will be discussed in connection with FIGS. 54-56. Finally, the authorized user can use position based insights 1090 section to request impact analytics in connection with a unit or position. For example, the selection of the button 1092 will navigate to a screen that displays the HIE load statistics for the past week in connection with the defense unit; an example of this screen is shown in FIG. 41. Additionally, the selection of the button 1094 will navigate to a screen that displays the HIE load statistics for the past week in connection with the linebacker position; an example of this screen is shown in FIG. 44.

It should be understood that this dashboard 1002 provides a significant improvement in the efficiency of using the system 10 by bringing together and effectively visually presenting a limited list of high priority information without requiring the user to navigate through multiple screens in order to obtain this information. This in turn improves the efficiency of using the system 10 because it saves the user form navigating to a selected screen, manipulating the data associated with that screen, and then trying to interpret the resulting data. These factors tangibly improve the functionality of the system 10, particularly the user interface, and more particularly effectively displaying the user interface on a remote terminal 28 that has a small screen (e.g., mobile phone).

Figure 27:
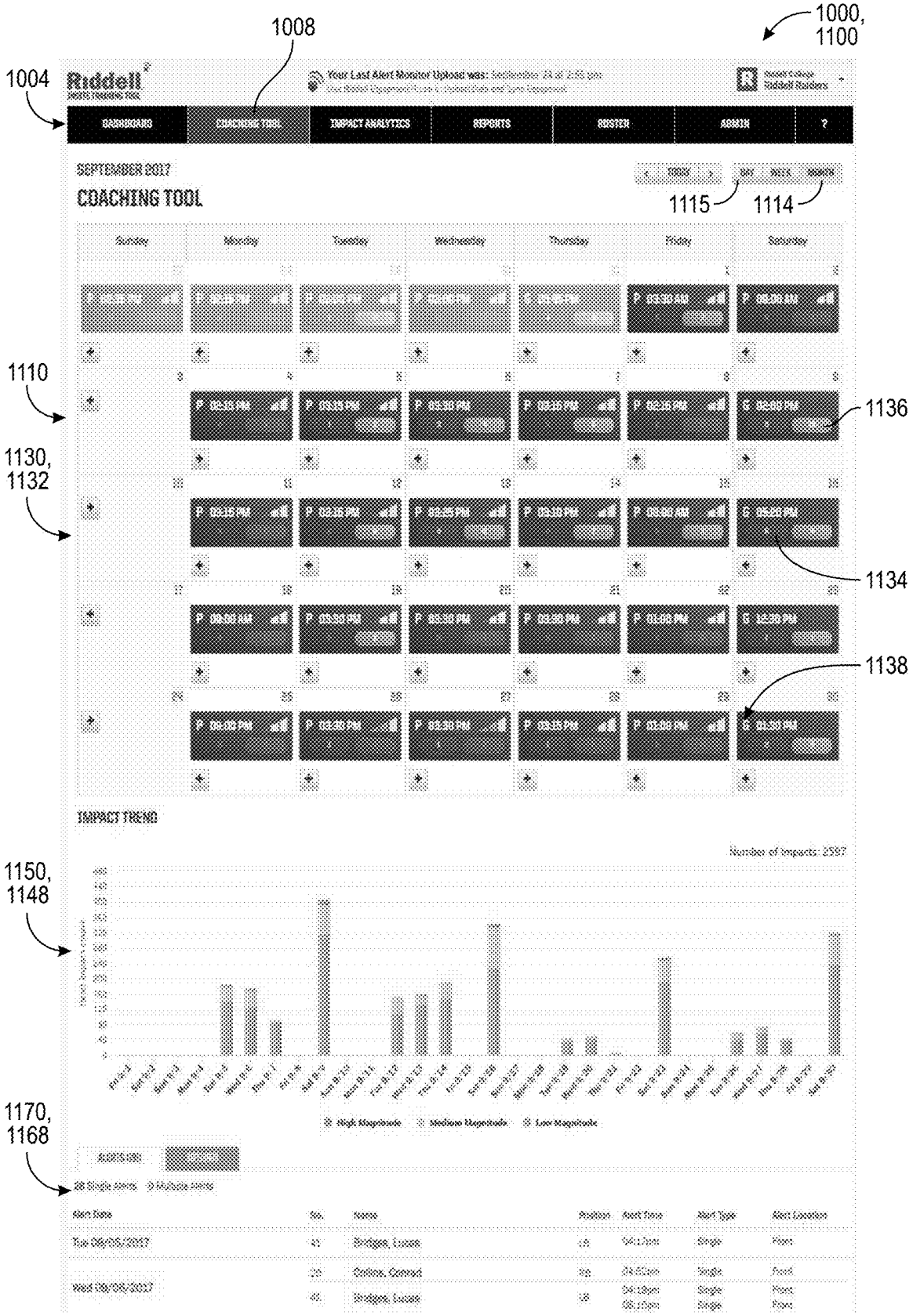
FIG. 27 illustrates a first screen contained within the coaching tool of the GUI.
Figure 28A:
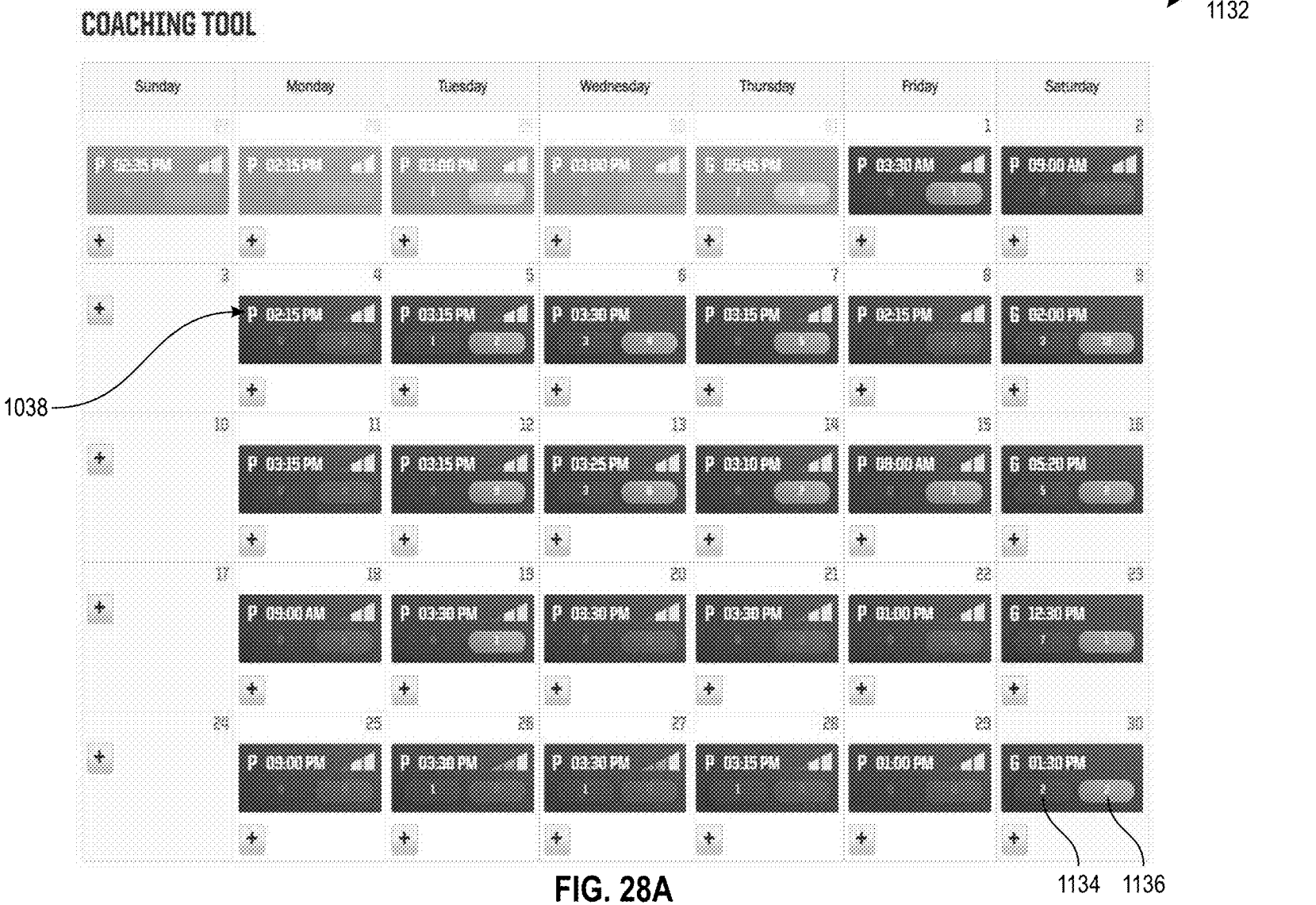
FIG. 28A illustrates a first section of the first screen of the coaching tool of the GUI, which includes a month view of a practice planner.

An authorized user can leave the dashboard 1002 and navigate to a first screen 1100 contained within the coaches tool 1110. FIG. 27 shows an exemplary graphical representation of the first screen 1100, which may be displayed by the remote terminal 28 within the system 10. Specifically, this first screen 1100 may be displayed by selecting button 1008 and the month view button 1114. The coaches tool 1110 includes a monthly view 1132 of a practice planner 1130, monthly view 1148 of an impact trend chart 1150, monthly view 1168 of an alert chart 1170, and monthly view 1188 of a training opportunities chart 1090 (shown in FIGS. 27 and 28C, but not in FIG. 28D). As best shown in FIG. 28A, the monthly view 1132 of the practice planner 1130 shows a high level view of the number of alerts 1134 and the number of training opportunities 1136 that were recorded on each day. Also, the monthly view 1132 of the practice planner 1130 displays whether a game or a practice occurred on the specific days by using the letters "P" or "G" in the upper left area 1138 of each day. It should be understood that more or less information may be displayed within the monthly view 1132 of the practice planner 1130.

Figure 28B:
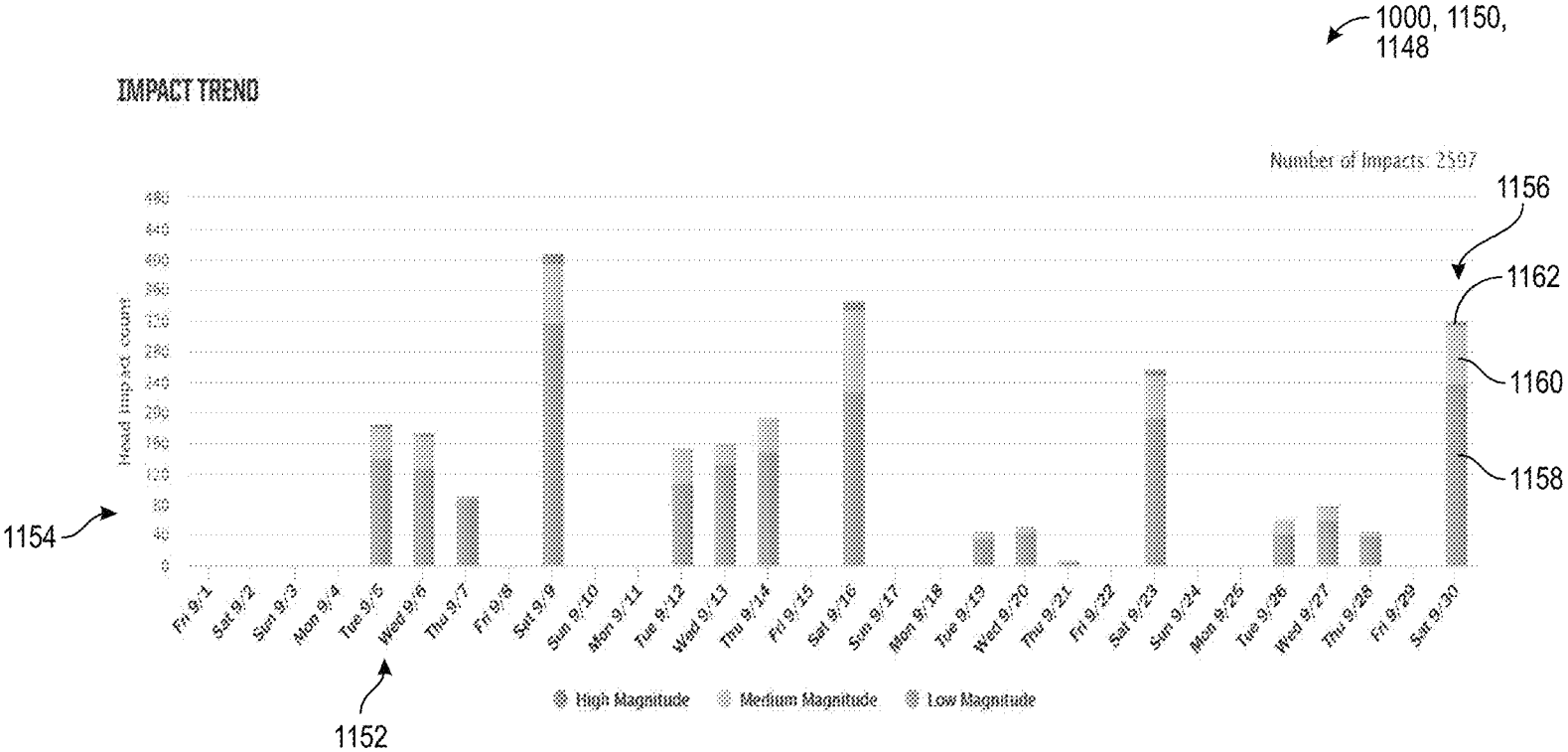
FIG. 28B illustrates a second section of the first screen of the coaching tool of the GUI, which includes a month view of an impact trend chart.

The impact trend chart 1150 shown in FIGS. 27 and 28B show the impact trends for the entire team over the selected month (e.g., September 2017). In particular, the impact trend chart 1150 includes an X-axis 1152, which has days of the month, and a Y-axis 1154, which has impact count. Bars are displayed within the impact chart, which represents the total number of impact recorded by the team over each of the days. For example, 9/30 or September $30^{th}$ the team recorded approximately 320 total impacts 1156, where approximately 240 were of low magnitude 1158, approximately 70 were of medium magnitude 1160, and approximately 10 were of high magnitude 1162. It should be understood that the high, medium and low categories of impacts 1158, 1160, 1162 are derived from the severity levels contained within the impact matrix. Specifically, severity levels 1 and 2 are considered low magnitude impacts shown in gray 1158, severity levels 3 and 4 are considered medium magnitude impacts showing in yellow 1160, and severity level 5 is considered a high magnitude impact is shown in orange 1162.

The alert chart 1170 shown in FIGS. 27 and 28C show a subset of the alert data that was collected based on algorithm 502 for the team over the selected month (e.g., September 2017). In particular, the alert charts 1170 shows: alert date 1072, player identifier (e.g., number) 1174, player name 1176, player position 1178, alert time 1180, alert type 1182, and alert location 1184. In this chart, the alert type 1182 can be either a single impact or a cumulative impact alert. Specifically, the single impact alert is triggered in step 546 of algorithm 502 and the cumulative impact alert is triggered in step 552 of algorithm 502. It should also be understood that this alert chart 1170 only displays a portion of the alert data and that in other embodiments the chart may include other alerts and/or more/less of the alert data. The alert time 1180 may be used by the authorized user to correlate this alert with the impact the player experienced, which can be shown on the videotape of the game. This may aid the authorized user's ability to help the player avoid these alerts in the future. In an alternative embodiment, the game tape may automatically be synced with the videotape from the game and selection of the alert type may pull up 1 minute of videotape prior to the impact and 1 minute of videotape after the impact. In a further alternative embodiment, as opposed to the text set forth under alert location 1184, the alert chart 1170 may include a graphical representation of a specific player's head showing the location of the impact.

Figure 28D:
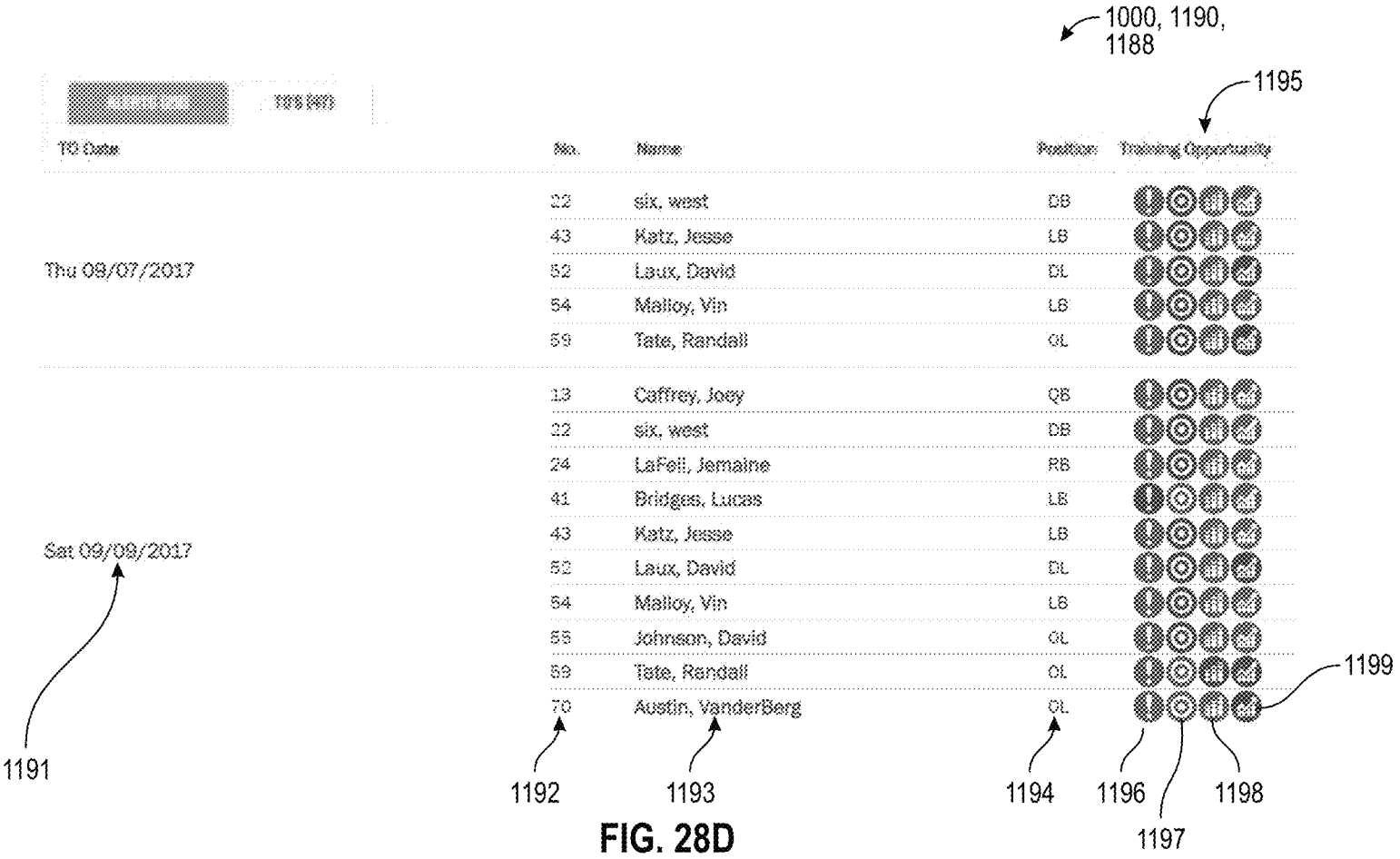
FIG. 28D illustrates a fourth section of the first screen of the coaching tool of the GUI, which includes a month view of a training opportunities chart.

The training opportunities chart 1190 shown in FIG. 28D shows a subset of the training opportunities that were triggered based on the above eight algorithms 504, 506, 508, 510, 512, 514, 516, 518 for the team over the selected month (e.g., September 2017). In particular, the training opportunities chart 1190 shows: training opportunity date 1191, specific player identifier (e.g., number) 1192, specific player name 1193, specific player position 1194, and an icon or indicator that represents the type of training opportunity 1195. Here, the first icon or indicator 1196 represents training opportunities that are based on intensity, which include training opportunities that are determined using algorithms 504, 506 and 508. Specifically, these training opportunities are shown in FIG. 28D are based upon training opportunities #1, #2, and/or #3, as these are training opportunities for the individual players. The second icon 1197 represents training opportunities that are based on location, which include training opportunities are determined using algorithm 518. Specifically, these training opportunities are shown in FIG. 28D are based upon training opportunity #8, as these are training opportunities for the individual players. The third icon 1197 represents training opportunities that are based on volume, which include training opportunities that are determined using algorithms 510 and 512. Specifically, these training opportunities are shown in FIG. 28D are based upon training opportunities #4 and/or #5, as these are training opportunities for the specific players. The fourth icon 1199 represents training opportunities that are based on load, which include training opportunities that are determined using algorithms 514 and 516. Specifically, these training opportunities are shown in FIG. 28D are based upon training opportunities #6 and/or #7, as these are training opportunities for the individual players. It should be understood that more or less training opportunities may be present within this training opportunities chart 1190. For example, the training opportunities chart 1190 may also contain training opportunities based on local or regional data sets instead of national data.

Figure 29:
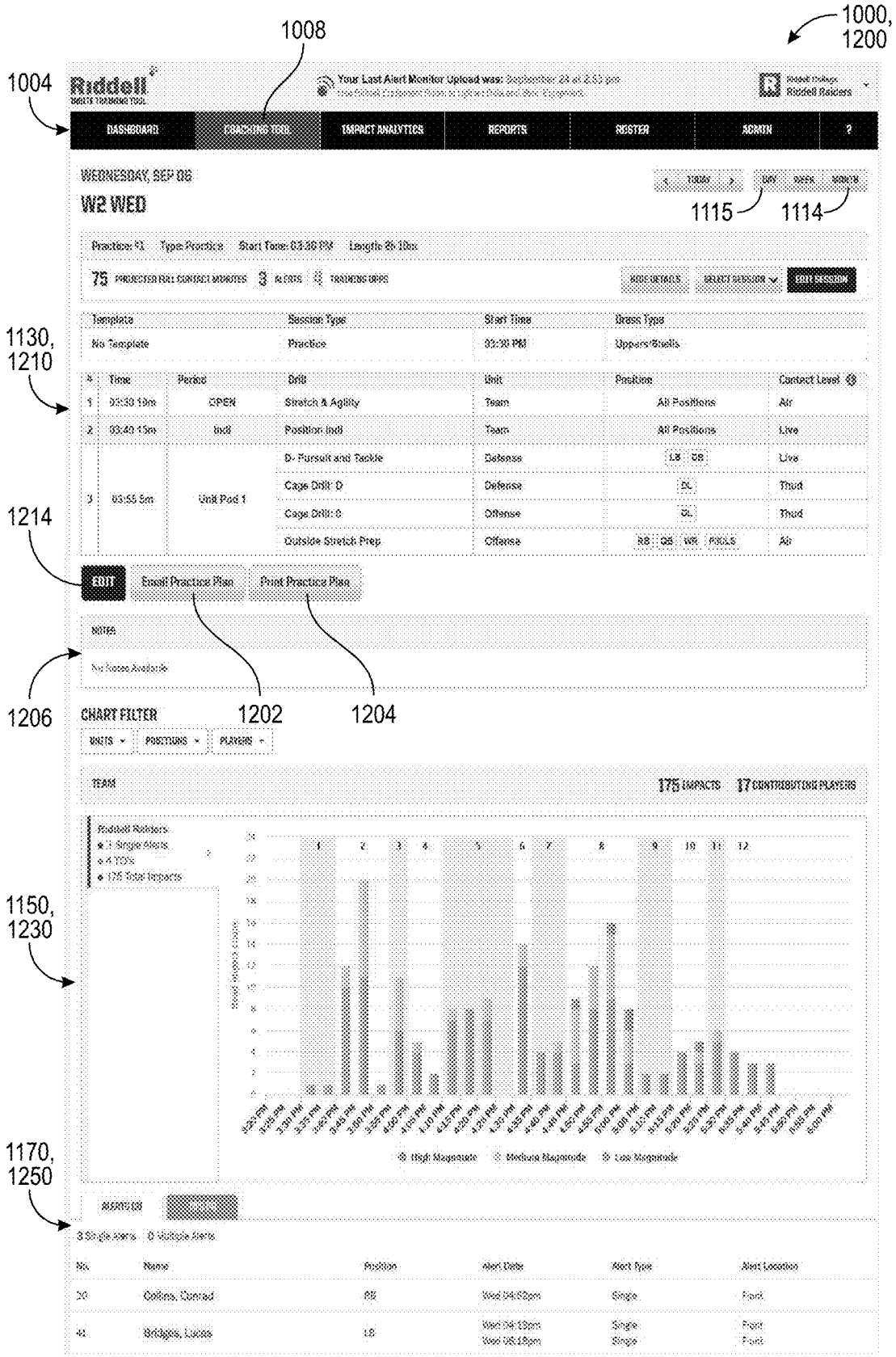
FIG. 29 illustrates a second screen contained within the coaching tool of the GUI.

An authorized user can leave the first screen 1100 contained within the coaches tool 1110 and navigate to a second screen 1200 contained within the coaches tool 1110. FIG. 29 shows an exemplary graphical representation of the second screen 1200, which may be displayed by the remote terminal 28 within the system 10. Specifically, this second screen 1200 may be displayed by: (i) selecting a single day contained within monthly view 1132 of the practice planner 1130 or (ii) selecting the day view button 1115 from practice planner 1130 instead of selecting the month view button 1114. The second screen 1200 contained within the coaches tool 1110 includes a team daily view 1210 of the practice planner 1130, team daily view 1230 of the impact trend chart 1150, team daily view 1250 of the alert chart 1170, and team daily view 1270 of the training opportunities chart 1270 (shown in FIG. 34, but not in FIG. 29 or 30C).

Figure 30A:
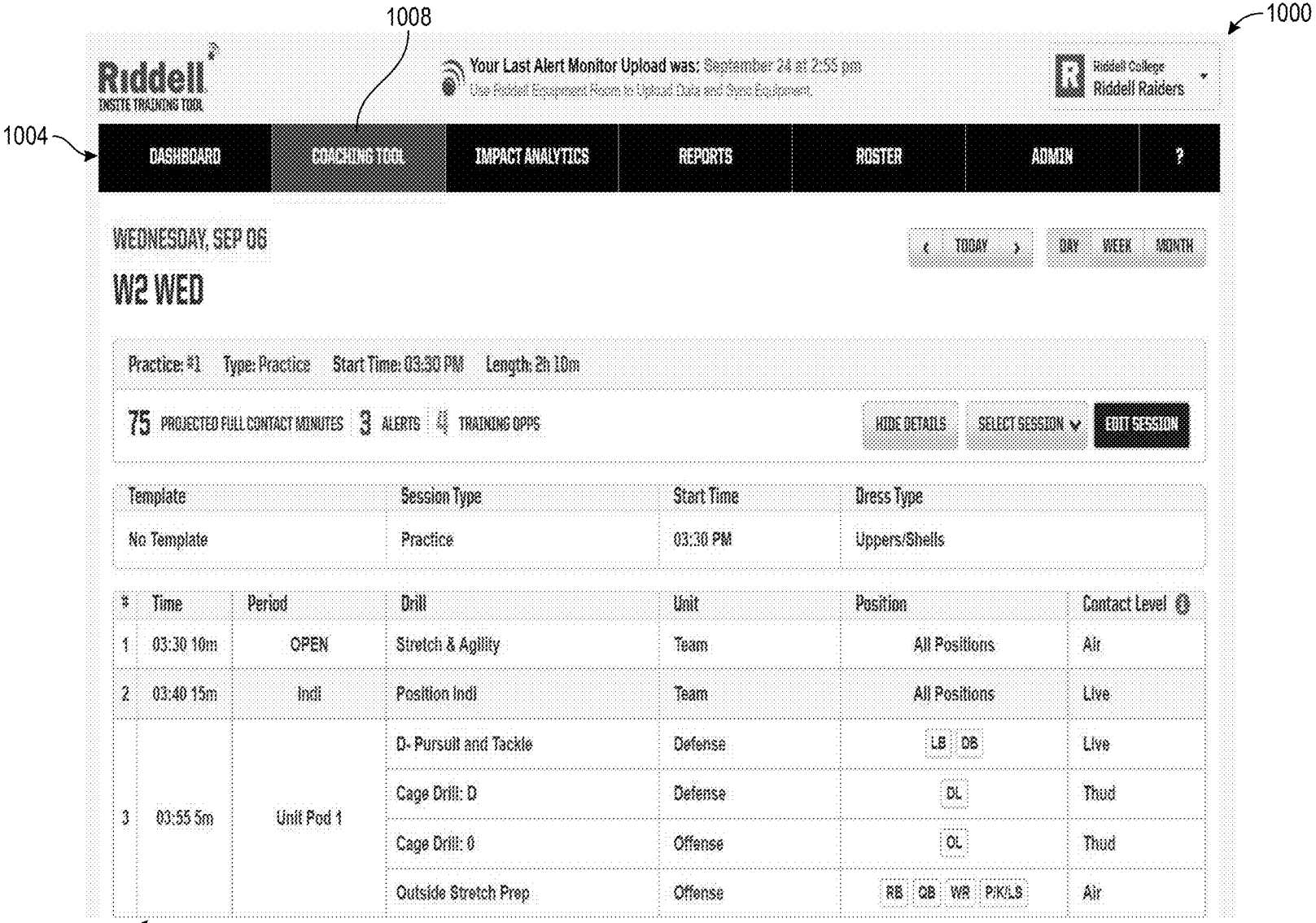
FIG. 30A illustrates a first section of the second screen of the coaching tool of the GUI, which includes a day view of a practice planner.
Figure 30B:
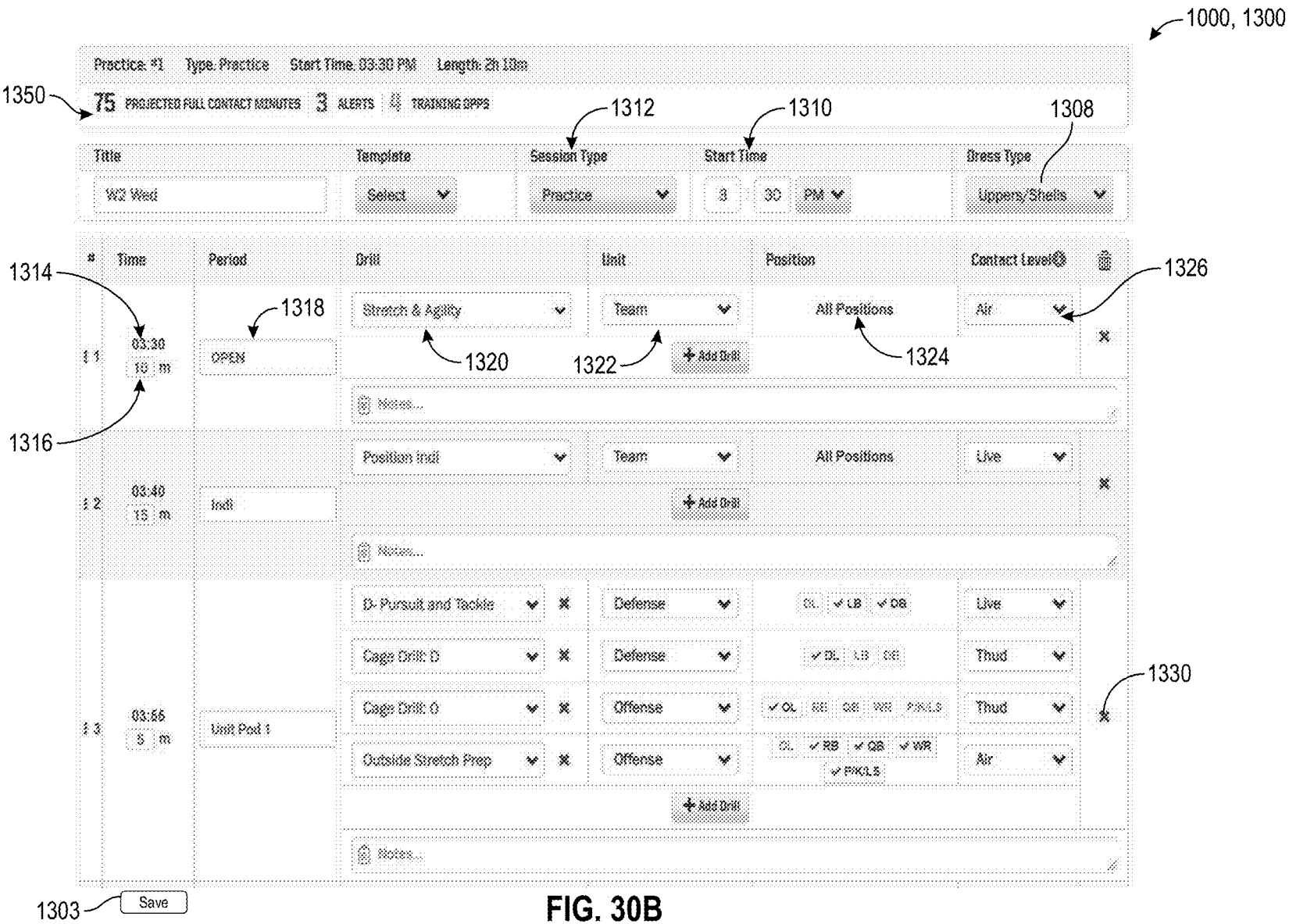
FIG. 30B illustrates a screen for editing practice plans within the GUI.

The practice planner 1150 shown in FIG. 29 can be edited by selecting the edit session button 1214, which brings up the screen 1300 shown in FIG. 30A. From this screen 1300 shown in FIG. 30A, the authorized user can edit the practice plan. Edits to the practice plan may include specifying the dress type (e.g., walkthrough, helmets only, uppers/shells, full pads) 1308, start time 1310, session type (e.g., practice, game, scrimmage) 1312. Additionally, the authorized user may specify how the practice will be broken down into individual components. For example, the authorized user may specify: (i) start time for the period 1314, (ii) duration of the period 1316, (iii) name of the period 1318, (iv) drill (e.g., stretch & agility, cage drill: D, outside stretch prep, etc.) 1320, (v) unit (e.g., entire team, subset of the team) 1322, (vi) positions (e.g., lineman, running back, etc.) 1324, and (vii) contact level 1326. It should be understood that multiple drills in 1320 may be added to a single time period 1318. To remove the time period, the user selected the "X" 1330 on the right-hand side of the screen. It should be understood that the practice plan and edits thereto may include additional, fewer, or other options tailored to different sports.

Once the authorized user is finished editing the practice plan using screen 1300, the system 10 will calculate the total number of projected full contact minutes 1350. This number can be utilized by the authorized user to players who are not subject to too many full contact minutes per week/per month. Additionally, the drills 1320 in combination with the total number of projected full contact minutes 1350 may be utilized by the system to project how many impact alerts and training opportunities will occur during the practice. Specifically, the system 10 may utilize a learning algorithm that studies the team's alert data and impact matrixes that are generated during various drills in 1320. This projection of the number of impact alerts and training opportunities may also be used by the authorized user to help ensure that the players are not placed in a position to experience many alerts/training opportunities per week/month. It should be understood that the authorized user may make the determination of how many full contact minutes and or projected alerts/training opportunities are acceptable per week by setting a $20^{th}$ threshold value or acceptable threshold within the system 10. In this embodiment, the system 10 will compare the projections against this acceptable threshold and will provide warnings to the user, if the user deigns a practice plan that exceeds this projected threshold. Alternatively, system 10 may determine the $20^{th}$ threshold value or acceptable threshold based on an analysis of the data associated with teams that play at a similar level. Like the above embodiment, the system 10 will provide the user with a warning to the user, if the user deigns a practice plan that exceeds this projected threshold.

Once the authorized user is satisfied with the practice plan, the authorized user can save the plan by selecting the save button 1305. Selecting the save button 1305 will send the user back to screen 1200. However, the updated version of the practice plan will replace the previously displayed version of the practice plan upon the user's arrival at screen 1200. Once back at screen 1200, the user can email 1202, print 1204 the practice plan, or provide additional notes 1206 about the practice plan. It should be understood that the system 10 may provide other options (e.g., request comments from another user, publish a practice plan to players, etc.) to the user in connection with the practice plan.

Figure 30C:
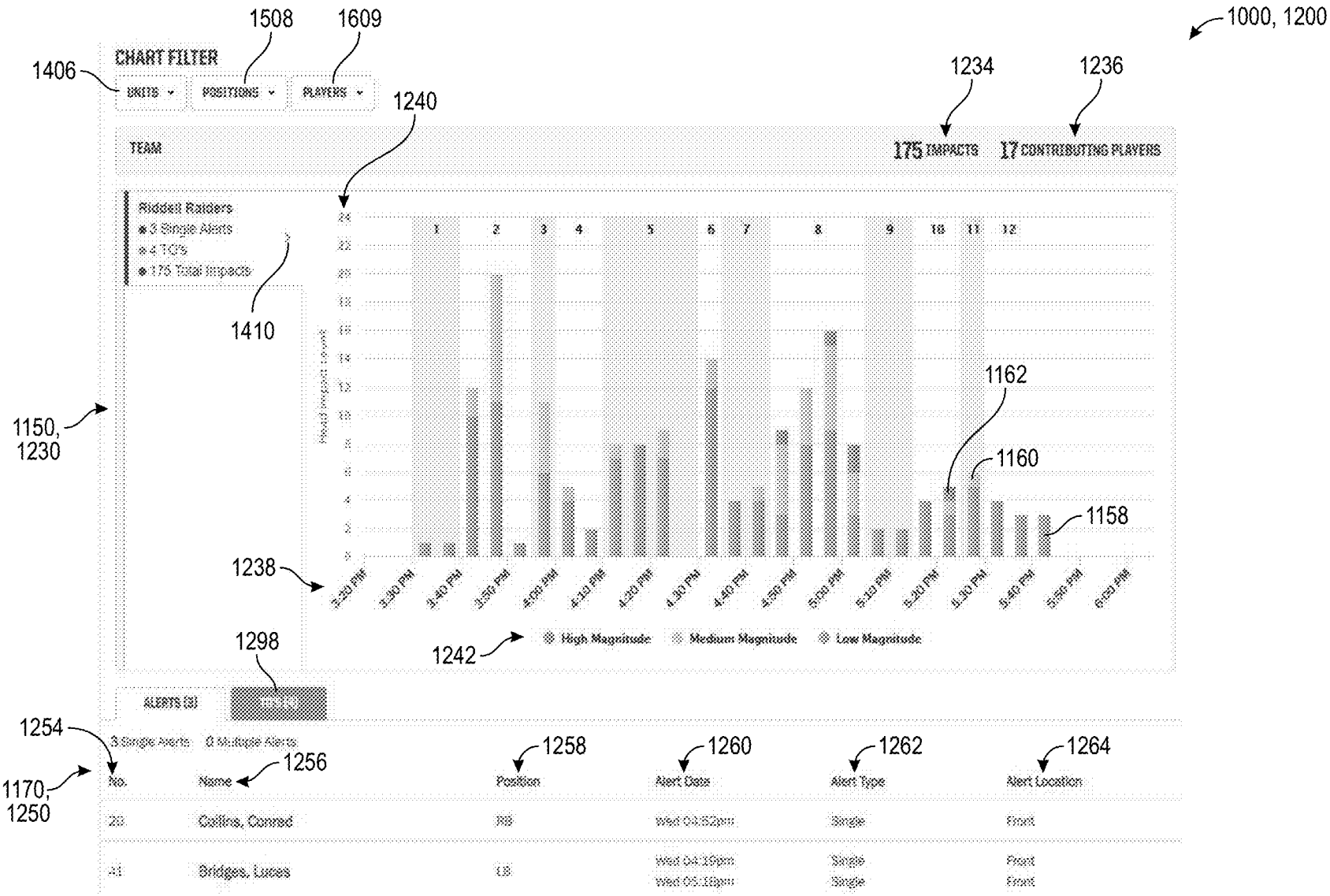
FIG. 30C illustrates a second section of the second screen of the coaching tool of the GUI, which includes a day view of an impact trend chart for a team along with an alert chart.

FIG. 30C shows a portion of the second screen 1200, wherein only the team daily view 1230 of the impact chart 1150 and the team daily view 1250 of the alert chart 1170 are shown. Specifically, this team daily view 1230 of the impact chart 1150 shows the total number of impact that occurred during the day 1234, the total number of specific player's that experienced an impact during the day 1236, the time periods that correlate to the practice plan 1238, number of impacts broken down over a time period that is based on the practice plan 1240, magnitude of the impacts 1242 that the team recorded during the selected day (e.g., Sep. 6, 2017). As described above in connection with FIG. 28B, the magnitude of the impacts 1242 are grouped into high, medium and low categories 1158, 1160, 1162, wherein severity levels 1 and 2 are considered low magnitude impacts shown in gray 1158, severity levels 3 and 4 are considered medium magnitude impacts showing in yellow 1160, and severity level 5 is considered a high magnitude impact is shown in orange 1162. It should be understood that the groupings of the time periods 1238 and the magnitude of impacts 1242 may be grouped in other manners.

Also, this team daily view 1250 of the alert chart 1170 shows the player identifier (e.g., number) 1254, player name 1256, player position 1258, alert time 1260, alert type (e.g., single or cumulative) 1262 and alert location 1264 that the team recorded during the selected day (e.g., September 16). Instead of viewing the alert chart 1170, the authorized user can view the training opportunities chart 1190 by selecting button 1298, shown in FIG. 30C. The selection of button 1298 replaces the alert chart 1170, shown in FIG. 30C, with the training opportunities chart 1190, shown in FIG. 34. In particular, this team daily view 1270 of the training opportunities chart 1190 shows the player identifier (e.g., number) 1274, player name 1276, player position 1278, date 1280, and training opportunity type 1282 that the individual players within the team recorded during the selected day (e.g., Sep. 6, 2017).

From the second screen 1200, the authorized user can select the unit button 1406 or select the arrow button 1410. The selection of either one of these buttons 1406, 1410, replaces the team daily view 1230 of the impact chart 1150 with a unit daily view 1430 of the impact chart 1150. In particular, the unit screen 1400 shows the impacts that the selected unit (e.g., offense) 1412 recorded during the selected day (e.g., Sep. 6, 2017). Specifically, this unit daily view 1430 of the impact chart 1150 shows the total number of impact that occurred during the day within the selected unit 1434, the total number of specific player's that are within the selected unit and experienced an impact during the day 1436, the time periods that correlate to the practice plan 1438, number of impacts broken down over a time period that is based on the practice plan 1440, magnitude of the impacts 1442 that the unit recorded during the selected day (e.g., Sep. 6, 2017).

Figure 31:
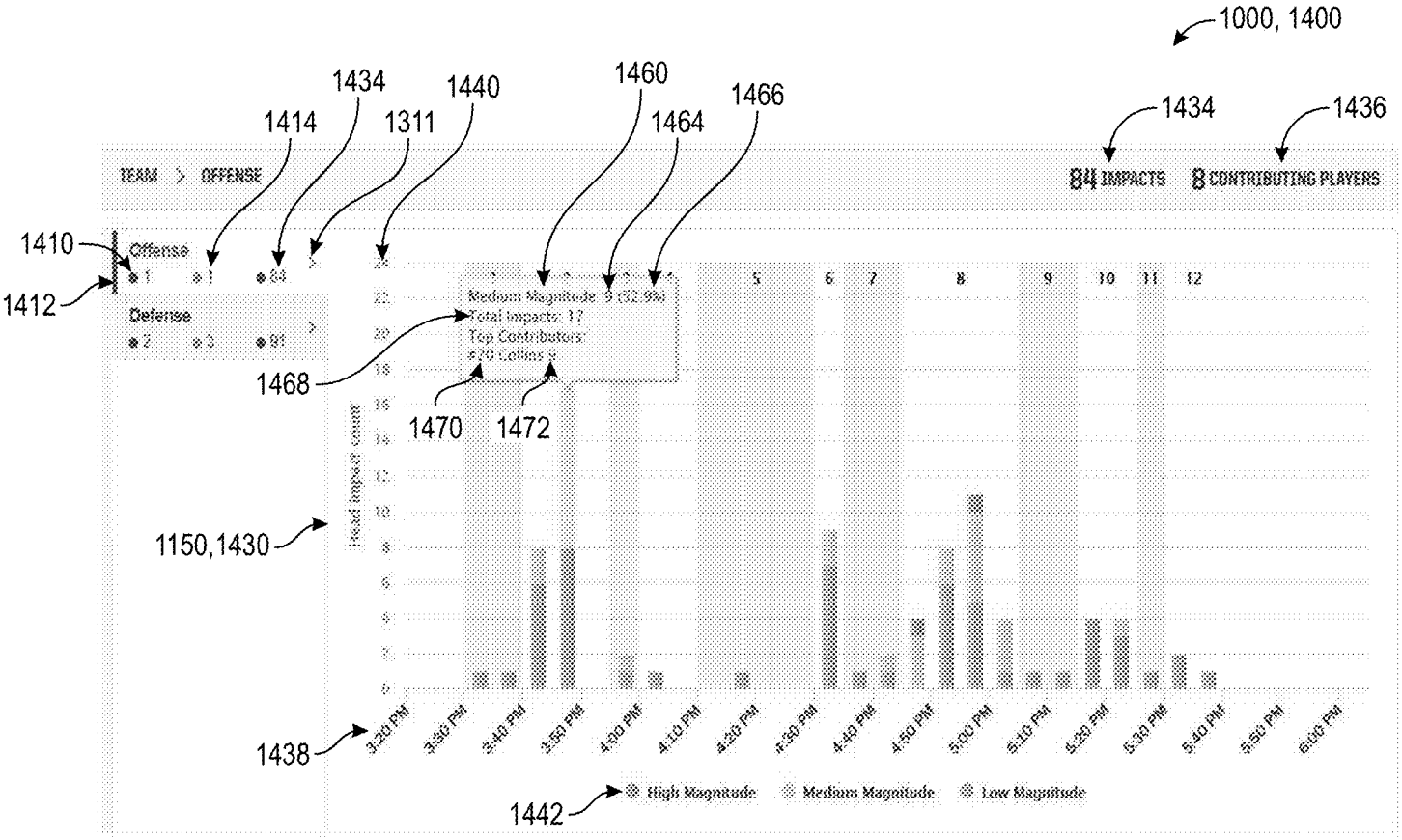
FIG. 31 illustrates a replacement second section of the second screen of the coaching tool of the GUI, which includes a day view of an impact trend chart for a unit of the team (i.e., offense)

Also, in connection with FIG. 31, the left side of the unit daily view 1430 of the impact chart 1150 displays the number of alerts over the selected day for the selected unit 1410, number of training opportunities over the selected day for the selected unit 1414, and the total number of impacts that occurred during the day 1434. In addition to the above information that is displayed within the chart 1150, the authorized user can hover over an extent of a bar on chart 1150 to obtain additional data about that extent of the bar. For example, FIG. 31 shows additional bar segment information 1460 by hovering over a bar that correlates to medium magnitude impacts that occurred from 3:45-3:50 on Sep. 6, 2017. This bar segment information 1460 includes: (i) number of impact 1464, (ii) percentage of impact that are contained within the selected segment in comparison to all impact contained within the bar 1466, (iii) total number of impacts contained within the bar 1468, (iv) player who had the most impacts within the selected bar segment (e.g., top contributor) 1470, and (v) the number of impacts that was experienced by top contributor 1472. It should be understood that this bar segment information 1460 may be displayed in connection with any chart described herein.

Figure 32:
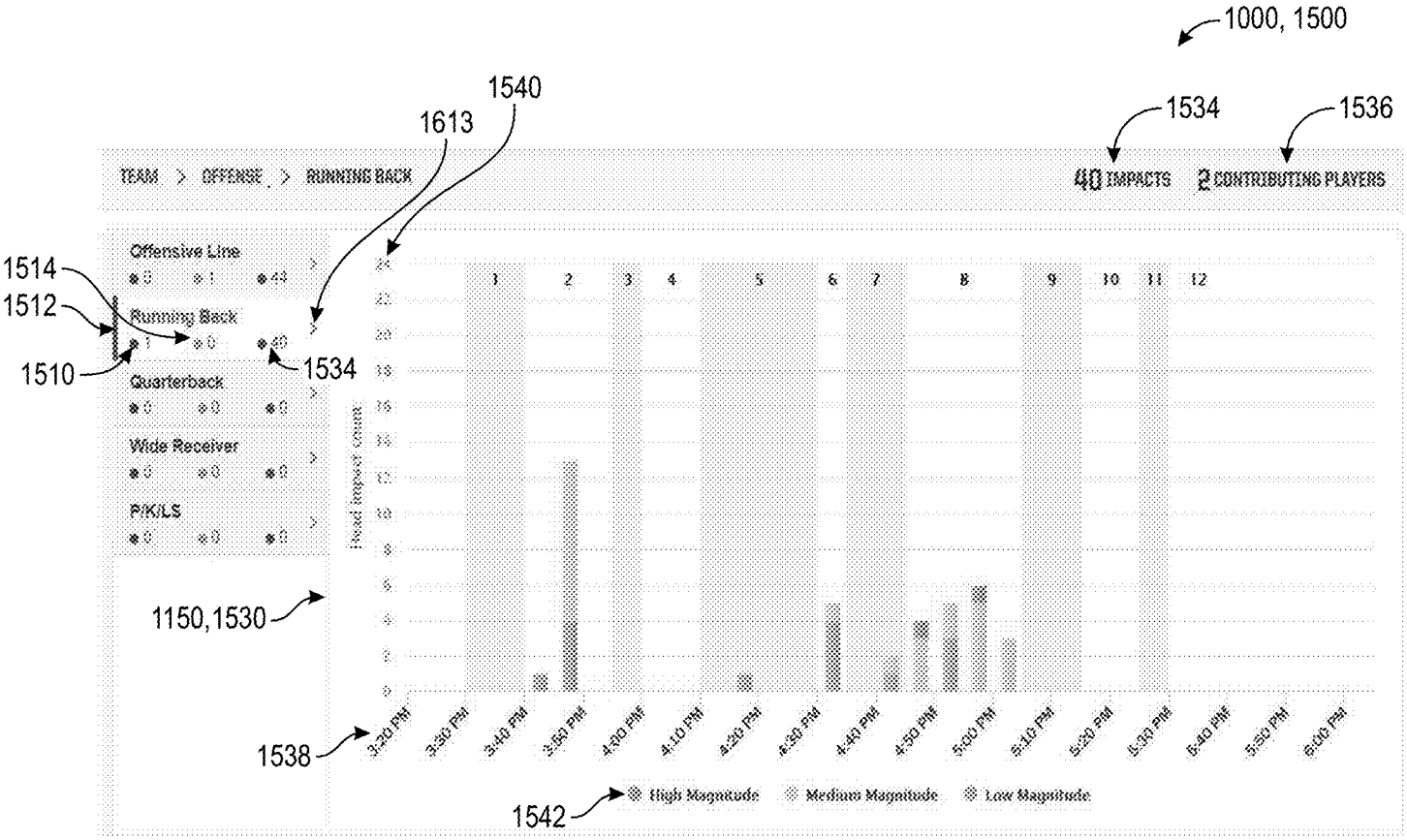
FIG. 32 illustrates a replacement second section of the second screen of the coaching tool of the GUI, which includes a day view of an impact trend chart for a selected player position (i.e., running back)

From the second screen 1200, the authorized user can select the position button 1508. Alternately, the authorized user may select the arrow button 1511 from the screen 1400 shown in FIG. 31. The selection of either one of these buttons 1508, 1511, replaces either: (i) the team daily view 1230 of the impact chart 1150 or (ii) unit daily view 1430 of the impact chart 1150 with a position daily view 1530 of the impact chart 1150. In particular, the position screen 1500 shows the impacts that the selected position (e.g., running back) 1512 recorded during the selected day (e.g., Sep. 6, 2017). Specifically, this position daily view 1530 of the impact chart 1150 shows the total number of impact that occurred during the day for the position 1534, the total number of specific player's that experienced an impact during the day that play the selected position 1536, the time periods that correlate to the practice plan 1538, number of impacts broken down over a time period that is based on the practice plan 1540, magnitude of the impacts 1542 that the position recorded during the selected day (e.g., Sep. 6, 2017). Also, in connection with FIG. 32, the left side of the position daily view 1530 of the impact chart 1150 displays the number of alerts over the selected day for the selected position 1510, number of training opportunities over the selected day for the selected unit 1414, and the total number of impacts that occurred during the day 1434.

From the second screen 1200, the authorized user can select the position button 1609. Alternately, the authorized user may select the arrow button 1613 from the screen 1600 shown in FIG. 33. The selection of either one of these buttons 1609, 1613, replaces either: (i) the team daily view 1230 of the impact chart 1150 or (ii) position daily view 1530 of the impact chart 1150 with a player daily view 1630 of the impact chart 1150. In particular, the player screen 1600 shows the impacts that the selected player (e.g., Conradrb Collins) 1612 recorded during the selected day (e.g., Sep. 6, 2017). Specifically, this player daily view 1630 of the impact chart 1150 shows the total number of impact that occurred during the day for the player 1534, the time periods that correlate to the practice plan 1638, number of impacts broken down over a time period that is based on the practice plan 1640, magnitude of the impacts 1642 that the player recorded during the selected day (e.g., Sep. 6, 2017). Also, in connection with FIG. 32, the left side of the player daily view 1630 of the impact chart 1150 displays the number of alerts over the selected day for the selected player 1610, number of training opportunities over the selected day for the selected player 1614, and the total number of impacts that occurred during the day 1634.

Figure 33:
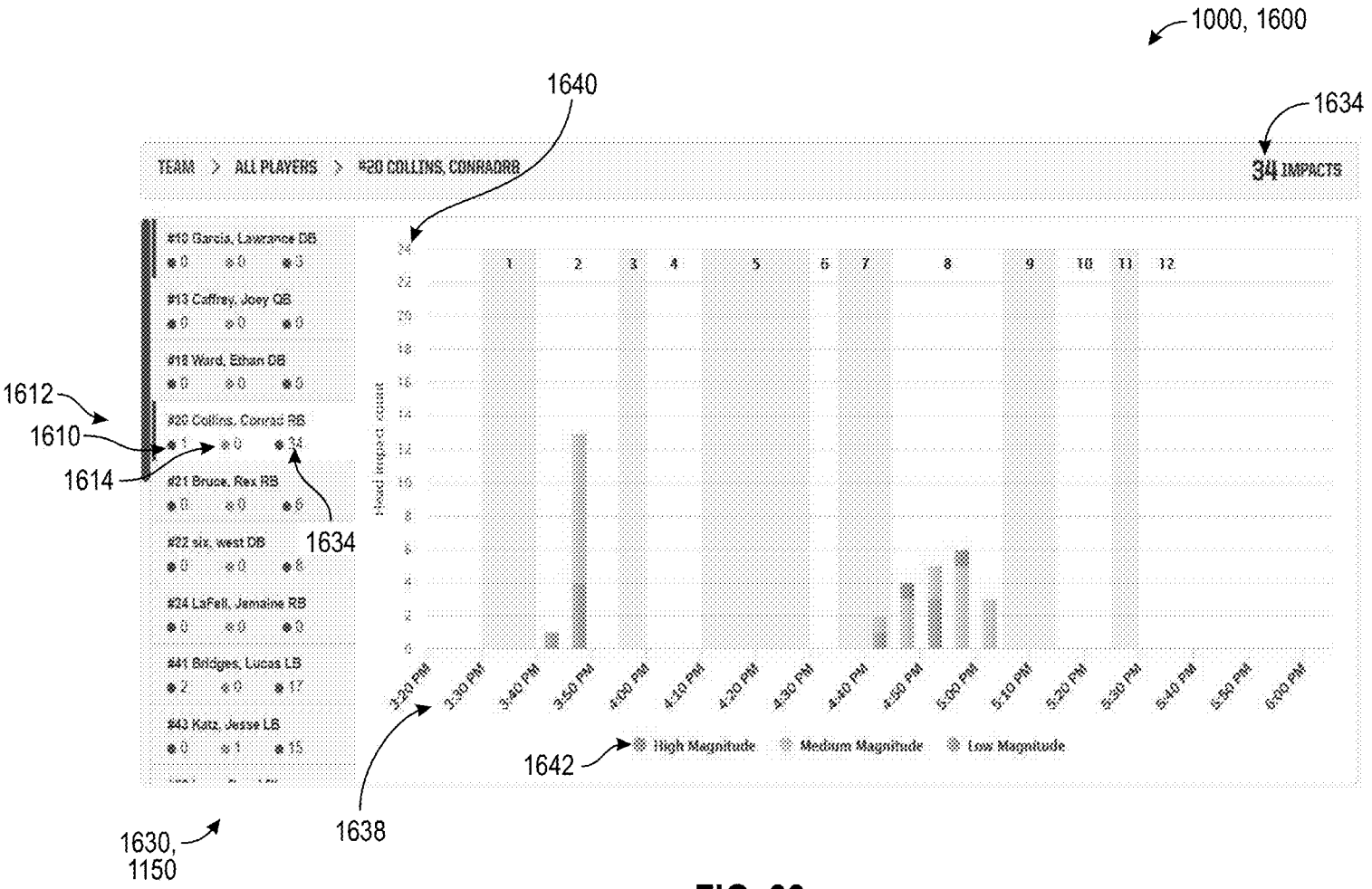
FIG. 33 illustrates a replacement second section of the second screen of the coaching tool of the GUI, which includes a day view of the impact trend chart for a selected player (i.e., Conrad Collins)
Figure 34:
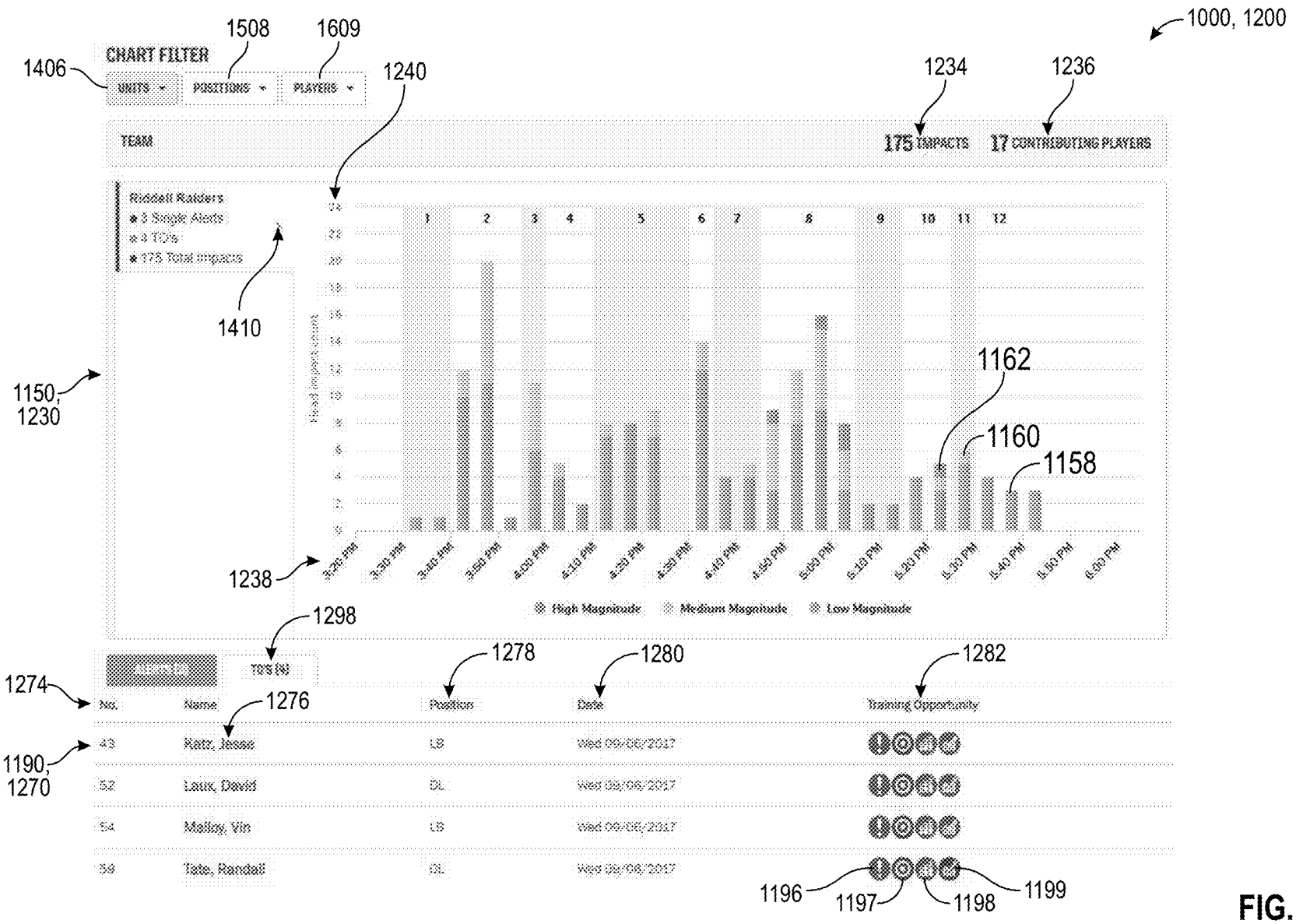
FIG. 34 illustrates a third section of the second screen of the coaching tool of the GUI, which includes a day view of an impact trend chart for a team along with the training opportunity chart.
Figure 35:
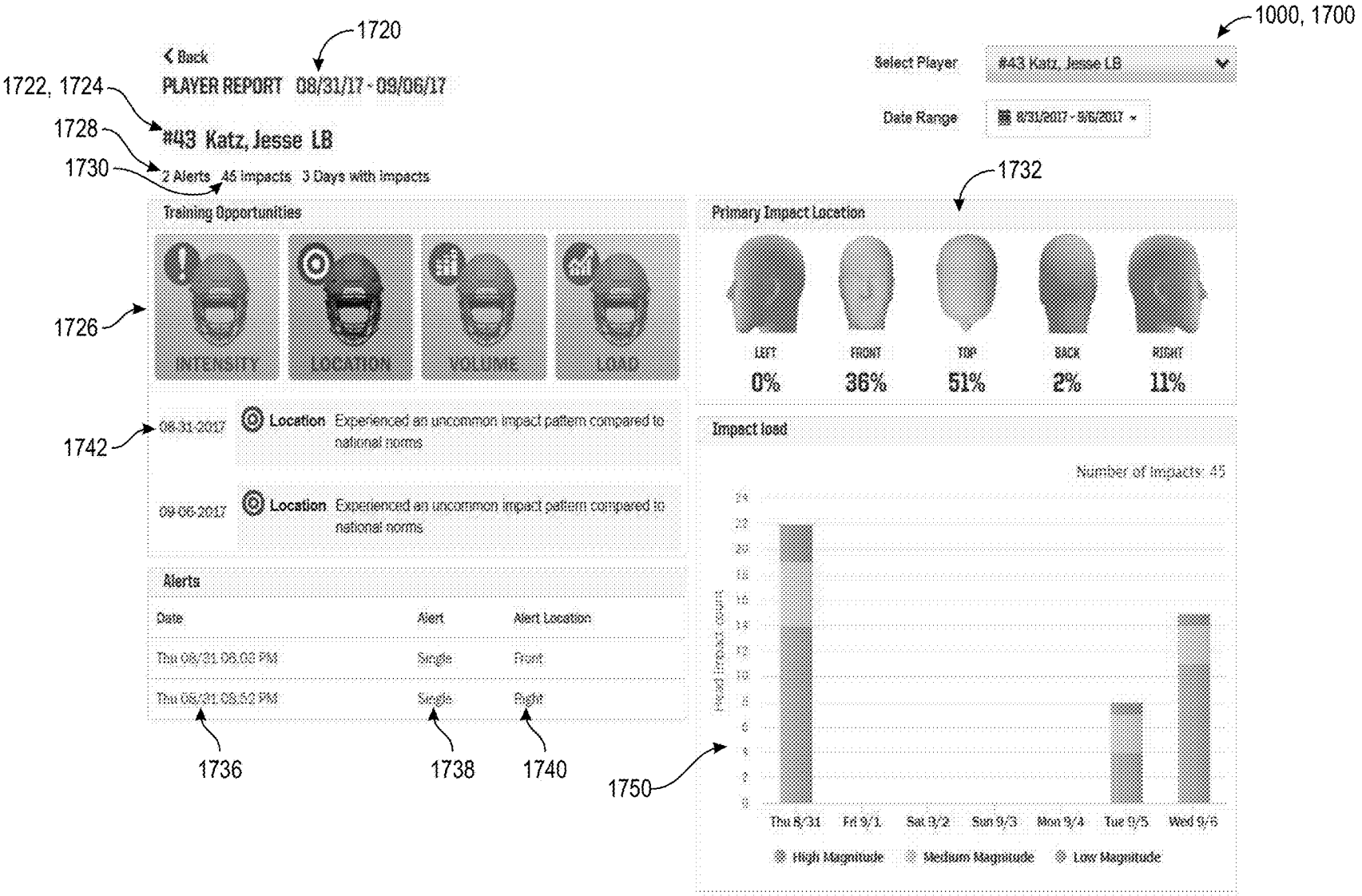
FIG. 35 illustrates a third screen of the coaching tool of the GUI, which includes a first example of a player report for a predefined amount of time (e.g., 7 days) and showing a training opportunity based upon impact location.

As shown in FIG. 34, the authorized user can view the training opportunities chart 1190 by selecting button 1298, shown in FIG. 33. After displaying the training opportunities chart 1190, the authorized user can gain additional information about each of the training opportunities by selecting the training opportunity icons 1196, 1197, 1198, and 1199 on the right side of the screen. For example, if the authorized user may select icon or indicator 1197 that is associated with Jesse Katz, the specific player training opportunity screen or player report 1700 is displayed for the selected training opportunity in FIG. 35. Referring to FIG. 35, the specific player training opportunity screen or player report 1700 is derived from the physiological data that was collected using at least one of the eight algorithms (e.g., 504, 506, 508, 510, 512, 514, 516, and 518) discussed above. The specific player report displays: (i) the report time period 1720, (ii) specific player's name 1722, (iii) player details 1724 (e.g., specific player's number and specific player's position), (iv) training opportunities 1726 triggered by a player during the report time period, (v) the number of alerts 1728 triggered by a player during the report time period, (vi) the number of impacts 1730 experienced by a player during the report time period, (vii) graphical representation of the impact locations 1732 the experienced by a player during the report time period, wherein the percentages of impacts are shown below the graphical representations of the headform, (viii) alert date 1736, (ix) alert type 1738, (x) alert location 1740, (xi) reporting view 1750 of the impact chart 1150, and (xii) training opportunity date 1742.

The specific player report 1700 for Jesse Katz, shown in FIG. 35 shows that the player triggered two locations based on training opportunity 1196 on Aug. 31, 2017 and Sep. 6, 2017. This training opportunity was based upon the specific player experiencing an uncommon impact pattern compared to national norms. This training opportunity was determined using algorithm 518 and is training opportunity #8. It should be understood that this specific player report 1700 provides a significant improvement in the efficiency of using the system 10 by bringing together and effectively visually presenting a limited list of high priority information without requiring the user to navigate through multiple screens in order to obtain this information. This in turn improves the efficiency of using the system 10 because it saves the user from navigating to a selected screen, manipulating the data associated with that screen, and then trying to interpret the resulting data. These factors tangibly improve the functionality of the system 10, particularly the user interface, and more particularly effectively displaying the user interface on a remote terminal 28 that has a small screen (e.g., mobile phone).

Figure 36:
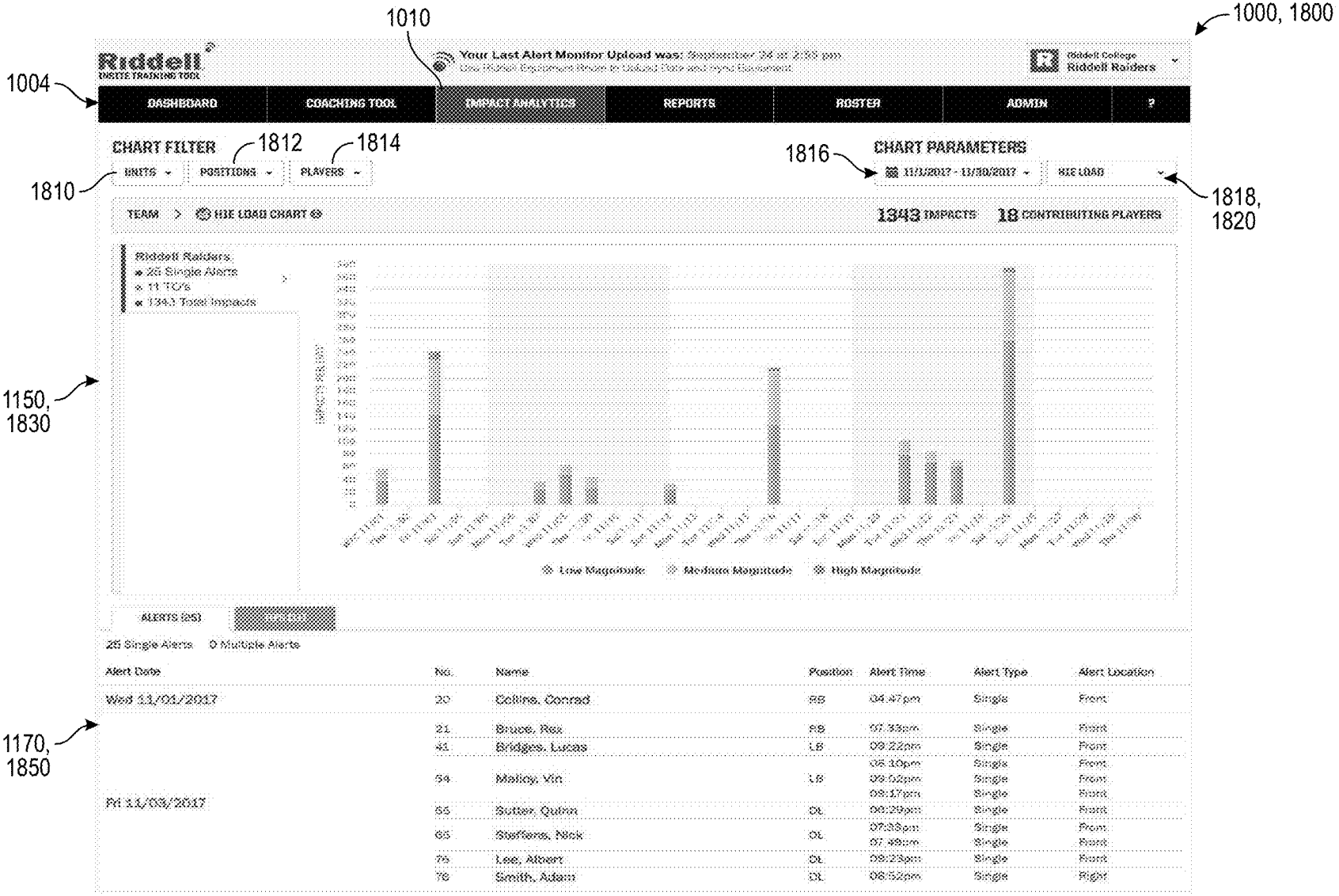
FIG. 36 illustrates a first screen contained within the impact analytics tool of the GUI, which includes an HIE load chart and the alert chart.
Figure 37:
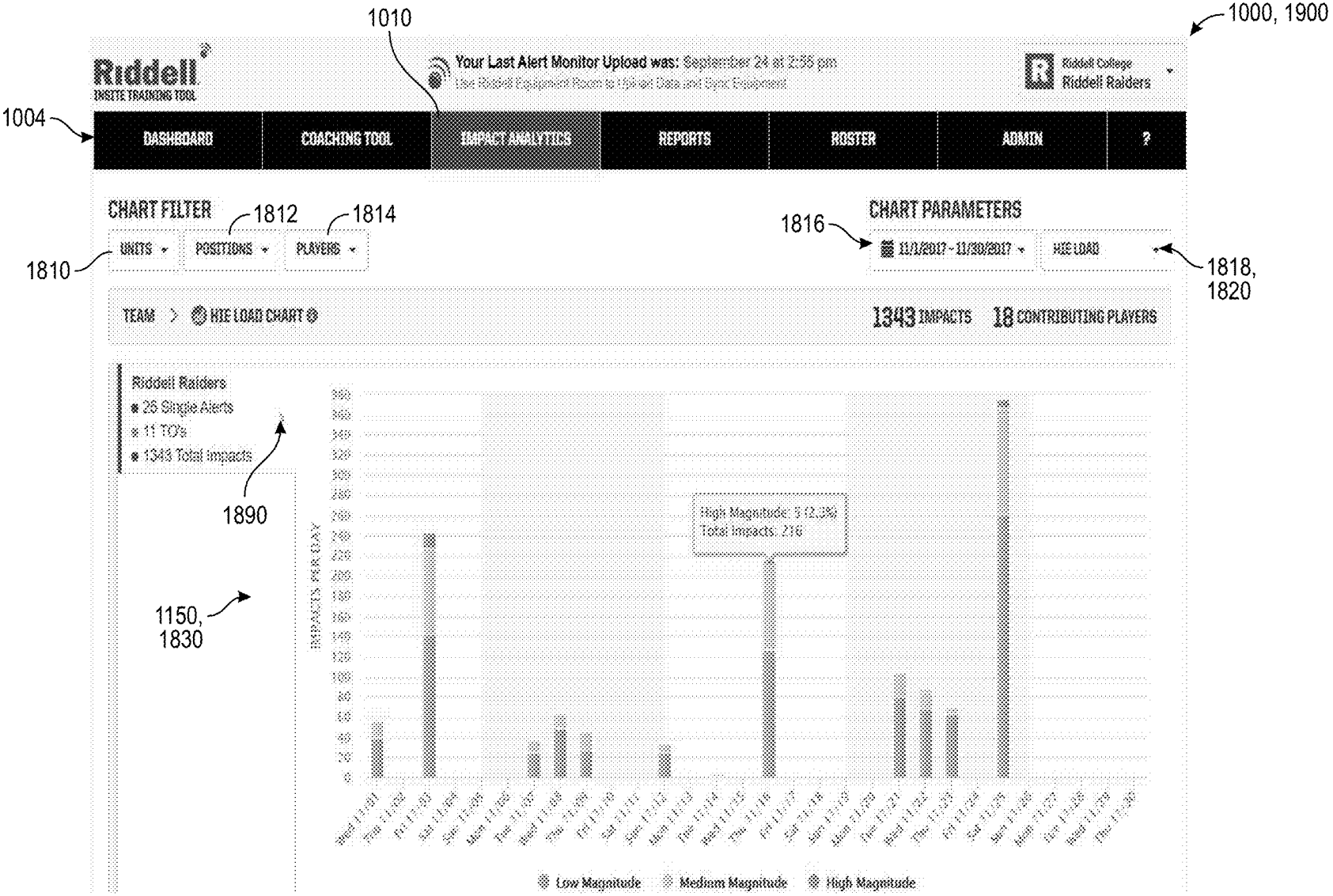
FIG. 37 illustrates a first section of the first screen contained within the impact analytics tool of the GUI, which includes an HIE load chart for a selected unit (i.e., offense) of the team.

FIGS. 36-49 show various screens 1800 that are associated with the impact analytics tool 1010. Specifically, the authorized user will navigate to the impact analysis screen 1800 by selecting button 1010. The impact analysis tool 1010 allows the authorized user to visually see a particular set of information and/or compare various data sets contained within the physiological parameter data. Specifically, the authorized user can select to see data associated with the team, with a unit by selecting the unit from the drop-down 1710, with a position by selecting the position from the drop-down 1712, with a player by selecting the player from the drop-down 1714. After or before, the authorized user can also select the desired time period 1716, the authorized user can also select the data the user desires to view using button 1718. In the exemplary embodiment disclosed herein, the viewable data includes: HIE load 1720, HITsp 1722, and HIE location 1724. In particular, FIG. 36 show a view of an HIE load screen 1800 that includes reporting period view 1830 of the impact chart 1150 and reporting period view 1850 of the alert chart 1170. Additionally, FIG. 37 shows a screen 1900 that is a zoomed in version of screen 1800, where only the reporting period view 1830 of the impact chart 1150 is viewable. This chart is broken down in the same manner as the charts discussed above in connection with FIGS. 27, 28B, 28C, as such the above descriptions apply in equal force to this chart.

Figure 38:
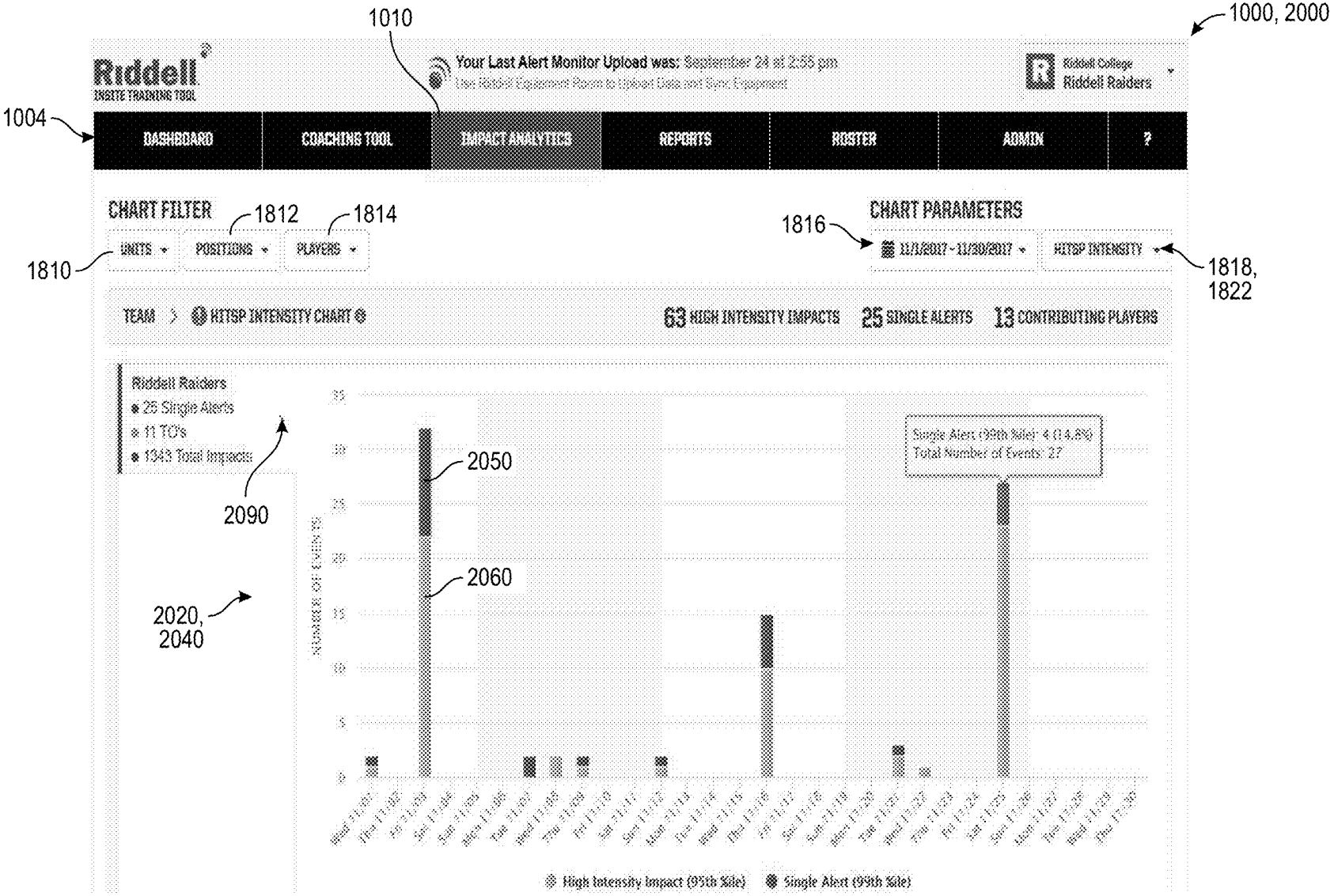
FIG. 38 illustrate a replacement first section of the first screen contained within the impact analytics tool of the GUI, which includes a HITsp load chart for a selected unit (i.e., offense) of the team.

FIG. 38 shows a view of a HITsp screen 2000, which can be reached by selecting HITsp 1822 from the 1818 drop-down button on screen 1800 shown in FIG. 36. By making this selection, the reporting period view 1830 of the impact chart 1150 is replaced with a reporting period view 2020 of the HITsp chart 2040. The HITsp chart 2040 shows the single alerts 2050 and cumulative alerts 2060 that were recorded by the HIU 22 over the reporting period. Additionally, as discussed above in connection with FIG. 31, the authorized user can hover their mouse over a section of the graph to obtain additional information. In FIG. 38, additional information is displayed about the single alerts that occurred on Nov. 25, 2017. Specifically, there were four single alerts that occurred on Nov. 25, 2017, which made up 14.8% of the total alerts (i.e., 27) that occurred on Nov. 25, 2017.

Figure 39:
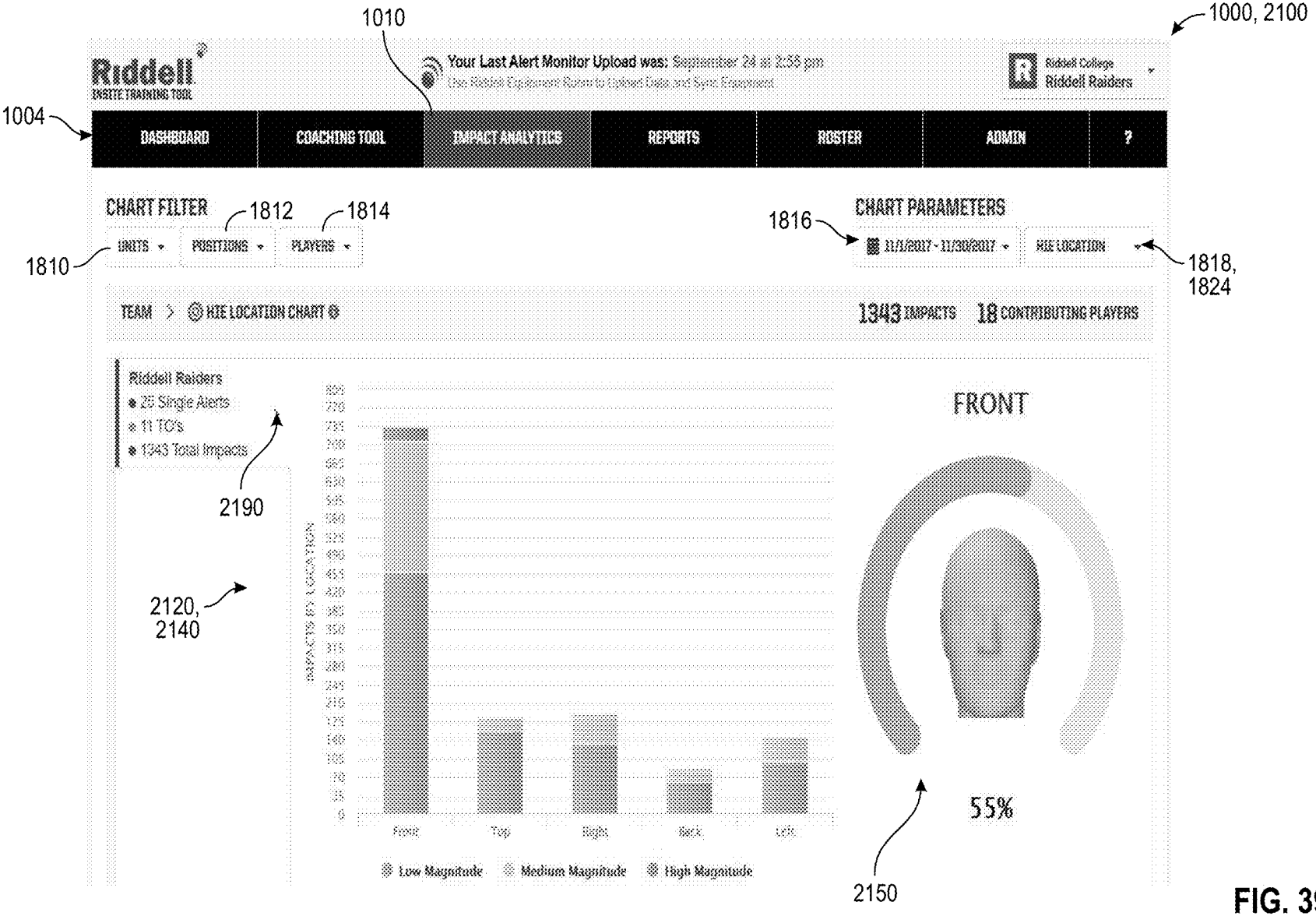
FIG. 39 illustrates a replacement first section of the first screen contained within the impact analytics tool of the GUI, which includes an HIE location chart for a selected unit (i.e., offense) of the team.

FIG. 39 shows a view of an HIE location screen 2100, which can be reached by selecting HIE location 1824 from the 1818 dropdown button on screen 1800 shown in FIG. 36. By making this selection, the reporting period view 1830 of the impact chart 1150 is replaced with a reporting period view 2120 of the HIT location chart 2140. The HIT location chart 2140 shows the impact locations that were recorded by the HIU 22 over the reporting period and their associated severity level (e.g., low, medium, and high). In addition to including a breakdown of these HIT locations in chart 2140, the HIE location screen 2100 also includes a graphical representation 2150 of a player's head that shows the HIE location that makes up a majority of the impact that is shown within the reporting period.

Figure 40:
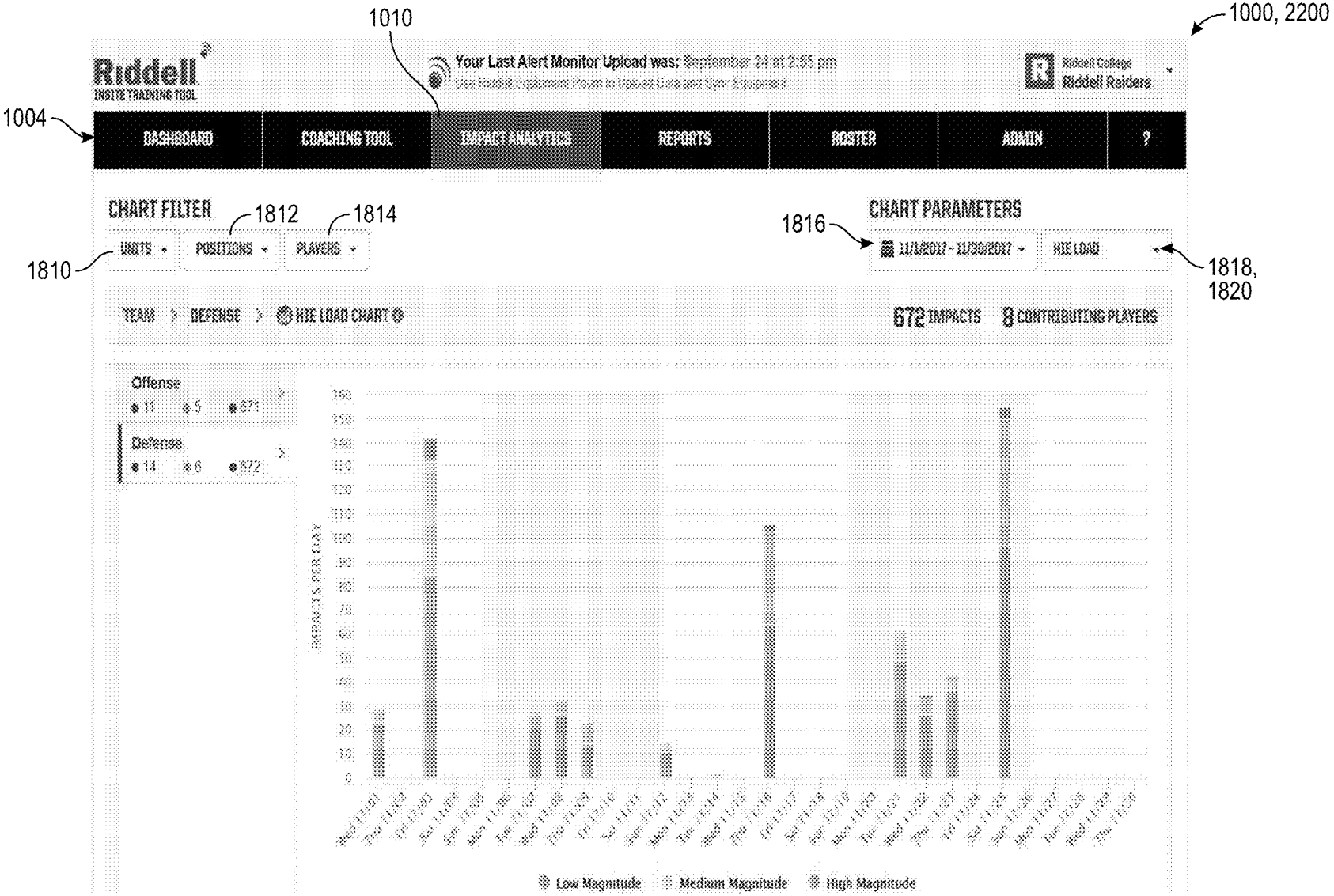
FIG. 40 illustrates the first section of the first screen contained within the impact analytics tool of the GUI, which includes the HIE load chart for a selected unit (i.e., offense) of the team.

Similar to the transitional functionality between FIGS. 30C and 31, the authorized user may select a desired unit from the drop-down using button 1810 or may select the arrow 1890 to transition from the team HIE load screen 1800, as shown in FIG. 37, to a unit HIE load screen 2200, shown in FIG. 40. The only difference between the team HIE load screen 1800 to the unit HIE load screen 2200 is the fact that the HIE load data is displayed for a different player grouping (e.g., defense instead of the team). Likewise, the authorized user may select a desired unit from the drop-down using button 1810 or may select the arrow 2090 to transition from the team HITsp screen 2000, as shown in FIG. 38, to a unit HITsp screen 2300, shown in FIG. 41. The only difference between the team HITsp screen 2000 to the unit HITsp screen 2300 is the fact that the HITsp data is displayed for a different player grouping (e.g., defense instead of the team). Further, the authorized user may select a desired unit from the drop-down using button 1810 or may select the arrow 2190 to transition from the team HIE location screen 2100, shown in FIG. 39, to a unit HIE location screen 2400, shown in FIG. 42. The only difference between the team HIE location screen 2100 to the unit HIE location screen 2400 is the fact that the HIE location data is displayed for a different player grouping (e.g., defense instead of the team). As described above, different groupings of players (e.g., team, unit, position) may be selected for analysis. Another example of a different grouping is shown in connection with FIG. 43, which displays position HIE load screen 2500 for linebackers of the reporting period. It should be understood that other grouping of players may be selected, other recorded physiological parameter data may be displayed, other reporting ranges may be picked to display information that will aid the authorized user in training players and developing practice plans.

In contrast to the data shown in FIGS. 36-43 that display data related to a group of players, FIGS. 44-48 show various screens 2600, 2700 2800, 2900, and 3000 that display data related to one specific player. This allows the authorized user to understand the HIE load, HITsp, and HIE location of the impacts the specific player (e.g., Vin Malloy) has experienced over the reporting time period. In addition to displaying the HIE load, HITsp, and HIE location for the player, the authorized user can also graphically compare this data against data that is associated with other groups within the team. As shown in FIG. 44, the authorized user can compare Vin Malloy's HIE load, shown by the bars within the graph, for the reporting time period against the average HIE load for the team, shown by the black line 2610. This information allows the authorized user to make determinations about how the player is comparing, on average, against other groups within the team. For example, is this player receiving far more impacts than other players within the team that is participating in the same activities. In addition to comparing the team's data against the player's data, the system can also compare any one of the following: team, unit, position, player against any one of the following: team, unit, position, player. It should be understood that other comparisons could be made.

Figure 49:
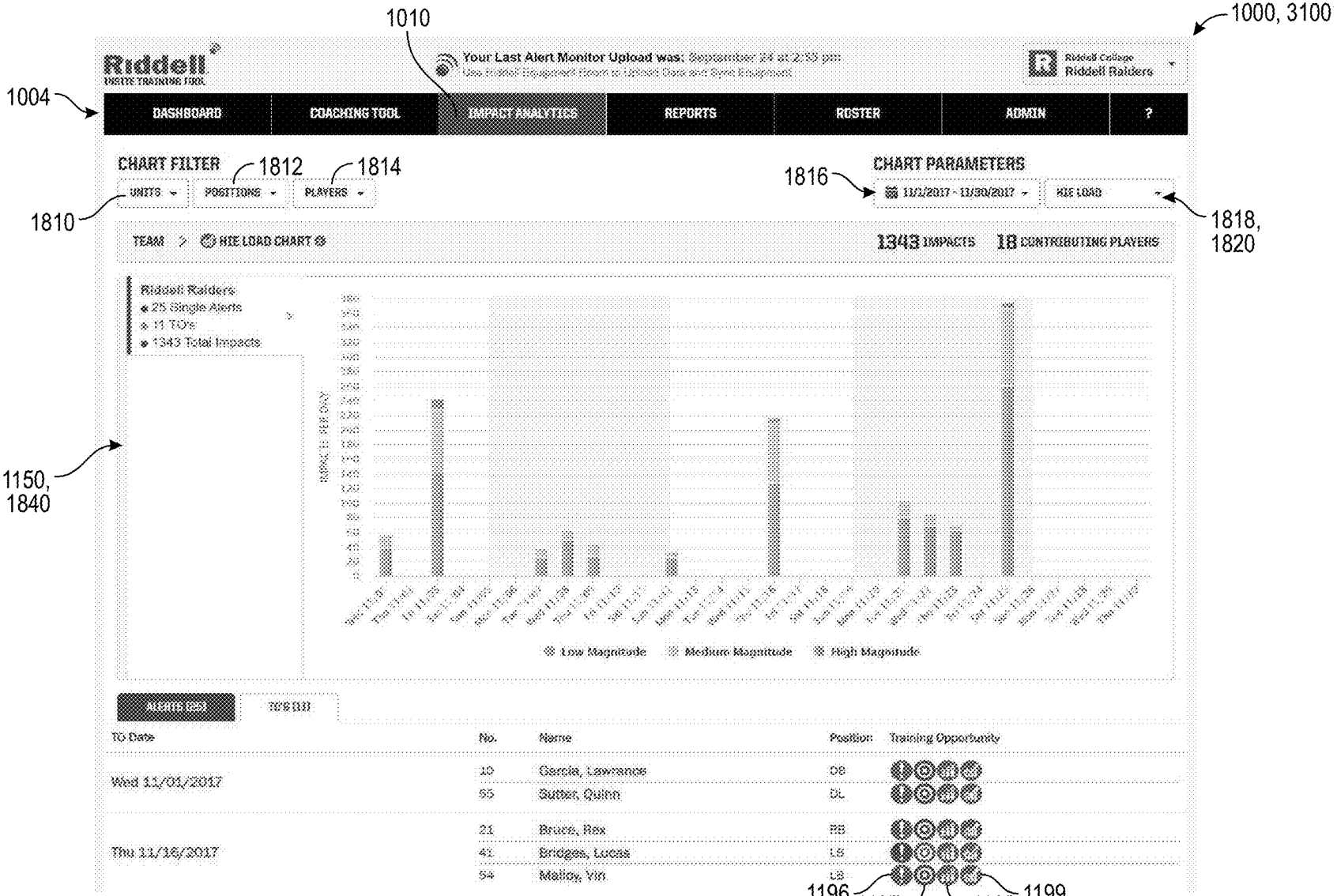
FIG. 49 illustrates a second screen contained within the impact analytics tool of the GUI, which includes an HIE load chart and the training opportunity chart.
Figure 50:
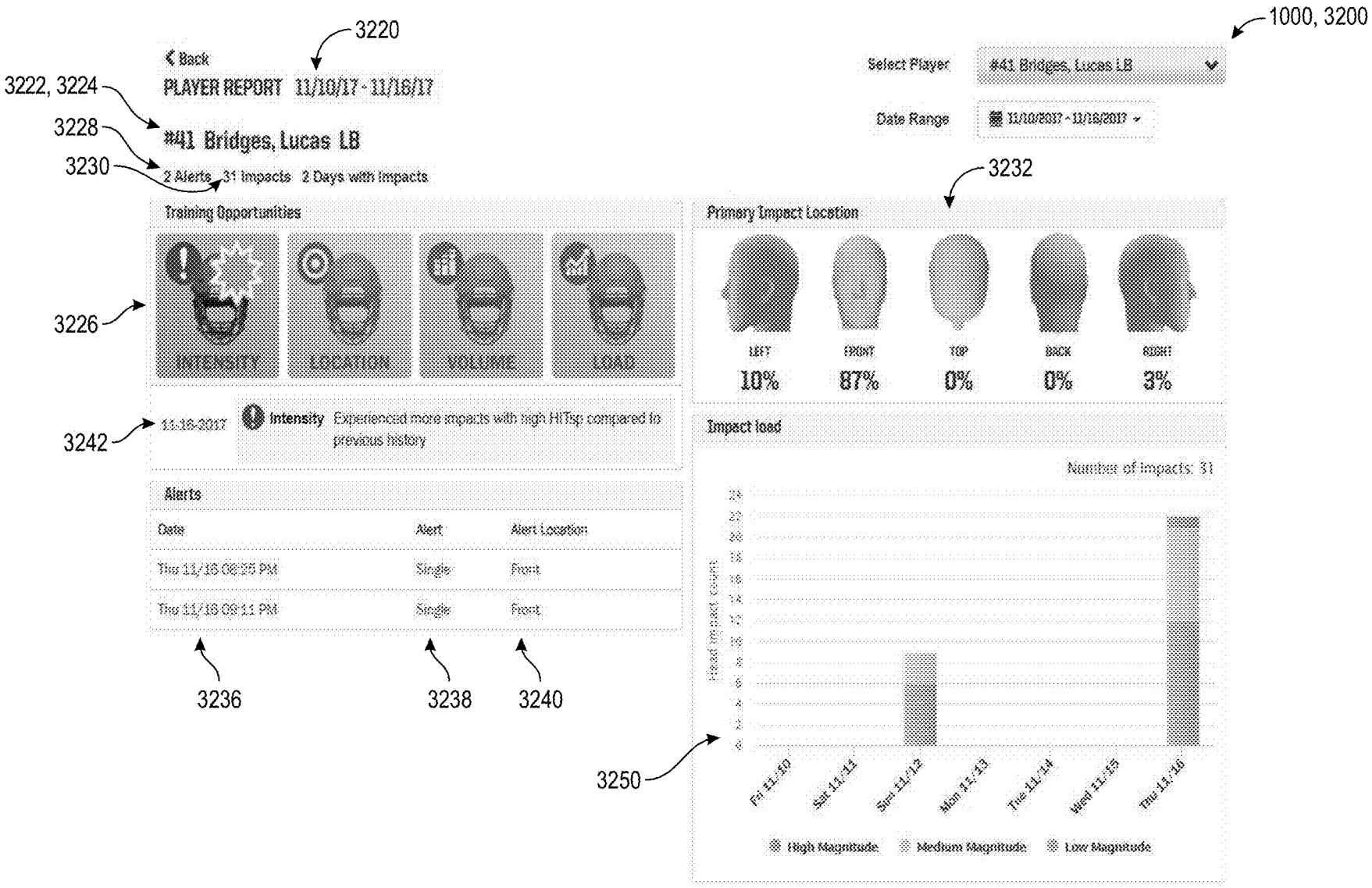
FIG. 50 illustrates a third screen of the impact analytics tool of the GUI, which includes a second example of a player report for a predefined amount of time (e.g., 7 days) and showing a training opportunity based upon impact intensity.

Referring to FIG. 49, the authorized user can gain additional information about each of the training opportunities by selecting the training opportunity icons 1196, 1197, 1198, and 1199 on the right side of the screen. For example, if the authorized user may select icon or indicator 1196 that is associated with Lucas Bridges, the specific player training opportunity screen or player report 3200 is displayed for the selected training opportunity is displayed in FIG. 50. Referring to FIG. 50, the player training opportunity screen or player report 3200 is derived from the physiological data that was collected using at least one of the eight algorithms (e.g., 504, 506, 508, 510, 512, 514, 516, and 518) discussed above. The specific player report displays: (i) the report time period 3220, (ii) player's name 3222, (iii) player details 3224 (e.g., player's number and player's position), (iv) training opportunities 3226 triggered by a player during the report time period, (v) the number of alerts 3228 triggered by a player during the report time period, (vi) the number of impacts 3230 experienced by a player during the report time period, (vii) graphical representation of the impact locations 3232 the player experienced during the report time period, wherein the percentages of impacts are shown below the graphical representations of the headform, (viii) alert date 3236, (ix) alert type 3238, (x) alert location 3240, (xi) reporting view 3250 of the impact chart 1150, and (xii) training opportunity date 3242. The specific player report for Lucas Bridges, FIG. 50, shows that the specific player triggered one intensity-based training opportunity 1196 on Nov. 16, 2017. This training opportunity was based upon the specific player experiencing more impacts with high HITsp compared to the player's previous history using algorithm 508 and is training opportunity #3.

Figure 51:
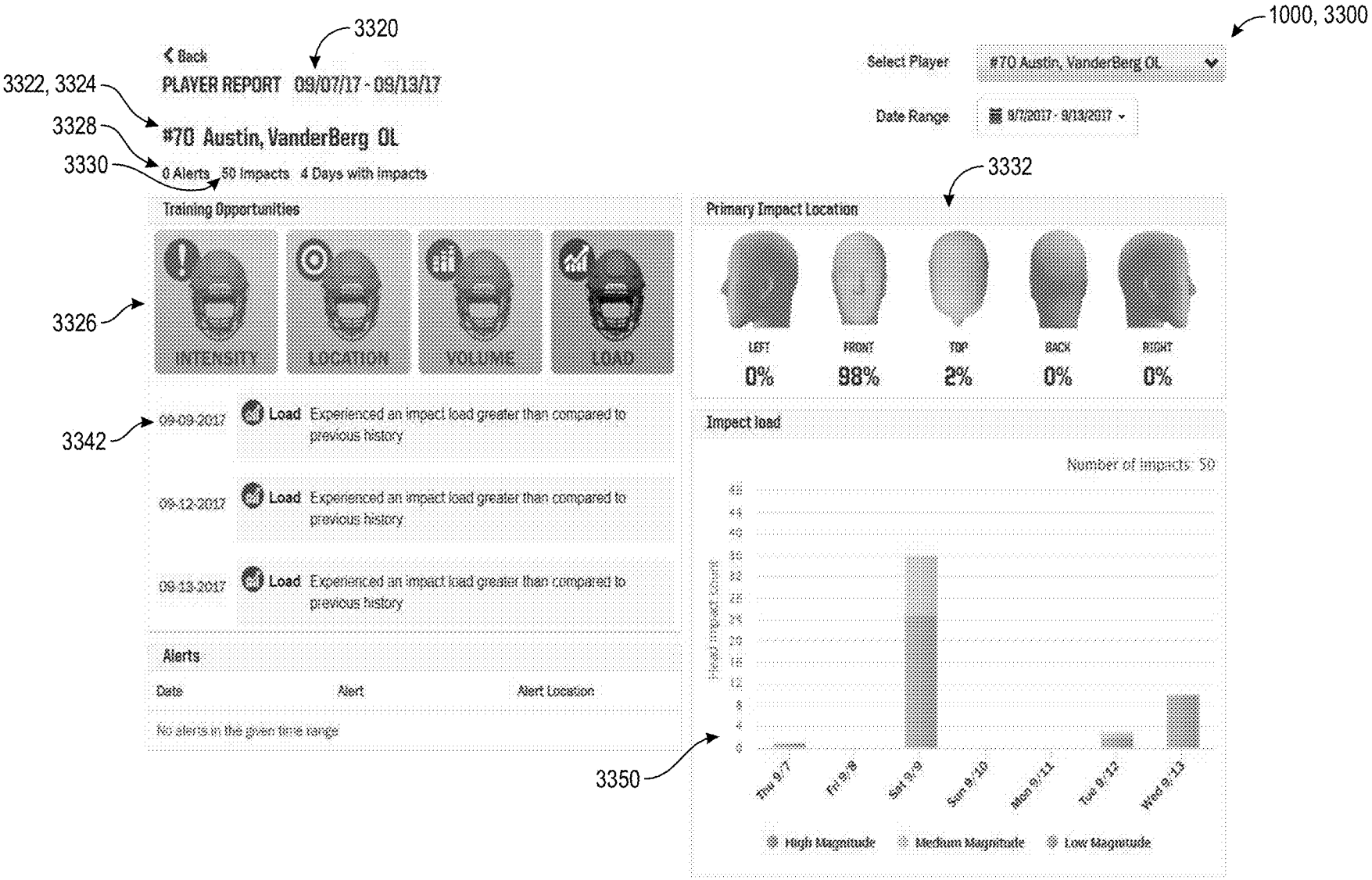
FIG. 51 illustrates a fourth screen of the impact analytics tool of the GUI, which includes a third example of a player report for a predefined amount of time (e.g., 7 days) showing a training opportunity based upon impact load.

Alternatively, the authorized user may select icon or indictor 1199 that is associated with VanderBerg Austin, the specific player training opportunity screen or player report 3300 is displayed for the selected training opportunity is displayed in FIG. 51. Referring to FIG. 51, the specific player training opportunity screen or player report 3300 is derived from the physiological data that was collected using at least one of the eight algorithms (e.g., 504, 506, 508, 510, 512, 514, 516, and 518) discussed above. The specific player report displays: (i) the report time period 3320, (ii) player's name 3322, (iii) player details 3324 (e.g., player's number and player's position), (iv) training opportunities 3326 triggered by a player during the report time period, (v) the number of alerts 3328 triggered by a player during the report time period, (vi) the number of impacts 3330 experienced by a player during the report time period, (vii) graphical representation of the impact locations 3332 the specific player experienced by a player during the report time period, wherein the percentages of impacts are shown below the graphical representations of the headform, (viii) alert date 3336, (ix) alert type 3338, (x) alert location 3340, (xi) reporting view 3350 of the impact chart 1150, and (xii) training opportunity date 3342. The specific player report for VanderBerg Austin, FIG. 51, shows that the specific player triggered three loads based training opportunity 1199 on Sep. 9, 2017, Sep. 12, 2017, and Sep. 13, 2017. This training opportunity is based upon the specific player experiencing an impact load that is greater than the player's history. This training opportunity was determined using algorithm 516 and is training opportunity #7.

Figure 52:
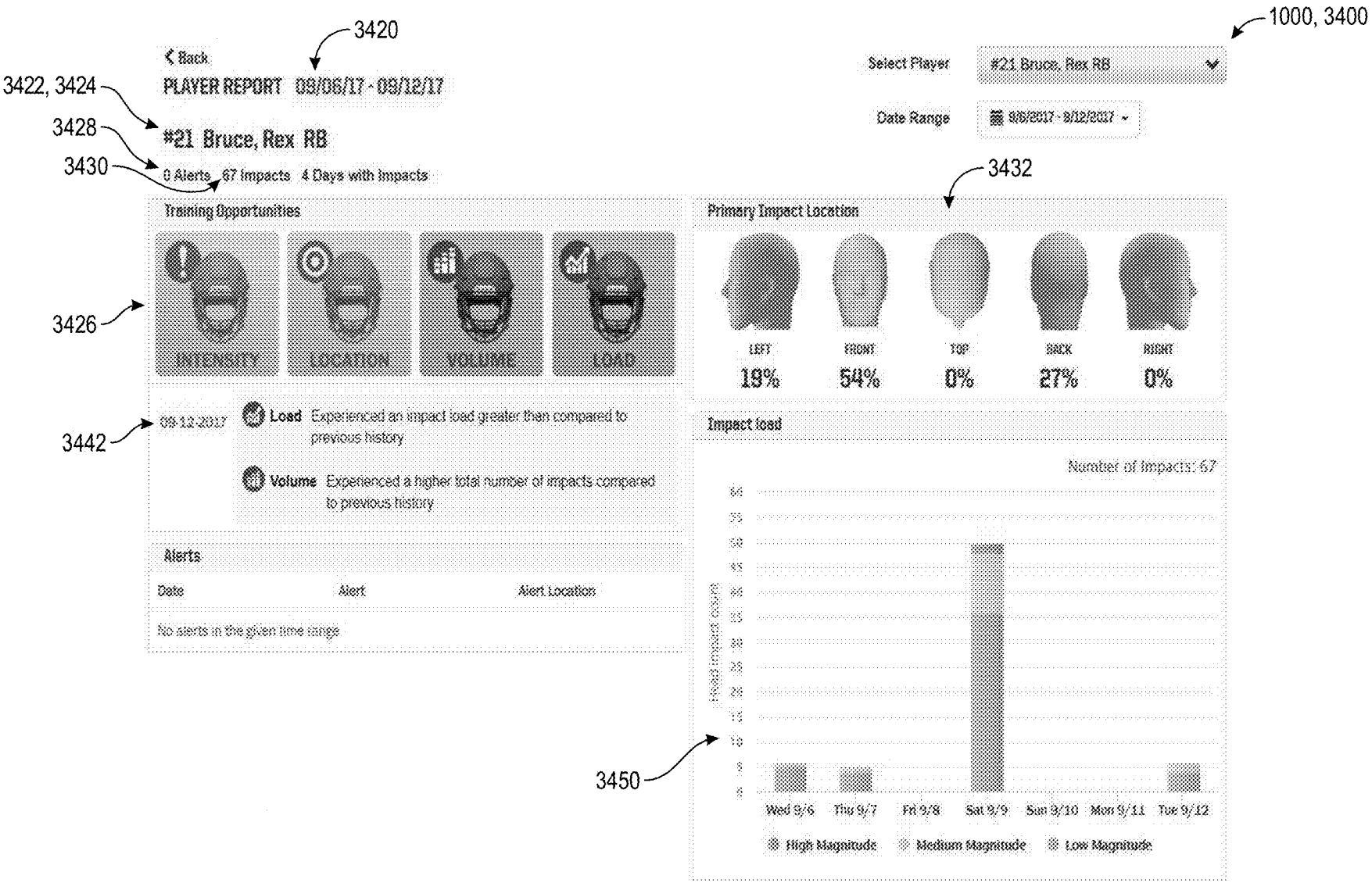
FIG. 52 illustrates a fifth screen of the impact analytics tool of the GUI, which includes a fourth example of a player report for a predefined amount of time (e.g., 7 days) and showing a training opportunity based upon impact volume and load.
Figure 53:
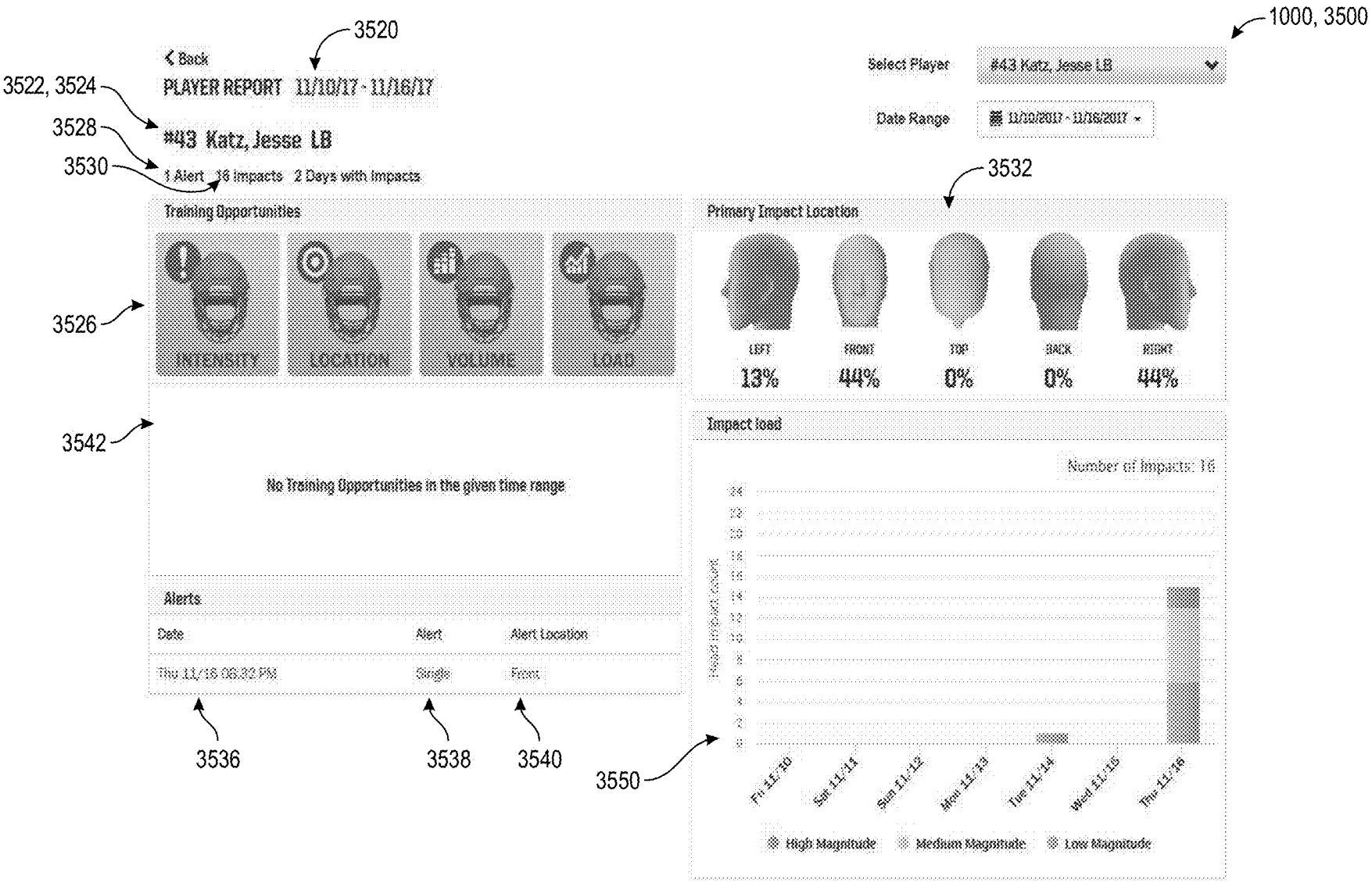
FIG. 53 illustrates a sixth screen of the impact analytics tool of the GUI, which includes a fifth example of a player report for a predefined amount of time (e.g., 7 days) and showing no training opportunity being triggered.

Further, the authorized user may select icon or indicator 1198 that is associated with Rex Bruce, the specific player training opportunity screen or player report 3400 is displayed for the selected training opportunity is displayed in FIG. 52. Referring to FIG. 52, the specific player training opportunity screen or player report 3200 is derived from the physiological data that was collected using at least one of the eight algorithms (e.g., 504, 506, 508, 510, 512, 514, 516, and 518) discussed above. The specific player report displays: (i) the report time period 3420, (ii) player's name 3422, (iii) player details 3424 (e.g., player's number and player's position), (iv) training opportunities 3426 triggered by a player during the report time period, (v) the number of alerts 3428 triggered by a player during the report time period, (vi) the number of impacts 3430 experienced by a player during the report time period, (vii) graphical representation of the impact locations 3432 the player experienced by a player during the report time period, wherein the percentages of impacts are shown below the graphical representations of the headform, (viii) alert date 3436, (ix) alert type 3438, (x) alert location 3440, (xi) reporting view 3450 of the impact chart 1150, and (xii) training opportunity date 3442. The player report for Rex Bruce, FIG. 52, shows that the specific player triggered one volume and one load based training opportunities 1198 on Sep. 12, 2017. These training opportunities are based upon the specific player experiencing an impact load that is greater than the player's history and experiencing a higher number of impacts compared to the player's history. These training opportunities were determined using algorithm 516 and is training opportunity #7 and using algorithm 512 and is training opportunity #5. While only a few player reports that contain training opportunities were shown in FIGS. 35 and 50-53, it should be understood that each of the 19 training opportunities that were discussed above in detail in connection with FIGS. 14-18 along with the other training opportunities that were discussed more generally in connection with FIGS. 13B-13D may also be displayed within player reports. These additional player reports may take a form that is similar to the forms shown in FIGS. 35 and 50-53.

Figure 54:
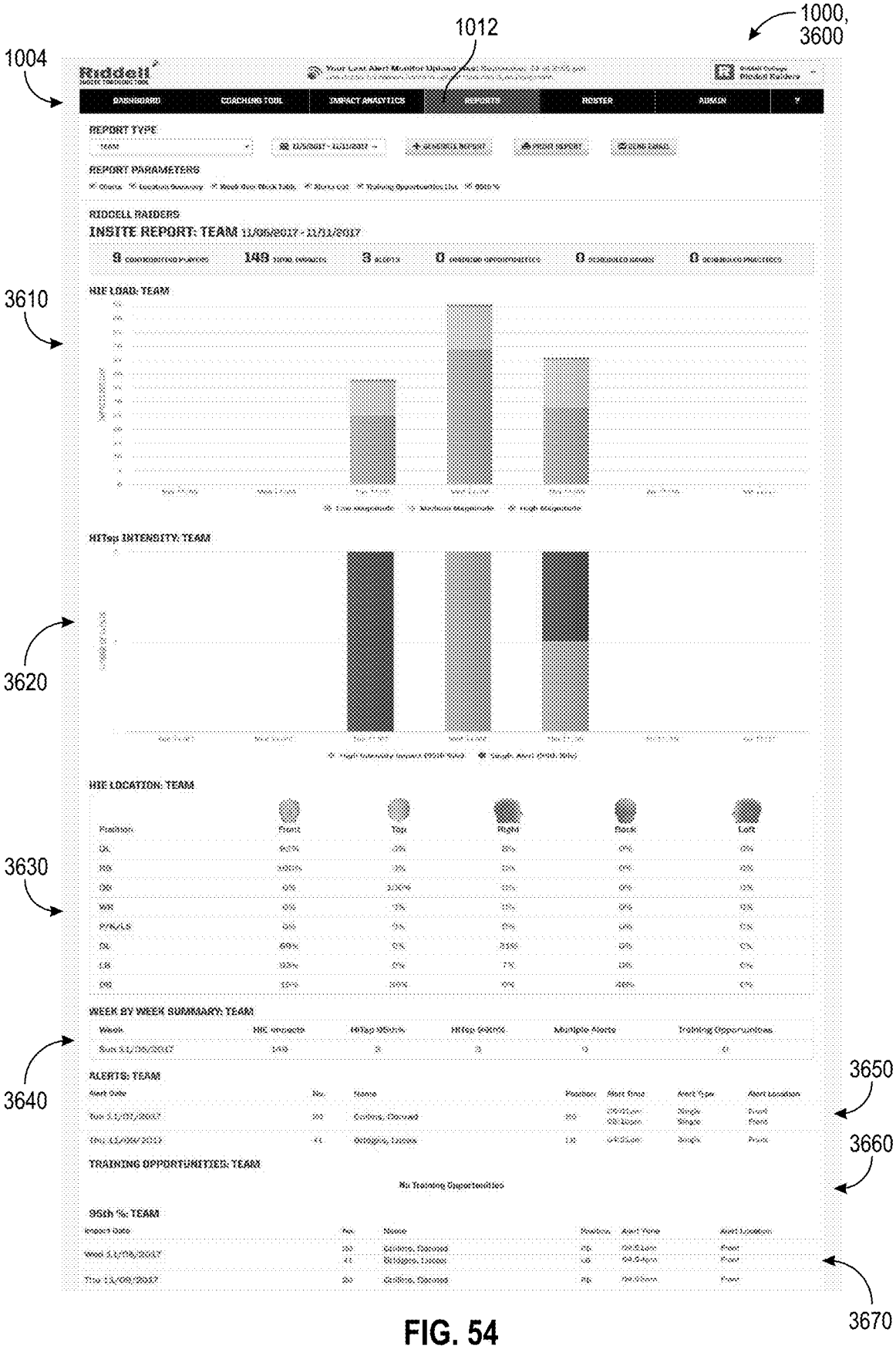
FIG. 54 illustrates a first screen of the team report tool of the GUI, which shows data that was recorded of a reporting period.
Figure 56:
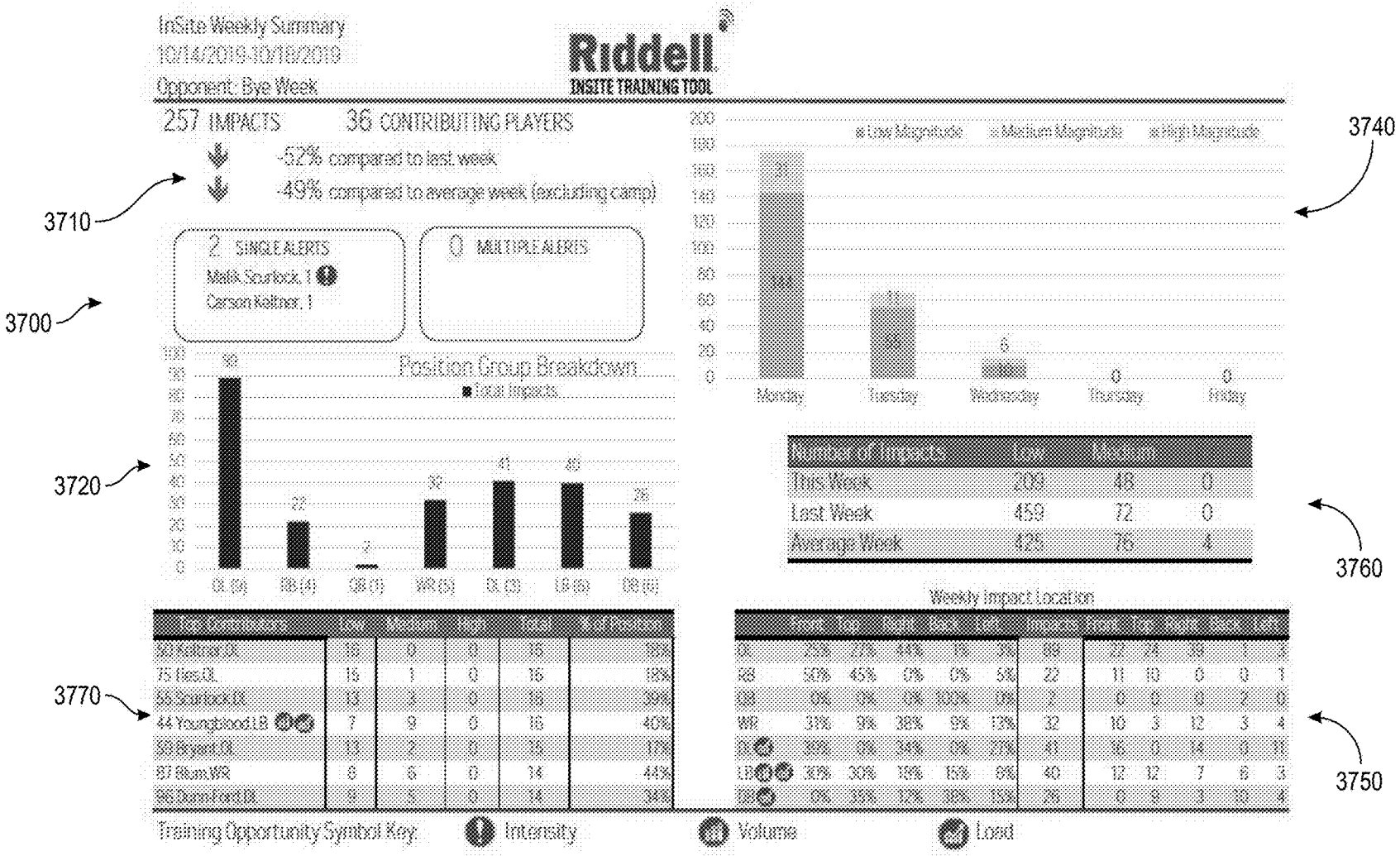
FIG. 56 illustrates a first weekly report for a team that is sent to an authorized user.
Figure 57:
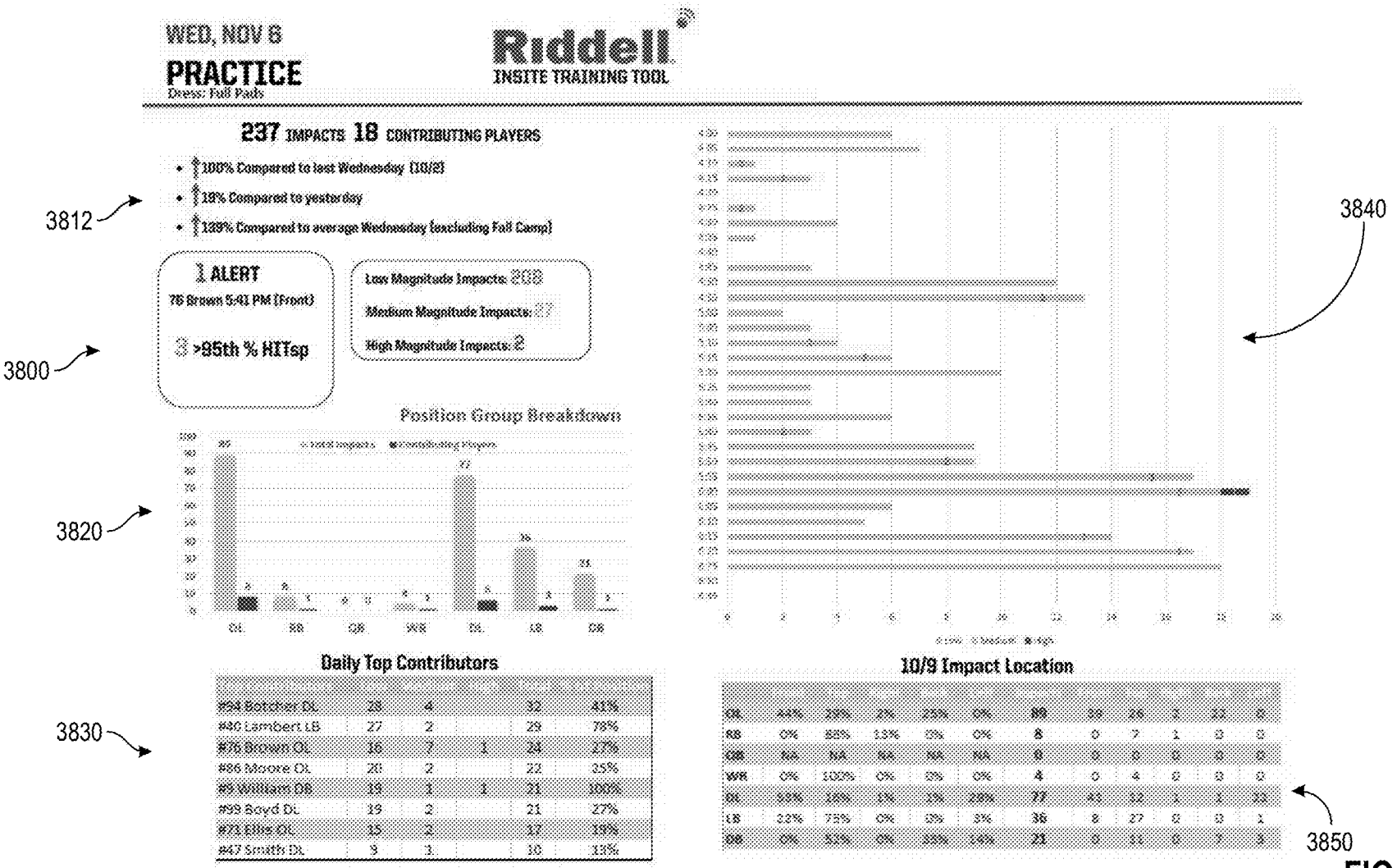
FIG. 57 illustrates a first daily report for a team that is sent to an authorized user.

In addition to generating player reports, as shown in FIGS. 35 and 50-53, system 10 may also generate other reports. These reports may be time-based reports (e.g., daily, weekly, monthly, seasonally, or custom) or the reports may be player group-based reports (e.g., team, unit, position, or custom). As shown in FIG. 54, these reports may be generated by manually going into the system 10 using the remote terminal 28 and selecting the reports tab 1012. Alternatively, as shown in FIGS. 56 and 57, the reports may be automatically generated by the system 10 and sent (e.g., via email or text) to the authorized users. Further, the system 10 may allow a user to design a custom report (e.g., select the layout and the information contained within the report) within the system 10 and have this custom report automatically generated after a predefined time period, such as a day, week, or month.

Referring to FIG. 54, the authorized user may create the report 3600 for the entire team over the reporting period. This report 3600 may contain: (i) the HIE load of the team over the reporting period 3610, (ii) the HITsp for the team over the reporting period 3620, (iii) the HIE location for the team over the reporting period 3630, (iv) a weekly summary 2640, (v) all alerts that occurred during the reporting period 3650, (vi) training opportunities that were triggered over the reporting period 3660, (vii) which players are experiencing impacts that are greater than 95% of their team 3670, and/or (viii) other similar information. It should be understood that all or a subset of this information may be included within this report 3600.

Figure 55A:
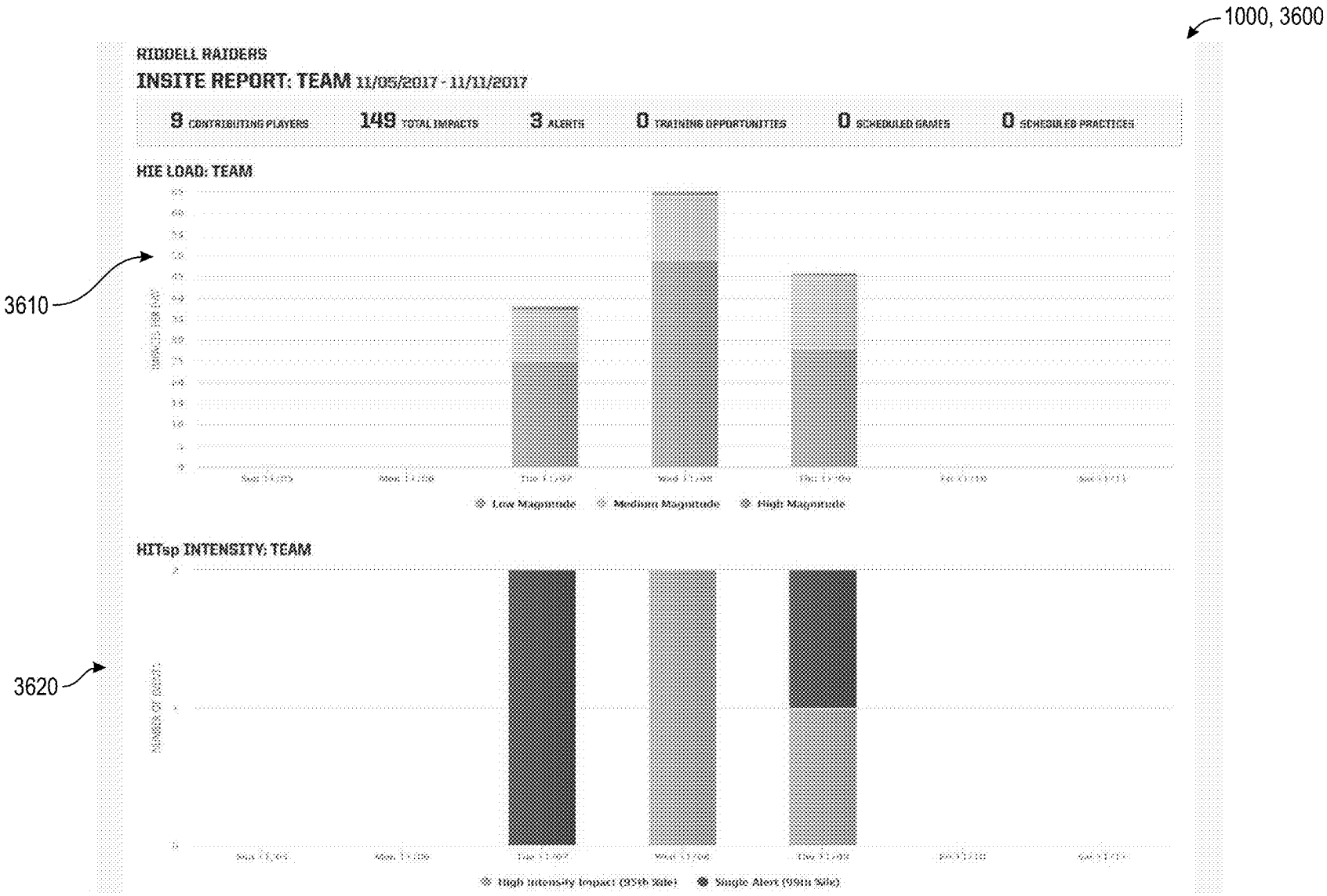
FIG. 55A illustrates a first section of the first screen of the team report tool of the GUI.

FIGS. 55A-55B show zoomed in sections of the report 3600 shown in FIG. 54. Specifically, the HIE load of the team over the reporting period 3610 shows the number of impacts per day and the severity (e.g., low, medium, and high) of these impacts. The HITsp for the team over the reporting period of 3620 shows the number of alerts that were received per day. For example, two single impact alerts were received on Nov. 7, 2017. The HIE location for the team over the reporting period 3630 breaks down the team into individual positions and then displays the percentage of impacts per location. For example, an average of all players who played offensive line during the reporting period received 92% of their impacts in the front of their helmet. In contrast, an average of all players who played defensive back during the reporting period received 46% of their impacts in the rear of their helmet. The weekly summary 2640 shows a quick snapshot of the HIE impacts 3641, HITsp impacts that were greater than the 95% for the player's position and level 3642, HITsp impacts that were greater than the 99% for the player's position and level 3643, cumulative alerts 3644, and training opportunities 3645 that occurred during the week. Finally, the alerts 3650, training opportunities 3660 and 95% impact 3670 provide additional information about which players experienced these impacts.

FIGS. 56 and 57 show reports that can automatically be generated by the system 10. These reports provide a significant improvement in the efficiency of the system 10 because it does not have to perform all of these algorithms, which also improves the efficiency of the system 10 as it reduces the amount of data that system 10 must simultaneously monitor and process. For example, the algorithms that are described above can be performed during times when the system 10 is not being used (e.g., late at night) during practice or game play, which in turn allows the system 10 to focus on requests made by authorized users that are actively logged into the system 10. Additionally, creation of the reports reduce the cost of running the system 10 because the system can tailor its power usage (e.g., when it performs the above described algorithms) to select times when power is less expensive and by providing the reports the authorized user does not have to log into the system to pull this information therefrom. Further, these reports provides a significant improvement in the efficiency of using the system 10 by bringing together and effectively visually presenting a limited list of high priority information without requiring the user to navigate through multiple screens in order to obtain this information. This in turn improves the efficiency of using the system 10 because it saves the user from even logging into the system 10 let alone navigating through multiple screens. These factors tangibly improve the functionality of the system 10, particularly the user interface, and more particularly effectively displaying the user interface on a remote terminal 28 that has a small screen (e.g., mobile phone).

The report shown in FIGS. 56 and 57 are similar to the report shown in FIGS. 54-55B. These reports include some similarities and some differences. For example, some of the similarities include the fact that both include HIE load chart 3740, and HIE location for the team over the reporting period 3750. Some differences between the report shown in FIGS. 54-55B and the report are shown in FIG. 56 include: the comparison between weeks 3710, the total number of impacts broken down by group 3720, top contributors 3730, and a weekly comparison of the impacts based on severity 3760. Instead of a weekly report that is shown in FIG. 56, a daily report 3800 that is shown in FIG. 57 could be generated. The daily report 3800 contains information that is similar to the weekly report 3700, such as the total number of impacts broken down by group 3820, top contributors 3830, HIE load chart 3840, and HIE location for the team over the reporting period 3850. Additionally, the daily report includes comparisons between days 3812 and other general information. It should be understood that these reports are only example reports and are not intended to be limiting. As such, it should be understood that a report may include any information that is contained within the team/national database 32, 38 that the authorized user is allowed to access.

Figure 58:
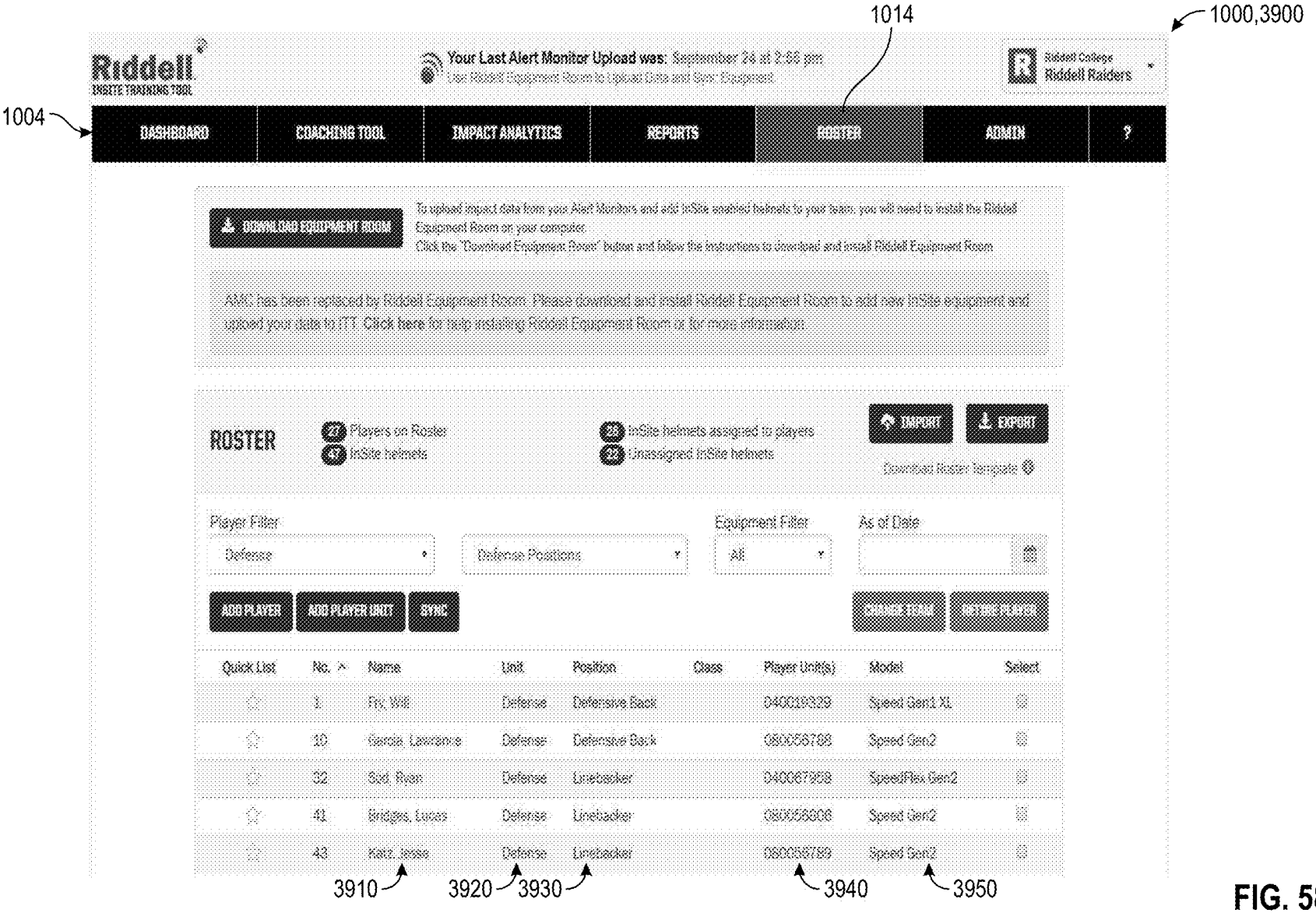
FIG. 58 illustrates a first screen of the roster tool of the GUI, which includes players that are on the team's roster.

FIG. 58 show the roster page 3900 that displays the players 3910, units 3920, positions 3930, the IHU 22 identifier 3940, and the helmet model 3950. As described above, this page 3900 is the page the authorized user utilizes to enter the player's information and associate that information with a specific IHU 22. Once this occurs, then the IHU 22 is tailored to the player by programing in the values/ranges into the IHU 22 for the specific player. Also, as discussed above, these original values/ranges may be adjusted or replaced after a predefined number of impacts have been experienced. Nevertheless, this roster page 3900 provides an overview of the player's and their associated information. Additionally, as discussed above, this roster page 3900 may include additional information about each player, such as equipment assignments and profiles (e.g., relevant sizes, type of shoes, type of helmet, type of helmet padding, type of chin strap, type of faceguard, and etc.), medical data for each player (e.g., medical history, injuries, height, weight, emergency information, and etc.), other statistics for the players, workout regiments for the players, other player data (e.g., head and helmet scans, contact information, or class year in school) and/or etc.

Figure 59:
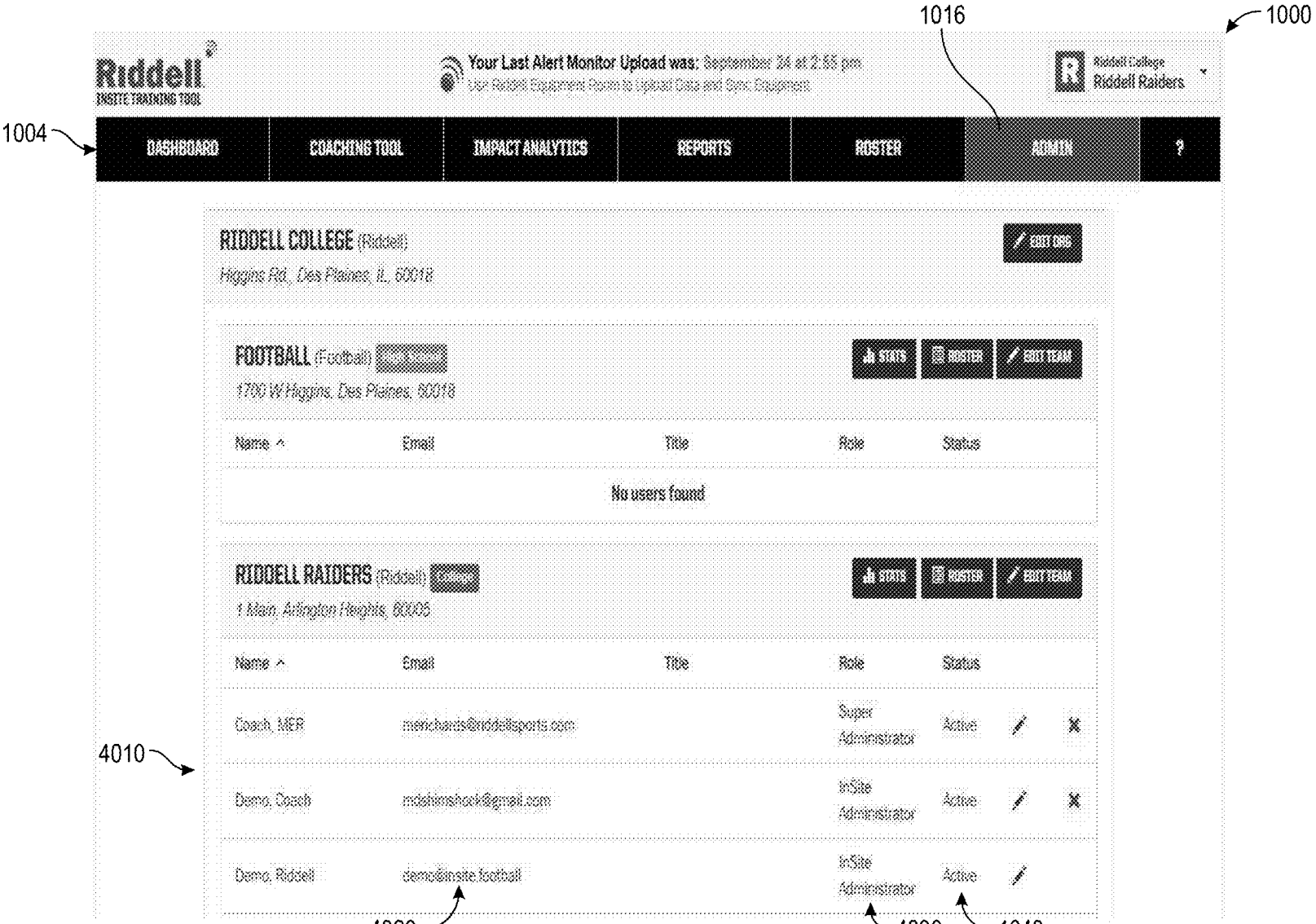
FIG. 59 illustrates a first screen of the administrator tool of the GUI.
Figure 60:
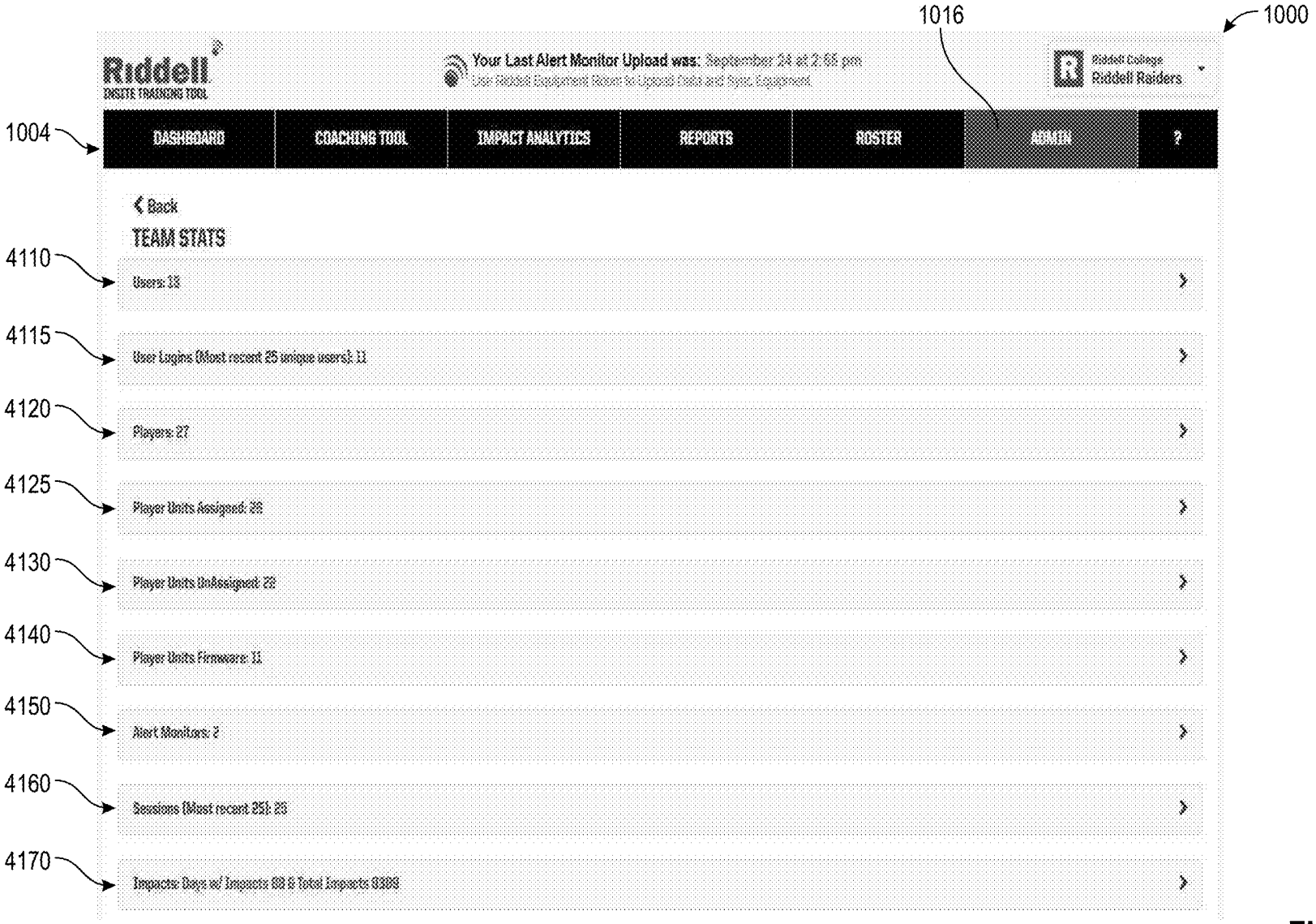
FIG. 60 illustrates a second screen of the administrator tool of the GUI.
Figure 61A:
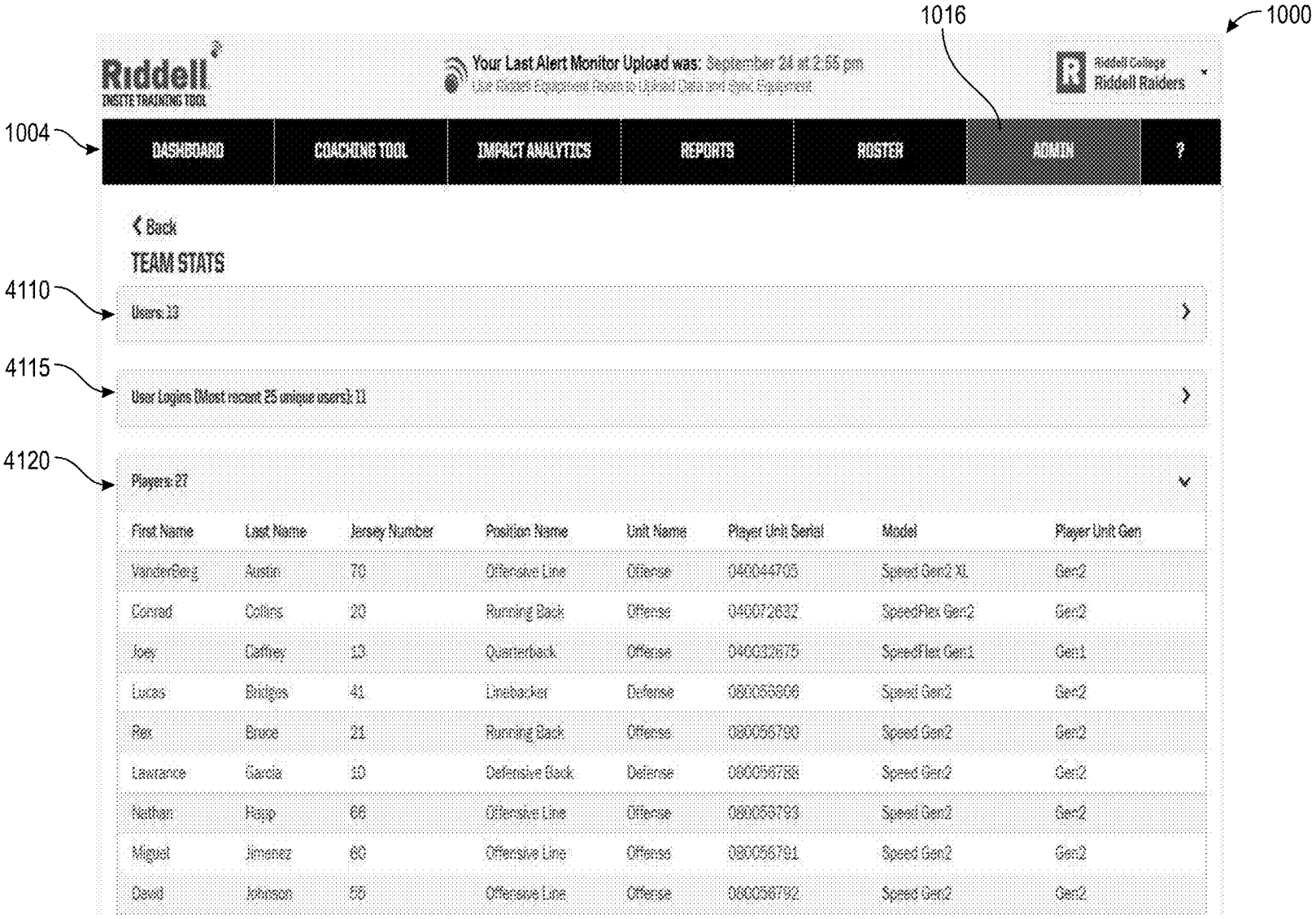
FIG. 61A illustrates a first section of a third screen of the administrator tool of the GUI.
Figure 61B:
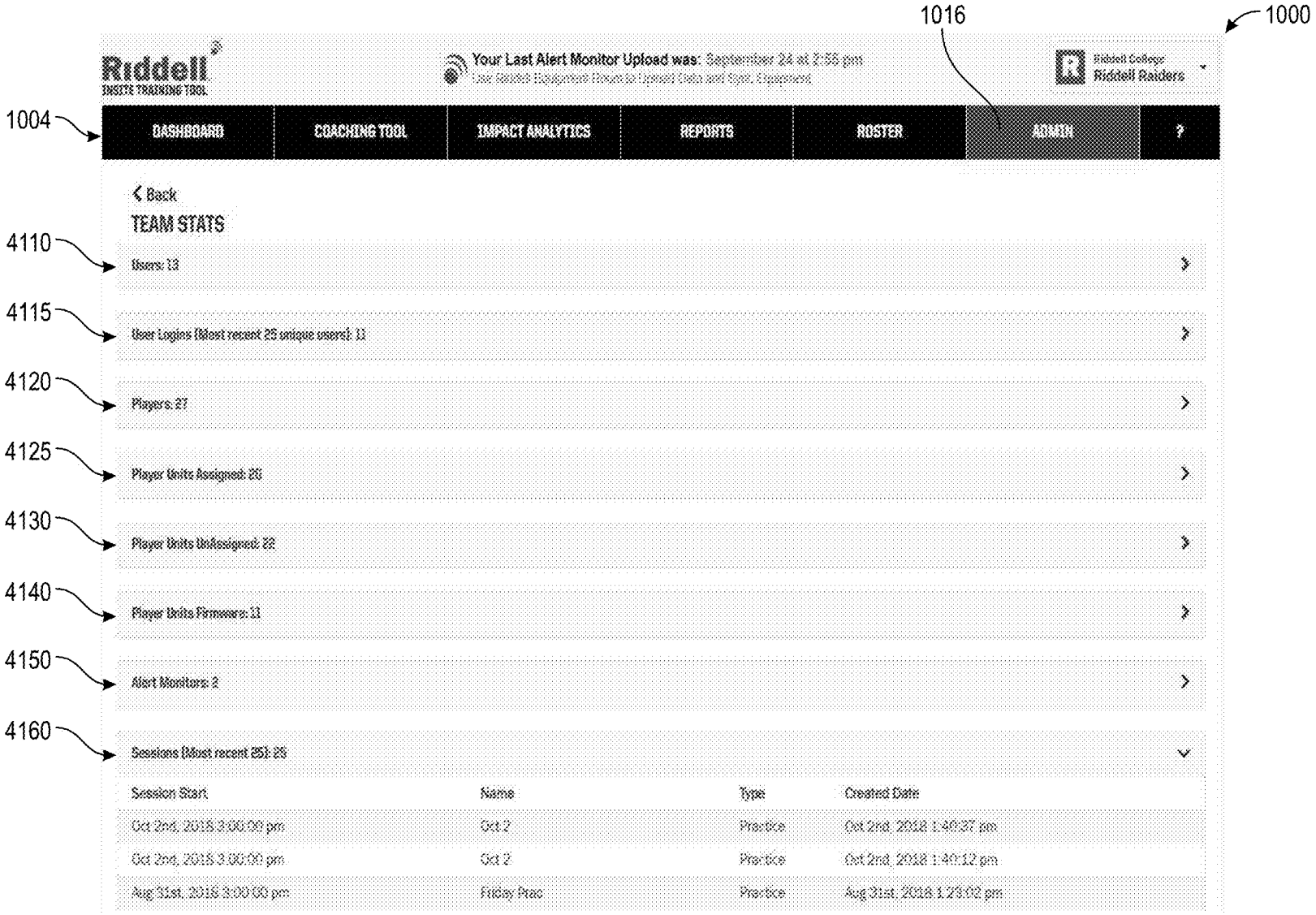
FIG. 61B illustrates a second section of a third screen of the administrator tool of the GUI.
Figure 61C:
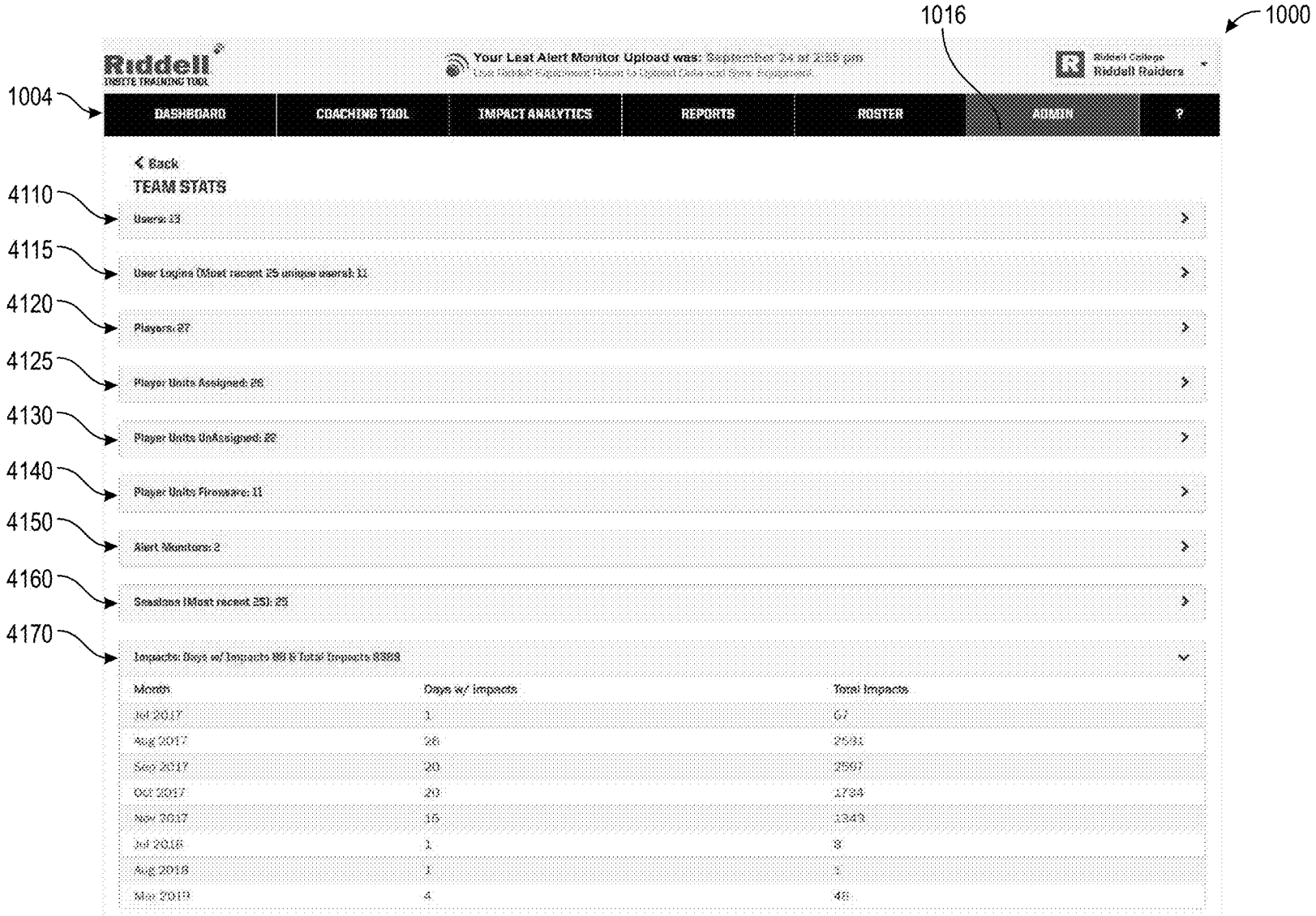
FIG. 61C illustrates a third section of a third screen of the administrator tool of the GUI.

FIG. 59 shows general administrator capabilities that can be accessed by selecting tab 1016 from any screen. These general administrator capabilities include knowledge about who are authorized users 4010, their email address 4020, their access level 4030, and their status 4040. As discussed above, an authorized user may have different access levels. For example, Coach MER has super administrator access, which allows him to access his team data and make any changes therein. However, Coach MER cannot access any other team data or any information that is not associated with his team. In contrast, Riddell Demo has InSite Administrator access, which allows him to access all team data from around the country/world. Additionally, contained within the administrator tab 1016, are general team statistics. Examples of such team statistics are shown in FIGS. 60 and 61C. Specifically, FIG. 60 show the number of users 4110, user logins 4115, number of players that are on the roster 4120, number of IHU 22 that are assigned to players 4125, number of IHUs 22 that are not assigned to players 4130, firmware versions of each IHU 4140, information about the alert devices 4150, information about the 25 most recent sessions 4160, and total number of impacts 4170. Each of these items can be expanded by selection of the arrow 4105 to display additional information, examples of such are shown in FIGS. 61A-61C.

7. Industrial Application

As is known in the data processing and communications arts, a general-purpose computer typically comprises a central processor or other processing device, an internal communication bus, various types of memory or storage media (RAM, ROM, EEPROM, cache memory, disk drives etc.) for code and data storage, and one or more network interface cards or ports for communication purposes. The software functionalities involve programming, including executable code as well as associated stored data. The software code is executable by the general-purpose computer. In operation, the code is stored within the general-purpose computer platform. At other times, however, the software may be stored at other locations and/or transported for loading into the appropriate general-purpose computer system.

A server, for example, includes a data communication interface for packet data communication. The server also includes a central processing unit (CPU), in the form of one or more processors, for executing program instructions. The server platform typically includes an internal communication bus, program storage and data storage for various data files to be processed and/or communicated by the server, although the server often receives programming and data via network communications. The hardware elements, operating systems and programming languages of such servers are conventional in nature, and it is presumed that those skilled in the art are adequately familiar therewith. The server functions may be implemented in a distributed fashion on a number of similar platforms, to distribute the processing load.

Hence, aspects of the disclosed methods and systems outlined above may be embodied in programming. Program aspects of the technology may be thought of as "products" or "articles of manufacture" typically in the form of executable code and/or associated data that is carried on or embodied in a type of machine-readable medium. "Storage" type media include any or all of the tangible memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible "storage" media, terms such as computer or machine "readable medium" refer to any medium that participates in providing instructions to a processor for execution.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims. While the specific embodiments have been illustrated and described, numerous modifications come to mind without significantly departing from the spirit of the invention, and the scope of protection is only limited by the scope of the accompanying Claims.

The invention claimed is:

1. A physiological parameter monitoring system for a protective sports helmet worn by a specific player engaged in playing a contact sport, the monitoring system comprising:

a helmet shell;

an energy attenuation layer installed within the helmet shell, the energy attenuation layer having:

an inner extent configured to be placed adjacent to a specific player's head when the helmet is worn by the specific player;

an outer extent configured to be placed adjacent to an inner surface of the helmet shell;

a void residing between the inner and outer extents of the energy attenuation layer;

a first region (i) residing between the inner extent of the energy attenuation layer and the void, and (ii) having a first set of mechanical properties; and a second region (i) residing between the outer extent of the energy attenuation layer and the void, and (ii) having a second set of mechanical properties, wherein at least a portion of the second set of mechanical properties differs from the first set of mechanical properties;

an in-helmet unit removably installed within the helmet shell, the in-helmet unit having:

a sensor assembly removably positioned in the void between the first region and the second region, wherein the sensor assembly is configured to detect sensor data experienced by the specific player while engaged in playing a session of the contact sport;

a control module coupled to the sensor assembly and removably positioned within the helmet shell, the control module being configured to receive sensor data and condition said sensor data to determine physiological parameter data for the specific player, wherein the physiological parameter data is stored in the control module for the session of the contact sport; and a receiving device remote from the helmet shell and the in-helmet unit, wherein the receiving device receives physiological parameter data for the specific player from the control module after completion of one or more plays of the session of the contact sport that resulted in detection of said sensor data by the sensor assembly;

a remote server that subsequently receives physiological parameter data for the specific player from the receiving device that is transmitted after conclusion of the session of the contact sport, wherein the remote server subsequently runs at least one training algorithm that selectively generates a report applicable to the specific player when the received physiological parameter data for the specific player exceeds a predetermined threshold derived from a previously recorded collection of physiological parameter data, wherein said report is provided to an authorized user and includes a collection of information with one or more of: a first training opportunity icon representative of a future training opportunity for the specific player based on impact intensity, a second training opportunity icon representative of a future training opportunity for the specific player based on impact location, a third training opportunity icon representative of a future training opportunity for the specific player based on impact volume, and a fourth training opportunity icon representative of a future training opportunity for the specific player based on impact load; and a remote graphical user interface (GUI) configured to selectively display said report to said authorized user.

2. The physiological parameter monitoring system of claim 1, wherein the previously recorded collection of physiological parameter data includes: (i) a number of alertable impacts other similarly situated players have received over an alertable time period, and (ii) a number of alertable impacts the specific player has received over the alertable time period.

3. The physiological parameter monitoring system of claim 1, wherein the previously recorded collection of physiological parameter data includes: (i) a number of high magnitude impacts other similarly situated players have received over a high magnitude time period, and (ii) a number of high magnitude impacts received by the specific player over the high magnitude time period.

4. The physiological parameter monitoring system of claim 1, wherein the previously recorded collection of physiological parameter data includes: (i) a number of impacts other similarly situated players have received over an impact time period, and (ii) a number of impacts the specific player has received over the impact time period.

5. The physiological parameter monitoring system of claim 1, wherein the previously recorded collection of physiological parameter data includes: (i) an impact load other similarly situated players have received over an impact load time period, and (ii) an impact load the specific player has received over the impact load time period.

6. The physiological parameter monitoring system of claim 1, wherein the previously recorded collection of physiological parameter data includes: (i) an average historical number of high magnitude impacts the specific player has experienced and (ii) an average recent number of high magnitude impacts the specific player has experienced.

7. The physiological parameter monitoring system of claim 1, wherein the previously recorded collection of physiological parameter data includes: (i) an average historical number of impacts the specific player has experienced and (ii) an average recent number of impacts the specific player has experienced.

8. A physiological parameter monitoring system for a protective sports helmet worn by a specific player engaged in playing a contact sport, the monitoring system comprising:

a helmet shell;

an energy attenuation layer installed within the shell of the helmet and including an arrangement of energy attenuation members;

an in-helmet unit removably installed within the helmet shell, the in-helmet unit having:

a sensor assembly positioned within an extent of the arrangement of energy attenuation members of the energy attenuation layer, the sensor assembly configured to detect sensor data experienced by the specific player while playing a session of the contact sport;

a control module positioned within the helmet shell and coupled to the sensor assembly, the control module configured to: (i) receive sensor data from the sensor assembly, (ii) condition the sensor data to derive physiological parameter data for the specific player over a predetermined amount of time, and (iii) store said physiological parameter data prior to transmission of said data after conclusion of the session of the contact sport that resulted in detection of the sensor data;

a remote server configured to receive the physiological parameter data from the control module after the conclusion of said session, wherein the remote server runs at least one training algorithm that selectively generates a report applicable to the specific player when the received physiological parameter data for the specific player exceeds a predetermined threshold derived from a previously recorded collection of physiological parameter data, wherein said report is provided to an authorized user and includes a collection of information with one or more of: a first training opportunity icon representative of a future training opportunity for the specific player based on impact intensity, a second training opportunity icon representative of a future training opportunity for the specific player based on impact location, a third training opportunity icon representative of a future training opportunity for the specific player based on impact volume, and a fourth training opportunity icon representative of a future training opportunity for the specific player based on impact load, and wherein the report is generated after a predetermined amount of time subsequent to the conclusion of said session; and, wherein said previously recorded collection of physiological parameter data is distinct from said physiological parameter data for said specific player.

9. The physiological parameter monitoring system of claim 8, wherein the previously recorded collection of physiological parameter data comprises: (i) said specific player's own historical data, and (ii) a team's historical data.

10. The physiological parameter monitoring system of claim 8, wherein the previously recorded collection of physiological parameter data includes: (i) a sum of alertable impacts other similarly situated players have received over an alertable time period, and (ii) a sum of alertable impacts the specific player has received over the alertable time period.

11. The physiological parameter monitoring system of claim 8, wherein the previously recorded collection of physiological parameter data includes: (i) a sum of impacts other similarly situated players have received over an impact time period, and (ii) a sum of impacts the player has received over the impact time period.

12. The physiological parameter monitoring system of claim 8, wherein the previously recorded collection of physiological parameter data includes: (i) an impact load other similarly situated players have received over an impact load time period, and (ii) an impact load the specific player has received over the impact load time period.

13. The physiological parameter monitoring system of claim 8, wherein the previously recorded collection of physiological parameter data includes: (i) an average historical number of high magnitude impacts the player has experienced and (ii) an average recent number of high magnitude impacts the specific player has experienced.

14. A physiological parameter monitoring system for multiple players wearing a protective sports helmet while engaged in playing a contact sport, the monitoring system comprising:

a first helmet shell configured to be worn by a first player and having:

an energy attenuation layer including an arrangement of energy attenuation members;

an in-helmet unit removably installed within the arrangement of energy attenuation members of the energy attenuation layer, the in-helmet unit having:

a sensor assembly configured to detect sensor data experienced by the first player while engaged in playing a session of the contact sport;

a control module coupled to the sensor assembly, the control module being configured to receive sensor data and condition said sensor data to determine physiological parameter data for the first player, wherein the physiological parameter data is stored in the control module;

a second helmet shell configured to be worn by a second player and having:

an energy attenuation layer including an arrangement of energy attenuation members;

an in-helmet unit removably installed within the arrangement of energy attenuation members of the energy attenuation layer, the in-helmet unit having:

a sensor assembly configured to detect sensor data experienced by the second player while engaged in playing a session of the contact sport;

a control module coupled to the sensor assembly, the control module being configured to receive sensor data and condition said sensor data to determine physiological parameter data for the second player, wherein the physiological parameter data is stored in the control module;

a receiving device remote from said in-helmet units, wherein the receiving device selectively receives physiological parameter data for the first and second players from said control modules after completion of a first time interval of the session of the contact sport;

a remote server that subsequently receives physiological parameter data for the first and second players from the receiving device that is transmitted after conclusion of the session of the contact sport, wherein the remote server subsequently runs at least one training algorithm that selectively generates: (i) a first report applicable to the first player when the received physiological parameter data for the first player exceeds a first predetermined threshold derived from a daily or weekly summary of the previously recorded collection of physiological parameter data, and (ii) a second report applicable to the second player when the received physiological parameter data for the second player exceeds a second predetermined threshold derived from a daily or weekly summary of the previously recorded collection of physiological parameter data, wherein said first and second reports are provided to an authorized user and include a collection of information that includes one or more training opportunity icons representative of a future training opportunity tailored to each of the first and second players based on daily or weekly summaries of one or more of: impact intensities, impact locations, impact volumes, and impact loads; and a remote graphical user interface (GUI) configured to selectively display said first and second reports to said authorized user.

15. The monitoring system of claim 14, wherein the previously recorded collection of physiological parameter data for the first player includes: (i) a number of alertable impacts other similarly situated players have received over an alertable time period, and (ii) a number of alertable impacts the first player has received over the alertable time period.

16. The monitoring system of claim 15, wherein the similarly situated players play the same position as the first player.

17. The monitoring system of claim 15, wherein the previously recorded collection of physiological parameter data for the second player includes: (i) a number of alertable impacts other similarly situated players have received over an alertable time period, and (ii) a number of alertable impacts the second player has received over the alertable time period.

18. The monitoring system of claim 17, wherein the similarly situated players play the same position as the second player.

19. The monitoring system of claim 14, wherein the first predetermined threshold is substantially similar to the second predetermined threshold.

20. The monitoring system of claim 14, wherein the first player report and the second player report each include at least one training opportunity indicator.

21. The monitoring system of claim 14, wherein the first player report and the second player report each include impact location indicators that comprise a first graphical headform oriented in a front orientation, a second graphical headform oriented in a rear orientation, and a third graphical headform oriented in a side orientation.

22. The monitoring system of claim 21, wherein the first player report and the second player report further includes an impact percentage that is associated with at least one of the first graphical headform, the second graphical headform and the third graphical headform.

* * * * *